US009789371B2

(12) United States Patent
Boggs et al.

(10) Patent No.: US 9,789,371 B2
(45) **Date of Patent: *Oct. 17, 2017**

(54) GOLF CLUB HEAD OR OTHER BALL STRIKING DEVICE HAVING IMPACT-INFLUENCING BODY FEATURES

(71) Applicant: NIKE, Inc., Beaverton, OR (US)

(72) Inventors: Joshua M. Boggs, Aledo, TX (US); Eric A. Larson, Ft. Worth, TX (US); Andrew G. V. Oldknow, Beaverton, OR (US); Michael T. Prichard, Portland, OR (US); Nathaniel J. Radcliffe, Trophy Club, TX (US); Robert M. Boyd, Flower Mound, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/593,790

(22) Filed: Jan. 9, 2015

(65) Prior Publication Data

US 2015/0367194 A1 Dec. 24, 2015

Related U.S. Application Data

(60) Provisional application No. 62/015,237, filed on Jun. 20, 2014.

(51) Int. Cl.

| | |
|---|---|
| ***A63B 53/04*** | (2015.01) |
| ***A63B 60/52*** | (2015.01) |
| *A63B 60/00* | (2015.01) |

(52) U.S. Cl.
CPC ..... *A63B 53/04* (2013.01); *A63B 53/0466* (2013.01); *A63B 60/52* (2015.10); (Continued)

(58) Field of Classification Search
CPC ..... A63B 53/04
See application file for complete search history.

(56) References Cited

U.S. PATENT DOCUMENTS

| | | | |
|---|---|---|---|
| 569,438 | A | 10/1896 | Urquhart |
| 632,885 | A | 9/1899 | Sweny |

(Continued)

FOREIGN PATENT DOCUMENTS

| | | | |
|---|---|---|---|
| CA | 2139690 | A1 | 7/1996 |
| CN | 2258782 | Y | 8/1997 |

(Continued)

OTHER PUBLICATIONS

Dec. 18, 2012—(WO) International Search Report and Written Opinion App. No. PCT/US2012/057490.

(Continued)

*Primary Examiner* — Michael Dennis

(57) ABSTRACT

A ball striking device, such as a golf club head, has a face with a striking surface configured for striking a ball, a channel extending across a portion of the sole, wherein the channel is recessed from adjacent surfaces of the sole, and/or a void defined on the sole of the body, wherein the channel has width defined in a front to rear direction and a depth of recession from the adjacent surfaces of the sole at a vertical plane passing through the face center, wherein a ratio of the width to the depth is about 0.8:1 to 1.2:1.

18 Claims, 52 Drawing Sheets

(52) U.S. Cl.
CPC . *A63B 2053/045* (2013.01); *A63B 2053/0408* (2013.01); *A63B 2053/0412* (2013.01); *A63B 2053/0433* (2013.01); *A63B 2053/0491* (2013.01); *A63B 2060/002* (2015.10); *A63B 2209/02* (2013.01)

(56) References Cited

U.S. PATENT DOCUMENTS 648,256 A 4/1900 Hartley
651,920 A 6/1900 Cushing, Jr.
670,522 A 3/1901 Thompson
727,086 A 5/1903 Burnam
777,400 A 12/1904 Clark
1,039,491 A 9/1912 Collins
1,058,463 A 4/1913 Pringle
1,083,434 A 1/1914 Curry
1,133,129 A 3/1915 Govan
1,135,621 A 4/1915 Roberts
1,137,457 A 4/1915 Breitenbaugh
1,165,559 A 12/1915 Vories
1,173,384 A 2/1916 Rees
1,190,589 A 7/1916 Rolfe
1,206,104 A 11/1916 Goodrich
1,206,105 A 11/1916 Goodrich
1,219,417 A 3/1917 Vories
1,222,770 A 4/1917 Kaye
1,235,922 A 8/1917 Pittar
1,250,301 A 12/1917 Goodrich
1,258,212 A 3/1918 Goodrich
1,429,569 A 9/1922 Craig
1,463,533 A 7/1923 Kurz, Jr.
1,529,959 A 3/1925 Martin
1,549,265 A 8/1925 Kaden
1,556,928 A 10/1925 Ganders
1,568,485 A 1/1926 Turney
1,594,850 A 8/1926 Perkins
1,605,140 A 11/1926 Perkins
1,620,588 A 3/1927 Wilson
1,644,177 A 10/1927 Collins
1,676,518 A 7/1928 Boles
1,697,846 A 1/1929 Anderson
1,697,998 A 1/1929 Novak et al.
1,705,997 A 3/1929 Williams
1,818,359 A 8/1931 Samaras et al.
1,840,924 A 1/1932 Tucker
1,854,548 A 4/1932 Hunt
1,916,792 A 7/1933 Hadden
1,974,224 A 9/1934 Van Der Linden
1,993,928 A 3/1935 Glover
2,004,968 A 6/1935 Young
2,041,676 A 5/1936 Gallagher
2,087,685 A 7/1937 Hackney
2,171,383 A 8/1939 Wettlaufer
2,179,034 A 11/1939 Duncan, Jr.
2,217,338 A 10/1940 Fuller
2,242,670 A 5/1941 Fuller
2,305,270 A 12/1942 Nilson
2,329,313 A 9/1943 Winter
2,346,617 A 4/1944 Schafer
2,381,636 A 8/1945 Bancroft
2,384,333 A 9/1945 Nilson
2,429,351 A 10/1947 Fetterolf
2,451,262 A 10/1948 Watkins
2,455,150 A 11/1948 Verderber
2,475,926 A 7/1949 Verderber
2,477,438 A 7/1949 Brouwer
2,495,444 A 1/1950 Chamberlain et al.
2,503,506 A 4/1950 Miller
2,520,701 A 8/1950 Verderber
2,520,702 A 8/1950 Verderber
2,550,846 A 5/1951 Milligan
2,571,970 A 10/1951 Verderber
2,576,866 A 11/1951 Verderber
2,593,368 A 4/1952 Verderber
2,691,525 A 10/1954 Callaghan, Sr.
2,705,147 A 3/1955 Winter
2,750,194 A 6/1956 Clark
2,777,694 A 1/1957 Winter
2,847,219 A 8/1958 Shoemaker et al.
2,962,286 A 11/1960 Brouwer
2,968,486 A 1/1961 Walton
3,045,371 A 7/1962 Kurlinski
3,064,980 A 11/1962 Steiner
3,084,940 A 4/1963 Cissel
3,166,320 A 1/1965 Onions
3,170,698 A 2/1965 Schoeffler et al.
3,199,873 A 8/1965 Surratt
3,270,564 A 9/1966 Evans
3,292,928 A 12/1966 Billen
3,305,235 A 2/1967 Williams, Jr.
3,477,720 A 11/1969 Saba
3,516,674 A 6/1970 Scarborough
3,519,271 A 7/1970 Smith
3,589,731 A 6/1971 Chancellor, Jr.
3,601,399 A 8/1971 Agens et al.
3,606,327 A 9/1971 Gorman
3,753,564 A 8/1973 Brandell
3,788,647 A 1/1974 Evans
3,791,647 A 2/1974 Verderber
3,792,863 A 2/1974 Evans
3,806,131 A 4/1974 Evans
3,810,631 A 5/1974 Braly
3,814,437 A 6/1974 Winquist
3,829,102 A 8/1974 Harrison
3,840,231 A 10/1974 Moore
3,931,363 A 1/1976 Giolito et al.
3,931,969 A 1/1976 Townhill
3,945,646 A 3/1976 Hammond
3,966,210 A 6/1976 Rozmus
3,970,236 A 7/1976 Rogers
3,976,299 A 8/1976 Lawrence et al.
3,979,125 A 9/1976 Lancellotti
3,980,301 A 9/1976 Smith
3,997,170 A 12/1976 Goldberg
4,027,885 A 6/1977 Rogers
4,121,832 A 10/1978 Ebbing
4,139,196 A 2/1979 Riley
4,165,874 A 8/1979 Lezatte et al.
4,194,739 A 3/1980 Thompson
4,291,883 A 9/1981 Smart et al.
4,322,083 A 3/1982 Imai
4,398,965 A 8/1983 Campau
4,431,192 A 2/1984 Stuff, Jr.
4,438,931 A 3/1984 Motomiya
4,444,392 A 4/1984 Duclos
4,511,145 A 4/1985 Schmidt
4,523,759 A 6/1985 Igarashi
4,534,558 A 8/1985 Yoneyama
4,582,321 A 4/1986 Yoneyama
4,630,827 A 12/1986 Yoneyama
4,632,400 A 12/1986 Boone
4,635,941 A 1/1987 Yoneyama
4,664,383 A 5/1987 Aizawa
4,667,963 A 5/1987 Yoneyama
4,681,321 A 7/1987 Chen et al.
4,697,814 A 10/1987 Yamada
4,708,347 A 11/1987 Kobayashi
4,728,105 A 3/1988 Kobayashi
4,732,389 A 3/1988 Kobayashi
4,754,974 A 7/1988 Kobayashi
4,811,950 A 3/1989 Kobayashi
4,842,280 A 6/1989 Hilton
4,856,782 A 8/1989 Cannan
4,867,458 A 9/1989 Sumikawa et al.
4,871,174 A 10/1989 Kobayashi
4,878,666 A 11/1989 Hosoda
4,884,808 A 12/1989 Retzer
4,895,371 A 1/1990 Bushner
4,898,387 A 2/1990 Finney
4,898,389 A 2/1990 Plutt
4,927,144 A 5/1990 Stormon
4,928,972 A 5/1990 Nakanishi et al.
4,930,781 A 6/1990 Allen
4,940,236 A 7/1990 Allen

(56) References Cited

U.S. PATENT DOCUMENTS 4,984,800 A 1/1991 Hamada
4,991,850 A 2/1991 Wilhlem
5,004,242 A 4/1991 Iwanaga et al.
5,009,425 A 4/1991 Okumoto et al.
D318,703 S 7/1991 Shearer
5,028,049 A 7/1991 McKeighen
5,060,951 A 10/1991 Allen
5,067,715 A 11/1991 Schmidt et al.
5,076,585 A 12/1991 Bouquet
D323,035 S 1/1992 Yang
5,078,397 A 1/1992 Aizawa
5,080,366 A 1/1992 Okumoto et al.
5,092,599 A 3/1992 Okumoto et al.
D326,130 S 5/1992 Chorne
5,133,553 A 7/1992 Divnick
5,149,091 A 9/1992 Okumoto et al.
5,160,142 A 11/1992 Marshall
5,163,682 A 11/1992 Schmidt et al.
5,176,383 A 1/1993 Duclos
5,180,166 A 1/1993 Schmidt et al.
5,183,255 A 2/1993 Antonious
5,186,465 A 2/1993 Chorne
5,193,810 A 3/1993 Antonious
5,205,560 A 4/1993 Hoshi et al.
5,211,401 A 5/1993 Hainey
5,213,328 A 5/1993 Long et al.
5,221,086 A 6/1993 Antonious
5,221,088 A 6/1993 McTeigue et al.
5,228,689 A 7/1993 Donofrio, Sr.
5,228,694 A 7/1993 Okumoto et al.
5,230,512 A 7/1993 Tattershall
5,233,544 A 8/1993 Kobayashi
5,245,537 A 9/1993 Barber
5,253,869 A 10/1993 Dingle et al.
5,269,517 A 12/1993 Petruccelli et al.
5,282,625 A 2/1994 Schmidt et al.
5,290,036 A 3/1994 Fenton et al.
5,292,123 A 3/1994 Schmidt, Jr. et al.
5,295,689 A 3/1994 Lundberg
5,299,807 A 4/1994 Hutin
5,301,941 A 4/1994 Allen
5,301,946 A 4/1994 Schmidt et al.
5,316,305 A 5/1994 McCabe
5,326,106 A 7/1994 Meyer
5,330,187 A 7/1994 Schmidt et al.
5,332,225 A 7/1994 Ura
D350,176 S 8/1994 Antonious
5,333,871 A 8/1994 Wishon
5,340,104 A 8/1994 Griffin
5,346,216 A 9/1994 Aizawa
5,346,219 A 9/1994 Pehoski et al.
5,354,063 A 10/1994 Curchod
5,364,093 A 11/1994 Huston et al.
5,372,365 A 12/1994 McTeigue et al.
D354,103 S 1/1995 Allen
5,377,985 A 1/1995 Ohnishi
5,380,010 A 1/1995 Werner et al.
5,385,346 A 1/1995 Carroll et al.
5,390,920 A 2/1995 Nickum
5,393,056 A 2/1995 Richardson
5,398,929 A 3/1995 Kitaichi
5,407,196 A 4/1995 Busnardo
5,411,263 A 5/1995 Schmidt et al.
5,413,337 A 5/1995 Goodman et al.
5,413,345 A 5/1995 Nauck
5,419,556 A 5/1995 Take
5,419,560 A 5/1995 Bamber
5,429,356 A 7/1995 Dingle et al.
5,429,366 A 7/1995 McCabe
5,433,441 A 7/1995 Olsen et al.
5,435,551 A 7/1995 Chen
5,437,456 A 8/1995 Schmidt et al.
5,441,269 A 8/1995 Henwood
5,447,307 A 9/1995 Antonious
5,451,056 A 9/1995 Manning
5,451,058 A 9/1995 Price et al.
D363,749 S 10/1995 Kenmi
5,460,376 A 10/1995 Schmidt et al.
5,464,211 A 11/1995 Atkins, Sr.
5,464,217 A 11/1995 Shenoha et al.
5,467,988 A 11/1995 Henwood
5,472,201 A 12/1995 Aizawa et al.
5,472,203 A 12/1995 Schmidt et al.
5,478,082 A 12/1995 De Knight et al.
D366,508 S 1/1996 Hutin
5,480,152 A 1/1996 Schmidt et al.
5,489,097 A 2/1996 Simmons
5,492,327 A 2/1996 Biafore, Jr.
5,497,995 A 3/1996 Swisshelm
5,505,453 A 4/1996 Mack
5,511,786 A 4/1996 Antonious
5,516,106 A 5/1996 Henwood
5,518,243 A 5/1996 Redman
5,524,081 A 6/1996 Paul
D372,063 S 7/1996 Hueber
5,531,439 A 7/1996 Azzarella
5,533,725 A 7/1996 Reynolds, Jr.
5,533,728 A 7/1996 Pehoski et al.
5,538,245 A 7/1996 Moore
D372,512 S 8/1996 Simmons
5,547,188 A 8/1996 Dumontier et al.
5,547,427 A 8/1996 Rigal et al.
D375,130 S 10/1996 Hlinka et al.
5,564,705 A 10/1996 Kobayashi et al.
D375,987 S 11/1996 Lin
5,570,886 A 11/1996 Rigal et al.
5,580,058 A 12/1996 Coughlin
5,581,993 A 12/1996 Strobel
5,584,770 A 12/1996 Jensen
5,586,947 A 12/1996 Hutin
5,586,948 A 12/1996 Mick
D377,509 S 1/1997 Katayama
5,595,552 A 1/1997 Wright et al.
5,601,498 A 2/1997 Antonious
5,603,668 A 2/1997 Antonious
5,607,365 A 3/1997 Wolf
5,611,740 A 3/1997 Nagamoto
D378,770 S 4/1997 Hlinka et al.
5,616,088 A 4/1997 Aizawa et al.
5,616,832 A 4/1997 Nauck
5,626,528 A 5/1997 Toulon
5,626,530 A 5/1997 Schmidt et al.
5,632,695 A 5/1997 Hlinka et al.
5,634,855 A 6/1997 King
D381,382 S 7/1997 Fenton, Jr.
D382,612 S 8/1997 Oyer
5,669,829 A 9/1997 Lin
5,674,132 A 10/1997 Fisher
5,676,606 A 10/1997 Schaeffer et al.
5,681,993 A 10/1997 Heitman
D386,550 S 11/1997 Wright et al.
D386,551 S 11/1997 Solheim et al.
D387,113 S 12/1997 Burrows
D387,405 S 12/1997 Solheim et al.
5,692,968 A 12/1997 Shine
5,692,972 A 12/1997 Langslet
5,695,409 A 12/1997 Jackson
5,709,613 A 1/1998 Sheraw
5,709,615 A 1/1998 Liang
5,711,722 A 1/1998 Miyajima et al.
5,718,301 A 2/1998 Williams
5,718,641 A 2/1998 Lin
D392,007 S 3/1998 Fox
5,724,265 A 3/1998 Hutchings
5,728,006 A 3/1998 Teitell et al.
5,735,754 A 4/1998 Antonious
D394,688 S 5/1998 Fox
5,746,664 A 5/1998 Reynolds, Jr.
5,749,795 A 5/1998 Schmidt et al.
5,755,625 A 5/1998 Jackson
5,766,094 A 6/1998 Mahaffey et al.
5,772,525 A 6/1998 Klein
5,772,526 A 6/1998 Hano
5,772,527 A 6/1998 Liu

(56) References Cited

U.S. PATENT DOCUMENTS 5,776,009 A 7/1998 McAtee
5,779,555 A 7/1998 Nomura et al.
5,785,609 A 7/1998 Sheets et al.
D397,387 S 8/1998 Allen
5,788,584 A 8/1998 Parente et al.
5,792,000 A 8/1998 Weber et al.
5,792,001 A 8/1998 Henwood
D397,750 S 9/1998 Frazetta
D398,687 S 9/1998 Miyajima et al.
D398,946 S 9/1998 Kenmi
5,803,825 A 9/1998 Hamilton
5,803,829 A 9/1998 Hayashi
5,803,830 A 9/1998 Austin et al.
D399,274 S 10/1998 Bradford
5,820,481 A 10/1998 Raudman
5,826,874 A 10/1998 Teitell et al.
D400,945 S 11/1998 Gilbert et al.
5,839,975 A 11/1998 Lundberg
D403,037 S 12/1998 Stone et al.
5,851,157 A 12/1998 Koide et al.
5,863,257 A 1/1999 Busnardo
5,863,261 A 1/1999 Eggiman
D405,488 S 2/1999 Burrows
5,873,791 A 2/1999 Allen
5,888,148 A 3/1999 Allen
5,908,357 A 6/1999 Hsieh
5,928,087 A 7/1999 Emberton et al.
5,931,741 A 8/1999 Fenton, Jr.
5,941,782 A 8/1999 Cook
D413,952 S 9/1999 Oyer
D414,234 S 9/1999 Darrah
5,947,841 A 9/1999 Silvestro
5,951,410 A 9/1999 Butler et al.
5,955,667 A 9/1999 Fyfe
5,971,868 A 10/1999 Kosmatka
5,973,596 A 10/1999 French et al.
5,993,329 A 11/1999 Shieh
5,997,415 A 12/1999 Wood
6,001,028 A 12/1999 Tang et al.
6,001,030 A 12/1999 Delaney
6,007,432 A 12/1999 Kosmatka
6,012,988 A 1/2000 Burke
6,015,354 A 1/2000 Ahn et al.
6,018,705 A 1/2000 Gaudet et al.
D422,041 S 3/2000 Bradford
6,042,486 A 3/2000 Gallagher
6,044,704 A 4/2000 Sacher
6,045,364 A 4/2000 Dugan et al.
6,048,278 A 4/2000 Meyer et al.
6,052,654 A 4/2000 Gaudet et al.
6,074,308 A 6/2000 Domas
6,074,309 A 6/2000 Mahaffey
6,080,068 A 6/2000 Takeda
6,086,485 A 7/2000 Hamada et al.
6,089,994 A 7/2000 Sun
6,095,931 A 8/2000 Hettinger et al.
6,117,022 A 9/2000 Crawford et al.
6,120,384 A 9/2000 Drake
6,123,627 A 9/2000 Antonious
6,149,533 A 11/2000 Finn
6,149,534 A 11/2000 Peters et al.
6,159,109 A 12/2000 Langslet
6,171,204 B1 1/2001 Starry
6,176,791 B1 1/2001 Wright
6,193,614 B1 2/2001 Sasamoto et al.
6,196,932 B1 3/2001 Marsh et al.
6,203,449 B1 3/2001 Kenmi
6,206,788 B1 3/2001 Krenzler
6,224,493 B1 5/2001 Lee et al.
6,248,021 B1 6/2001 Ognjanovic
6,261,102 B1 7/2001 Dugan et al.
6,270,422 B1 8/2001 Fisher
6,270,423 B1 8/2001 Webb
6,299,546 B1 10/2001 Wang
6,299,553 B1 10/2001 Petuchowski et al.
6,302,807 B1 10/2001 Rohrer
6,319,149 B1 11/2001 Lee
6,328,661 B1 12/2001 Helmstetter et al.
6,332,848 B1 12/2001 Long et al.
6,338,683 B1 1/2002 Kosmatka
6,342,018 B1 1/2002 Mason
6,344,000 B1 2/2002 Hamada et al.
6,344,001 B1 2/2002 Hamada et al.
6,348,009 B1 2/2002 Dischler
6,348,013 B1 2/2002 Kosmatka
6,354,956 B1 3/2002 Doong
6,354,961 B1 3/2002 Allen
RE37,647 E 4/2002 Wolf
6,368,232 B1 4/2002 Hamada et al.
6,368,234 B1 4/2002 Galloway
6,386,987 B1 5/2002 Lejeune, Jr.
6,390,932 B1 5/2002 Kosmatka et al.
6,390,933 B1 5/2002 Galloway et al.
6,394,910 B1 5/2002 McCarthy
6,402,634 B2 6/2002 Lee et al.
6,402,637 B1 6/2002 Sasamoto et al.
6,402,638 B1 6/2002 Kelley
6,413,167 B1 7/2002 Burke
6,422,951 B1 7/2002 Burrows
6,428,423 B1 8/2002 Merko
6,430,843 B1 8/2002 Potter et al.
6,431,990 B1 8/2002 Manwaring
6,431,997 B1 8/2002 Rohrer
6,435,982 B1 8/2002 Galloway et al.
6,441,745 B1 8/2002 Gates
6,443,857 B1 9/2002 Chuang
6,447,405 B1 9/2002 Chen
6,454,665 B2 9/2002 Antonious
6,456,938 B1 9/2002 Barnard
6,471,603 B1 10/2002 Kosmatka
D465,251 S 11/2002 Wood et al.
6,475,100 B1 11/2002 Helmstetter et al.
6,478,690 B2 11/2002 Helmstetter et al.
6,482,107 B1 11/2002 Urbanski et al.
6,506,126 B1 1/2003 Goodman
6,506,129 B2 1/2003 Chen
6,514,154 B1 2/2003 Finn
6,514,155 B1 2/2003 Sheets
6,524,194 B2 2/2003 McCabe
6,524,198 B2 2/2003 Takeda
6,530,847 B1 3/2003 Antonious
6,533,679 B1 3/2003 McCabe et al.
6,558,268 B2 5/2003 Tindale
6,558,271 B1 5/2003 Beach et al.
6,561,917 B2 5/2003 Manwaring
6,575,854 B1 6/2003 Yang et al.
6,602,149 B1 8/2003 Jacobson
6,605,007 B1 8/2003 Bissonnette et al.
6,607,450 B1 8/2003 Hackman
6,607,451 B2 8/2003 Kosmatka et al.
6,616,547 B2 9/2003 Vincent et al.
6,625,848 B1 9/2003 Schneider
6,634,956 B1 10/2003 Pegg
6,638,175 B2 10/2003 Lee et al.
6,641,490 B2 11/2003 Ellemor
6,648,769 B2 11/2003 Lee et al.
6,652,390 B2 11/2003 Bradford
6,652,391 B1 11/2003 Kubica et al.
6,663,503 B1 12/2003 Kenmi
6,663,506 B2 12/2003 Nishimoto et al.
6,676,533 B1 1/2004 Hsien
6,679,786 B2 1/2004 McCabe
D486,542 S 2/2004 Burrows
6,688,989 B2 2/2004 Best
6,695,715 B1 2/2004 Chikaraishi
6,697,820 B1 2/2004 Tarlie
6,719,641 B2 4/2004 Dabbs et al.
6,719,645 B2 4/2004 Kouno
6,739,983 B2 5/2004 Helmstetter et al.
6,743,112 B2 6/2004 Nelson
6,743,118 B1 6/2004 Soracco
6,757,572 B1 6/2004 Forest
6,767,292 B1 7/2004 Skalla, Sr.
6,773,360 B2 8/2004 Willett et al.

(56) References Cited

U.S. PATENT DOCUMENTS

| | | | |
|---|---|---|---|
| 6,780,123 | B2 | 8/2004 | Hasebe |
| 6,783,465 | B2 | 8/2004 | Matsunaga |
| 6,800,037 | B2 | 10/2004 | Kosmatka |
| 6,800,038 | B2 | 10/2004 | Willett et al. |
| 6,800,039 | B1 | 10/2004 | Tseng |
| 6,802,772 | B1 | 10/2004 | Kunzle et al. |
| D498,508 | S | 11/2004 | Antonious |
| 6,811,496 | B2 | 11/2004 | Wahl et al. |
| 6,819,247 | B2 | 11/2004 | Birnbach et al. |
| 6,821,209 | B2 | 11/2004 | Manwaring et al. |
| 6,837,800 | B2 | 1/2005 | Rollinson et al. |
| 6,840,872 | B2 | 1/2005 | Yoneyama |
| D501,523 | S | 2/2005 | Dogan et al. |
| D501,903 | S | 2/2005 | Tanaka |
| D502,232 | S | 2/2005 | Antonious |
| 6,855,068 | B2 | 2/2005 | Antonious |
| 6,863,620 | B2 | 3/2005 | Tucker, Sr. |
| D504,478 | S | 4/2005 | Burrows |
| 6,876,947 | B1 | 4/2005 | Darley et al. |
| 6,878,071 | B1 | 4/2005 | Schwieger et al. |
| 6,882,955 | B1 | 4/2005 | Ohlenbusch et al. |
| 6,887,165 | B2 | 5/2005 | Tsurumaki |
| 6,899,638 | B2 | 5/2005 | Iwata et al. |
| 6,900,759 | B1 | 5/2005 | Katayama |
| D506,236 | S | 6/2005 | Evans et al. |
| D508,274 | S | 8/2005 | Burrows |
| 6,923,729 | B2 | 8/2005 | McGinty et al. |
| 6,923,733 | B2 | 8/2005 | Chen |
| 6,926,618 | B2 | 8/2005 | Sanchez et al. |
| 6,929,558 | B2 | 8/2005 | Manwaring et al. |
| 6,960,142 | B2 | 11/2005 | Bissonnette et al. |
| 6,979,270 | B1 | 12/2005 | Allen |
| 6,991,552 | B2 | 1/2006 | Burke |
| 6,991,555 | B2 | 1/2006 | Reese |
| 6,991,560 | B2 | 1/2006 | Tseng |
| D515,642 | S | 2/2006 | Antonious |
| 6,994,635 | B2 | 2/2006 | Poynor |
| 7,004,848 | B2 | 2/2006 | Konow |
| 7,018,303 | B2 | 3/2006 | Yamamoto |
| 7,018,304 | B2 | 3/2006 | Bradford |
| 7,021,140 | B2 | 4/2006 | Perkins |
| 7,025,692 | B2 | 4/2006 | Erickson et al. |
| D520,585 | S | 5/2006 | Hasebe |
| 7,037,198 | B2 | 5/2006 | Hameen-Anttila |
| 7,041,003 | B2 | 5/2006 | Bissonnette et al. |
| 7,041,014 | B2 | 5/2006 | Wright et al. |
| 7,048,646 | B2 | 5/2006 | Yamanaka et al. |
| D523,104 | S | 6/2006 | Hasebe |
| D523,498 | S | 6/2006 | Chen et al. |
| 7,056,229 | B2 | 6/2006 | Chen |
| 7,066,835 | B2 | 6/2006 | Evans et al. |
| 7,070,513 | B2 | 7/2006 | Takeda et al. |
| 7,070,515 | B1 | 7/2006 | Liu |
| 7,077,757 | B1 | 7/2006 | Payne et al. |
| 7,083,530 | B2 | 8/2006 | Wahl et al. |
| 7,086,964 | B2 | 8/2006 | Chen et al. |
| 7,090,590 | B2 | 8/2006 | Chen |
| 7,097,572 | B2 | 8/2006 | Yabu |
| 7,118,498 | B2 | 10/2006 | Meadows et al. |
| 7,121,956 | B2 | 10/2006 | Lo |
| 7,121,962 | B2 | 10/2006 | Reeves |
| 7,125,340 | B1 | 10/2006 | Priester et al. |
| 7,128,660 | B2 | 10/2006 | Gillig |
| 7,128,663 | B2 | 10/2006 | Bamber |
| 7,134,971 | B2 | 11/2006 | Franklin et al. |
| 7,137,907 | B2 | 11/2006 | Gibbs et al. |
| 7,140,974 | B2 | 11/2006 | Chao et al. |
| 7,140,975 | B2 | 11/2006 | Bissonnette et al. |
| 7,140,976 | B2 | 11/2006 | Chen et al. |
| 7,140,977 | B2 | 11/2006 | Atkins, Sr. |
| 7,147,569 | B2 | 12/2006 | Tang et al. |
| 7,156,750 | B2 | 1/2007 | Nishitani et al. |
| 7,160,200 | B2 | 1/2007 | Grober |
| 7,163,468 | B2 | 1/2007 | Gibbs et al. |
| 7,163,470 | B2 | 1/2007 | Galloway et al. |
| 7,166,041 | B2 | 1/2007 | Evans |
| 7,169,059 | B2 | 1/2007 | Rice et al. |
| D536,402 | S | 2/2007 | Kawami |
| 7,175,177 | B2 | 2/2007 | Meifu et al. |
| 7,175,511 | B2 | 2/2007 | Ueda et al. |
| 7,175,541 | B2 | 2/2007 | Lo |
| 7,186,188 | B2 | 3/2007 | Gilbert et al. |
| 7,192,364 | B2 | 3/2007 | Long |
| 7,201,668 | B1 | 4/2007 | Pamias |
| 7,207,898 | B2 | 4/2007 | Rice et al. |
| 7,211,006 | B2 | 5/2007 | Chang |
| 7,214,138 | B1 | 5/2007 | Stivers et al. |
| 7,226,362 | B1 | 6/2007 | Schell et al. |
| 7,226,366 | B2 | 6/2007 | Galloway |
| 7,234,351 | B2 | 6/2007 | Perkins |
| 7,235,020 | B1 | 6/2007 | Christensen |
| 7,241,230 | B2 | 7/2007 | Tsunoda |
| 7,244,189 | B1 | 7/2007 | Stobbe |
| 7,247,104 | B2 | 7/2007 | Poynor |
| 7,255,653 | B2 | 8/2007 | Saso |
| 7,258,631 | B2 | 8/2007 | Galloway et al. |
| 7,261,643 | B2 | 8/2007 | Rice et al. |
| D551,310 | S | 9/2007 | Kuan et al. |
| 7,264,554 | B2 | 9/2007 | Bentley |
| 7,264,555 | B2 | 9/2007 | Lee et al. |
| D552,701 | S | 10/2007 | Ruggiero et al. |
| 7,278,926 | B2 | 10/2007 | Frame |
| 7,281,985 | B2 | 10/2007 | Galloway |
| 7,294,064 | B2 | 11/2007 | Tsurumaki et al. |
| 7,297,071 | B2 | 11/2007 | Hyman |
| 7,297,073 | B2 | 11/2007 | Jung |
| 7,310,895 | B2 | 12/2007 | Whittlesey et al. |
| 7,318,782 | B2 | 1/2008 | Imamoto et al. |
| 7,326,121 | B2 | 2/2008 | Roake |
| 7,335,112 | B1 | 2/2008 | Bitondo |
| 7,344,452 | B2 | 3/2008 | Imamoto et al. |
| 7,347,795 | B2 | 3/2008 | Yamagishi et al. |
| D566,214 | S | 4/2008 | Evans et al. |
| 7,351,157 | B2 | 4/2008 | Priester et al. |
| 7,351,161 | B2 | 4/2008 | Beach |
| 7,367,898 | B2 | 5/2008 | Hawkins et al. |
| 7,371,184 | B2 | 5/2008 | Tao |
| 7,387,579 | B2 | 6/2008 | Lin et al. |
| 7,396,289 | B2 | 7/2008 | Soracco et al. |
| 7,396,293 | B2 | 7/2008 | Soracco |
| 7,396,296 | B2 | 7/2008 | Evans |
| 7,407,443 | B2 | 8/2008 | Franklin et al. |
| 7,419,439 | B1 | 9/2008 | Aleamoni |
| 7,419,441 | B2 | 9/2008 | Hoffman et al. |
| 7,431,660 | B2 | 10/2008 | Hasegawa |
| 7,431,662 | B2 | 10/2008 | Tucker, Sr. et al. |
| 7,431,663 | B2 | 10/2008 | Pamias |
| 7,435,189 | B2 | 10/2008 | Hirano |
| 7,438,649 | B2 | 10/2008 | Ezaki et al. |
| 7,442,132 | B2 | 10/2008 | Nishio |
| 7,445,563 | B1 | 11/2008 | Werner |
| 7,470,201 | B2 | 12/2008 | Nakahara et al. |
| 7,473,186 | B2 | 1/2009 | Best et al. |
| 7,476,161 | B2 | 1/2009 | Williams et al. |
| 7,494,426 | B2 | 2/2009 | Nishio et al. |
| 7,500,924 | B2 | 3/2009 | Yokota |
| 7,509,842 | B2 | 3/2009 | Kostuj |
| 7,520,820 | B2 | 4/2009 | Dimarco |
| 7,530,901 | B2 | 5/2009 | Imamoto et al. |
| 7,530,903 | B2 | 5/2009 | Imamoto et al. |
| 7,540,810 | B2 | 6/2009 | Hettinger et al. |
| 7,559,850 | B2 | 7/2009 | Gilbert et al. |
| 7,563,176 | B2 | 7/2009 | Roberts et al. |
| 7,572,193 | B2 | 8/2009 | Yokota |
| 7,575,523 | B2 | 8/2009 | Yokota |
| 7,575,524 | B2 | 8/2009 | Willett et al. |
| 7,582,024 | B2 | 9/2009 | Shear |
| 7,585,233 | B2 | 9/2009 | Horacek et al. |
| 7,588,503 | B2 | 9/2009 | Roach et al. |
| 7,601,077 | B2 | 10/2009 | Serrano et al. |
| 7,602,301 | B1 | 10/2009 | Stirling et al. |
| 7,618,331 | B2 | 11/2009 | Hirano |
| 7,621,820 | B2 | 11/2009 | Clausen et al. |
| 7,627,451 | B2 | 12/2009 | Vock et al. |

(56) References Cited

U.S. PATENT DOCUMENTS 7,632,193 B2 12/2009 Thielen
7,641,569 B2 1/2010 Best et al.
7,647,071 B2 1/2010 Rofougaran et al.
7,651,409 B1 1/2010 Mier
7,682,264 B2 3/2010 Hsu et al.
D613,357 S 4/2010 Utz
7,691,004 B1 4/2010 Lueders
7,713,138 B2 5/2010 Sato et al.
7,717,803 B2 5/2010 DiMarco
7,717,807 B2 5/2010 Evans et al.
7,722,478 B2 5/2010 Ebner
D616,952 S 6/2010 Oldknow
7,736,242 B2 6/2010 Stites et al.
D619,666 S 7/2010 DePaul
7,749,101 B2 7/2010 Imamoto et al.
7,753,809 B2 7/2010 Cackett et al.
7,758,452 B2 7/2010 Soracco
7,758,453 B2 7/2010 Horacek et al.
7,766,760 B2 8/2010 Priester et al.
7,771,263 B2 8/2010 Telford
7,771,285 B2 8/2010 Porter
7,771,290 B2 8/2010 Bezilla et al.
7,780,535 B2 8/2010 Hagood et al.
7,789,742 B1 9/2010 Murdock et al.
7,800,480 B1 9/2010 Joseph et al.
7,801,575 B1 9/2010 Balardeta et al.
7,803,066 B2 9/2010 Solheim et al.
7,804,404 B1 9/2010 Balardeta et al.
7,811,182 B2 10/2010 Ligotti, III et al.
7,821,407 B2 10/2010 Shears et al.
7,824,277 B2 11/2010 Bennett et al.
7,825,815 B2 11/2010 Shears et al.
7,831,212 B1 11/2010 Balardeta et al.
7,837,574 B2 11/2010 Brunner
7,837,575 B2 11/2010 Lee et al.
7,846,036 B2 12/2010 Tanaka
7,853,211 B1 12/2010 Balardeta et al.
7,857,705 B1 12/2010 Galloway
7,857,711 B2 12/2010 Shear
7,867,105 B2 1/2011 Moon
7,871,336 B2 1/2011 Breier et al.
7,878,924 B2 2/2011 Clausen et al.
7,881,499 B2 2/2011 Bissonnette et al.
7,883,428 B1 2/2011 Balardeta et al.
7,887,440 B2 2/2011 Wright et al.
7,892,102 B1 2/2011 Galloway
7,896,753 B2 3/2011 Boyd et al.
7,918,745 B2 4/2011 Morris et al.
7,922,596 B2 4/2011 Vanderbilt et al.
7,922,603 B2 4/2011 Boyd et al.
7,927,231 B2 4/2011 Sato et al.
7,931,545 B2 4/2011 Soracco et al.
7,934,998 B2 5/2011 Yokota
7,934,999 B2 5/2011 Cackett et al.
7,935,003 B2 5/2011 Matsunaga et al.
7,938,739 B2 5/2011 Cole et al.
7,941,097 B1 5/2011 Balardeta et al.
7,946,926 B1 5/2011 Balardeta et al.
7,957,767 B2 6/2011 Rofougaran
7,959,519 B2 6/2011 Zielke et al.
7,959,523 B2 6/2011 Rae et al.
7,967,699 B2 6/2011 Soracco
RE42,544 E 7/2011 Chao et al.
7,978,081 B2 7/2011 Shears et al.
7,988,565 B2 8/2011 Abe
7,993,211 B2 8/2011 Bardha
7,993,213 B1 8/2011 D'Eath
7,997,999 B2 8/2011 Roach et al.
8,007,371 B2 8/2011 Breier et al.
8,012,041 B2 9/2011 Gibbs et al.
8,016,694 B2 9/2011 Llewellyn et al.
8,025,586 B2 9/2011 Teramoto
8,033,928 B2 10/2011 Cage
8,043,166 B2 10/2011 Cackett et al.
8,052,539 B2 11/2011 Kimber
8,070,622 B2 12/2011 Schmidt
8,074,495 B2 12/2011 Kostuj
8,092,316 B2 1/2012 Breier et al.
8,092,318 B2 1/2012 Oldknow et al.
8,100,779 B2 1/2012 Solheim et al.
8,105,175 B2 1/2012 Breier et al.
8,117,903 B2 2/2012 Golden et al.
D659,781 S 5/2012 Oldknow
8,172,697 B2 5/2012 Cackett et al.
8,177,661 B2 5/2012 Beach et al.
8,177,664 B2 5/2012 Horii et al.
8,182,364 B2 5/2012 Cole et al.
8,187,116 B2 5/2012 Boyd et al.
8,206,241 B2 6/2012 Boyd et al.
8,210,961 B2 7/2012 Finn et al.
8,226,495 B2 7/2012 Savarese et al.
D665,472 S 8/2012 McDonnell et al.
8,235,841 B2 * 8/2012 Stites ..... A63B 53/0466 473/328
8,235,844 B2 8/2012 Albertsen et al.
8,241,143 B2 8/2012 Albertsen et al.
8,241,144 B2 8/2012 Albertsen et al.
8,251,834 B2 8/2012 Curtis et al.
8,251,836 B2 8/2012 Brandt
8,257,195 B1 9/2012 Erickson
8,257,196 B1 9/2012 Abbott et al.
8,272,974 B2 9/2012 Mickelson et al.
8,277,337 B2 10/2012 Shimazaki
8,282,506 B1 10/2012 Holt
8,303,434 B1 11/2012 DePaul
8,308,583 B2 11/2012 Morris et al.
8,328,659 B2 12/2012 Shear
8,330,284 B2 12/2012 Weston et al.
8,333,668 B2 12/2012 De La Cruz et al.
8,337,319 B2 12/2012 Sargent et al.
8,337,325 B2 12/2012 Boyd et al.
8,337,335 B2 12/2012 Dugan
8,342,978 B2 1/2013 Tamura
8,353,782 B1 1/2013 Beach et al.
8,353,786 B2 1/2013 Beach et al.
D675,691 S 2/2013 Oldknow et al.
D675,692 S 2/2013 Oldknow et al.
D676,512 S 2/2013 Oldknow et al.
D676,909 S 2/2013 Oldknow et al.
D676,913 S 2/2013 Oldknow et al.
D676,914 S 2/2013 Oldknow et al.
D676,915 S 2/2013 Oldknow et al.
8,382,604 B2 2/2013 Billings
D677,353 S 3/2013 Oldknow et al.
D678,913 S 3/2013 Chu
D678,964 S 3/2013 Oldknow et al.
D678,965 S 3/2013 Oldknow et al.
D678,968 S 3/2013 Oldknow et al.
D678,969 S 3/2013 Oldknow et al.
D678,970 S 3/2013 Oldknow et al.
D678,971 S 3/2013 Oldknow et al.
D678,972 S 3/2013 Oldknow et al.
D678,973 S 3/2013 Oldknow et al.
8,403,771 B1 3/2013 Rice et al.
D679,354 S 4/2013 Oldknow et al.
8,430,763 B2 4/2013 Beach et al.
8,430,770 B2 4/2013 Dugan
8,435,134 B2 5/2013 Tang et al.
8,435,135 B2 5/2013 Stites et al.
D684,230 S 6/2013 Roberts et al.
8,491,416 B1 7/2013 Demille et al.
8,517,851 B2 8/2013 Cackett et al.
8,517,855 B2 8/2013 Beach et al.
8,517,860 B2 8/2013 Albertsen et al.
8,523,698 B2 9/2013 Hotaling et al.
8,529,368 B2 9/2013 Rice et al.
8,535,171 B2 9/2013 McGinnis, Jr.
8,562,453 B2 10/2013 Sato
8,579,728 B2 11/2013 Morales et al.
8,591,351 B2 11/2013 Albertsen et al.
8,591,352 B2 11/2013 Hirano
8,591,353 B1 11/2013 Honea et al.
8,593,286 B2 11/2013 Razoumov et al.
D697,152 S 1/2014 Harbert et al.

(56) References Cited

U.S. PATENT DOCUMENTS 8,628,433 B2 1/2014 Stites et al.
8,632,419 B2 1/2014 Tang et al.
8,641,555 B2 2/2014 Stites et al.
8,663,027 B2 3/2014 Morales et al.
8,690,704 B2 4/2014 Thomas
8,696,450 B2 4/2014 Rose et al.
8,696,491 B1 4/2014 Myers
8,702,531 B2 4/2014 Boyd et al.
8,715,096 B2 5/2014 Cherbini
8,734,265 B2 5/2014 Soracco
D707,768 S 6/2014 Oldknow et al.
D707,769 S 6/2014 Oldknow et al.
D707,773 S 6/2014 Oldknow et al.
8,758,153 B2 6/2014 Sargent et al.
D708,281 S 7/2014 Oldknow et al.
D709,575 S 7/2014 Oldknow et al.
8,771,098 B2 7/2014 Hilton
8,801,532 B2 8/2014 Katayama
8,827,831 B2 9/2014 Burnett et al.
8,827,836 B2 9/2014 Thomas
8,834,289 B2 9/2014 de La Cruz et al.
8,834,290 B2 9/2014 Bezilla et al.
8,840,483 B1 9/2014 Steusloff et al.
8,858,360 B2 10/2014 Rice et al.
8,900,064 B2 12/2014 Franklin
D725,729 S 3/2015 Song
8,979,668 B2 3/2015 Nakamura
D726,847 S 4/2015 Song
9,011,267 B2 4/2015 Burnett et al.
9,033,817 B2 5/2015 Snyder
9,072,948 B2 7/2015 Franklin et al.
9,089,747 B2 7/2015 Boyd et al.
9,089,749 B2 7/2015 Burnett et al.
9,101,805 B2 8/2015 Stites et al.
9,101,808 B2 8/2015 Stites et al.
9,149,693 B2 10/2015 Stites et al.
9,259,627 B1 2/2016 Myers et al.
9,526,956 B2 12/2016 Murphy et al.
2001/0005695 A1 6/2001 Lee et al.
2001/0035880 A1 11/2001 Musatov et al.
2001/0041628 A1 11/2001 Thorne et al.
2001/0053720 A1 12/2001 Lee et al.
2002/0004723 A1 1/2002 Meifu et al.
2002/0019265 A1 2/2002 Allen
2002/0019677 A1 2/2002 Lee
2002/0049507 A1 4/2002 Hameen-Anttila
2002/0052246 A1 5/2002 Burke
2002/0052750 A1 5/2002 Hirooka
2002/0055396 A1 5/2002 Nishimoto et al.
2002/0072815 A1 6/2002 McDonough et al.
2002/0077189 A1 6/2002 Tuer et al.
2002/0082775 A1 6/2002 Meadows et al.
2002/0107085 A1 8/2002 Lee et al.
2002/0123386 A1 9/2002 Perlmutter
2002/0137576 A1 9/2002 Dammen
2002/0151994 A1 10/2002 Sisco
2002/0160848 A1 10/2002 Burke
2002/0169035 A1 11/2002 Liu
2002/0173364 A1 11/2002 Boscha
2002/0173365 A1 11/2002 Boscha
2002/0183134 A1 12/2002 Allen et al.
2002/0183657 A1 12/2002 Socci et al.
2002/0189356 A1 12/2002 Bissonnette et al.
2003/0008722 A1 1/2003 Konow
2003/0009913 A1 1/2003 Potter et al.
2003/0013545 A1 1/2003 Vincent et al.
2003/0014134 A1 1/2003 Morgan
2003/0036436 A1 2/2003 Casanova et al.
2003/0040380 A1 2/2003 Wright et al.
2003/0045371 A1 3/2003 Wood et al.
2003/0054900 A1 3/2003 Tindale
2003/0130059 A1 7/2003 Billings
2003/0132844 A1 7/2003 Walker
2003/0190975 A1 10/2003 Fagot
2003/0191547 A1 10/2003 Morse
2003/0207718 A1 11/2003 Perlmutter
2003/0220154 A1 11/2003 Anelli
2004/0009829 A1 1/2004 Kapilow
2004/0018890 A1 1/2004 Stites et al.
2004/0023729 A1 2/2004 Nagai et al.
2004/0067797 A1 4/2004 Knecht
2004/0106460 A1 6/2004 Lee et al.
2004/0121852 A1 6/2004 Tsurumaki
2004/0132541 A1 7/2004 MacIlraith
2004/0142603 A1 7/2004 Walker
2004/0176183 A1 9/2004 Tsurumaki
2004/0177531 A1 9/2004 DiBenedetto et al.
2004/0180730 A1 9/2004 Franklin et al.
2004/0192463 A1 9/2004 Tsurumaki et al.
2004/0204257 A1 10/2004 Boscha et al.
2004/0219991 A1 11/2004 Suprock et al.
2004/0225199 A1 11/2004 Evanyk et al.
2004/0229707 A1 11/2004 Lin
2004/0259651 A1 12/2004 Storek
2005/0009630 A1 1/2005 Chao et al.
2005/0017454 A1 1/2005 Endo et al.
2005/0032582 A1 2/2005 Mahajan et al.
2005/0032586 A1 2/2005 Willett et al.
2005/0037862 A1 2/2005 Hagood et al.
2005/0043109 A1 2/2005 Buckley et al.
2005/0049075 A1 3/2005 Chen et al.
2005/0049081 A1 3/2005 Boone
2005/0054457 A1 3/2005 Eyestone et al.
2005/0070371 A1 3/2005 Chen et al.
2005/0079922 A1 4/2005 Priester et al.
2005/0096151 A1 5/2005 Hou et al.
2005/0096761 A1 5/2005 Hanover et al.
2005/0101407 A1 5/2005 Hirano
2005/0119068 A1 6/2005 Onoda et al.
2005/0119070 A1 6/2005 Kumamoto
2005/0124435 A1 6/2005 Gambetta et al.
2005/0137024 A1 6/2005 Stites et al.
2005/0188566 A1 9/2005 Whittlesey et al.
2005/0192118 A1 9/2005 Rice et al.
2005/0215340 A1 9/2005 Stites et al.
2005/0215350 A1 9/2005 Reyes et al.
2005/0227775 A1 10/2005 Cassady et al.
2005/0227781 A1 10/2005 Huang et al.
2005/0240294 A1 10/2005 Jones et al.
2005/0261073 A1 11/2005 Farrington et al.
2005/0266933 A1 12/2005 Galloway
2005/0282650 A1 12/2005 Miettinen et al.
2005/0288119 A1 12/2005 Wang et al.
2006/0000528 A1 1/2006 Galloway
2006/0019770 A1 1/2006 Meyer et al.
2006/0025229 A1 2/2006 Mahajan et al.
2006/0029916 A1 2/2006 Boscha
2006/0040757 A1 2/2006 Rosselli
2006/0040765 A1 2/2006 Sano
2006/0046868 A1 3/2006 Murphy
2006/0052173 A1 3/2006 Telford
2006/0063600 A1 3/2006 Grober
2006/0068932 A1 3/2006 Rice et al.
2006/0073908 A1 4/2006 Tavares et al.
2006/0073910 A1 4/2006 Imamoto et al.
2006/0079349 A1 4/2006 Rae et al.
2006/0084516 A1 4/2006 Eyestone et al.
2006/0084525 A1 4/2006 Imamoto et al.
2006/0089845 A1 4/2006 Marcell et al.
2006/0090549 A1 5/2006 Kostuj
2006/0094520 A1 5/2006 Kostuj
2006/0094524 A1 5/2006 Kostuj
2006/0094531 A1 5/2006 Bissonnette et al.
2006/0105849 A1 5/2006 Brunner
2006/0105853 A1 5/2006 Glass
2006/0105857 A1 5/2006 Stark
2006/0109116 A1 5/2006 Keays
2006/0111201 A1 5/2006 Nishio et al.
2006/0122002 A1 6/2006 Konow
2006/0122004 A1 6/2006 Chen et al.
2006/0166737 A1 7/2006 Bentley
2006/0166738 A1 7/2006 Eyestone et al.
2006/0183564 A1 8/2006 Park
2006/0184336 A1 8/2006 Kolen

(56) References Cited

U.S. PATENT DOCUMENTS

| | | | |
|---|---|---|---|
| 2006/0189407 | A1 | 8/2006 | Soracco |
| 2006/0194178 | A1 | 8/2006 | Goldstein |
| 2006/0194644 | A1 | 8/2006 | Nishio |
| 2006/0199659 | A1 | 9/2006 | Caldwell |
| 2006/0224306 | A1 | 10/2006 | Workman et al. |
| 2006/0240908 | A1 | 10/2006 | Adams et al. |
| 2006/0276256 | A1 | 12/2006 | Storek |
| 2006/0281582 | A1 | 12/2006 | Sugimoto |
| 2006/0287118 | A1 | 12/2006 | Wright et al. |
| 2007/0006489 | A1 | 1/2007 | Case et al. |
| 2007/0010341 | A1 | 1/2007 | Miettinen et al. |
| 2007/0011919 | A1 | 1/2007 | Case |
| 2007/0015601 | A1 | 1/2007 | Tsunoda et al. |
| 2007/0021234 | A1 | 1/2007 | Tsurumaki et al. |
| 2007/0026961 | A1 | 2/2007 | Hou |
| 2007/0049400 | A1 | 3/2007 | Imamoto et al. |
| 2007/0049407 | A1 | 3/2007 | Tateno et al. |
| 2007/0049415 | A1 | 3/2007 | Shear |
| 2007/0049417 | A1 | 3/2007 | Shear |
| 2007/0082751 | A1 | 4/2007 | Lo et al. |
| 2007/0087866 | A1 | 4/2007 | Meadows et al. |
| 2007/0111811 | A1 | 5/2007 | Grober |
| 2007/0117648 | A1 | 5/2007 | Yokota |
| 2007/0129178 | A1 | 6/2007 | Reeves |
| 2007/0135225 | A1 | 6/2007 | Nieminen et al. |
| 2007/0135237 | A1 | 6/2007 | Reeves |
| 2007/0149309 | A1 | 6/2007 | Ford |
| 2007/0155538 | A1 | 7/2007 | Rice et al. |
| 2007/0191126 | A1 | 8/2007 | Mandracken |
| 2007/0225085 | A1 | 9/2007 | Koide et al. |
| 2007/0238538 | A1 | 10/2007 | Priester |
| 2007/0238551 | A1 | 10/2007 | Yokota |
| 2007/0270214 | A1 | 11/2007 | Bentley |
| 2008/0009360 | A1 | 1/2008 | Purtill |
| 2008/0015047 | A1 | 1/2008 | Rice et al. |
| 2008/0032817 | A1 | 2/2008 | Lo |
| 2008/0039222 | A1 | 2/2008 | Kiraly |
| 2008/0039228 | A1 | 2/2008 | Breier et al. |
| 2008/0051208 | A1 | 2/2008 | Lee et al. |
| 2008/0064523 | A1 | 3/2008 | Chen |
| 2008/0076580 | A1 | 3/2008 | Murdock et al. |
| 2008/0085778 | A1 | 4/2008 | Dugan |
| 2008/0085788 | A1 | 4/2008 | Rainer et al. |
| 2008/0119303 | A1 | 5/2008 | Bennett et al. |
| 2008/0125239 | A1 | 5/2008 | Clausen et al. |
| 2008/0125244 | A1 | 5/2008 | Meyer et al. |
| 2008/0125246 | A1 | 5/2008 | Matsunaga |
| 2008/0125288 | A1 | 5/2008 | Case |
| 2008/0132355 | A1 | 6/2008 | Hoffman et al. |
| 2008/0139339 | A1 | 6/2008 | Cheng |
| 2008/0146370 | A1 | 6/2008 | Beach et al. |
| 2008/0146374 | A1 | 6/2008 | Beach et al. |
| 2008/0171610 | A1 | 7/2008 | Shin |
| 2008/0182682 | A1 | 7/2008 | Rice et al. |
| 2008/0188310 | A1 | 8/2008 | Murdock |
| 2008/0200275 | A1 | 8/2008 | Wagen et al. |
| 2008/0218343 | A1 | 9/2008 | Lee et al. |
| 2008/0242354 | A1 | 10/2008 | Rofougaran |
| 2008/0248896 | A1 | 10/2008 | Hirano |
| 2008/0261715 | A1 | 10/2008 | Carter |
| 2008/0287205 | A1 | 11/2008 | Katayama |
| 2008/0318703 | A1 | 12/2008 | Mooney |
| 2009/0018795 | A1 | 1/2009 | Priester et al. |
| 2009/0048070 | A1 | 2/2009 | Vincent et al. |
| 2009/0062032 | A1 | 3/2009 | Boyd et al. |
| 2009/0075751 | A1 | 3/2009 | Gilbert et al. |
| 2009/0098949 | A1 | 4/2009 | Chen |
| 2009/0111602 | A1 | 4/2009 | Savarese et al. |
| 2009/0118035 | A1 | 5/2009 | Roenick |
| 2009/0120197 | A1 | 5/2009 | Golden et al. |
| 2009/0124410 | A1 | 5/2009 | Rife |
| 2009/0131190 | A1 | 5/2009 | Kimber |
| 2009/0131191 | A1 | 5/2009 | Priester et al. |
| 2009/0163285 | A1 | 6/2009 | Kwon et al. |
| 2009/0163294 | A1 | 6/2009 | Cackett et al. |
| 2009/0165530 | A1 | 7/2009 | Golden et al. |
| 2009/0165531 | A1 | 7/2009 | Golden et al. |
| 2009/0186717 | A1 | 7/2009 | Stites et al. |
| 2009/0203460 | A1 | 8/2009 | Clark |
| 2009/0203462 | A1 | 8/2009 | Stites et al. |
| 2009/0209358 | A1 | 8/2009 | Niegowski |
| 2009/0221380 | A1 | 9/2009 | Breier et al. |
| 2009/0221381 | A1 | 9/2009 | Breier et al. |
| 2009/0247312 | A1 | 10/2009 | Sato et al. |
| 2009/0254204 | A1 | 10/2009 | Kostuj |
| 2009/0260426 | A1 | 10/2009 | Lieberman et al. |
| 2009/0270743 | A1 | 10/2009 | Dugan et al. |
| 2009/0286611 | A1 | 11/2009 | Beach et al. |
| 2009/0318245 | A1 | 12/2009 | Yim et al. |
| 2010/0016095 | A1 | 1/2010 | Burnett et al. |
| 2010/0029402 | A1 | 2/2010 | Noble et al. |
| 2010/0029408 | A1 | 2/2010 | Abe |
| 2010/0035701 | A1 | 2/2010 | Kusumoto |
| 2010/0048314 | A1 | 2/2010 | Hsu et al. |
| 2010/0048324 | A1 | 2/2010 | Wada et al. |
| 2010/0049468 | A1 | 2/2010 | Papadourakis |
| 2010/0056298 | A1 | 3/2010 | Jertson et al. |
| 2010/0063778 | A1 | 3/2010 | Schrock et al. |
| 2010/0063779 | A1 | 3/2010 | Schrock et al. |
| 2010/0067566 | A1 | 3/2010 | Rofougaran |
| 2010/0069171 | A1 | 3/2010 | Clausen et al. |
| 2010/0093457 | A1 | 4/2010 | Ahern et al. |
| 2010/0093458 | A1 | 4/2010 | Davenport et al. |
| 2010/0093463 | A1 | 4/2010 | Davenport et al. |
| 2010/0099509 | A1 | 4/2010 | Ahem et al. |
| 2010/0113174 | A1 | 5/2010 | Ahern |
| 2010/0113176 | A1 | 5/2010 | Boyd et al. |
| 2010/0113183 | A1 | 5/2010 | Soracco |
| 2010/0113184 | A1 | 5/2010 | Kuan et al. |
| 2010/0117837 | A1 | 5/2010 | Stirling et al. |
| 2010/0121227 | A1 | 5/2010 | Stirling et al. |
| 2010/0121228 | A1 | 5/2010 | Stirling et al. |
| 2010/0130298 | A1 | 5/2010 | Dugan et al. |
| 2010/0144455 | A1 | 6/2010 | Ahern |
| 2010/0144456 | A1 | 6/2010 | Ahern |
| 2010/0154255 | A1 | 6/2010 | Robinson et al. |
| 2010/0190573 | A1 | 7/2010 | Boyd |
| 2010/0197423 | A1 | 8/2010 | Thomas et al. |
| 2010/0197426 | A1 | 8/2010 | De La Cruz et al. |
| 2010/0201512 | A1 | 8/2010 | Stirling et al. |
| 2010/0210371 | A1 | 8/2010 | Sato et al. |
| 2010/0216563 | A1 | 8/2010 | Stites et al. |
| 2010/0216564 | A1 | 8/2010 | Stites et al. |
| 2010/0216565 | A1 | 8/2010 | Stites et al. |
| 2010/0222152 | A1 | 9/2010 | Jaekel et al. |
| 2010/0234127 | A1 | 9/2010 | Snyder et al. |
| 2010/0255922 | A1 | 10/2010 | Lueders |
| 2010/0261546 | A1 | 10/2010 | Nicodem |
| 2010/0273565 | A1 | 10/2010 | Stites et al. |
| 2010/0273569 | A1 | 10/2010 | Soracco |
| 2010/0292024 | A1 | 11/2010 | Hagood et al. |
| 2010/0304877 | A1 | 12/2010 | Iwahashi et al. |
| 2010/0308105 | A1 | 12/2010 | Savarese et al. |
| 2011/0021284 | A1 | 1/2011 | Stites et al. |
| 2011/0028230 | A1 | 2/2011 | Balardeta et al. |
| 2011/0034270 | A1 | 2/2011 | Wahl et al. |
| 2011/0053698 | A1 | 3/2011 | Stites et al. |
| 2011/0081978 | A1 | 4/2011 | Murdock et al. |
| 2011/0082571 | A1 | 4/2011 | Murdock et al. |
| 2011/0087344 | A1 | 4/2011 | Murdock et al. |
| 2011/0092260 | A1 | 4/2011 | Murdock et al. |
| 2011/0092310 | A1 | 4/2011 | Breier et al. |
| 2011/0098127 | A1 | 4/2011 | Yamamoto |
| 2011/0098128 | A1 | 4/2011 | Clausen et al. |
| 2011/0118051 | A1 | 5/2011 | Thomas |
| 2011/0130223 | A1 | 6/2011 | Murdock et al. |
| 2011/0151977 | A1 | 6/2011 | Murdock et al. |
| 2011/0151997 | A1 | 6/2011 | Shear |
| 2011/0152001 | A1 | 6/2011 | Hirano |
| 2011/0195798 | A1 | 8/2011 | Sander et al. |
| 2011/0207552 | A1 | 8/2011 | Finn et al. |
| 2011/0212757 | A1 | 9/2011 | Murdock et al. |
| 2011/0217757 | A1 | 9/2011 | Chaplin et al. |
| 2011/0218053 | A1 | 9/2011 | Tang et al. |

(56) References Cited

U.S. PATENT DOCUMENTS

| | | | | |
|---|---|---|---|---|
| 2011/0224011 | A1 | 9/2011 | Denton et al. | |
| 2011/0224025 | A1 | 9/2011 | Balardeta et al. | |
| 2011/0230273 | A1 | 9/2011 | Niegowski et al. | |
| 2011/0256951 | A1 | 10/2011 | Soracco et al. | |
| 2011/0256954 | A1 | 10/2011 | Soracco | |
| 2011/0281621 | A1 | 11/2011 | Murdock et al. | |
| 2011/0294599 | A1 | 12/2011 | Albertsen et al. | |
| 2011/0306435 | A1 | 12/2011 | Seo | |
| 2011/0312437 | A1 | 12/2011 | Sargent et al. | |
| 2012/0019140 | A1 | 1/2012 | Maxik et al. | |
| 2012/0052972 | A1 | 3/2012 | Bentley | |
| 2012/0064991 | A1 | 3/2012 | Evans | |
| 2012/0077615 | A1 | 3/2012 | Schmidt | |
| 2012/0083362 | A1 | 4/2012 | Albertsen et al. | |
| 2012/0083363 | A1 | 4/2012 | Albertsen et al. | |
| 2012/0120572 | A1 | 5/2012 | Bentley | |
| 2012/0122601 | A1 | 5/2012 | Beach et al. | |
| 2012/0142447 | A1 | 6/2012 | Boyd et al. | |
| 2012/0142452 | A1 | 6/2012 | Burnett et al. | |
| 2012/0165110 | A1 | 6/2012 | Cheng | |
| 2012/0165111 | A1 | 6/2012 | Cheng | |
| 2012/0184393 | A1 | 7/2012 | Franklin | |
| 2012/0191405 | A1 | 7/2012 | Molyneux et al. | |
| 2012/0196701 | A1 | 8/2012 | Stites et al. | |
| 2012/0202615 | A1 | 8/2012 | Beach et al. | |
| 2012/0225731 | A1 | 9/2012 | Suwa et al. | |
| 2012/0244960 | A1 | 9/2012 | Tang et al. | |
| 2012/0270676 | A1 | 10/2012 | Burnett et al. | |
| 2012/0277029 | A1 | 11/2012 | Albertsen et al. | |
| 2012/0277030 | A1 | 11/2012 | Albertsen et al. | |
| 2012/0289361 | A1 | 11/2012 | Beach et al. | |
| 2012/0302366 | A1 | 11/2012 | Murphy | |
| 2013/0017901 | A1 | 1/2013 | Sargent et al. | |
| 2013/0065705 | A1 | 3/2013 | Morales et al. | |
| 2013/0095953 | A1 | 4/2013 | Hotaling et al. | |
| 2013/0102410 | A1 | 4/2013 | Stites et al. | |
| 2013/0130834 | A1 | 5/2013 | Stites et al. | |
| 2013/0137533 | A1 | 5/2013 | Franklin et al. | |
| 2013/0165252 | A1 | 6/2013 | Rice et al. | |
| 2013/0165254 | A1 | 6/2013 | Rice et al. | |
| 2013/0210542 | A1 | 8/2013 | Harbert et al. | |
| 2013/0324274 | A1 | 12/2013 | Stites | |
| 2013/0324284 | A1 | 12/2013 | Stites et al. | |
| 2014/0018184 | A1 | 1/2014 | Bezilla et al. | |
| 2014/0045607 | A1 | 2/2014 | Hilton | |
| 2014/0080624 | A1 | 3/2014 | Galvan et al. | |
| 2014/0080627 | A1* | 3/2014 | Bennett ..... | A63B 59/0092 473/332 |
| 2014/0080629 | A1 | 3/2014 | Sargent et al. | |
| 2014/0080634 | A1 | 3/2014 | Golden et al. | |
| 2014/0086023 | A1 | 3/2014 | Kasai et al. | |
| 2014/0256461 | A1 | 9/2014 | Beach et al. | |
| 2014/0364246 | A1 | 12/2014 | Davenport | |
| 2015/0094164 | A1 | 4/2015 | Galvan et al. | |
| 2015/0217167 | A1 | 8/2015 | Frame et al. | |
| 2015/0231453 | A1 | 8/2015 | Harbert et al. | |
| 2015/0238826 | A1 | 8/2015 | Llewellyn et al. | |
| 2015/0367195 | A1 | 12/2015 | Boggs et al. | |
| 2016/0059093 | A1 | 3/2016 | Nielson et al. | |
| 2016/0067560 | A1 | 3/2016 | Golden et al. | |
| 2016/0067563 | A1 | 3/2016 | Murphy et al. | |

FOREIGN PATENT DOCUMENTS

| | | | |
|---|---|---|---|
| CN | 1198955 | A | 11/1998 |
| CN | 2429210 | Y | 5/2001 |
| CN | 2431912 | Y | 5/2001 |
| CN | 2487416 | Y | 4/2002 |
| CN | 2688331 | Y | 3/2005 |
| CN | 1602981 | A | 4/2005 |
| CN | 101352609 | A | 1/2009 |
| CN | 101918090 | A | 12/2010 |
| CN | 101927084 | A | 12/2010 |
| CN | 102218209 | A | 10/2011 |
| CN | 104168965 | A | 11/2014 |
| DE | 202007013632 | U1 | 12/2007 |
| EP | 2332619 | A1 | 6/2011 |
| EP | 2377586 | A2 | 10/2011 |
| FR | 2672226 | A1 | 8/1992 |
| FR | 2717701 | A1 | 9/1995 |
| FR | 2717702 | A1 | 9/1995 |
| GB | 2280380 | A | 2/1995 |
| GB | 2374539 | A | 10/2002 |
| GB | 2388792 | A | 11/2003 |
| GB | 2422554 | A | 8/2006 |
| JP | 01259876 | | 10/1989 |
| JP | H06237 | | 1/1994 |
| JP | H06114127 | A | 4/1994 |
| JP | H0639036 | U | 5/1994 |
| JP | H06233837 | A | 8/1994 |
| JP | 107255886 | A | 10/1995 |
| JP | H07284546 | A | 10/1995 |
| JP | H08000785 | | 1/1996 |
| JP | H08141117 | A | 6/1996 |
| JP | 08-173586 | | 7/1996 |
| JP | H08196664 | A | 8/1996 |
| JP | H08243195 | A | 9/1996 |
| JP | H09135932 | A | 5/1997 |
| JP | H09154985 | A | 6/1997 |
| JP | H9-239075 | | 9/1997 |
| JP | H09239074 | A | 9/1997 |
| JP | H09276455 | A | 10/1997 |
| JP | H9-299521 | | 11/1997 |
| JP | H09299521 | A | 11/1997 |
| JP | H0305119 | A | 11/1998 |
| JP | H1157082 | A | 3/1999 |
| JP | H11169493 | A | 6/1999 |
| JP | H11244431 | A | 9/1999 |
| JP | 2980002 | B2 | 11/1999 |
| JP | 11299938 | | 11/1999 |
| JP | 2000-126340 | A | 5/2000 |
| JP | 11114102 | | 6/2000 |
| JP | 2000176056 | A | 6/2000 |
| JP | 2000197718 | | 7/2000 |
| JP | 2000271253 | A | 10/2000 |
| JP | 2001009069 | A | 1/2001 |
| JP | 2001054596 | A | 2/2001 |
| JP | 2001054599 | A | 2/2001 |
| JP | 2001058015 | | 3/2001 |
| JP | 2001062004 | | 3/2001 |
| JP | 2001137396 | | 5/2001 |
| JP | 2001145712 | | 5/2001 |
| JP | 2001264016 | A | 9/2001 |
| JP | 2001-293113 | A | 10/2001 |
| JP | 3216041 | B2 | 10/2001 |
| JP | 2002017908 | A | 1/2002 |
| JP | 2002017912 | A | 1/2002 |
| JP | 2002052099 | | 2/2002 |
| JP | 2002165905 | A | 6/2002 |
| JP | 2002177416 | A | 6/2002 |
| JP | 2002239040 | A | 8/2002 |
| JP | 2002248183 | A | 9/2002 |
| JP | 2002306646 | | 10/2002 |
| JP | 2002306647 | A | 10/2002 |
| JP | 2002320692 | | 11/2002 |
| JP | 2003000774 | | 1/2003 |
| JP | 2003079769 | | 3/2003 |
| JP | 2003093554 | A | 4/2003 |
| JP | 2003180887 | A | 7/2003 |
| JP | 2003210627 | | 7/2003 |
| JP | 200252099 | | 9/2003 |
| JP | 2004089567 | A | 3/2004 |
| JP | 2004141350 | A | 5/2004 |
| JP | 2004174224 | A | 6/2004 |
| JP | 2004216131 | A | 8/2004 |
| JP | 2004313762 | | 11/2004 |
| JP | 2004329544 | | 11/2004 |
| JP | 2005131280 | A | 5/2005 |
| JP | 2005193069 | | 7/2005 |
| JP | 2005253973 | A | 9/2005 |
| JP | 2005305178 | A | 11/2005 |
| JP | 2006000435 | A | 1/2006 |
| JP | 2006175135 | A | 7/2006 |

(56) References Cited

FOREIGN PATENT DOCUMENTS

| | | | |
|---|---|---|---|
| JP | 2006198251 | A | 8/2006 |
| JP | 2006223701 | A | 8/2006 |
| JP | 2006247023 | A | 9/2006 |
| JP | 2007209722 | A | 8/2007 |
| JP | 2007530151 | A | 11/2007 |
| JP | 2008036050 | A | 2/2008 |
| JP | 2008506421 | A | 3/2008 |
| JP | 2008073210 | A | 4/2008 |
| JP | 2008515560 | A | 5/2008 |
| JP | 2008200118 | | 9/2008 |
| JP | 2008224607 | A | 9/2008 |
| JP | 2008237689 | A | 10/2008 |
| JP | 2008253564 | A | 10/2008 |
| JP | 2009201744 | A | 9/2009 |
| JP | 2010148652 | A | 7/2010 |
| JP | 2010148653 | A | 7/2010 |
| JP | 2010154875 | | 7/2010 |
| JP | 2010154887 | A | 7/2010 |
| JP | 2010279847 | A | 12/2010 |
| JP | 2011024999 | A | 2/2011 |
| JP | 2011206535 | A | 10/2011 |
| KR | 20060090501 | A | 8/2006 |
| KR | 1020060114969 | | 11/2006 |
| KR | 20090129246 | A | 12/2009 |
| KR | 1020100020131 | | 2/2010 |
| KR | 20100051153 | A | 5/2010 |
| KR | 10-2010-0095917 | A | 9/2010 |
| KR | 101002846 | B1 | 12/2010 |
| KR | 20110005247 | A | 1/2011 |
| TW | 498774 | U | 8/2002 |
| TW | I292575 | | 1/2008 |
| TW | I309777 | | 5/2009 |
| WO | 9920358 | A1 | 4/1999 |
| WO | 9965574 | A2 | 12/1999 |
| WO | 0149376 | A1 | 7/2001 |
| WO | 0215993 | A | 2/2002 |
| WO | 2004056425 | A2 | 7/2004 |
| WO | 2004071594 | A1 | 8/2004 |
| WO | 200505842 | A1 | 1/2005 |
| WO | 2005035073 | A1 | 4/2005 |
| WO | 2005058427 | A2 | 6/2005 |
| WO | 2005079933 | A1 | 9/2005 |
| WO | 2005094953 | A2 | 10/2005 |
| WO | 2005118086 | A1 | 12/2005 |
| WO | 2006014459 | A2 | 2/2006 |
| WO | 2006073930 | A2 | 7/2006 |
| WO | 2008093710 | A1 | 8/2008 |
| WO | 2008154684 | A1 | 12/2008 |
| WO | 2008157691 | A2 | 12/2008 |
| WO | 2009035345 | A1 | 3/2009 |
| WO | 2009091636 | A1 | 7/2009 |
| WO | 2009152456 | A2 | 12/2009 |
| WO | 2010090814 | A1 | 8/2010 |
| WO | 2011153067 | A1 | 12/2011 |
| WO | 2012027726 | A2 | 3/2012 |
| WO | 2012138543 | A2 | 10/2012 |
| WO | 2012149385 | A1 | 11/2012 |
| WO | 2014070343 | A1 | 5/2014 |

OTHER PUBLICATIONS

Aug. 24, 2012—(WO) International Search Report and Written Opinion—App. PCT/US12/35476.
Aug. 8, 2013—(WO) International Preliminary Report on Patentability App. No. PCT/US2012/022027.
May 30, 2012—(WO) International Search Report and Written Opinion App. No. PCT/US2012/022027.
Nov. 26, 2010—(WO) International Search Report and Written Opinion App. No. PCT/US2010/043073.
"Photographs 1, 2 and 3", presented in U.S. Appl. No. 12/842,650, of unknown source, taken after the filing late of the U.S. Appl. No. 12/842,650, depicting a golf club product; presented to the Patent Office for consideration on Oct. 7, 2011.
Nov. 5, 2010—(WO) International Search Report & Written Opinion, App. No. PCT/US2009/064164.
Mar. 20, 2014—(WO) International Search Report and Written Opinion App. No. PCT/US2013/043641.
Nov. 6, 2013—(WO) Partial Search Report, App.No. PCT/US2013/043641.
Aug. 14, 2013—(WO) International Search Report and Written Opinion—App. PCT/US2013/025615.
United States Golf Association; Procedure for Measuring the Flexibility of a Golf Clubhead, USGA-TPX3004; Revision 1.0.0; May 1, 2008; p. 1-11.
Jan. 7, 2010—(WO) International Preliminary Report on Patentability App. PCT/US2008/067499.
May 19, 2009—(WO) International Search Report and Written Opinion App. No. PCT/US2008/067499.
Feb. 27, 2013—(WO) International Search Report and Written Opinion—App. PCT/US2012/067050.
Apr. 12, 2010—(WO) Partial Search Report App. No. PCT/US2010/021355.
Sep. 9, 2011—(WO) International Search Report and Written Opinion, App. No. PCT/US2011/023678.
Sep. 10, 2012—(WO) International Search Report App No. PCT/US2012/03542.
Jul. 31, 2013 —(WO) International Search Report and Written Opinion—App. No. PCT/US2013/043700.
Aug. 2, 2013—(WO) International Search Report and Written Opinion—App. PCT/US2013/043656.
Sep. 4, 2014—(WO) International Search Report and Written Opinion—Apr PCT/US2014/029044.
Jul. 7, 2010—(WO) International Search Report and Written Opinion, App. PCT/US2010/021355.
Nov. 30, 2012—(WO) International Search Report and Written Opinion App. PCT/US2012/052107.
May 6, 2011—(WO) International Search Report and Written Opinion—App. PCT/US2011/023968.
Mar. 24, 2014—(WO) International Search Report and Written Opinion—App. PCT/US2013/061812.
Aug. 21, 2015—(WO) International Search Report—App PCT/US2015/036578.
Oct. 28, 2015—(WO) International Searh Report and Written Opinion—App PCT/US2015/033371.
Sep. 28, 2015—(WO) International Search Report and Written Opinion—App PCT/US2015/032819.
http://www.sureshotgps.com/sureshotgps.php, Feb. 7, 2007.
Oct. 8, 2013—(WO) IPER PCT/US2012/031101.
Oct. 8, 2013—(WO) IPER PCT/US2012/031131.
Oct. 8, 2013—(WO) IPER PCT/US2012/031233.
Jan. 30, 2013—(WO) ISR PCT/US2012/031233.
Sep. 5, 2012—(WO) ISR PCT/US2012/031131.
Jan. 2, 2013—(WO) ISR PCT/US2012/031101.
Aug. 2, 2012—(WO) Partial International Search Report PCT/US2012/031233.
Aug. 2, 2012—(WO) Partial International Search Report PCT/US2012/031844.
Aug. 16 2013—(WO) International Search Report and Written Opinion PCT/US2013/021466.
Jan. 30, 2013—(WO) International Search Report and Written Opinion PCT/US2012/031844.
Aug. 21, 2015—(WO)—International Search Report—App PCT/US2015/036578.
Mar. 3, 2016—(WO) International Search Report and Written Opinion—App PCT/US2015/064755.
Jul. 12, 2016—(WO) ISR & WO—App. No. PCT/US151032821.
Callaway 2015 XR Driver, http://www.callawaygolf.com/golf-clubs/clearance/drivers/drivers-2015-xr.html, visited on Dec. 12, 2016.
Nov. 8, 2016—(WO) ISR & WO—App. No. PCT/US16/050897.

* cited by examiner

GOLF CLUB HEAD OR OTHER BALL STRIKING DEVICE HAVING IMPACT-INFLUENCING BODY FEATURES

This application claims priority to Provisional Application, U.S. Ser. No. 62/015,237, filed Jun. 20, 2014, which is incorporated herein by reference in its entirety.

TECHNICAL FIELD

The invention relates generally to golf club heads and other ball striking devices that include impact influencing body features. Certain aspects of this invention relate to golf club heads and other ball striking devices that have one or more of a compression channel extending across at least a portion of the sole, a void within the sole, and internal and/or external ribs.

BACKGROUND

Golf clubs and many other ball striking devices may have various face and body features, as well as other characteristics that can influence the use and performance of the device. For example, users may wish to have improved impact properties, such as increased coefficient of restitution (COR) in the face, increased size of the area of greatest response or COR (also known as the "hot zone") of the face, and/or improved efficiency of the golf ball on impact. A significant portion of the energy loss during an impact of a golf club head with a golf ball is a result of energy loss in the deformation of the golf ball, and reducing deformation of the golf ball during impact may increase energy transfer and velocity of the golf ball after impact. The present devices and methods are provided to address at least some of these problems and other problems, and to provide advantages and aspects not provided by prior ball striking devices. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to a ball striking device, such as a golf club head, having a face with a striking surface configured for striking a ball, a channel extending across a portion of the sole, wherein the channel is recessed from adjacent surfaces of the sole, a void defined on the sole of the body, and/or at least one external rib connected to the cover and extending downward from the cover.

According to one aspect, the channel has a width defined in a front to rear direction and a depth of recession from the adjacent surfaces of the sole, and the channel has a center portion extending across a center of the sole, a heel portion extending from a heel end of the center portion toward the heel, and a toe portion extending from a toe end of the center portion toward the toe. At least one of the width and the depth of the channel is greater at the heel portion and the toe portion than at the center portion. The wall thickness of the channel may differ in the center portion, the heel portion, and/or the toe portion.

According to another aspect, the body may have a first leg and a second leg extending rearwardly from a base portion of the body, with the void being defined between the first and second legs, and a cover extending between the first and second legs and defining a top of the void.

According to a further aspect, the ribs include a first external rib and a second external rib, and the external ribs are positioned within the void. The club head may additionally include one or more internal ribs.

Other aspects of the disclosure relate to a golf club or other ball striking device including a head or other ball striking device as described above and a shaft connected to the head/device and configured for gripping by a user. Aspects of the disclosure relate to a set of golf clubs including at least one golf club as described above. Yet additional aspects of the disclosure relate to a method for manufacturing a ball striking device as described above, including assembling a head as described above and/or connecting a handle or shaft to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
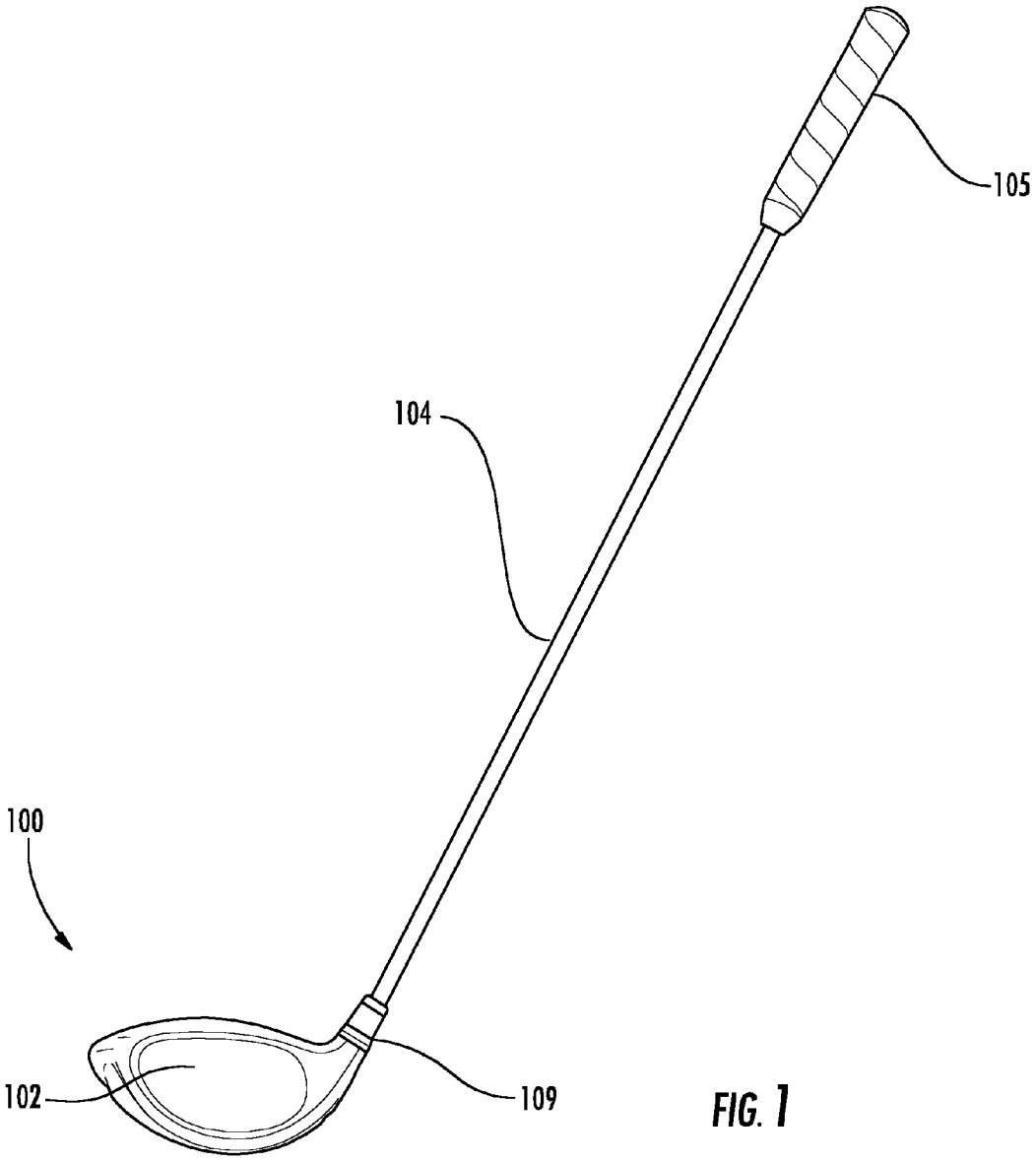
FIG. 1 is a front view of one embodiment of a golf club with a golf club head according to aspects of the disclosure, in the form of a golf driver.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft member, and it may be attached to the shaft in some manner.

The terms "shaft" or "handle" include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

In general, aspects of this invention relate to ball striking devices, such as golf club heads, golf clubs, and the like. Such ball striking devices, according to at least some examples of the invention, may include a ball striking head with a ball striking surface. In the case of a golf club, the ball striking surface is a substantially flat surface on one face of the ball striking head. Some more specific aspects of this invention relate to wood-type golf clubs and golf club heads, including drivers, fairway woods, hybrid clubs, and the like, although aspects of this invention also may be practiced in connection with iron-type clubs, putters, and other club types as well.

According to various aspects and embodiments, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal (the term "metal," as used herein, includes within its scope metal alloys, metal matrix composites, and other metallic materials). It is understood that the head may contain components made of several different materials, including carbon-fiber composites, polymer materials, and other components. Additionally, the components may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, fairway woods and hybrid clubs, as well as other types of wood-type clubs. Such devices may include a one-piece construction or a multiple-piece construction. Example structures of ball striking devices according to this invention will be described in detail below in conjunction with FIGS. 1-13, 34A-34B, and 35 which illustrate one illustrative embodiment of a ball striking device 100 in the form of a wood-type golf club (e.g. a driver), and FIGS. 14-20, which also illustrate an illustrative embodiment of a ball striking device 100 in the form of a wood-type golf club (e.g., a driver). It is understood that similar configurations may be used for other wood-type clubs, including a fairway wood (e.g., a 3-wood, 5-wood, 7-wood, etc.), as illustrated in FIGS. 21-26D and in FIGS. 36-37F, or a hybrid club, as illustrated in FIGS. 27-33 and FIGS. 38-39C. As mentioned previously, aspects of this disclosure may alternately be used in connection with long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters.

The golf club 100 shown in FIGS. 1-13 includes a golf club head or a ball striking head 102 configured to strike a ball in use and a shaft 104 connected to the ball striking head 102 and extending therefrom. FIGS. 1-13 illustrate one embodiment of a ball striking head in the form of a golf club head 102 that has a face 112 connected to a body 108, with a hosel 109 extending therefrom and a shaft 104 connected to the hosel 109. For reference, the head 102 generally has a top or crown 116, a bottom or sole 118, a heel 120 proximate the hosel 109, a toe 122 distal from the hosel 109, a front 124, and a back or rear 126, as shown in FIGS. 1-13. The shape and design of the head 102 may be partially dictated by the intended use of the golf club 100. For example, it is understood that the sole 118 is configured to face the playing surface in use. With clubs that are configured to be capable of hitting a ball resting directly on the playing surface, such as a fairway wood, hybrid, iron, etc., the sole 118 may contact the playing surface in use, and features of the club may be designed accordingly. In the club 100 shown in FIGS. 1-13, the head 102 has an enclosed volume, measured per "USGA PROCEDURE FOR MEA- SURING THE CLUB HEAD SIZE OF WOOD CLUBS", TPX-3003, REVISION 1.0.0 dated Nov. 21, 2003, as the club 100 is a wood-type club designed for use as a driver, intended to hit the ball long distances. In this procedure, the volume of the club head is determined using the displaced water weight method. According to the procedure, any large concavities must be filled with clay or dough and covered with tape so as to produce a smooth contour prior to measuring volume. Club head volume may additionally or alternately be calculated from three-dimensional computer aided design (CAD) modeling of the golf club head. In other applications, such as for a different type of golf club, the head 102 may be designed to have different dimensions and configurations. For example, when configured as a driver, the club head 102 may have a volume of at least 400 cc, and in some structures, at least 450 cc, or even at least 470 cc. The head 102 illustrated in the form of a driver in FIGS. 1-13, 34A, 34B, and 35 has a volume of approximately 460 cc, and the head 102 illustrated in the form of a driver in FIGS. 14-20 has a volume of approximately 420 cc. If instead configured as a fairway wood (e.g., FIGS. 21-26D and 36-37F), the head may have a volume of 120 cc to 250 cc, and if configured as a hybrid club (e.g., FIGS. 27-33 and 38-39C), the head may have a volume of 85 cc to 170 cc. Other appropriate sizes for other club heads may be readily determined by those skilled in the art. The loft angle of the club head 102 also may vary, e.g., depending on the shot distance desired for the club head 102. For example, a driver golf club head may have a loft angle range of 7 degrees to 16 degrees, a fairway wood golf club head may have a loft angle range of 12 to 25 degrees, and a hybrid golf club head may have a loft angle range of 16 to 28 degrees.

The body 108 of the head 102 can have various different shapes, including a rounded shape, as in the head 102 shown in FIGS. 1-13, a generally square or rectangular shape, or any other of a variety of other shapes. It is understood that such shapes may be configured to distribute weight in any desired, manner, e.g., away from the face 112 and/or the geometric/volumetric center of the head 102, in order to create a lower center of gravity and/or a higher moment of inertia.

In the illustrative embodiment illustrated in FIGS. 1-13, the head 102 has a hollow structure defining an inner cavity 106 (e.g., defined by the face 112 and the body 108) with a plurality of inner surfaces defined therein. In one embodiment, the inner cavity 106 may be filled with air. However, in other embodiments, the inner cavity 106 could be filled or partially filled with another material, such as foam. In still further embodiments, the solid materials of the head may occupy a greater proportion of the volume, and the head may have a smaller cavity or no inner cavity 106 at all. It is understood that the inner cavity 106 may not be completely enclosed in some embodiments.

Figure 2:
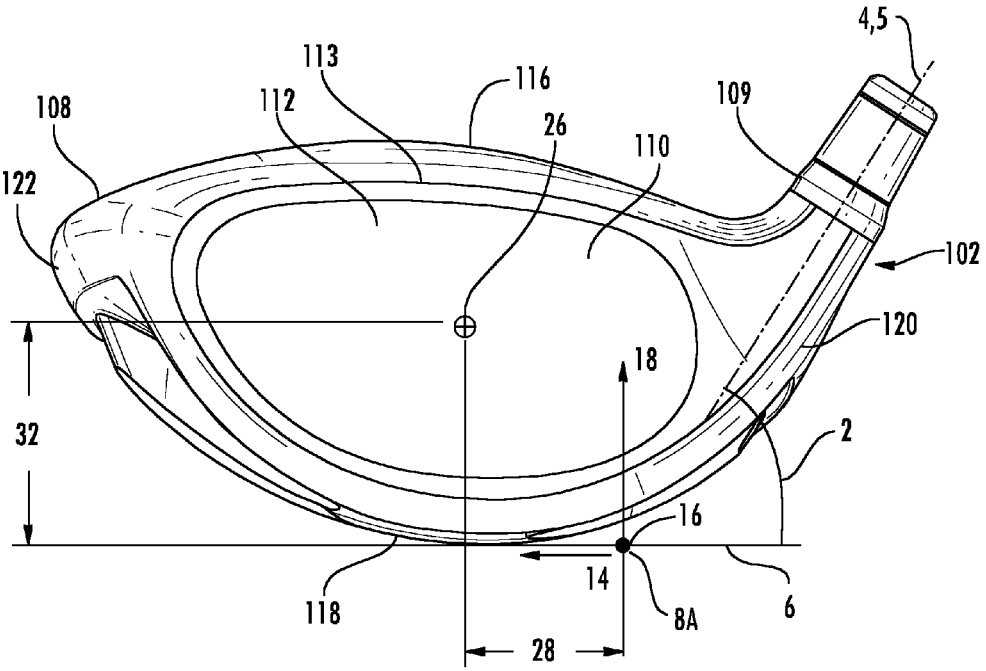
FIG. 2 is a front view of the club head of FIG. 1, showing a ground plane origin point.

The face 112 is located at the front 124 of the head 102 and has a ball striking surface (or striking surface) 110 located thereon and an inner surface 111 opposite the ball striking surface 110, as illustrated in FIG. 2. The ball striking surface 110 is typically an outer surface of the face 112 configured to face a ball in use and is adapted to strike the ball when the golf club 100 is set in motion, such as by swinging. As shown, the ball striking surface 110 is relatively flat, occupying at least a majority of the face 112. The face 112 has an outer periphery formed of a plurality of outer or peripheral edges 113. The edges of the face 112 may be defined as the boundaries of an area of the face 112 that is specifically designed to contact the ball in use, and may be recognized as the boundaries of an area of the face 112 that is intentionally shaped and configured to be suited for ball contact. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. Generally, the ball striking surface 110 is inclined with respect to the ground or contact surface (i.e., at a loft angle), to give the ball a desired trajectory and spin when struck, and it is understood that different club heads 102 may have different loft angles. Additionally, the face 112 may have a variable thickness and also may have one or more internal or external inserts and/or supports in some embodiments. In one embodiment, the face 112 of the head 102 in FIGS. 1-13 may be made from titanium (e.g., Ti-6Al-4V alloy or other alloy); however, the face 112 may be made from other materials in other embodiments.

It is understood that the face 112, the body 108, and/or the hosel 109 can be formed as a single piece or as separate pieces that are joined together. The face 112 may be formed as a face member with the body 108 being partially or wholly formed by one or more separate pieces connected to the face member. Such a face member may be in the form of, e.g., a face plate member or face insert, or a partial or complete cup-face member having a wall or walls extending rearward from the edges of the face 112. These pieces may be connected by an integral joining technique, such as welding, cementing, or adhesively joining Other known techniques for joining these parts can be used as well, including many mechanical joining techniques, including releasable mechanical engagement techniques. As one example, a body member formed of a single, integral, cast piece may be connected to a face member to define the entire club head. The head 102 in FIGS. 1-13 may be constructed using this technique, in one embodiment. As another example, a single, integral body member may be cast with an opening in the sole. The body member is then connected to a face member, and a separate sole piece is connected within the sole opening to completely define the club head. Such a sole piece may be made from a different material, e.g., polymer or composite. The head 102 in FIGS. 14-20 may be constructed using this technique, in one embodiment. As a further example, either of the above techniques may be used, with the body member having an opening on the top side thereof. A separate crown piece is used to cover the top opening and form part or the entire crown 116, and this crown piece may be made from a different material, e.g., polymer or composite. As yet another example, a first piece including the face 112 and a portion of the body 108 may be connected to one or more additional pieces to further define the body 108. For example, the first piece may have an opening on the top and/or bottom sides, with a separate piece or pieces connected to form part or all of the crown 116 and/or the sole 118. Further different forming techniques may be used in other embodiments.

The golf club 100 may include a shaft 104 connected to or otherwise engaged with the ball striking head 102 as shown in FIG. 1. The shaft 104 is adapted to be gripped by a user to swing the golf club 100 to strike the ball. The shaft 104 can be formed as a separate piece connected to the head 102, such as by connecting to the hosel 109, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Patent Application Publication No. 2009/0062029, filed on Aug. 28, 2007, U.S. Patent Application Publication No. 2013/0184098, filed on Oct. 31, 2012, and U.S. Pat. No. 8,533,060, issued Sep. 10, 2013, all of which are incorporated herein by reference in their entireties and made parts hereof. The head 102 may have an opening or other access 128 for the adjustable hosel 109 connecting structure that extends through the sole 118, as seen in FIGS. 1-13. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp the golf club shaft 104, as seen in FIG. 1. The grip element may be attached to the shaft 104 in any desired manner, including in conventional manners known and used in the art (e.g., via adhesives or cements, threads or other mechanical connectors, swedging/swaging, etc.).

The various embodiments of golf clubs 100 and/or golf club heads 102 described herein may include components that have sizes, shapes, locations, orientations, etc., that are described with reference to one or more properties and/or reference points. Several of such properties and reference points are described in the following paragraphs, with reference to FIGS. 2-7.

As illustrated in FIG. 2, a lie angle 2 is defined as the angle formed between the hosel axis 4 or a shaft axis 5 and a horizontal plane contacting the sole 118, i.e., the ground plane 6. It is noted that the hosel axis 4 and the shaft axis 5 are central axes along which the hosel 109 and shaft 104 extend.

Figure 3:
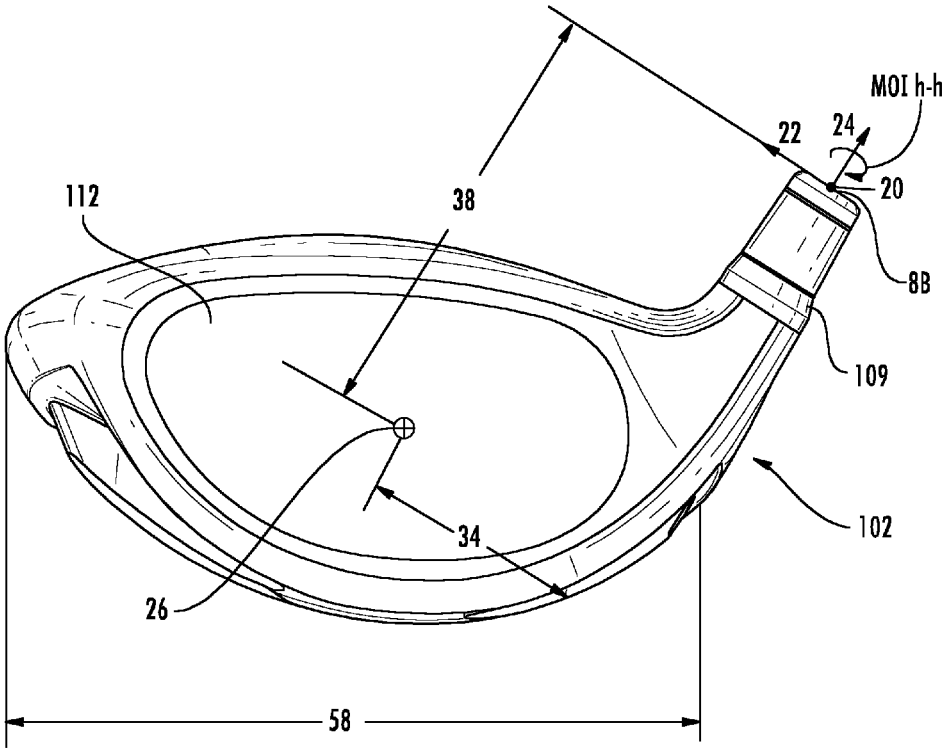
FIG. 3 is a front view of the club head of FIG. 1, showing a hosel origin point.

One or more origin points 8 (e.g., 8A, 8B) may be defined in relation to certain elements of the golf club 100 or golf club head 102. Various other points, such as a center of gravity, a sole contact, and a face center, may be described and/or measured in relation to one or more of such origin points 8. FIGS. 2 and 3 illustrate two different examples such origin points 8, including their locations and definitions. A first origin point location, referred to as a ground plane origin point 8A is generally located at the ground plane 6. The ground plane origin point 8A is defined as the point at which the ground plane 6 and the hosel axis 4 intersect. A second origin point location, referred to as a hosel origin point 8B, is generally located on the hosel 109. The hosel origin point 8B is defined on the hosel axis 4 and coincident with the uppermost edge 12B of the hosel 12. Either location for the origin point 8, as well as other origin points 8, may be utilized for reference without departing from this invention. It is understood that references to the ground plane origin point 8A and hosel origin point 8B are used herein consistent with the definitions in this paragraph, unless explicitly noted otherwise. Throughout the remainder of this application, the ground plane origin point 8A will be utilized for all reference locations, tolerances, calculations, etc., unless explicitly noted otherwise.

As illustrated in FIG. 2, a coordinate system may be defined with an origin located at the ground plane origin point 8A, referred to herein as a ground plane coordinate system. In other words, this coordinate system has an X-axis 14, a Y-axis 16, and a Z-axis 18 that all pass through the ground plane origin point 8A. The X-axis in this system is parallel to the ground plane and generally parallel to the striking surface 110 of the golf club head 102. The Y-axis 16 in this system is perpendicular to the X-axis 14 and parallel to the ground plane 6, and extends towards the rear 126 of the golf club head 102, i.e., perpendicular to the plane of the drawing sheet in FIG. 2. The Z-axis 18 in this system is perpendicular to the ground plane 6, and may be considered to extend vertically. Throughout the remainder of this application, the ground plane coordinate system will be utilized for all reference locations, tolerances, calculations, etc., unless explicitly noted otherwise.

Figure 4:
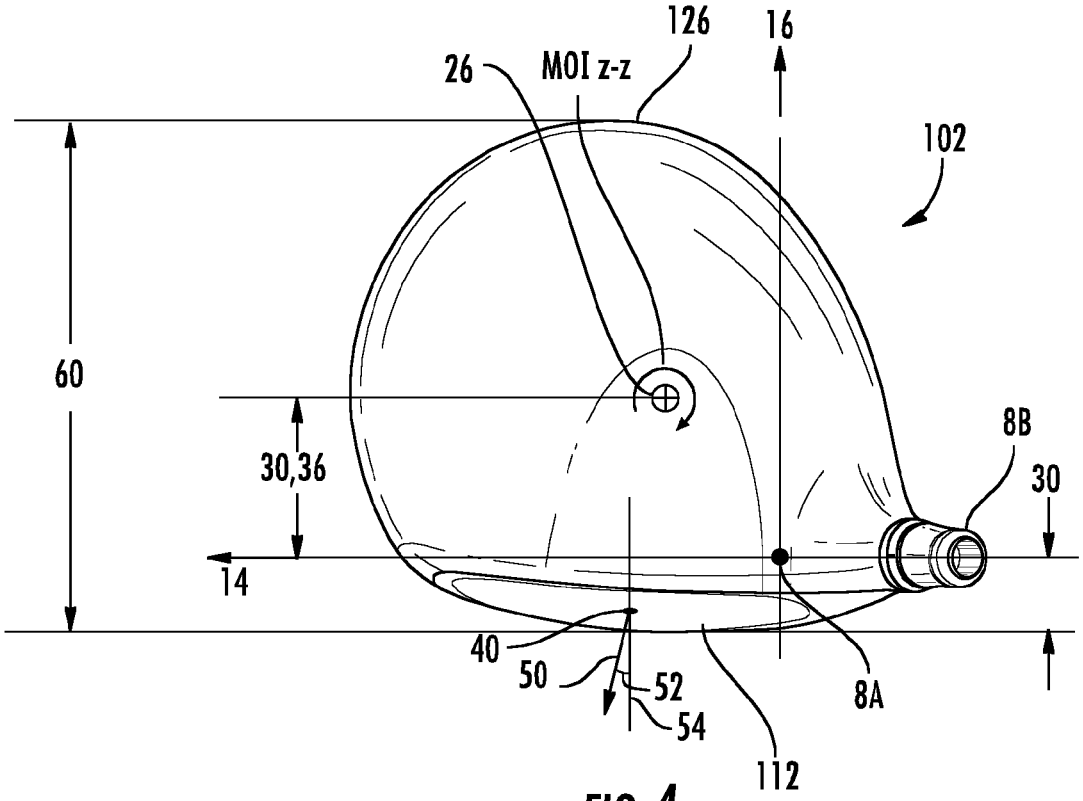
FIG. 4 is a top view of the club head of FIG. 1.

FIGS. 2 and 4 illustrate an example of a center of gravity location 26 as a specified parameter of the golf club head 102, using the ground plane coordinate system. The center of gravity of the golf club head 102 may be determined using various methods and procedures known and used in the art. The golf club head 102 center of gravity location 26 is provided with reference to its position from the ground plane origin point 8A. As illustrated in FIGS. 2 and 4, the center of gravity location 26 is defined by a distance CGX 28 from the ground plane origin point 8A along the X-axis 14, a distance CGY 30 from the ground plane origin point 8A along the Y-axis 16, and a distance CGZ 32 from the ground plane origin point 8A along the Z-axis 18.

Additionally as illustrated in FIG. 3, another coordinate system may be defined with an origin located at the hosel origin point 8B, referred to herein as a hosel axis coordinate system. In other words, this coordinate system has an X' axis 22, a Y' axis 20, and a Z' axis 24 that all pass through the hosel origin point 8B. The Z' axis 24 in this coordinate system extends along the direction of the shaft axis 5 (and/or the hosel axis 4). The X' axis 22 in this system extends parallel with the vertical plane and normal to the Z' axis 24. The Y' axis 20 in this system extends perpendicular to the X' axis 22 and the Z' axis 24 and extends toward the rear 126 of the golf club head 102, i.e., the same direction as the Y-axis 16 of the ground plane coordinate system.

FIG. 3 illustrates an example of a center of gravity location 26 as a specified parameter of the golf club head 102, using the hosel axis coordinate system. The center of gravity of the golf club head 102 may be determined using various methods and procedures known and used in the art. The golf club head 102 center of gravity location 26 is provided with reference to its position from the hosel origin point 8B. As illustrated in FIG. 3, the center of gravity location 26 is defined by a distance ΔX 34 from the hosel origin point 8B along the X' axis 22, a distance ΔY (not shown) from the hosel origin point 8B along the Y' axis 20, and a distance ΔZ 38 from the hosel origin point 8B along the Z' axis 24.

Figure 5:
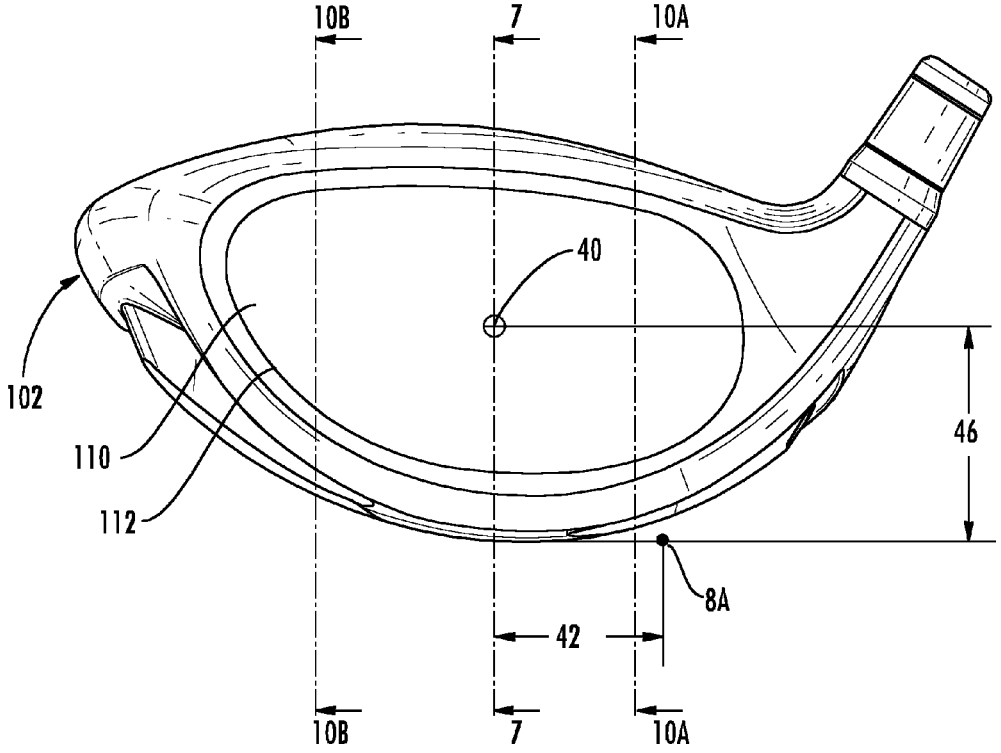
FIG. 5 is a front view of the club head of FIG. 1.

FIGS. 4 and 5 illustrate the face center (FC) location 40 on a golf club head 102. The face center location 40 illustrated in FIGS. 4 and 5 is determined using United States Golf Association (USGA) standard measuring procedures from the "Procedure for Measuring the Flexibility of a Golf Clubhead", USGA TPX-3004, Revision 2.0, Mar. 25, 2005. Using this USGA procedure, a template is used to locate the FC location 40 from both a heel 120 to toe 122 location and a crown 116 to sole 118 location. For measuring the FC location 40 from the heel to toe location, the template should be placed on the striking surface 110 until the measurements at the edges of the striking surface 110 on both the heel 120 and toe 122 are equal. This marks the FC location 40 from a heel to toe direction. To find the face center from a crown to sole dimension, the template is placed on the striking surface 110 and the FC location 40 from crown to sole is the location where the measurements from the crown 116 to sole 118 are equal. The FC location 40 is the point on the striking surface 110 where the crown to sole measurements on the template are equidistant, and the heel to toe measurements are equidistant.

As illustrated in FIG. 5, the FC location 40 can be defined from the ground plane origin coordinate system, such that a distance CFX 42 is defined from the ground plane origin point 8A along the X-axis 14, a distance CFY 44 is defined from the ground plane origin point 8A along the Y-axis 16, and a distance CFZ 46 is defined from the ground plane origin point 8A along the Z-axis 18. It is understood that the FC location 40 may similarly be defined using the hosel origin system, if desired.

Figure 6:
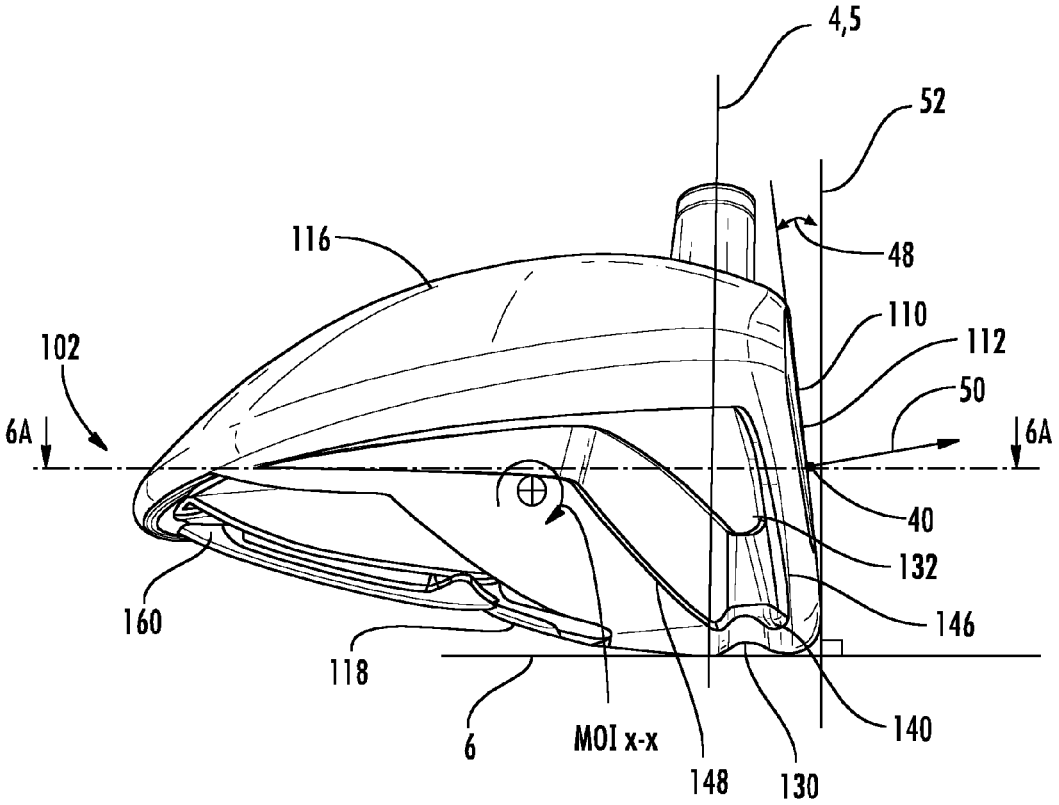
FIG. 6 is a side view of the club head of FIG. 1.
Figure 6A:
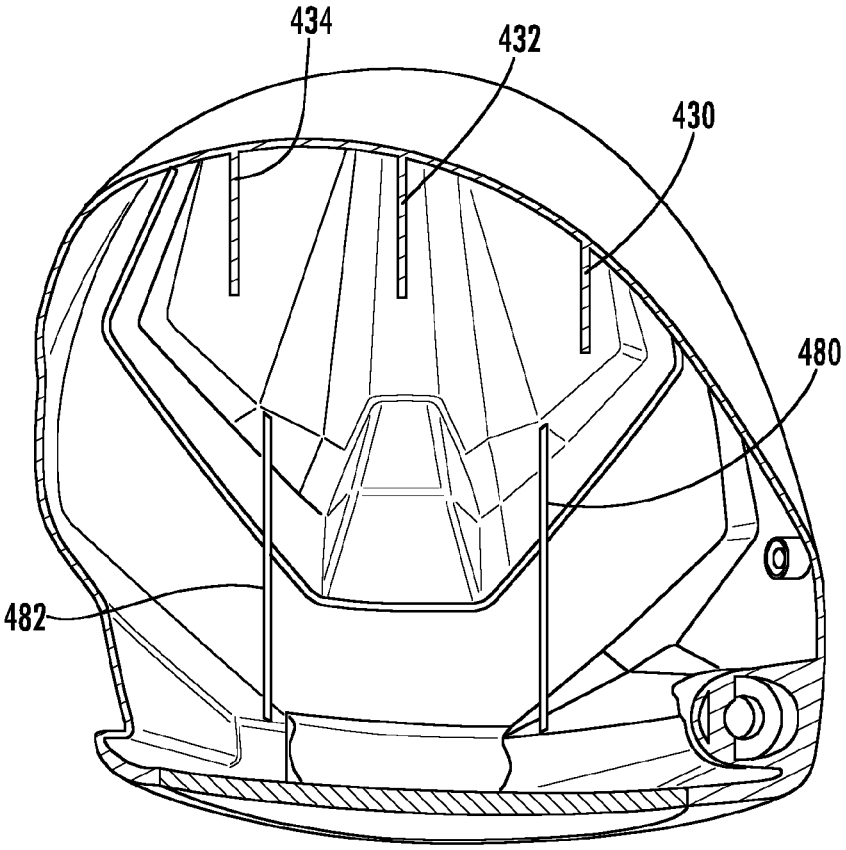
FIG. 6A is a cross-section view taken along line 6A-6A of FIG. 6.

FIG. 6 illustrates an example of a loft angle 48 of the golf club head 102. The loft angle 48 can be defined as the angle between a plane 53 that is tangential to the striking surface 110 at the FC location 40 and an axis 51 normal or perpendicular to the ground plane 6. Alternately, the loft angle 48 can be defined as the angle between an axis 50 normal or perpendicular to the striking surface 110 at the FC location 40, called a face center axis 50, and the ground plane 6. It is understood that each of these definitions of the loft angle 48 may yield the substantially the same loft angle measurement.

FIG. 4 illustrates an example of a face angle 52 of a golf club head 102. As illustrated in FIG. 4, the face angle 52 is defined as the angle between the face center axis 50 and a plane 54 perpendicular to the X-axis 14 and the ground plane 6.

FIG. 2 illustrates a golf club head 102 oriented in a reference position. In the reference position, the hosel axis 4 or shaft axis 5 lies in a vertical plane, as shown in FIG. 6. As illustrated in FIG. 2, the hosel axis 4 may be oriented at the lie angle 2. The lie angle 2 selected for the reference position may be the golf club 100 manufacturer's specified lie angle. If a specified lie angle is not available from the manufacturer, a lie angle of 60 degrees can be used. Furthermore, for the reference position, the striking surface 110 may, in some circumstances, be oriented at a face angle 54 of 0 degrees. The measurement setup for establishing the reference position can be found determined using the "Procedure for Measuring the Club Head Size of Wood Clubs", TPX-3003, Revision 1.0.0, dated Nov. 21, 2003.

As golf clubs have evolved in recent years, many have incorporated head/shaft interconnection structures connecting the shaft 104 and club head 102. These interconnection structures are used to allow a golfer to easily change shafts for different flex, weight, length or other desired properties. Many of these interconnection structures have features whereby the shaft 104 is connected to the interconnection structure at a different angle than the hosel axis 4 of the golf club head, including the interconnection structures discussed elsewhere herein. This feature allows these interconnection structures to be rotated in various configurations to potentially adjust some of the relationships between the club head 102 and the shaft 104 either individually or in combination, such as the lie angle, the loft angle, or the face angle. As such, if a golf club 100 includes an interconnection structure, it shall be attached to the golf club head when addressing any measurements on the golf club head 102. For example, when positioning the golf club head 102 in the reference position, the interconnection structures should be attached to the structure. Since this structure can influence the lie angle, face angle, and loft angle of the golf club head, the interconnection member shall be set to its most neutral position. Additionally, these interconnection members have a weight that can affect the golf club heads mass properties, e.g. center of gravity (CG) and moment of inertia (MOI) properties. Thus, any mass property measurements on the golf club head should be measured with the interconnection member attached to the golf club head.

The moment of inertia is a property of the club head 102, the importance of which is known to those skilled in the art. There are three moment of inertia properties referenced herein. The moment of inertia with respect to an axis parallel to the X-axis 14 of the ground plane coordinate system, extending through the center of gravity 26 of the club head 102, is referenced as the MOI x-x, as illustrated in FIG. 6. The moment of inertia with respect to an axis parallel to the Z-axis 18 of the ground plane coordinate system, extending through the center of gravity 26 of the club head 102, is referenced as the MOI z-z, as illustrated in FIG. 4. The moment of inertia with respect to the Z' axis 24 of the hosel axis coordinate system is referenced as the MOI h-h, as illustrated in FIG. 3. The MOI h-h can be utilized in determining how the club head 102 may resist the golfer's ability to close the clubface during the swing.

Figure 7:
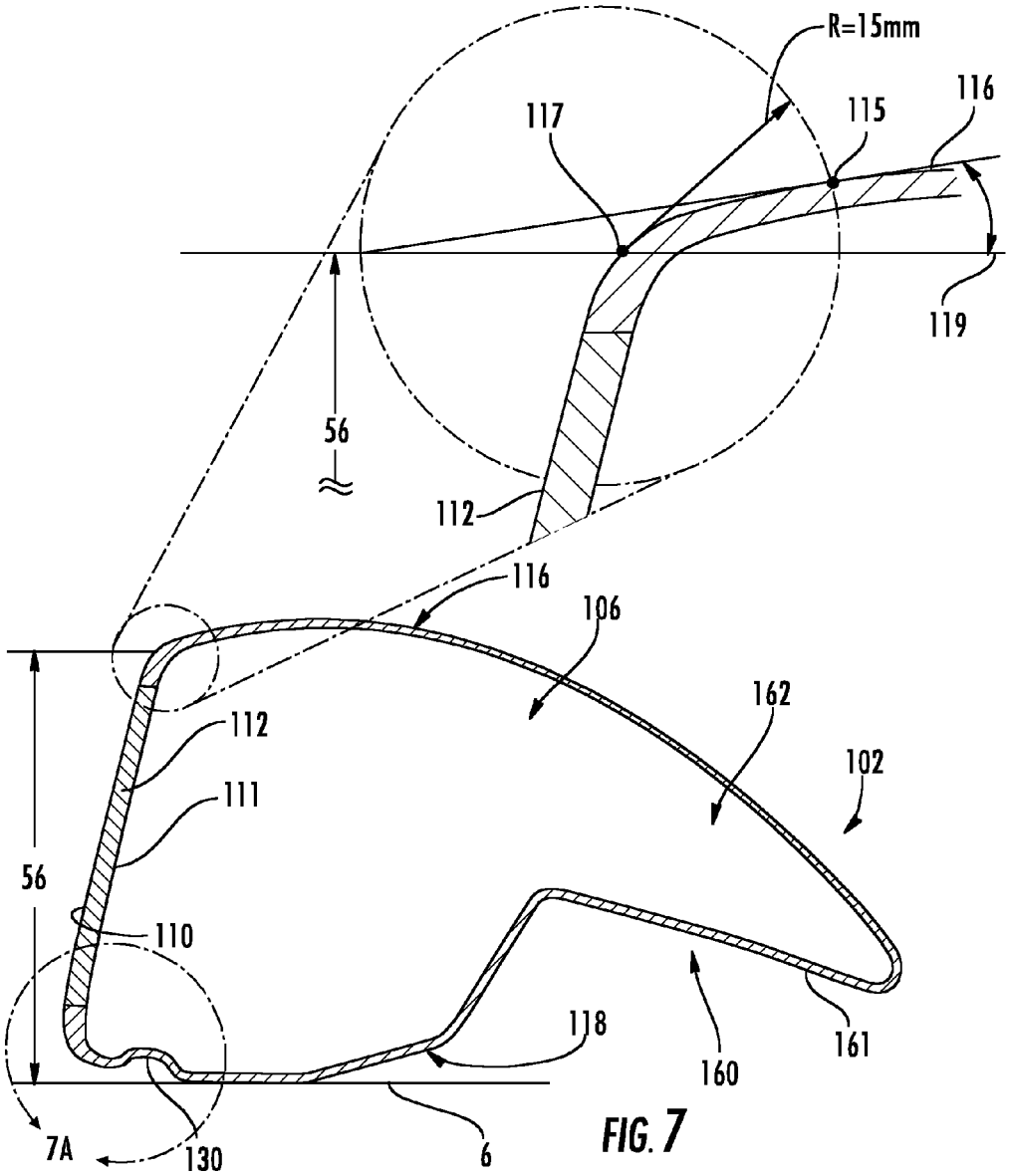
FIG. 7 is a cross-section view taken along line 7-7 of FIGS. 5 and 8, with a magnified portion also shown.

The ball striking face height (FH) 56 is a measurement taken along a plane normal to the ground plane and defined by the dimension CFX 42 through the face center 40, of the distance between the ground plane 6 and a point represented by a midpoint of a radius between the crown 116 and the face 112. An example of the measurement of the face height 56 of a head 102 is illustrated in FIG. 7. The face height 56 in one embodiment of the club head 102 of FIGS. 1-13 may be 50-72 mm, or may be approximately 59.9 mm+/−0.5 mm in another embodiment. It is understood that the club heads 102 described herein may be produced with multiple different loft angles, and that different loft angles may have some effect on face height 56.

Additionally, the geometry of the crown 116 as it approaches the face 112 may assist in the efficiency of the impact. A crown departure angle 119 may define this geometry and is shown in FIG. 7. The crown departure angle 119 may be taken along a plane normal to the ground plane and defined by the dimension CFX 42 through the face center 40. In order to measure the crown departure angle effectively additional points must be defined. Starting with a midpoint 117 of the radius between the crown 116 and the face 112, a circle with a radius of 15 mm is projected onto the crown 116. A line is then projected from this intersection point along a direction parallel to the curvature at that crown and circle-crown intersection point 115. The crown departure angle 119 is then measured as the angle from a plane parallel to the ground plane and the line projected parallel to the curvature at the circle-crown intersection point 115. The crown departure angle 119 may be approximately 10 degrees, or may be within the range of 7 to 20 degrees.

The head length 58 and head breadth 60 measurements can be determined by using the USGA "Procedure for Measuring the Club Head Size of Wood Clubs," USGA-TPX 3003, Revision 1.0.0, dated Nov. 21, 2003. Examples of the measurement of the head length 58 and head breadth 60 of a head 102 are illustrated in FIGS. 3 and 4.

Geometry and Mass Properties of Club Heads

In the golf club 100 shown in FIGS. 1-13, the head 102 has dimensional characteristics that define its geometry and also has specific mass properties that can define the performance of the golf club as it relates to the ball flight that it imparts onto a golf ball during the golf swing or the impact event itself. This illustrative embodiment and other embodiments are described in greater detail below.

The head 102 as shown in FIGS. 1-13 illustrates a driver golf club head. The head 102 has a head weight of 198 to 210 grams. The head has a center of gravity CGX in the range of 20 to 24 mm, CGY in the range of 16 to 20 mm, and CGZ in the range of 30 to 34 mm. Correspondingly from the hosel coordinate system, the ΔX is in the range of 34 to 38 mm, the ΔY is in the range of 16 to 20 mm, and the ΔZ is in the range of 68 to 72 mm. The head 102 has a corresponding MOI x-x of approximately 2400 to 2800 g*cm$^2$, MOI z-z of approximately 4200 to 4800 g*cm$^2$, and an MOI h-h of approximately 6700 to 7100 g*cm$^2$. The head 102 generally has a head length ranging from 115 to 122 mm and a head breadth ranging from 113 to 119 mm. Additionally, the head has a face center 40 defined by a CFX between (where between is defined herein as inclusive) 21 to 25 mm, a CFY between 13 to 17 mm, and a CFZ between 31 to 35 mm.

The head 102 as shown in FIGS. 14-20 illustrates another embodiment of a driver golf club head. This head generally has a head weight of 198 to 210 grams. This head has a cylindrical weight 181 (described in more detail below) that fits within a weight receptacle that can move the center of gravity in the CGY direction between 1-5 mm (or at least 2 mm). The head has a center of gravity CGX in the range of 23 to 27 mm, CGY in the range of 13 to 19 mm, and CGZ in the range of 27 to 32 mm when the heavier end of the weight 181*a* is in the forward position, and the head has a center of gravity CGX in the range of 23 to 27 mm, CGY in the range of 14 to 24 mm, and CGZ in the range of 27 to 32 mm when the heavier end of the weight 181*a* is in the rearward position. Correspondingly, from the hosel coordinate system, the ΔX is in the range of 34 to 40 mm, the ΔY is in the range of 13 to 19 mm with the heavier end of the weight 181*a* in the forward position, and the ΔY is in the range of 14 to 24 mm with the heavier end of the weight 181*a* in the rearward position, the ΔZ is in the range of 51 to 58 mm. The head 102 has a corresponding MOI x-x of approximately 2400 to 2800 g*cm$^2$, MOI z-z of approximately 4100 to 4600 g*cm$^2$, and an MOI h-h of approximately 7000 to 7400 g*cm$^2$ when the heavier end of the weight 181*a* is in the rearward position. The head 102 has a corresponding MOI x-x of approximately 2000 to 2400 g*cm$^2$, MOI z-z of approximately 3800 to 4300 g*cm$^2$, and an MOI h-h of approximately 6600 to 7000 g*cm$^2$ when the heavier end of the weight 181*a* is in the forward position. The head 102 generally has a head length ranging from 120 to 124 mm and a head breadth ranging from 105 to 108 mm. Additionally, the head has a face center 40 defined by a CFX between 22 to 26 mm, a CFY between 11 to 15 mm, and a CFZ between 28 to 32 mm.

Figure 35:
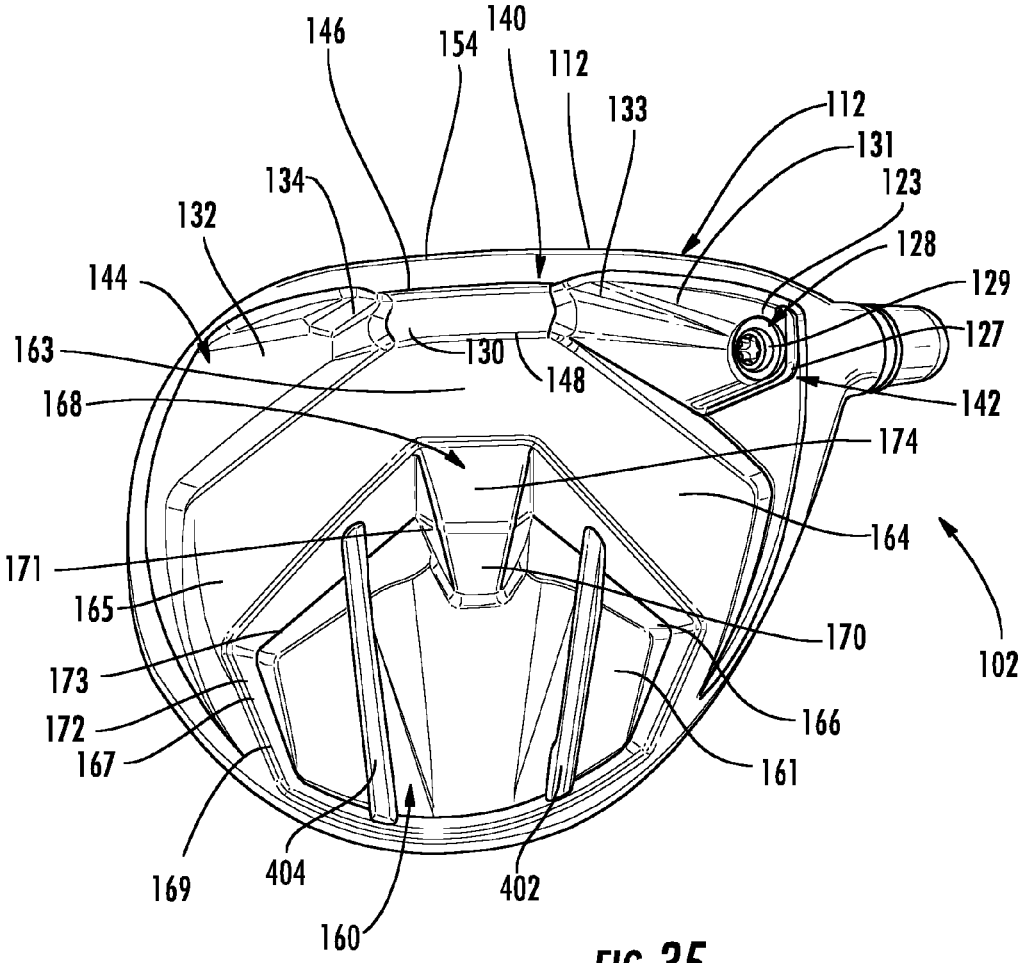
FIG. 35 is a bottom view of another embodiment of a golf club head according to aspects of the disclosure, in the form of a driver golf club head.

The head 102 as shown in FIG. 35 illustrates another embodiment a driver golf club head. The head 102 has a head weight of 198 to 210 grams. The head has a center of gravity CGX in the range of 23 to 27 mm, CGY in the range of 13 to 17 mm, and CGZ in the range of 29 to 33 mm. Correspondingly from the hosel coordinate system, the ΔX is in the range of 35 to 39 mm, the ΔY is in the range of 13 to 17 mm, and the ΔZ is in the range of 69 to 73 mm. The head 102 has a corresponding MOI x-x of approximately 2200 to 2600 g*cm$^2$, an MOI z-z of approximately 4100 to 4600 g*cm$^2$, and an MOI h-h of approximately 6700 to 7100 g*cm$^2$. The head 102 generally has a head length ranging from 121 to 126 mm and a head breadth ranging from 106 to 112 mm. Additionally, the head has a face center 40 defined by a CFX between 24 to 29 mm, a CFY between 12 to 17 mm, and a CFZ between 29 to 34 mm.

The head 102 as shown in FIGS. 21-26D illustrates a fairway wood golf club head. This head generally has a head weight of 208 to 224 grams. The head has a center of gravity CGX in the range of 21 to 26 mm, CGY in the range of 13 to 19 mm, and CGZ in the range of 15 to 19 mm. Correspondingly from the hosel coordinate system, the ΔX is in the range of 27 to 32 mm, the ΔY is in the range of 13 to 19 mm, and the ΔZ is in the range of 57 to 64 mm. The head 102 has a corresponding MOI x-x of approximately 1250 to 1550 g*cm$^2$, an MOI z-z of approximately 2400 to 2800 g*cm$^2$, and an MOI h-h of approximately 4400 to 5000 g*cm$^2$. The head 102 generally has a head length ranging from 101 to 105 mm and a head breadth ranging from 86 to 90 mm. Additionally, the head has a face center 40 defined by a CFX between 21 to 25 mm, a CFY between 8 to 13 mm, and a CFZ between 18 to 22 mm.

Figure 36:
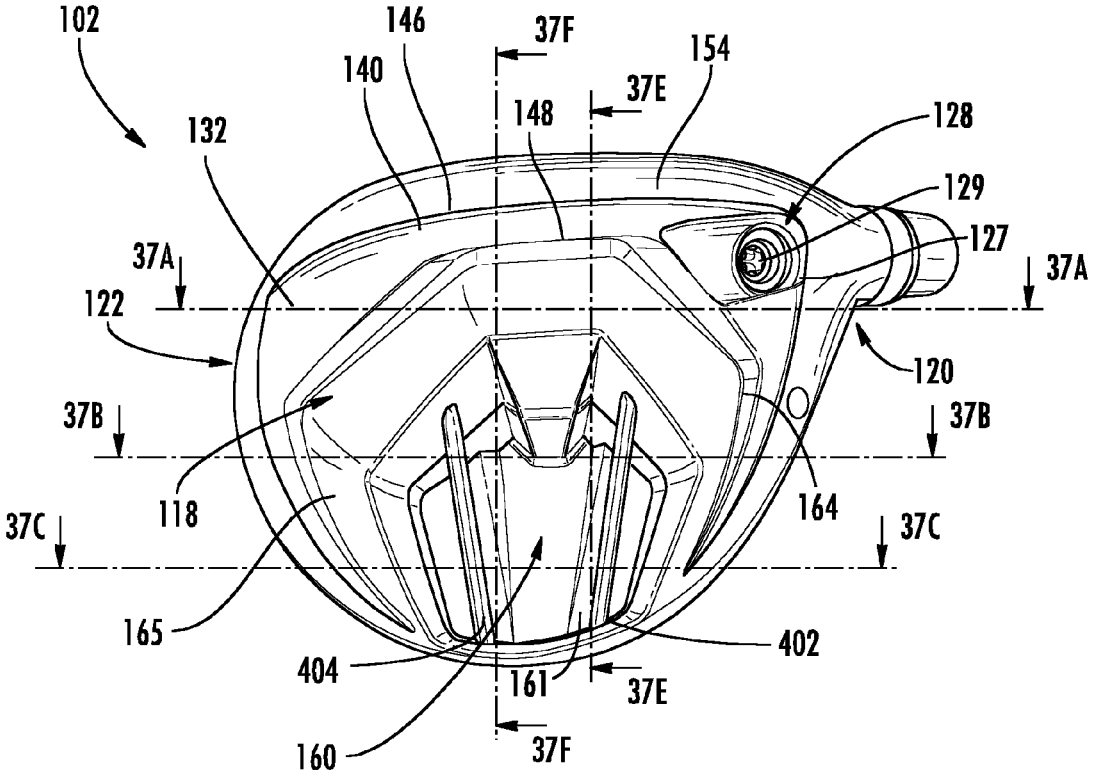
FIG. 36 is a bottom view of another embodiment of a golf club head according to aspects of the disclosure, in the form of a fairway wood golf club head.
Figure 37A:
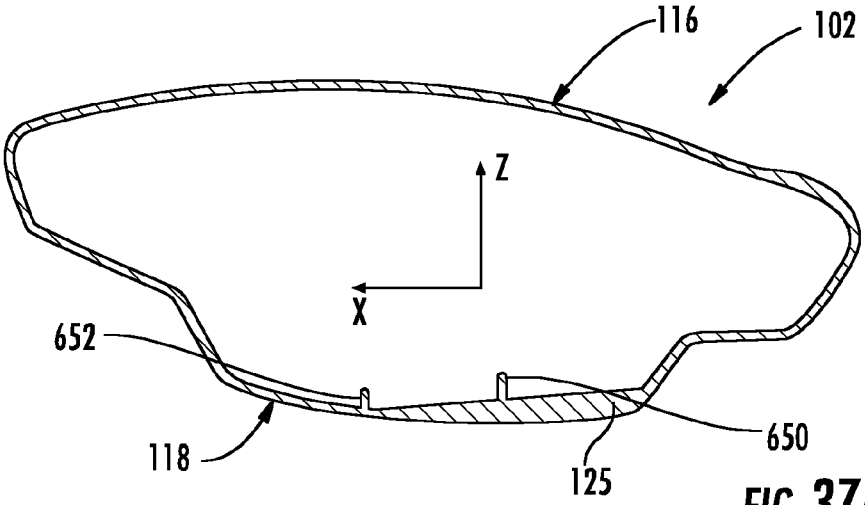
FIG. 37A is an area cross-section view taken along line 37A-37A of FIG. 36.
Figure 37B:
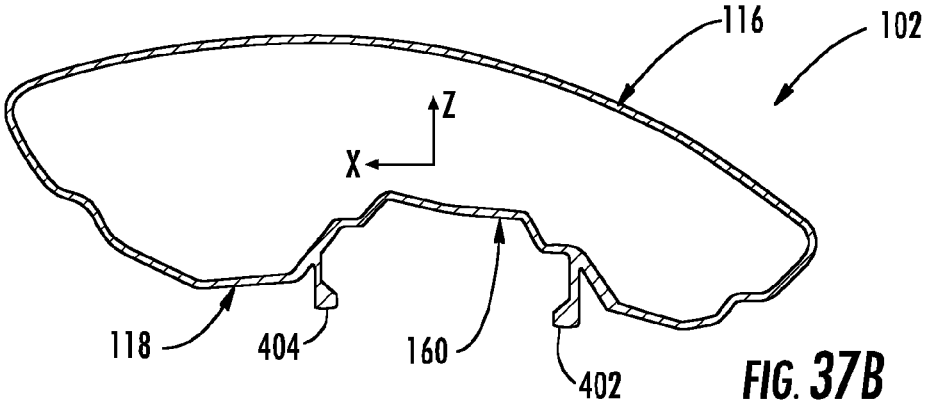
FIG. 37B is an area cross-section view taken along line 37B-37B of FIG. 36.
Figure 37C:
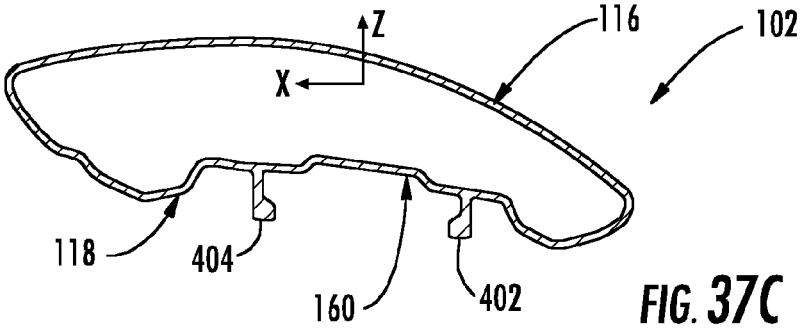
FIG. 37C is an area cross-section view taken along line 37C-37C of FIG. 36.
Figure 37D:
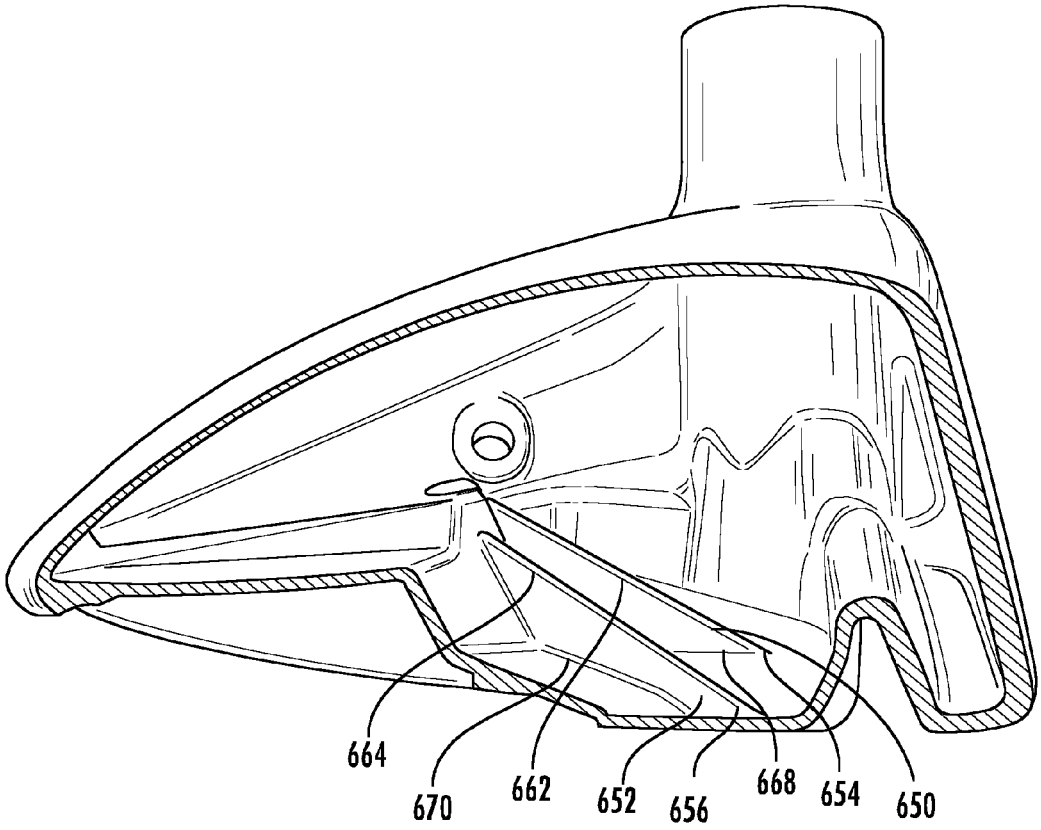
FIG. 37D is a side perspective view of a golf club head of FIG. 36 with a portion removed to show internal detail.
Figure 37E:
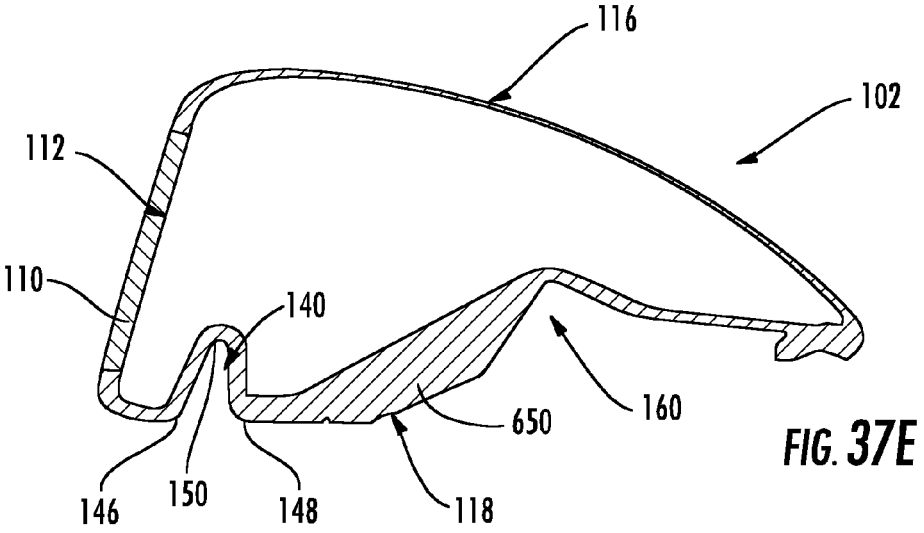
FIG. 37E is a cross-section view of the golf club of FIG. 36.
Figure 37F:
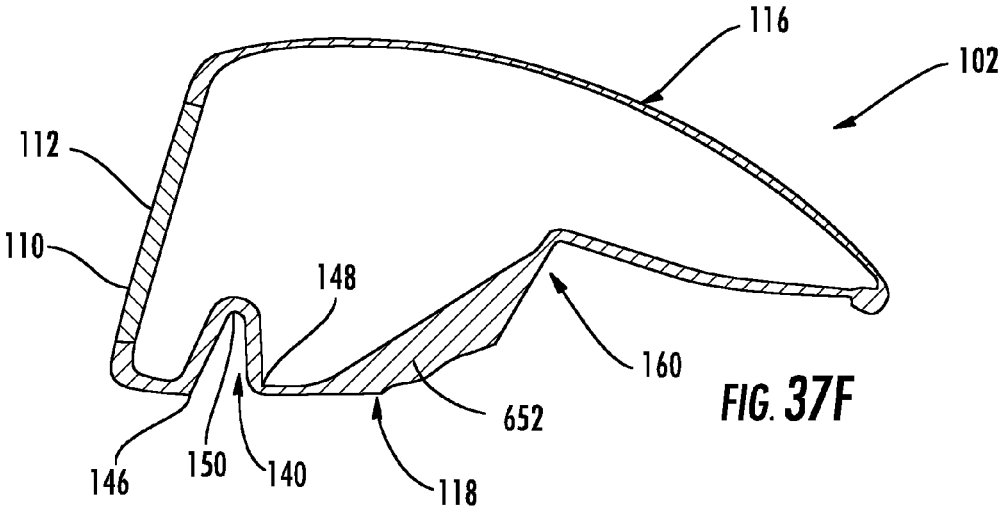
FIG. 37F is another cross-section view of the golf club of FIG. 36.

The head 102 as shown in FIGS. 36-37F illustrate another embodiment of a fairway wood golf club head. This head generally has a head weight of 208 to 224 grams. The head has a center of gravity CGX in the range of 17 to 22 mm, CGY in the range of 9 to 14 mm, and CGZ in the range of 16 to 20 mm. Correspondingly from the hosel coordinate system, the ΔX is in the range of 24 to 29 mm, the ΔY is in the range of 9 to 14 mm, and the ΔZ is in the range of 42 to 47 mm. The head 102 has a corresponding MOI x-x of approximately 1150 to 1450 g*cm$^2$, an MOI z-z of approximately 2300 to 2800 g*cm$^2$, and an MOI h-h of approximately 3500 to 4100 g*cm$^2$. The head 102 generally has a head length ranging from 96 to 105 mm and a head breadth ranging from 81 to 87 mm. The head 102 generally has a head length ranging from 120 to 124 mm and a head breadth ranging from 105 to 108 mm. Additionally, the head has a face center 40 defined by a CFX between 19 to 23 mm, a CFY between 11 to 15 mm, and a CFZ between 17 to 21 mm.

The head 102 as shown in FIGS. 27-33 illustrates a hybrid golf club head. This head generally has a head weight of 222 to 250 grams. The head has a center of gravity CGX in the range of 22 to 26 mm, CGY in the range of 8 to 13 mm, and CGZ in the range of 13 to 17 mm. Correspondingly, from the hosel coordinate system, the ΔX is in the range of 27 to 32 mm, the ΔY is in the range of 8 to 13 mm, and the ΔZ is in the range of 60 to 65 mm. The head 102 has a corresponding MOI x-x of approximately 800 to 1200 g*cm$^2$, an MOI z-z of approximately 2000 to 2400 g*cm$^2$, and an MOI h-h of approximately 3600 to 4000 g*cm$^2$. The head 102 generally has a head length ranging from 97 to 102 mm and a head breadth ranging from 64 to 71 mm. Additionally, the head has a face center 40 defined by a CFX between 22 to 26 mm, a CFY between 6 to 12 mm, and a CFZ between 17 to 21 mm.

Figure 38:
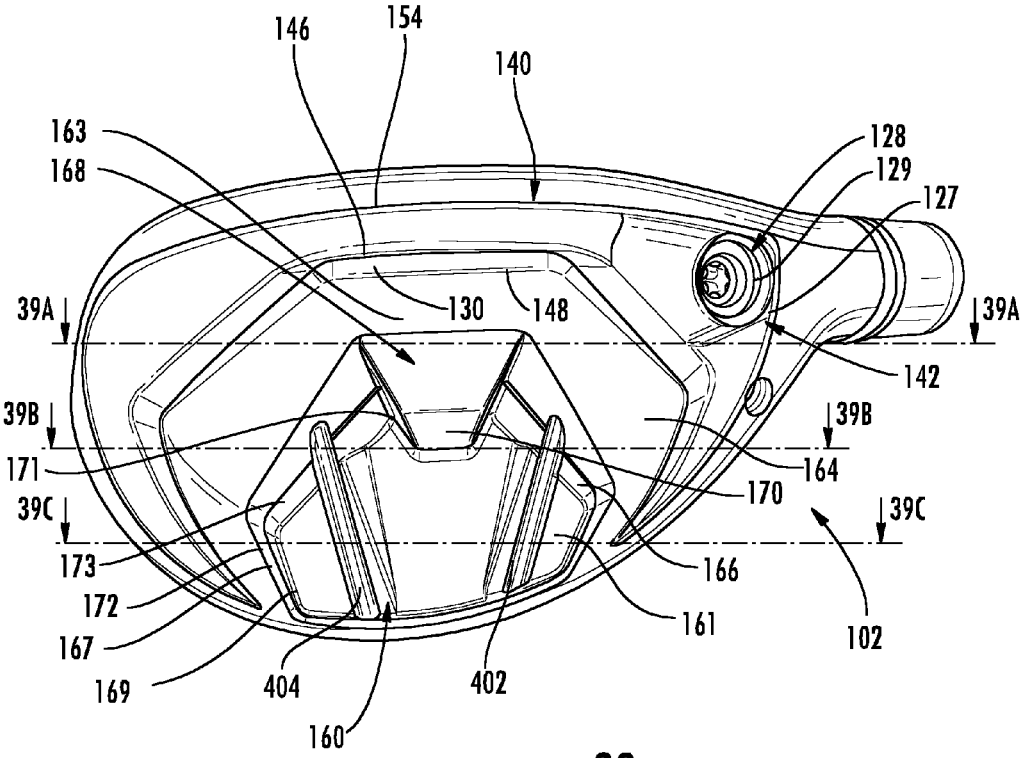
FIG. 38 bottom view of another embodiment of a golf club head according to aspects of the disclosure, in the form of a hybrid golf club head.
Figure 39A:
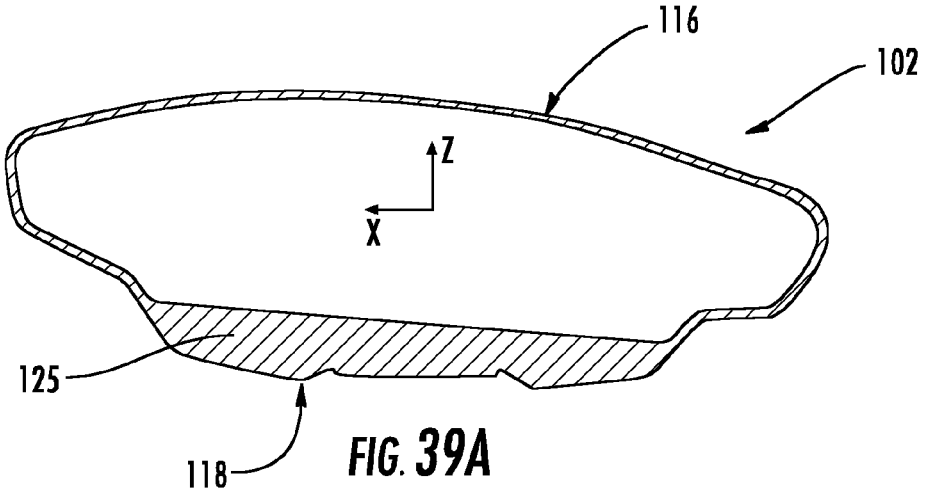
FIG. 39A is an area cross-section view taken along line 39A-39A of FIG. 38.
Figure 39B:
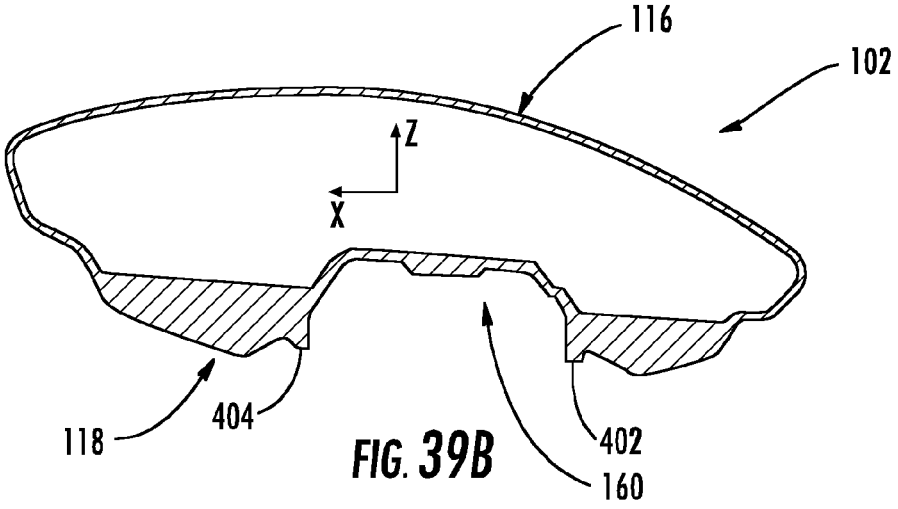
FIG. 39B is an area cross-section view taken along line 39B-39B of FIG. 38.
Figure 39C:
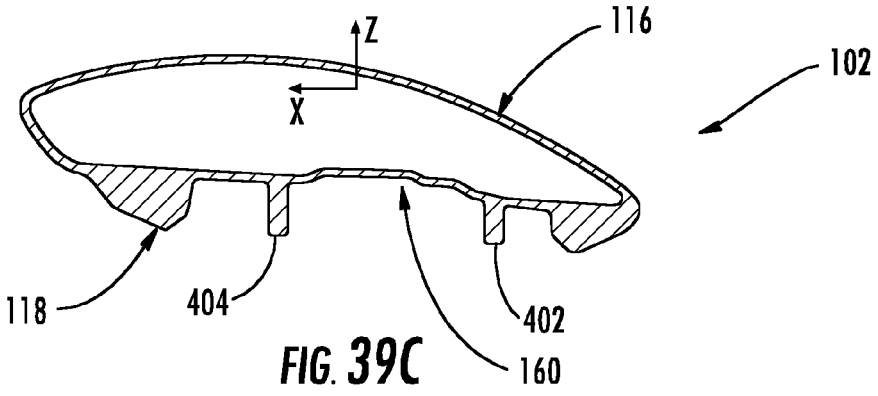
FIG. 39C is an area cross-section view taken along line 39C-39C of FIG. 38.

The head 102 as shown in FIGS. 38-39C illustrates another embodiment of a hybrid golf club head. This head generally has a head weight of 222 to 250 grams. The head has a center of gravity CGX in the range of 24 to 28 mm, CGY in the range of 6 to 11 mm, and CGZ in the range of 13 to 17 mm. Correspondingly, from the hosel coordinate system, the ΔX is in the range of 27 to 32 mm, the ΔY is in the range of 6 to 11 mm, and the ΔZ is in the range of 45 to 51 mm. The head 102 has a corresponding MOI x-x of approximately 650 to 1000 g*cm$^2$, an MOI z-z of approximately 2100 to 2500 g*cm$^2$, and an MOI h-h of approximately 3800 to 4200 g*cm$^2$ The head 102 generally has a head length ranging from 100 to 105 mm and a head breadth ranging from 61 to 67 mm. The head 102 generally has a head length ranging from 120 to 124 mm and a head breadth ranging from 105 to 108 mm. Additionally, the head has a face center 40 defined by a CFX between 26 to 30 mm, a CFY between 8 to 13 mm, and a CFZ between 16 to 20 mm.

Channel Structure of Club Head

In general, the ball striking heads 102 according to the present invention include features on the body 108 that influence the impact of a ball on the face 112, such as one or more compression channels 140 positioned on the body 108 of the head 102 that allow at least a portion of the body 108 to flex, produce a reactive force, and/or change the behavior or motion of the face 112, during impact of a ball on the face 112. In the golf club 100 shown in FIGS. 1-13, the head 102 includes a single channel 140 located on the sole 118 of the head 102. As described below, this channel 140 permits compression and flexing of the body 108 during impact on the face 112, which can influence the impact properties of the club head. This illustrative embodiment and other embodiments are described in greater detail below.

Figure 1A:
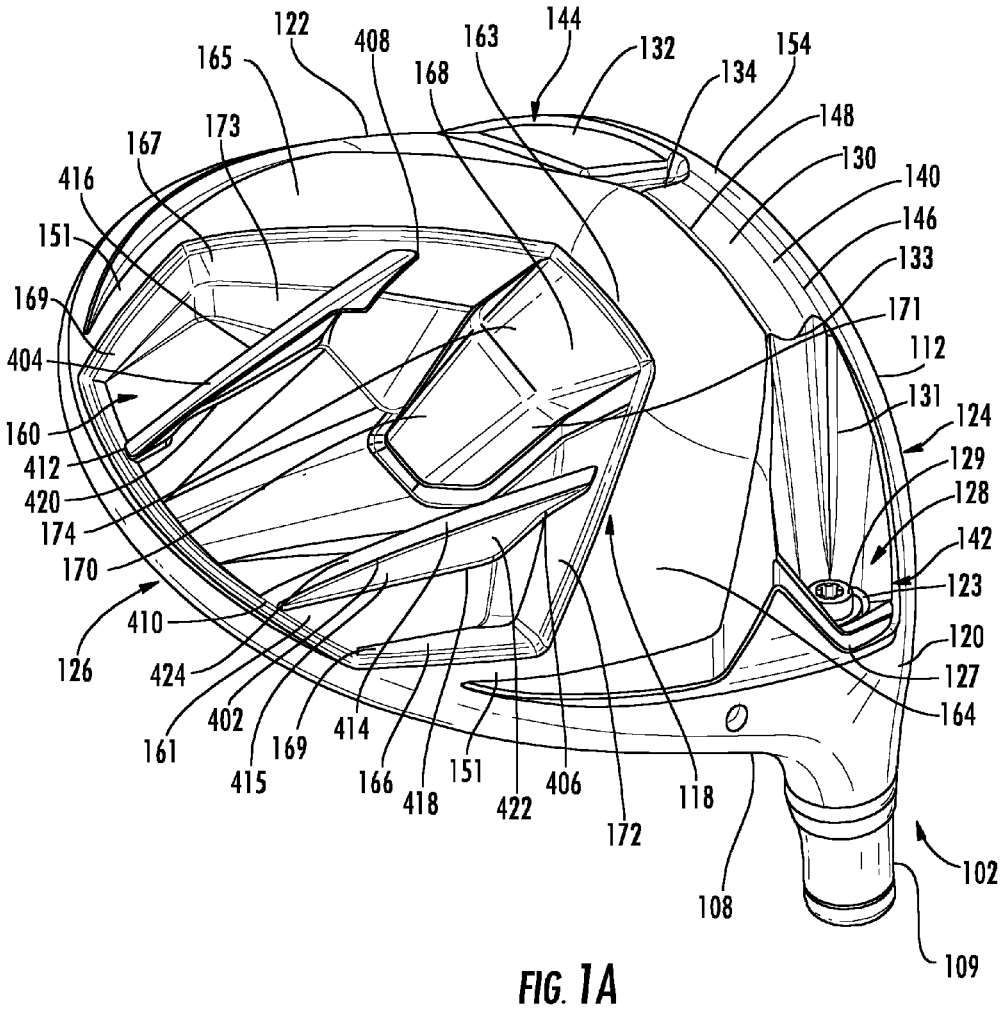
FIG. 1A is a bottom right rear perspective view of the golf club head of FIG. 1.
Figure 8:
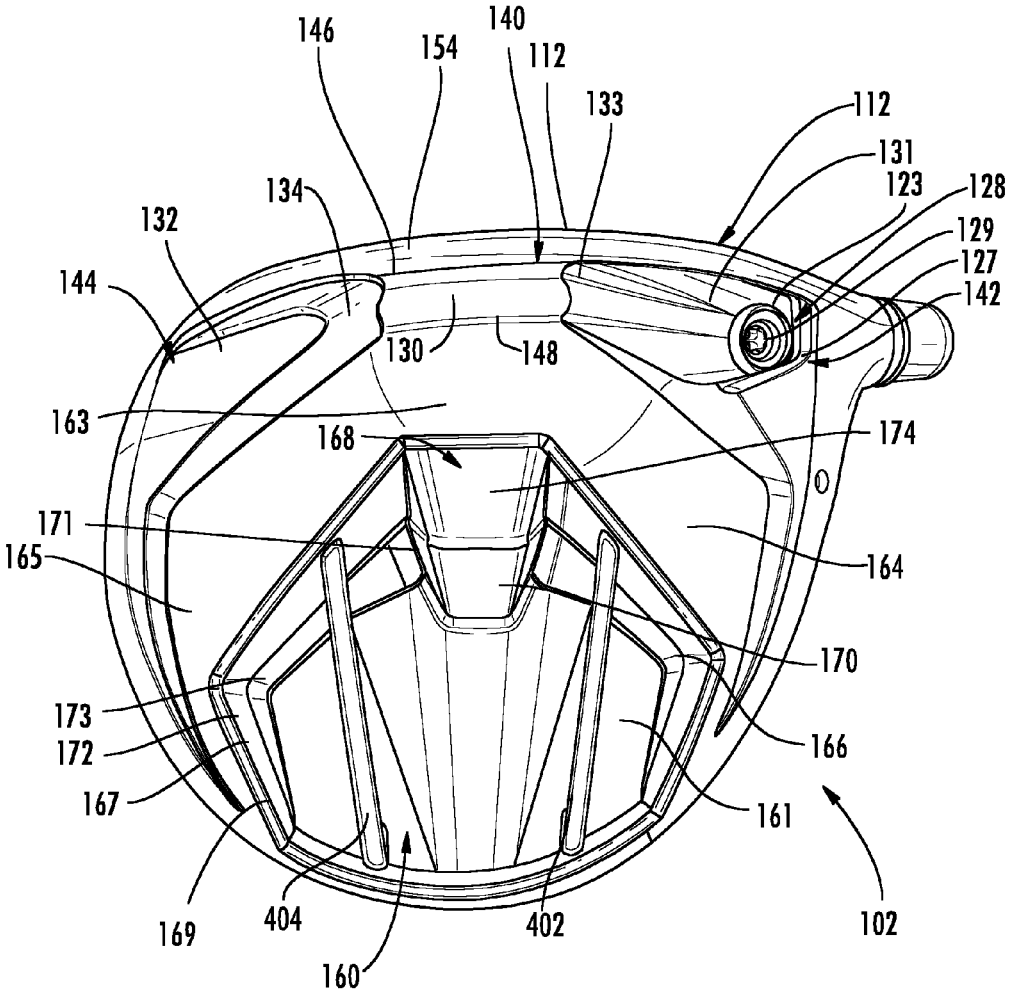
FIG. 8 is a bottom view of the club head of FIG. 1.
Figure 8A:
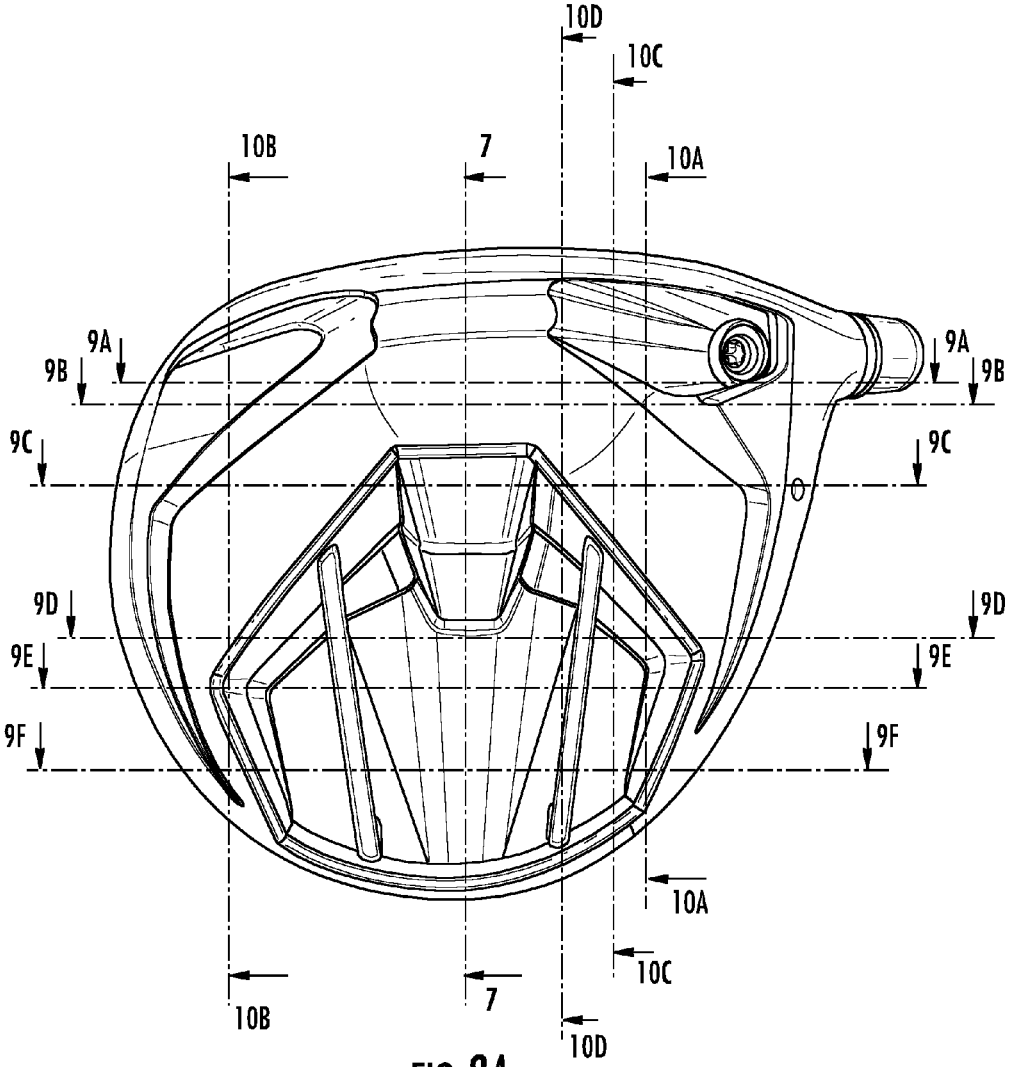
FIG. 8A is another bottom view with cross-sections of the club head of FIG. 1.

The golf club head 102 shown in FIGS. 1-13 includes a compression channel 140 positioned on the sole 118 of the head 102, and which may extend continuously across at least a portion of the sole 118. In other embodiments, the head 102 may have a channel 140 positioned differently, such as on the crown 116, the heel 120, and/or the toe 122. It is also understood that the head 102 may have more than one channel 140, or may have an annular channel extending around the entire or substantially the entire head 102. As illustrated in FIGS. 1A and 8, the channel 140 of this example structure is elongated, extending between a first end 142 located proximate the heel 120 of the head 102 and a second end 144 located proximate the toe 122 of the head 102. The channel 140 has a boundary that is defined by a first or front edge 146 and a second or rear edge 148 that extend between the ends 142, 144. In this embodiment, the channel 140 extends across the sole, adjacent to and along the bottom edge 113 of the face 112, and further extends proximate the heel 120 and toe 122 areas of the head 102. The channel 140 is recessed inwardly with respect to the immediately adjacent surfaces of the head 102 that extend from and/or are in contact with the edges 146, 148 of the channel 140, as shown in FIGS. 1A and 6-13. It is understood that, with a head 102 having a thin-wall construction (e.g., the embodiment of FIGS. 1-13), the recessed nature of the channel 140 creates corresponding raised portions on the inner surfaces of the body 108.

Figure 7A:
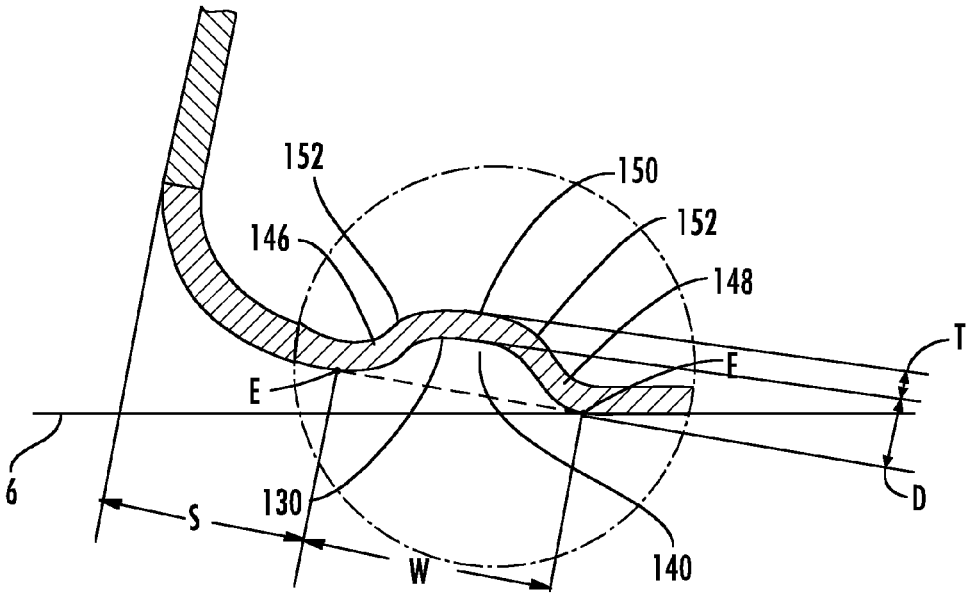
FIG. 7A is a magnified view of a portion of the club head of FIG. 7.

As illustrated in FIG. 7A, the channel 140 has a width W and a depth D that may vary in different portions of the channel 140. The width W and depth D of the channel 140 may be measured with respect to different reference points. For example, the width W of the channel 140 may be measured between radius end points (see points E in FIG. 7A), which represent the end points of the radii or fillets of the front edge 146 and the rear edge 148 of the channel 140, or in other words, the points where the recession of the channel 140 from the body 108 begins. This measurement can be made by using a straight virtual line segment that is tangent to the end points of the radii or fillets as the channel 140 begins to be recessed into the body 108. This may be considered to be a comparison between the geometry of the body 108 with the channel 140 and the geometry of an otherwise identical body that does not have the channel 140. The depth D of the channel 140 may also be measured normal to an imaginary line extending between the radius end points. As further illustrated in FIGS. 7 and 7A, a rearward spacing S of the channel 140 from the edge of the face 112 may be defined using the radius end point of the front edge 146 of the channel 140, measured rearwardly from the center of the radius between the sole 118 and the face 112. As illustrated in FIGS. 7 and 7A, the rearward spacing S of the channel 140 location relative to the front of the head 102 may be defined for any cross-section taken in a plane perpendicular to the X-Axis 14 and Z-Axis 18 at any location along the X-Axis 14 by the dimension S from the forward most edge of the face dimension at the cross-section to the radius of the end point of the channel (shown as point E in FIG. 7A) along a straight virtual line segment that is tangent to the end points of the radii or fillets as the channel 140 begins to be recessed into the body 108. This may be considered to be a comparison between the geometry of the body 108 with the channel 140 and the geometry of an otherwise identical body that does not have the channel 140. If the reference points for measurement of the width W and/or depth D of the channel 140 are not explicitly described herein with respect to a particular example or embodiment, the radius end points may be considered the reference points for both width W and/or depth D measurement. Properties such as width W, depth D, and rearward spacing S, etc., in other embodiments (e.g., as shown in FIGS. 14-20) may be measured or expressed in the same manner described herein with respect to FIGS. 1-13.

The head 102 in the embodiment illustrated in FIGS. 1-13 has a channel 140 that generally has a center portion 130 that has a relatively consistent width W (front to rear) and depth D of recession and heel and toe portions 131, 132 that have greater widths W and greater depths D of recession from adjacent surfaces of the sole 118. In this configuration, the front edge 146 and the rear edge 148 are both generally parallel to the bottom edge of the face 112 and/or generally parallel to each other along the entire length of the center portion 130, i.e., between opposed ends 133, 134 of the center portion 130. In this configuration, the front and rear edges 146, 148 may generally follow the curvature of the bulge radius of the face 112. In other embodiments, the front edge 146 and/or the rear edge 146 at the center portion 130 may be angled, curved, etc. with respect to each other and/or with respect to the adjacent edges of the face 112. The front and rear edges 146, 148 at the heel portion 131 and the toe portion 132 are angled away from each other, such that the widths W of the heel and toe portions 131, 132 gradually increase toward the heel 120 and the toe 122, respectively. The depths D of the heel and toe portions 131, 132 of the channel 140 also increase from the center portion 130 toward the heel 120 and toe 122, respectively. In this configuration, the narrowest portions of the heel and toe portions 131, 132 are immediately adjacent the ends 133, 134 of the center portion 130. Additionally, in this configuration, the portions of the heel and toe portions 131, 132 are immediately adjacent the ends 133, 134 of the center portion 130 are shallower than other locations more proximate the heel 120 and toe 122, respectively. Further, in the embodiment shown in FIGS. 1A and 8, the front edge 146 at the heel and toe portions 131, 132 is generally parallel to the adjacent edges 113 of the face 112, while the rear edge 148 angles or otherwise diverges away from the edges 113 of the face 112 at the heel and toe portions 131, 132. In one embodiment, the access 128 for the adjustable hosel 109 connecting structure 129 may be in communication with and/or may intersect the channel 140, such as in the head 102 illustrated in FIGS. 1A and 8, in which the access 128 is in communication with and intersects the heel portion 131 of the channel 140. The access 128 in this embodiment includes an opening 123 within the channel 140 that receives a part of the hosel interconnection structure 129, and a wall 127 is formed adjacent the access 128 to at least partially surround the opening 123. In one embodiment, the wall 127 extends completely across the heel portion 131 of the channel 140, and the wall 127 is positioned between the opening 123 and the heel 120 and/or the heel end 142 of the channel 140. In the embodiment illustrated in FIGS. 1A and 8, the wall 127 extends rearwardly from the front edge 146 of the channel 140 and then jogs away from the heel 120 to intersect with the rear edge 148 of the channel 140. The wall 127 may have a different configuration in other embodiments, such as extending only partially across the channel 140 and/or completely surrounding the opening 123. In other embodiments, the channel 140 may be oriented and/or positioned differently. For example, the channel 140 may be oriented adjacent to a different portion of edge 113 of the face 112, and at least a portion of the channel 140 may be parallel or generally parallel to one or more of the edges of the face 112. The size and shape of the compression channel 140 also may vary widely without departing from this invention.

The channel 140 is substantially symmetrically positioned on the head 102 in the embodiment illustrated in FIGS. 1-13, such that the center portion 130 is generally symmetrical with respect to a vertical plane passing through the geometric centerline of the sole 118 and/or the body 108, and the midpoint of the center portion 130 may also be coincident with such a plane. However, in another embodiment, the center portion 130 may additionally or alternately be symmetrical with respect to a vertical plane (generally normal to the face 112) passing through the geometric center of the face 112 (which may or may not be aligned the geometric center of the sole 118 and/or the body 108), and the midpoint of the center portion 130 may also be coincident with such a plane. This arrangement and alignment may be different in other embodiments, depending at least in part on the degree of geometry and symmetry of the body 108 and the face 112. For example, in another embodiment, the center portion 130 may be asymmetrical with respect to one or more of the planes discussed above, and the midpoint may not coincide with such plane(s). This configuration can be used to vary the effects achieved for impacts on desired portions of the face 112 and/or to compensate for the effects of surrounding structural features on the impact properties of the face 112.

The center portion 130 of the channel 140 in this embodiment has a curved and generally semi-circular cross-sectional shape or profile, with a trough 150 and sloping, depending side walls 152 that are smoothly curvilinear, extending from the trough 150 to the respective edges 146, 148 of the channel 140. The trough 150 forms the deepest (i.e. most inwardly-recessed) portion of the channel 140 in this embodiment. It is understood that the center portion 130 may have a different cross-sectional shape or profile, such as having a sharper and/or more polygonal (e.g. rectangular) shape in another embodiment. Additionally, as described above, the center portion 130 of the channel 140 may have a generally constant depth across the entire length, i.e., between the ends 133, 134 of the center portion 130. In another embodiment, the center portion 130 of the channel 140 may generally increase in depth D so that the trough 150 has a greater depth at and around the midpoint of the center portion 130 and is shallower more proximate the ends 133, 134. Further, in one embodiment, the wall thickness T of the body 108 may be reduced at the channel 140, as compared to the thickness at other locations of the body 108, to provide for increased flexibility at the channel 140. In one embodiment, the wall thickness(es) T in the channel 140 (or different portions thereof) may be from 0.3-2.0 mm, or from 0.6-1.8 mm in another embodiment.

The wall thickness T may also vary at different locations within the channel 140. For example, in one embodiment, the wall thickness T is slightly greater at the center portion 130 of the channel 140 than at the heel and toe portions 131, 132. In a different embodiment, the wall thickness may be smaller at the center portion 130, as compared to the heel and toe portions 131, 132. The wall thickness T in either of these embodiments may gradually increase or decrease to create these differences in wall thickness in one embodiment. The wall thickness T in the channel 140 may have one or more "steps" in wall thickness to create these differences in wall thickness in another embodiment, or the channel 140 may have a combination of gradual and step changes in wall thickness. In a further embodiment, the entire channel 140, or at least the majority of the channel 140, may have a consistent wall thickness T. It is understood that any of the embodiments in FIGS. 1-33 may have any of these wall thickness T configurations.

The heel and toe portions 131, 132 of the channel 140 may have different cross-sectional shapes and/or profiles than the center portion 130. For example, as seen in FIGS. 7-10, the heel and toe portions 131, 132 have a more angular and less smoothly-curved cross-sectional shape as compared to the center portion 130, which has a semi-circular or other curvilinear cross-section. In other embodiments, the center portion 130 may also be angularly shaped, such as by having a rectangular or trapezoidal cross section, and/or the heel and toe portions 131, 132 may have a more smoothly-curved and/or semi-circular cross-sectional shape.

In the embodiment shown in FIGS. 1-13, the channel 140 is spaced from the bottom edge 113 of the face 112, with a spacing portion 154 defined between the front edge 146 of the channel 140 and the bottom edge 113. The spacing portion 154 is located immediately adjacent the channel 140 and junctures with one of the side walls 152 of the channel 140 along the front edge 146 of the channel 140, as shown in FIGS. 1A and 7-10. In this embodiment, the spacing portion 154 is oriented at an angle to the ball striking surface 110 and extends rearward from the bottom edge 113 of the face 112 to the channel 140. In various embodiments, the spacing portion 154 may be oriented with respect to the ball striking surface 110 at an acute (i.e. <90°), obtuse (i.e. >90°), or right angle. Force from an impact on the face 112 can be transferred to the channel 140 through the spacing portion 154, as described below. The spacing portion 154 may have a distance S as illustrated in FIG. 7A. In other embodiments, the spacing portion 154 may be oriented at a right angle or an obtuse angle to the ball striking surface 110, and/or the spacing portion 154 may have a different distance S than shown in FIGS. 1A and 7-13. The spacing portion 154 may be larger when measured in the direction of the Y-axis 16 at the center portion of the channel 140 than on the heel and toe portions 131, 132 or the spacing portion 154 may be the same dimension to the center, heel and toe portions 131, 132. Alternatively, the spacing portion 154 may be smaller when measured in the direction of the Y-axis 16 at the center portion of the channel 140 than on the heel and toe portions 131, 132.

In one embodiment, part or the entire channel 140 may have surface texturing or another surface treatment, or another type of treatment that affects the properties of the channel 140. For example, certain surface treatments, such as peening, coating, etc., may increase the stiffness of the channel and reduce flexing. As another example, other surface treatments may be used to create greater flexibility in the channel 140. As a further example, surface treatments may increase the smoothness of the channel 140 and/or the smoothness of transitions (e.g. the edges 146, 148) of the channel 140, which can influence aerodynamics, interaction with playing surfaces, visual appearance, etc. Further surface texturing or other surface treatments may be used as well. Examples of such treatments that may affect the properties of the channel 140 include heat treatment, which may be performed on the entire head 102 (or the body 108 without the face 112), or which may be performed in a localized manner, such as heat treating of only the channel 140 or at least a portion thereof. Cryogenic treatment or surface treatments may be performed in a bulk or localized manner as well. Surface treatments may be performed on either or both of the inner and outer surfaces of the head 102 as well.

The compression channel 140 of the head 102 shown in FIGS. 1-13 can influence the impact of a ball (not shown) on the face 112 of the head 102. In one embodiment, the channel 140 can influence the impact by flexing and/or compressing in response to the impact on the face 112, which may influence the stiffness/flexibility of the impact response of the face 112. For example, when the ball impacts the face 112, the face 112 flexes inwardly. Additionally, some of the impact force is transferred through the spacing portion 154 to the channel 140, causing the sole 118 to flex at the channel 140. This flexing of the channel 140 may assist in achieving greater impact efficiency and greater ball speed at impact. The more gradual impact created by the flexing also creates a longer impact time, which can also result in greater energy and velocity transfer to the ball during impact. Further, because the channel 140 extends into the heel 120 and toe 122, the head 102 higher ball speed for impacts that are away from the center or traditional "sweet spot" of the face 112. It is understood that one or more channels 140 may be additionally or alternately incorporated into the crown 116 and/or sides 120, 122 of the body 108 in order to produce similar effects. For example, in one embodiment, the head 102 may have one or more channels 140 extending completely or substantially completely around the periphery of the body 108, such as shown in U.S. patent application Ser. No. 13/308,036, filed Nov. 30, 2011, which is incorporated by reference herein in its entirety.

In one embodiment, the center portion 130 of the channel 140 may have different stiffness than other areas of the channel 140 and the sole 118 in general, and contributes to the properties of the face 112 at impact in one embodiment. For example, in the embodiment of FIGS. 1-13, the center portion 130 of the channel 140 is less flexible than the heel and toe portions 131, 132, due to differences in geometry, wall thickness, etc., as discussed elsewhere herein. The portions of the face 112 around the center 40 are generally the most flexible, and thus, less flexibility from the channel 140 is needed for impacts proximate the face center 40. The portions of the face 112 more proximate the heel 120 and toe 122 are generally less flexible, and thus, the heel and/or toe portions 131, 132 of the channel 140 are more flexible to compensate for the reduced flexibility of the face 112 for impacts near the heel 120 and the toe 122. This permits the club head 102 to transfer more impact energy to the ball and/or increase ball speed on off-center hits, such as by reducing energy loss due to ball deformation. In another embodiment, the center portion 130 of the channel 140 may be more flexible than the heel and toe portions 131, 132, to achieve different effects. The flexibility of various portions of the channel 140 may be configured to be complementary to the flexibility and/or dimensions (e.g., height, thickness, etc.) of adjacent portions of the face 112, and vice versa. It is understood that certain features of the head 102 (e.g. the access 128) may influence the flexibility of the channel 140. It is also understood that various structural features of the channel 140 and/or the center portion 130 thereof may influence the impact properties achieved by the club head 102, as well as the impact response of the face 112, as described elsewhere herein. For example, smaller width W, smaller depth D, and larger wall thickness T can create a less flexible channel 140 (or portion thereof), and greater width W, greater depth D, and smaller wall thickness T can create a more flexible channel 140 (or portion thereof). Use of different structural materials and/or use of filler materials in different portions of the head 102 or different portions of the channel 140 can also create different flexibilities. It is understood that other structural features on the head 102 other than the channel 140 may influence the flexibility of the channel 140, such as the thickness of the sole 118 and/or the various structural ribs described elsewhere herein.

The relative dimensions of portions of the channel 140, the face 112, and the adjacent areas of the body 108 may influence the overall response of the head 102 upon impacts on the face 112, including ball speed, twisting of the club head 102 on off-center hits, spin imparted to the ball, etc. For example, a wider width W channel 140, a deeper depth D channel 140, a smaller wall thickness T at the channel 140, a smaller space S between the channel 140 and the face 112, and/or a greater face height 56 of the face 112 can create a more flexible impact response on the face 112. Conversely, a narrower width W channel 140, a shallower depth D channel 140, a greater wall thickness T at the channel 140, a larger space S between the channel 140 and the face 112, and/or a smaller face height 56 of the face 112 can create a more rigid impact response on the face 112. The length of the channel 140 and/or the center portion 130 thereof can also influence the impact properties of the face 112 on off-center hits, and the dimensions of these other structures relative to the length of the channel may indicate that the club head has a more rigid or flexible impact response at the heel and toe areas of the face 112. Thus, the relative dimensions of these structures can be important in providing performance characteristics for impact on the face 112, and some or all of such relative dimensions may be critical in achieving desired performance. Some of such relative dimensions are described in greater detail below. In one embodiment of a club head 102 as shown in FIGS. 1-13, the length (heel to toe) of the center portion 130 is approximately 30.0 mm. It is understood that the properties described below with respect to the center portion 130 of the channel 140 (e.g., length, width W, depth D, wall thickness T) correspond to the dimension that is measured on a vertical plane extending through the face center FC, and that the center portion 130 of the channel 140 may extend farther toward the heel 120 and the toe 122 with these same or similar dimensions, as described above. It is also understood that other structures and characteristics may also affect the impact properties of the face 112, including the thickness of the face 112, the materials from which the face 112, channel 140, or other portions of the head 102 are made, the stiffness or flexibility of the portions of the body 108 behind the channel 140, any internal or external rib structures, etc.

The channel 140 may have a center portion 130 and heel and toe portions 131, 132 on opposed sides of the center portion 130, as described above. In one embodiment, the center portion 130 has a substantially constant width (front to rear), or in other words, may have a width that varies no more than +/−10% across the entire length (measured along the heel 120 to toe 122 direction) of the center portion 130. The ends 133, 134 of the center portion 130 may be considered to be at the locations where the width begins to increase and/or the point where the width exceeds +/−10% difference from the width W along a vertical plane passing through the face center FC. In another embodiment, the width W of the center portion 130 may vary no more than +/−5%, and the ends 133, 134 may be considered to be at the locations where the width exceeds +/−5% difference from the width W along a vertical plane passing through the geometric centerline of the sole 118 and/or the body 108. The center portion 130 may also have a depth D and/or wall thickness T that substantially constant and/or varies no more than +/−5% or 10% along the entire length of the center portion 130. The embodiments shown in FIGS. 14-20 and described elsewhere herein may have channels 140 with center portions 130 that are defined in the same manner(s) as described herein with respect to the embodiment of FIGS. 1-13.

In one embodiment of a club head 102 as shown in FIGS. 1-13 and 34A-34B, the depth D of the center portion 130 of the channel may be approximately 2.5 mm+/−0.1 mm, or may be in the range of 2.0-3.0 mm in another embodiment. Additionally, in one embodiment of a club head 102 as shown in FIGS. 1-13, the width W of the center portion 130 of the channel 140 may be approximately 9.0 mm+/−0.1 mm, or may be in the range of 8.0-10.0 mm in another embodiment. In one embodiment of a club head 102 as shown in FIGS. 1-13, the rearward spacing S of the center portion 130 of the channel 140 from the face 112 may be approximately 8.5 mm. In these embodiments, the depth D, the width W, and the spacing S do not vary more than +/−5% or +/−10% over the entire length of the center portion 130. The club head 102 as shown in FIGS. 14-20 may have a channel 140 with a center portion 130 having similar width W, depth D, and spacing S in one embodiment. It is understood that the channel 140 may have a different configuration in another embodiment.

The club head 102 in any of the embodiments described herein may have a wall thickness T in the channel 140 that is different from the wall thickness T at other locations on the body 108 and/or may have different wall thicknesses at different portions of the channel 140. The wall thickness T at any point on the club head 102 can be measured as the minimum distance between the inner and outer surfaces, and this measurement technique is considered to be implied herein, unless explicitly described otherwise. Wall thicknesses T in other embodiments (e.g., as shown in FIGS. 14-33) may be measured using these same techniques. In the embodiment illustrated in FIGS. 1-13, the wall thickness T is greater at the center portion 130 of the channel 140 than at the toe portion 132. This smaller wall thickness T at the toe portion 132 helps to compensate for the smaller face height 56 toward the toe 122, in order to increase response of the face 112. In general, the wall thickness T is approximately 1.25 to 1.75 times thicker, or approximately 1.5 times thicker, in the center portion 130 as compared to the toe portion 132. Areas of the center portion 130 may have thicknesses that are approximately 1.5 to 3.25 times thicker than the toe portion 132. In one example, the wall thickness in the center portion 130 of the channel 140 may be approximately 1.1 mm or 1.0 to 1.2 mm, and the wall thickness T in the toe portion 132 (or at least a portion thereof) may be approximately 0.7 mm or 0.6 to 0.8 mm. In the embodiment of FIGS. 1-13, the front edge 146 of the center portion 130 of the channel has a wall thickness T that is approximately 1.8 mm or 1.7 to 1.9 mm, and the wall thickness T decreases to approximately 1.1 mm at the trough 150. In this embodiment, the wall thickness T is generally constant between the trough 150 and the rear edge 148. The wall thickness T is generally constant along the length of the center portion 130 in one embodiment, i.e., areas that are equally spaced from the front and rear edges 146, 148 will generally have equal thicknesses, while areas that are different distances from the front and rear edges 146, 148 may have different thicknesses. The wall thickness T in the embodiment in FIGS. 1-13 is greater in at least some areas of the heel portion 131, as compared to the center portion 130, in order to provide increased structural strength for the hosel interconnection structure that extends through the sole 118 of the head 102. For example, the wall thickness T of the heel portion 131 may be greater in the areas surrounding the access 128. Other areas of the heel portion 131 may have a wall thickness T similar to that of the center portion 130 or the toe portion 132. In one embodiment, the wall thickness T in the heel portion 131 is greatest at the trough 150 and is smaller (e.g., similar to that of the toe portion 132) at the rear sidewall 152 that extends from the trough 150 to the rear edge 148. The wall thickness T at the center portion 130 is also greater than the wall thickness in at least some other portions of the sole 118. It is understood that "wall thickness" T as referred to herein may be considered to be a target or average wall thickness at a specified area.

In the embodiment of FIGS. 14-20, the center portion 130 of the channel 140 has a substantially constant wall thickness T of approximately 1.2 mm or 1.1 to 1.3 mm. The heel and toe portions 131, 132 of the channel 140 in FIGS. 14-20 have approximately the same thickness profiles as described herein with respect to FIGS. 1-13. Therefore, in general, the embodiments of FIGS. 1-13 and 14-20 may be described as having a wall thickness T in the center portion 130 that is 1.0 to 1.3 mm and a wall thickness T in the heel and/or toe portions 131, 132 that is 0.6 to 0.8 mm. This general embodiment may also be considered to have an overall wall thickness T range in the center portion 130 of 1.0 to 1.9 mm, and an overall wall thickness T over the entire channel 140 of 0.6 to 1.9 mm. This general embodiment may further be considered to have a wall thickness T in the center portion 130 that is 1.25 to 2.25 times greater than the wall thickness T in the heel portion 131 and/or the toe portion 132. It is understood that the channel 140 of FIGS. 1-13 may be used in connection with the head 102 of FIGS. 14-20, and vice versa.

The various dimensions of the center portion 130 of the channel 140 of the club head 102 in FIGS. 1-13 may have relative dimensions with respect to each other that may be expressed by ratios. In one embodiment, the channel 140 has a width W and a wall thickness T in the center portion 130 that are in a ratio of approximately 8:1 to 10:1 (width/thickness). In one embodiment, the channel 140 has a width W and a depth D in the center portion 130 that are in a ratio of approximately 3.5:1 to 4.5:1 (width/depth). In one embodiment, the channel 140 has a depth D and a wall thickness T in the center portion 130 that are in a ratio of approximately 2:1 to 2.5:1 (depth/thickness). In one embodiment, the center portion 130 of the channel 140 has a length and a width W that are in a ratio of approximately 3:1 to 4:1 (length/width). In one embodiment, the face 112 has a face width (heel to toe) and the center portion 130 of the channel 140 has a length (heel to toe) that are in a ratio of 2.5:1 to 3.5:1 (face width/channel length). The edges of the striking surface 110 for measuring face width may be located in the same manner used in connection with United States Golf Association (USGA) standard measuring procedures from the "Procedure for Measuring the Flexibility of a Golf Clubhead", USGA TPX-3004, Revision 2.0, Mar. 25, 2005. In other embodiments, the channel 140 may have structure with different relative dimensions.

Void Structure of Club Head

The club head 102 may utilize a geometric weighting feature in some embodiments, which can provide for reduced head weight and/or redistributed weight to achieve desired performance. For example, in the embodiment of FIGS. 1-13, the head 102 has a void 160 defined in the body 108, and may be considered to have a portion removed from the body 108 to define the void 160. In one embodiment, as shown in FIGS. 1A and 8, the sole 118 of the body 108 has a base member 163 and a first leg 164 and a second leg 165 extending rearward from the base member 163 on opposite sides of the void 160. The base member 163 generally defines at least a central portion of the sole 118, such that the channel 140 extends across the base member 163. The base member 163 may be considered to extend to the bottom edge 113 of the face 112 in one embodiment. As shown in FIGS. 1A and 8, the first leg 164 and the second leg 165 extend away from the base member 163 and away from the ball striking face 112. The first leg 164 and the second leg 165 in this embodiment extend respectively towards the rear 126 of the club at the heel 120 and toe 122 of the club head 102. Additionally, in the embodiment of FIGS. 1A and 8, an interface area 168 is defined at the location where the legs 164, 165 meet, and the legs 164, 165 extend continuously from the interface area 168 outwardly towards the heel 120 and toe 122 of the club head 102. It is understood that the legs 164, 165 may extend at different lengths to achieve different weight distribution and performance characteristics. The width of the base member 163 between the channel 140 and the interface area 168 may contribute to the response of the channel through impact. This base member width can be approximately 18 mm, or may be in a range of 11 mm to 25 mm.

In one embodiment the void 160 is generally V-shaped, as illustrated in FIGS. 1A and 8. In this configuration, the legs 164, 165 converge towards one another and generally meet at the interface area 168 to define this V-shape. The void 160 has a wider dimension at the rear 126 of the club head 102 and a more narrow dimension proximate a central region of the club head 102 generally at the interface area 168. The void 160 opens to the rear 126 of the club head 102 and to the bottom in this configuration. As shown in FIGS. 1A and 7-10, the void 160 is defined between the legs 164, 165, and has a cover 161 defining the top of the void 160. The cover 161 in this embodiment connects to the crown 116 around the rear 126 of the club head 102 and extends such that a space 162 is defined between the cover 161 and the crown 116. This space 162 is positioned over the void 160 and may form a portion of the inner cavity 106 of the club head 102 in one embodiment. The inner cavity 106 in this configuration may extend the entire distance from the face 112 to the rear 126 of the club head 102. In another embodiment, at least some of the space 162 between the cover 161 and the crown 116 may be filled or absent, such that the inner cavity 106 does not extend to the rear 126 of the club head 102. The cover 161 in the embodiment of FIGS. 1A and 7-10 also extends between the legs 164, 165 and forms the top surface of the void 160. In a further embodiment, the void 160 may be at least partially open and/or in communication with the inner cavity 106 of the club head 102, such that the inner cavity 106 is not fully enclosed.

In one exemplary embodiment, the interface area 168 has a height defined between the cover 161 and the sole 118, and is positioned proximate a central portion or region of the body 108 and defines a base support wall 170 having a surface that faces into the void 160. The base support wall 170 extends from the cover 161 to the sole 118 in one embodiment. Additionally, as illustrated in FIGS. 1A and 8, the base support wall 170 projects into the void 160 and has side surfaces 171 extending from the interface area 168 rearwardly into the void 160. In the embodiment of FIGS. 1A and 8, the first leg 164 defines a first wall 166, and the second leg 165 defines a second wall 167. A proximal end of the first wall 166 connects to one side of the base support wall 170, and a proximal end of the second wall 167 connects to the opposite side of the base support wall 170. The walls 166, 167 may be connected to the base support wall 170 via the side surfaces 171 of the base support wall 170, as shown in FIGS. 1A and 8. It is understood that the legs 164, 165 and walls 166, 167 can vary in length and can also be different lengths from each other in other embodiments. External surfaces of the walls 166, 167 face into the void 160 and may be considered to form a portion of an exterior of the golf club head 102.

The walls 166, 167 in the embodiment of FIGS. 1A and 8 are angled or otherwise divergent away from each other, extending outwardly toward the heel 120 and toe 122 from the interface area 168. The walls 166, 167 may further be angled with respect to a vertical plane relative to each other as well. Each of the walls 166, 167 has a distal end portion 169 at the rear 126 of the body 108. In one embodiment, the distal end portions 169 are angled with respect to the majority portion of each wall 166, 167. The distal end portions 169 may be angled inwardly with respect to the majority portions of the walls 166, 167, as shown in the embodiment shown in FIGS. 1A and 8, or the distal end portions 169 may be angled outwardly or not angled at all with respect to the majority portions of the walls 166, 167 in another embodiment. The legs 164, 165 may have similarly angled distal end portions 151. In the embodiment of FIGS. 1A and 8, the walls 166, 167 (including the distal end portions 169) have angled surfaces 172 proximate the sole 118, that angle farther outwardly with respect to the upper portions 173 of each wall 166, 167 proximate the cover 161. In this configuration, the upper portions 173 of each wall 166, 167 are closer to vertical (and may be substantially vertical), and the angled surfaces 172 angle outwardly to increase the periphery of the void 160 proximate the sole 118. The base support wall 170 in this embodiment has a similar configuration, being closer to vertical with an angled surface 174 angled farther outwardly proximate the sole 118. This configuration of the walls 166, 167 and the base support wall 170 may provide increased strength relative to a completely flat surface. In a configuration such as shown in FIGS. 1A and 8, where the walls 166, 167 and/or the base support wall 170 are angled outwardly, the void 160 may have an upper perimeter defined at the cover 161 and a lower perimeter defined at the sole 118 that is larger than the upper perimeter. In another embodiment, the walls 166, 167 and/or the base support wall 170 may have different configurations. Additionally, the respective heights of the walls 166, 167, and the distal end portions 169 thereof, are greatest proximate the interface area 168 and decrease towards the rear 126 of the club head 102 in the embodiment shown in FIGS. 1A and 8. This configuration may also be different in other embodiments.

In one embodiment, the walls 166, 167, the base support wall 170, and/or the cover 161 may each have a thin wall construction, such that each of these components has inner surfaces facing into the inner cavity 106 of the club head 102. In another embodiment, one or more of these components may have a thicker wall construction, such that a portion of the body 108 is solid. Additionally, the walls 166, 167, the base support wall 170, and the cover 161 may all be integrally connected to the adjacent components of the body 108, such as the base member 163 and the legs 164, 165. For example, at least a portion of the body 108 including the walls 166, 167, the base support wall 170, the cover 161, the base member 163, and the legs 164, 165 may be formed of a single, integrally formed piece, e.g., by casting. Such an integral piece may further include other components of the body 108, such as the entire sole 118 (including the channel 140) or the entire club head body 108. As another example, the walls 166, 167, the base support wall 170, and/or the cover 161 may be connected to the sole 118 by welding or other integral joining technique to form a single piece. In another embodiment, the walls 166, 167, the base support wall 170, and/or the cover 161 may be formed of separate pieces. For example, in the embodiment of FIGS. 14-20, the walls 166, 167, the base support wall 170, and the cover 161 are formed as a single separate piece that is inserted into an opening 175 in the sole 118, as described in greater detail below. In another embodiment, the cover 161 may be formed of a separate piece, such as a non-metallic piece.

An angle may be defined between the legs 164, 165 in one embodiment, which angle can vary in degree, and may be, e.g., a right angle, acute angle or obtuse angle. For example, the angle can be in the general range of 30 degrees to 110 degrees, and more specifically 45 degrees to 90 degrees. The angle between the legs 164, 165 may be relatively constant at the sole 118 and at the cover 161 in one embodiment. In another embodiment, this angle may be different at a location proximate the sole 118 compared to a location proximate the cover 161, as the walls 166, 167 may angle or otherwise diverge away from each other. Additionally, in other embodiments, the void 160 may be asymmetrical, offset, rotated, etc., with respect to the configuration shown in FIGS. 1-13, and the angle between the legs 164, 165 in such a configuration may not be measured symmetrically with respect to the vertical plane passing through the center (s) of the face 112 and/or the body 108 of the club head 102. It is understood that the void 160 may have a different shape in other embodiments, and may not have a V-shape and/or a definable "angle" between the legs 164, 165.

In another embodiment, the walls 166, 167 may be connected to the underside of the crown 116 of the body 108, such that the legs 164, 165 depend from the underside of the crown 116. In other words, the cover 161 may be considered to be defined by the underside of the crown 116. In this manner, the crown 116 may be tied or connected to the sole 118 by these structures in one embodiment. It is understood that the space 162 between the cover 161 and the underside of the crown 116 in this embodiment may be partially or completely nonexistent.

Driver #2—Channel Parameters

FIGS. 14-20 illustrate another embodiment of a golf club head 102 in the form of a driver. The head 102 of FIGS. 14-20 includes many features similar to the head 102 of FIGS. 1-13, and such common features are identified with similar reference numbers. For example, the head 102 of FIGS. 14-20 has a channel 140 that is similar to the channel 140 in the embodiment of FIGS. 1-13, having a center portion 130 with a generally constant width W and depth D and heel and toe portions 131, 132 with increased width W and depth D. In the embodiment of FIGS. 14-20, the head 102 has a face that has a smaller face height 56 than the face 112 of the head 102 in FIGS. 1-13 (measured as described herein), which may tend to decrease the flexibility of the face 112. It is understood that other aspects of the head 102 may operate to affect the flexibility of the face 112, such as face thickness, overall face size, materials and/or material properties (e.g., Young's modulus), curvature of the face, stiffening structures, etc. In one embodiment, the smaller face height 56 of the embodiment of FIGS. 14-20 may be compensated with decreased face thickness and/or modulus, to increase the flexibility of the face 112. Additionally, in one embodiment, the channel 140 may have increased flexibility to offset the reduced flexibility of the face 112, thereby producing a consistent CT measurement. As described above, channel flexibility may be influenced by factors such as the width W, the depth D, wall thickness T, etc., of the channel 140.

As described above, in the embodiment of FIGS. 14-20, the center portion 130 of the channel 140 has a substantially constant wall thickness T of approximately 1.2 mm or 1.1-1.3 mm. The heel and toe portions 131, 132 of the channel 140 in FIGS. 14-20 have approximately the same wall thickness profiles as described herein with respect to FIGS. 1-13. Additionally, as stated above, in the embodiment of FIGS. 14-20, the face height 56 is smaller than the face height 56 of the embodiment of FIGS. 1-13. For example, in one embodiment, the face height 56 for the club head 102 in FIGS. 14-20 may be approximately 55.5 mm+/−0.5 mm. Further, in the embodiment of FIGS. 14-20, the rearward spacing S of the center portion 130 of the channel 140 from the face 112 may be approximately 7.0 mm. The relative dimensions (i.e., ratios) of the portions of the channel 140 described herein with respect to the embodiment of FIGS. 1-13 are similar for the embodiment of FIGS. 14-20, except for the ratios involving the face height 56, rearward spacing S of the channel 140, and the wall thickness T in the center portion 130 of the channel 140. Examples of these ratios for the embodiment of FIGS. 14-20 are described below.

In one embodiment of a club head 102 as shown in FIGS. 14-20, the channel 140 has a width W and a wall thickness T in the center portion 130 that are in a ratio of approximately 7.5:1 to 9.5:1 (width/thickness). In one embodiment, the channel 140 has a depth D and a wall thickness T in the center portion 130 that are in a ratio of approximately 1.5:1 to 2.5:1 (depth/thickness). The relative dimensions of embodiments of the club head 102 of FIGS. 14-20 with respect to the face height 56 and the rearward spacing S of the channel 140 are described elsewhere herein. In other embodiments, the channel 140 may have structure with different relative dimensions.

In the embodiment of FIGS. 14-20, the head 102 has an opening 175 on the sole 118 that receives a separate sole piece 176 that forms at least a portion of the sole 118 of the club head 102. The sole piece 176 may partially or completely define the void 160. In this embodiment, the head 102 has a base member 163 and a first leg 164 and a second leg 165 extending rearward from the base member 163, and an interface area 168 between the legs 164, 165, similar to the embodiment of FIGS. 1-13. The legs 164, 165 both have distal end portions 151 that are angled with respect to the majority portions of the legs 164, 165, as described above. The legs 164, 165 define the opening 175 between them, in combination with the interface area 168. In the embodiment of FIGS. 14-17, the opening 175 extends to the rear 126 of the club head 102, such that the sole piece 176 is contiguous with the rear periphery of the club head 102; however in another embodiment (not shown), the body 108 may have a rear member defining the rear edge of the opening 175. Additionally, the opening 175 is at least partially contiguous with the internal cavity 106 of the club head 102 in the embodiment of FIGS. 14-17. In another embodiment, one or more walls may isolate the opening 175 from the internal cavity 106.

Figure 14:
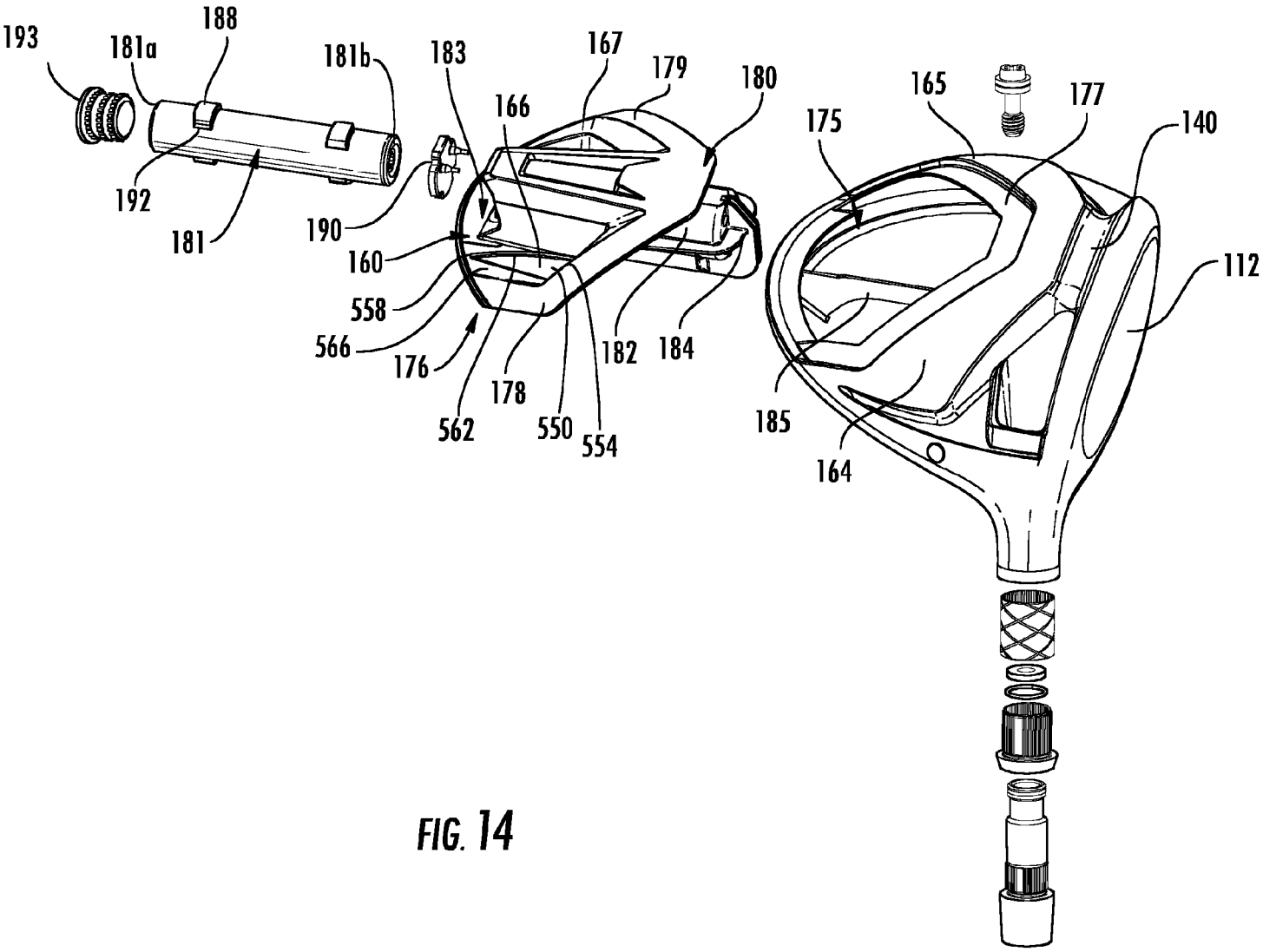
FIG. 14 is an exploded perspective view of another embodiment of a golf club head according to aspects of the disclosure, in the form of a golf driver.
Figure 15:
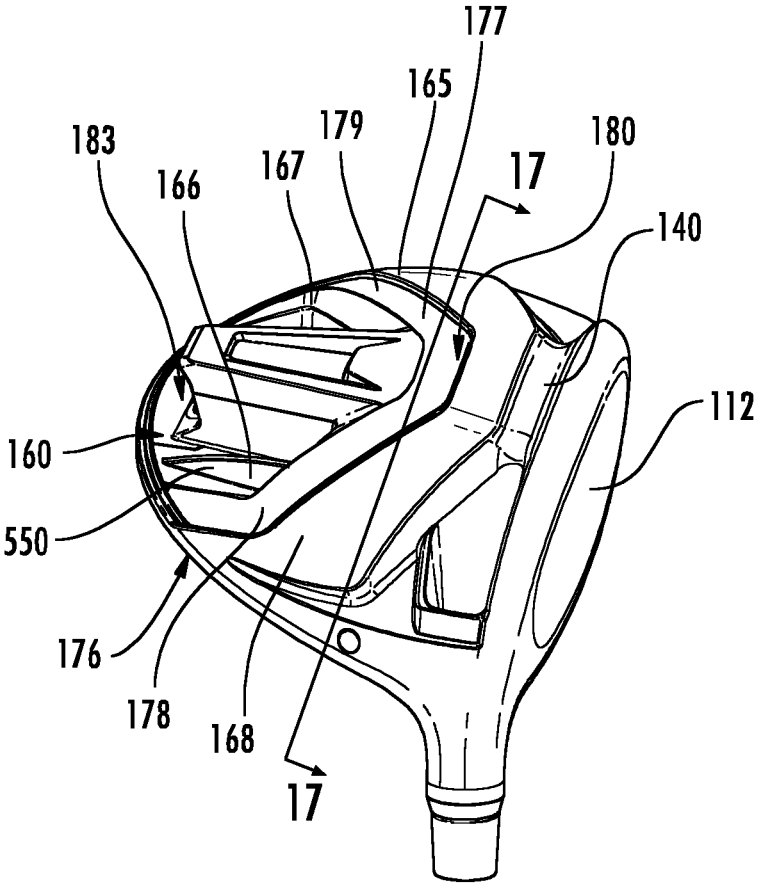
FIG. 15 is a perspective view of the club head of FIG. 14, in an assembled state.
Figure 16:
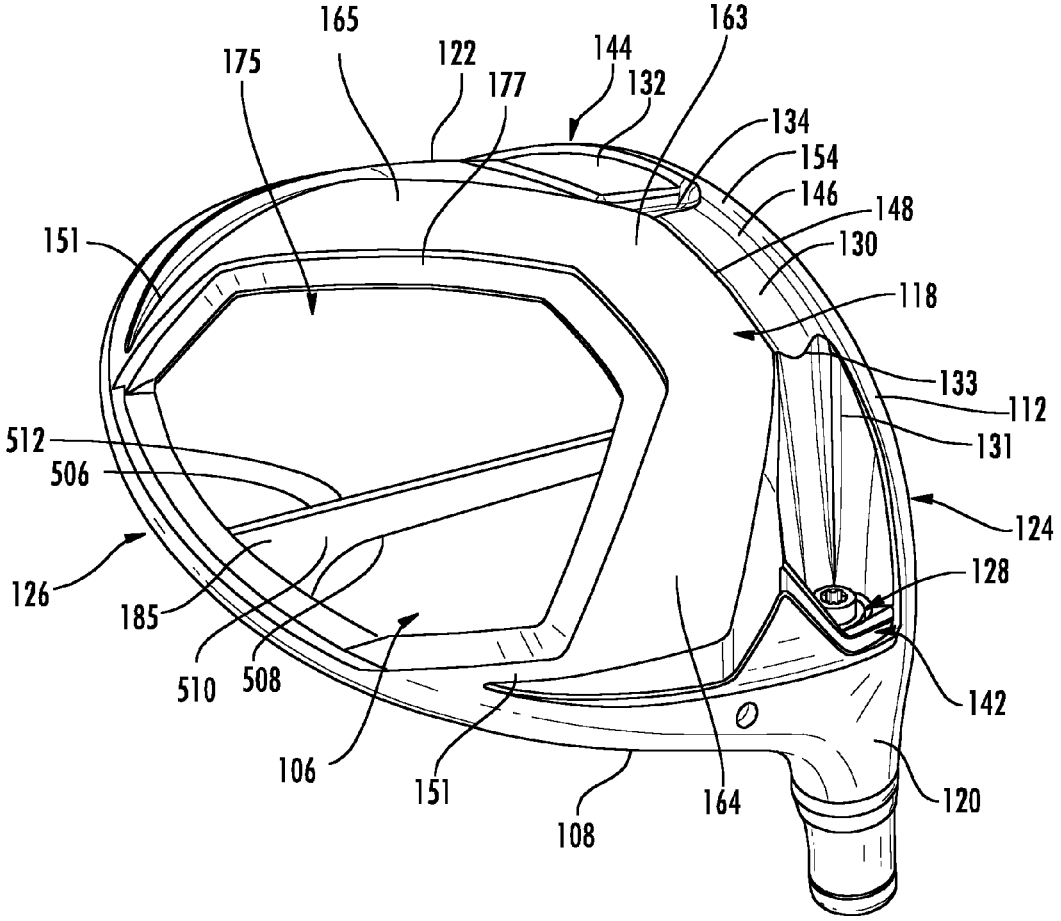
FIG. 16 is a left rear perspective view of the club head of FIG. 14, with a sole piece removed.
Figure 17:
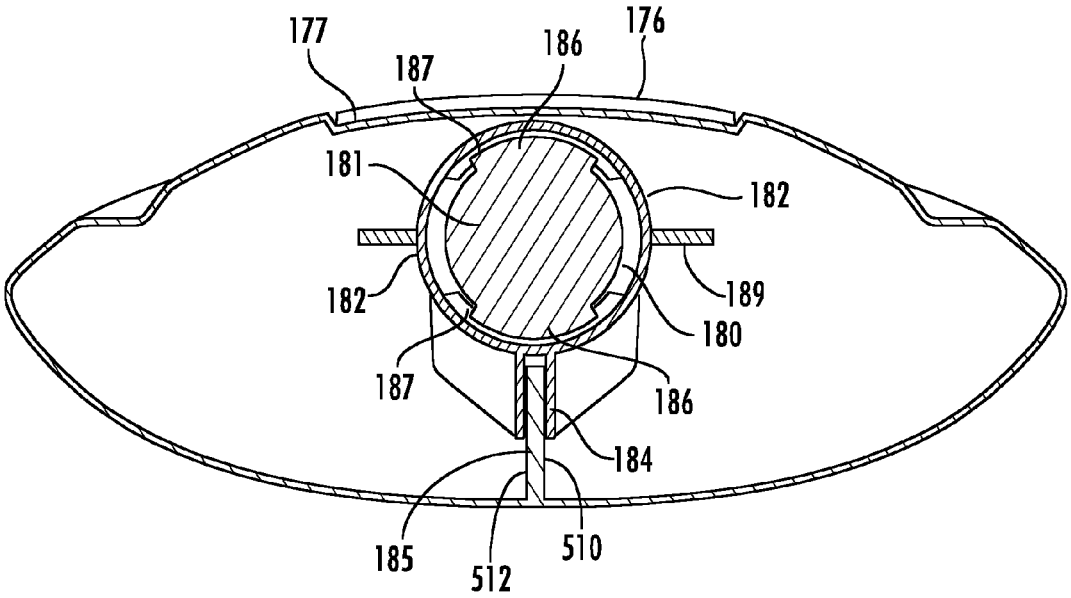
FIG. 17 is a cross-section view taken along line 17-17 of FIG. 16.

The sole piece 176 is configured to be received in the opening 175 and to completely cover the opening 175 in one embodiment, as shown in FIGS. 14-15. The opening 175 in this embodiment is surrounded by a recessed ledge 177 that supports the edge of the sole piece 176. In this configuration, the edges of the sole piece 176 are nearly flush and slightly recessed from the adjacent surfaces of the sole 118 to protect the finish on the sole piece 176. The sole piece 176 in this embodiment defines a void 160 and a cover 161 over the top of the void 160, which is spaced from the underside of the crown 116 to form a space 162. The sole piece 176 in this embodiment also has legs 178, 179 that are angled and configured similarly to the legs 164, 165 of the body 108, and the legs 178, 179 of the sole piece 176 are positioned adjacent the legs 164, 165 of the body 108 when the sole piece 176 is received in the opening 175. Further, in this embodiment, the legs 178, 179 of the sole piece 176 define the walls 166, 167 facing into the void 160, having angled distal end portions 169, and also having angled surfaces 172 proximate the sole 118 that angle farther outwardly with respect to the upper portions 173 of each wall 166, 167. The shapes of the walls 166, 167 and the void 160 are similar to the shapes of such components in the embodiment illustrated in FIGS. 1-13.

The sole piece 176 may be connected and retained within the opening 175 by a number of different structures and techniques, including adhesives or other bonding materials, welding, brazing, or other integral joining techniques, use of mechanical fasteners (e.g., screws, bolts, etc.), or use of interlocking structures, among others. In the embodiment of FIGS. 14-17, the sole piece 176 may be connected and retained within the opening 175 by a combination of adhesive (e.g., applied around the ledge 177) and mechanical interlocking structures. As illustrated in FIGS. 14-17, the mechanical interlocking structures may include a notch or channel 184 that is configured to receive an interlocking structure on the body 108. In the embodiment of FIGS. 14-17, the channel 184 extends along the front and top sides of the sole piece 176, and receives one or more structural ribs 185 connected to the internal surfaces of the head 102 defining the inner cavity 106. The sole piece 176 may include additional structural ribs 189 to add stiffness and/or limit movement of the sole piece 176. This mechanical interlocking helps to retain the sole member 176 in position and resist movement of the sole member 176 during swinging or striking of the club head 102. Other structures may be used in additional embodiments.

A number of different materials may be used to form the sole piece 176 in various embodiments, and the sole piece 176 may be formed from a single material or multiple different materials. In one embodiment, the sole piece 176 may be formed of a polymeric material, which may include a fiber-reinforced polymer or other polymer-based composite material. For example, the sole piece 176 may be formed from a carbon-fiber reinforced nylon material in one embodiment, which provides low weight and good strength, stability, and environmental resistance, as well as other beneficial properties. Additionally, in one embodiment, the body 108 may be formed by casting a single metallic piece (e.g., titanium alloy) configured with the opening 175 for receiving the sole piece 176 and another opening for connection to a face member to form the face 112. It is understood that the components of the head 102 may be formed by any other materials and/or techniques described herein.

In one embodiment, the sole piece 176 may define one or more weight receptacles configured to receive one or more removable weights. For example, the sole piece 176 in the embodiment of FIGS. 14-20 has a weight receptacle 180 in the form of a tube that is configured to receive a cylindrical weight 181, with the receptacle 180 and the weight 181 both having axes oriented generally in the front-to-rear direction. The axis of the receptacle 180 may be vertically inclined in one embodiment, and the receptacle 180 in the embodiment of FIGS. 14-20 has an axis that is slightly vertically inclined. The weight receptacle 180 in this embodiment is formed by a tube member 182 that extends rearwardly from the interface area 168, having an opening 183 proximate the rear 126 of the club head 102, where the weight 181 is configured to be inserted through the opening 183. The tube member 182 in this embodiment is positioned within the void 160. In another embodiment, the sole piece 176 may have the weight receptacle 180 oriented in a different direction, such as the crown-sole direction, the heel-toe direction, or any number of angled directions, and/or the sole piece 176 may define multiple weight receptacles 180. The weight 181 may have one end 181*a* that is heavier than an opposite end 181*b*, such that the weight 181 can be inserted into the receptacle 180 in multiple weighting configurations. For example, the weight 181 may be inserted in a first configuration, where the heavy end 181*a* is closer to the face 112 and the lighter end 181*b* is closer to the rear 126, shifting the CG of the club head 102 forward. As another example, the weight 181 may be inserted in a second configuration, where the heavy end 181*a* is closer to the rear 126 and the lighter end 181*b* is closer to the face 112, shifting the CG of the club head 102 rearward. Thus, differing weighting characteristics and arrangements are possible to alter the performance characteristics of the club head 102. For example, in one embodiment, the weight 181 may be configured such that the CG 26 of the club head 102 can be moved from 1-5 mm (or at least 2 mm) by switching the weight 181 between the first and second configurations. The weight 181 may be configured with differently weighted portions by use of multiple pieces of different materials connected to each other (e.g., aluminum and tungsten), by use of weighted doping materials (e.g., a polymer member that has tungsten powder filler in one portion), or other structures.

The weight receptacle 180 and/or the weight 181 may have structures to lock or otherwise retain the weight 181 within the receptacle 180. For example, in one embodiment, the weight 181 may include one or more locking members 186 in the form of projections on the outer surface, which are engageable with one or more engagement structures 187 within the receptacle 180 to retain the weight 181 in place, such as slots on the inner surface of the receptacle 180. The locking members 186 illustrated in FIGS. 14 and 17-20 have ramp surfaces 188 and are configured to be engaged with the engagement structures 187 by rotating the weight 181, which shifts the locking members 186 into engagement with the engagement structures 187 in a "quarter-turn" configuration. The ramp surfaces 188 facilitate this engagement by permitting some error in the axial positioning of the weight 181. In another embodiment, the locking member(s) 186 may be in the form of flexible tabs or other complementary locking structure. In another embodiment, a separate retainer may be used, such as a cap that fits over the opening 183 of the receptacle 180 to retain the weight 181 in place. For example, the cap may be connected to the receptacle 180 by a snap configuration, a threaded configuration, a quarter-turn configuration, or other engagement technique, or by an adhesive or other bonding material. The weight 181 may have a vibration damper 190 on one or both ends 181*a*, 181*b*, such as shown in FIG. 14. In the embodiment in FIG. 14, the damper 190 is inserted into the receptacle 180 in front of the weight 181 to support the weight 181 for vibrational and/or stabilization purposes (i.e., accounting for tolerances to ensure a tight fit). The damper 190 may have a projection (not shown) that fits into a hole 191 at either end of the weight 181, such as a fastener drive hole. In a further embodiment, the weight 181 illustrated in FIGS. 14 and 20 may be in the form of a shell member that includes the locking members 186 for engagement with the receptacle 180 and is configured to receive one or more free weights inside, as described in greater detail below. For example, such a shell member may receive several stacked cylindrical weights having different densities to create the differential weighting configuration described above, with a cap connected to one end to permit the weights to be inserted or removed from the shell member. The weight 181 and/or the receptacle 180 may have further configurations in other embodiments.

Figure 20:
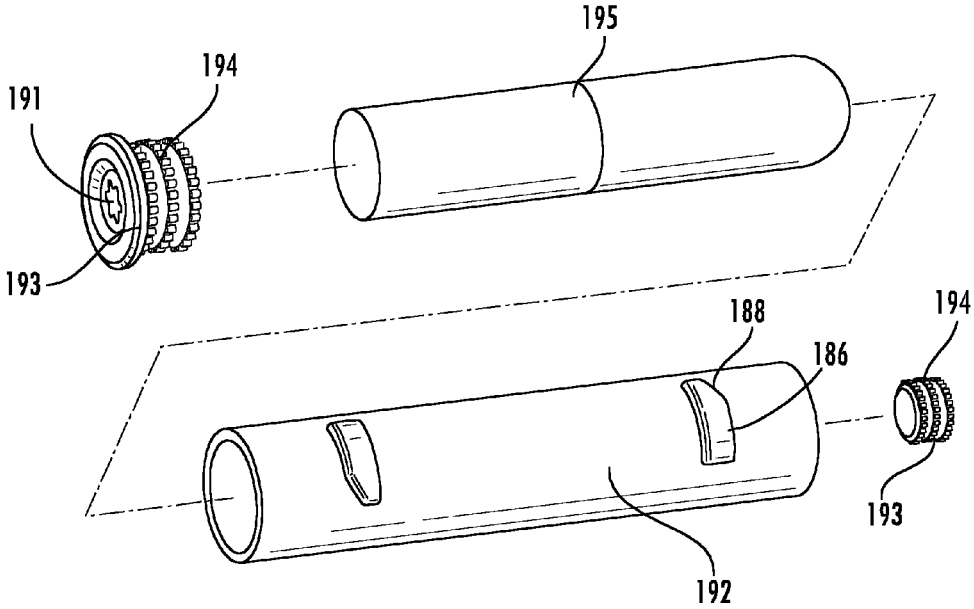
FIG. 20 is an exploded view of a weight of the club head of FIG. 14.

The weight 181 in one embodiment, as illustrated in FIG. 20, is formed of a shell 192 that has an internal cavity receiving one or more weight members 195, with caps 193 on one or both ends 181*a,b*. The weight member(s) 195 may be configured to create the differential weighting arrangement described above, where one end 181*a* is heavier than the other end 181*b*. For example, the weight member(s) 195 may be a single weight member with differently weighted portions, or may be multiple weight members (two or more) that are inserted into the shell 192 and may or may not be fixedly connected together. One or more spacers, dampers, or other structures may further be inserted into the shell 192 along with the weight member(s). In one embodiment, as shown in FIG. 20, the cap(s) 193 may have outer retaining members 194 that engage the inner surfaces of the shell 192 to retain the cap 193 to the shell 192, such as by interference or friction fit. The cap(s) 193 may have outer threading, and the shell 192 may have complementary threading to mate with the threading on the cap(s) 193, in another embodiment. Other retaining structures for the cap(s) 193 may be used in other embodiments, such as various snapping and locking structures, and it is understood that the retaining structure may be releasable and reconnectable in one embodiment, to allow changing of the weight members. The weight 181 may have only a single end cap 193 in another embodiment. The shell 192 has the locking members 186 thereon, and forms a structural support and retaining structure for the weight members inside, in the embodiment illustrated in FIG. 20. The configurations of the weight 181 and/or the receptacle 180 shown and described herein provide a number of different weighting configurations for the club head, as well as quick and easy adjustment between such weighting configurations.

Fairway Wood—Channel Parameters

FIGS. 21-26D and FIGS. 36-37F illustrate an additional embodiment of a golf club head 102 in the form of a fairway wood golf club head. The heads 102 of FIGS. 21-26D and 36-37F include many features similar to the head 102 of FIGS. 1-13 and the head 102 of FIGS. 14-20, and such common features are identified with similar reference numbers. For example, the head 102 of FIGS. 21-26D and 36-37F has a channel 140 that is similar to the channels 140 in the embodiments of FIGS. 1-20, having a center portion 130 with a generally constant width W and depth D and heel and toe portions 131, 132 with increased width and/or depth. Generally, the center portions 130 of the channels 140 in the heads 102 of these embodiments are deeper and more recessed from the adjacent surfaces of the body 108, as compared to the channels 140 in the embodiments of FIGS. 1-20. In this embodiment, the head 102 has a face that has a smaller height than the faces 112 of the heads 102 in FIGS. 1-20, which tends to reduce the amount of flexibility of the face 112. In one embodiment, the face height 56 of the heads 102 in FIGS. 21-26D and 36-37F may range from 28-40 mm. The deeper recess of the center portion 130 of the channel 140 in this embodiment results in increased flexibility of the channel 140, which helps to offset the reduced flexibility of the face 112. Conversely, the heel and toe portions 131, 132 of the channel 140 in the embodiment of FIGS. 21-26D and 36-37F are shallower in depth D than the heel and toe portions 131, 132 of the embodiments of FIGS. 1-20, and may have equal or even smaller depth D than the center portion 130. The heel and toe portions 131, 132 in this embodiment have greater flexibility than the center portion 130, e.g., due to smaller wall thickness T, greater width W, and/or greater depth D at the heel and toe portions 131, 132 of the channel. This assists in creating a more flexible impact response on the off-center areas of the face 112 toward the heel 120 and toe 122, as described above. Other features may further be used to increase or decrease overall flexibility of the face 112, as described above. The face 112 of the head 102 in FIGS. 21-26D and 36-37F may be made of steel, which has higher strength than titanium, but with lower face thickness to offset the reduced flexibility resulting from the higher strength material. As another example, the club head 102 of FIGS. 21-26D and 36-37F includes a void 160 defined between two legs 164, 165, with a cover 161 defining the top of the void 160, similar to the embodiment of FIGS. 1-13.

In one embodiment of a club head 102 as shown in FIGS. 21-26D and 36-37F, the depth D of the center portion 130 of the channel may be approximately 9.0 mm+/−0.1 mm, or may be in the range of 8.0-10.0 mm in another embodiment. Additionally, in one embodiment of a club head 102 as shown in FIGS. 21-26D and 36-37F, the width W of the center portion 130 of the channel 140 may be approximately 9.0 mm+/−0.1 mm, or may be in the range of 8.0-10.0 mm in another embodiment. In one embodiment of a club head 102 as shown in FIGS. 21-26D and 36-37F, the rearward spacing S of the center portion 130 of the channel 140 from the face 112 may be approximately 7.0 mm, or may be approximately 9.0 mm in another embodiment. In these embodiments, the depth D, the width W, and the spacing S do not vary more than +/−5% or +/−10% over the entire length of the center portion 130. It is understood that the channel 140 may have a different configuration in another embodiment.

In the embodiment illustrated in FIGS. 21-26D and 36-37F, the wall thickness T is greater at the center portion 130 of the channel 140 than at the heel and toe portion 131, 132. This smaller wall thickness T at the heel and toe portions 131, 132 helps to compensate for the smaller face height 56 toward the heel and toe 120, 122, in order to increase response of the face 112. In general, the wall thickness T in this embodiment is approximately 1.25-2.25 times thicker in the center portion 130 as compared to the toe portion 132, or approximately 1.7 times thicker in one embodiment. In one example, the wall thickness T in the center portion 130 of the channel 140 may be approximately 1.6 mm or 1.5 to 1.7 mm, and the wall thickness T in the heel and toe portions 131, 132 may be approximately 0.95 mm or 0.85 to 1.05 mm. These wall thicknesses T are generally constant throughout the center portion 130 and the heel and toe portions 131, 132, in one embodiment. The wall thickness T at the center portion 130 in the embodiment of FIGS. 21-26D and 36-37F is also greater than the wall thickness T in at least some other portions of the sole 118 in one embodiment, including the areas of the sole 118 located immediately adjacent to the rear edge 148 of the center portion 130. The sole 118 may have a thickened portion 125 located immediately adjacent to the rear edge 148 of the channel 140 that has a significantly greater wall thickness T than the channel 140, which adds sole weight to the head 102 to lower the CG.

The various dimensions of the center portion 130 of the channel 140 of the club head 102 in FIGS. 21-26D and 36-37F may have relative dimensions with respect to each other that may be expressed by ratios. In one embodiment, the channel 140 has a width D and a wall thickness T in the center portion 130 that are in a ratio of approximately 5:1 to 6.5:1 (width/thickness). In one embodiment, the channel 140 has a width W and a depth D in the center portion 130 that are in a ratio of approximately 0.8:1 to 1.2:1 (width/depth). In one embodiment, the channel 140 has a depth D and a wall thickness T in the center portion 130 that are in a ratio of approximately 5:1 to 6.5:1 (depth/thickness). In one embodiment, the center portion of the channel 140 has a length and a width W that are in a ratio of approximately 4:1 to 4.5:1 (length/width). In one embodiment, the face 112 has a face width (heel to toe) and the center portion 130 of the channel 140 has a length (heel to toe) that are in a ratio of 1.5:1 to 2.5:1 (face width/channel length). In other embodiments, the channel 140 may have structure with different relative dimensions.

Hybrid Club Head—Channel Parameters

FIGS. 27-33 and 38-39C illustrate an additional embodiment of a golf club head 102 in the form of a hybrid golf club head. The head 102 of FIGS. 27-33 and 38-39C includes many features similar to the heads 102 of FIGS. 1-26D and 36-37F, and such common features are identified with similar reference numbers. For example, the head 102 of FIGS. 27-33 and 38-39C has a channel 140 that similar to the channels 140 in the embodiments of FIGS. 1-26D and 36-37F, having a center portion 130 with a generally constant width W and depth D and heel and toe portions 131, 132 with increased width W and/or depth D. Generally, the center portion 130 of the channel 140 in the head 102 of this embodiment is deeper and more recessed from the adjacent surfaces of the body 108, as compared to the channels 140 in the embodiments of FIGS. 1-20. In this embodiment, the head 102 has a face that has a smaller height than the faces 112 of the heads 102 in FIGS. 1-20, which tends to reduce the amount of flexibility of the face 112. In one embodiment, the face height 56 of the head 102 in FIGS. 27-33 and 38-39C may range from 28-40 mm. The deeper recess of the center portion 130 of the channel 140 in this embodiment results in increased flexibility of the channel 140, which helps to offset the reduced flexibility of the face 112. Conversely, the heel and toe portions 131, 132 of the channel 140 in the embodiment of FIGS. 27-33 and 38-39C are shallower in depth D than the heel and toe portions 131, 132 of the embodiments of FIGS. 1-20, and may have equal or even smaller depth D than the center portion 130. The heel and toe portions 131, 132 in this embodiment have greater flexibility than the center portion 130, e.g., due to smaller wall thickness T, greater width W, and/or greater depth D at the heel and toe portions 131, 132 of the channel. This assists in creating a more flexible impact response on the off-center areas of the face 112 toward the heel 120 and toe 122, as described above. Other features may further be used to increase or decrease overall flexibility of the face 112, as described above. The face 112 of the head 102 in FIGS. 27-33 and 38-39C may be made of steel, which has higher strength than titanium, but with lower face thickness to offset the reduced flexibility resulting from the higher strength material.

In one embodiment of a club head 102 as shown in FIGS. 27-33 and 38-39C, the depth D of the center portion 130 of the channel may be approximately 8.0 mm+/−0.1 mm, or may be in the range of 7.0-9.0 mm in another embodiment. Additionally, in one embodiment of a club head 102 as shown in FIGS. 27-33 and 38-39C, the width W of the center portion 130 of the channel 140 may be approximately 8.0 mm+/−0.1 mm, or may be in the range of 7.0-9.0 mm in another embodiment. In one embodiment of a club head 102 as shown in FIGS. 27-33 and 38-39C, the rearward spacing S of the center portion 130 of the channel 140 from the face 112 may be approximately 8.0 mm, or may be approximately 6.0 mm in another embodiment. In these embodiments, the depth D, the width W, and the spacing S do not vary more than +/−5% or +/−10% over the entire length of the center portion 130. It is understood that the channel 140 may have a different configuration in another embodiment.

In the embodiment illustrated in FIGS. 27-33 and 38-39C, the wall thickness T is greater at the center portion 130 of the channel 140 than at the heel and toe portion 131, 132. This smaller wall thickness T at the heel and toe portions 131, 132 helps to compensate for the smaller face height 56 toward the heel and toe 120, 122, in order to increase response of the face 112. In general, the wall thickness T in this embodiment is approximately 1.0 to 2.0 times thicker in the center portion 130 as compared to the toe portion 132, or approximately 1.6 times thicker in one embodiment. In one example, the wall thickness T in the center portion 130 of the channel 140 may be approximately 1.6 mm or 1.5 to 1.7 mm, and the wall thickness T in the heel and toe portions 131, 132 may be approximately 1.0 mm or 0.9 to 1.1 mm. These wall thicknesses T are generally constant throughout the center portion 130 and the heel and toe portions 131, 132, in one embodiment. The wall thickness T at the center portion 130 in the embodiment of FIGS. 27-33 and 38-39C is also greater than the wall thickness T in at least some other portions of the sole 118 in one embodiment. The sole 118 may have a thickened portion 125 located immediately adjacent to the rear edge 148 of the channel 140 (at least behind the center portion 130) that has a significantly greater wall thickness T than the channel 140, which adds sole weight to the head 102 to lower the CG.

The various dimensions of the center portion 130 of the channel 140 of the club head 102 in FIGS. 27-33 may have relative dimensions with respect to each other that may be expressed by ratios. In one embodiment, the channel 140 has a width W and a wall thickness T in the center portion 130 that are in a ratio of approximately 4.5:1 to 5.5:1 (width/thickness). In one embodiment, the channel 140 has a width W and a depth D in the center portion 130 that are in a ratio of approximately 0.8:1 to 1.2:1 (width/depth). In one embodiment, the channel 140 has a depth D and a wall thickness T in the center portion 130 that are in a ratio of approximately 4.5:1 to 5.5:1 (depth/thickness). In one embodiment, the center portion of the channel 140 has a length and a width W that are in a ratio of approximately 4.5:1 to 5:1 (length/width). In one embodiment, the face 112 has a face width (heel to toe) and the center portion 130 of the channel 140 has a length (heel to toe) that are in a ratio of 1.5:1 to 2.5:1 (face width/channel length). In other embodiments, the channel 140 may have structure with different relative dimensions.

Channel Dimensional Relationships

The relationships between the dimensions and properties of the face 112 and various features of the body 108 (e.g., the channel 140 and/or ribs 185, 400, 402, 430, 432, 434, 480, 482, 550, 552, 600, 650, 652) can influence the overall response of the head 102 upon impacts on the face 112, including ball speed, twisting of the club head 102 on off-center hits, spin imparted to the ball, etc. Many of these relationships between the dimensions and properties of the face 112 and various features of the body 108 and channel 140 and/or ribs is shown in Tables 1 and 2 below.

The various dimensions of the center portion 130 of the channel 140 of the club head 102 in FIGS. 1-13 may have relative dimensions with respect to the face height 56 of the head 102 that may be expressed by ratios. In one embodiment, the face height 56 and the width W in the center portion 130 of the channel 140 are in a ratio of approximately 6:1 to 7.5:1 (height/width). In one embodiment, the face height 56 and the depth D in the center portion 130 of the channel 140 are in a ratio of approximately 23:1 to 25:1 (height/depth). In one embodiment, the face height 56 and the wall thickness T in the center portion 130 of the channel 140 are in a ratio of approximately 52:1 to 57:1 (height/thickness). The face height 56 may be inversely related to the width W and depth D of the channel 140 in the heel and toe portions 131, 132 in one embodiment, such that the width W and/or depth D of the channel 140 increases as the face height 56 decreases toward the heel 120 and toe 122. In one embodiment, the heel and toe portions 131, 132 of the channel 140 may have a width W that varies with the face height 56 in a substantially linear manner, with a slope (width/height) of −1.75 to −1.0. In one embodiment, the heel and toe portions 131, 132 of the channel 140 may have a depth D that varies with the face height 56 in a substantially linear manner, with a slope (depth/height) of −1.5 to −0.75. In other embodiments, the channel 140 and/or the face 112 may have structure with different relative dimensions.

The various dimensions of the center portion 130 of the channel 140 of the club head 102 in FIGS. 14-20 may have relative dimensions with respect to the face height 56 of the head 102 that may be expressed by ratios. In one embodiment, the face height 56 and the width W in the center portion 130 of the channel 140 are in a ratio of approximately 5.5:1 to 6.5:1 (height/width). In one embodiment, the face height 56 and the depth D in the center portion 130 of the channel 140 are in a ratio of approximately 20:1 to 25:1 (height/depth). In one embodiment, the face height 56 and the wall thickness T in the center portion 130 of the channel 140 are in a ratio of approximately 41:1 to 51:1 (height/thickness). The face height 56 may be inversely related to the width and depth of the channel 140 in the heel and toe portions 131, 132 in one embodiment, as similarly described above with respect to FIGS. 1-13. In other embodiments, the channel 140 and/or the face 112 may have structure with different relative dimensions.

The face height 56 in the embodiment of FIGS. 21-26D may vary based on the loft angle. For example, for a 14 or 16° loft angle, the club head 102 may have a face height 56 of approximately 36.4 mm or 36.9+/−0.5 mm. As another example, for a 19° loft angle, the club head 102 may have a face height 56 of approximately 35.1 mm or 37.5+/−0.5 mm. Other loft angles may result in different embodiments having similar or different face heights.

The face height 56 in the embodiment of FIGS. 27-33 may vary based on the loft angle. For example, for a 17-18° loft angle, the club head 102 may have a face height 56 of approximately 35.4 mm+/−0.5 mm. As another example, for a 19-20° loft angle, the club head 102 may have a face height 56 of approximately 34.4 mm+/−0.5 mm. As another example, for a 23° or 26° loft angle, the club head 102 may have a face height 56 of approximately 34.5 mm+/−0.5 mm or 35.2 mm+/−0.5 mm. Other loft angles may result in different embodiments having similar or different face heights.

The various dimensions of the center portion 130 of the channel 140 of the club head 102 in FIGS. 21-26D and 36-37F may have relative dimensions with respect to the face height 56 of the head 102 that may be expressed by ratios. In one embodiment, the face height 56 and the width W in the center portion 130 of the channel 140 are in a ratio of approximately 3.5:1 to 5:1 (height/width). In one embodiment, the face height 56 and the depth D in the center portion 130 of the channel 140 are in a ratio of approximately 3.5:1 to 5:1 (height/depth). In one embodiment, the face height 56 and the wall thickness T in the center portion 130 of the channel 140 are in a ratio of approximately 20:1 to 25:1 (height/thickness). The face height 56 may be inversely related to the width W and/or depth D of the channel 140 in the heel and toe portions 131, 132 in one embodiment, such that the width W and/or depth D of the channel 140 increases as the face height 56 decreases toward the heel 120 and toe 122. In one embodiment, the heel and toe portions 131, 132 of the channel 140 may have a width W that varies with the face height 56 in a substantially linear manner, with a slope (width/height) of −0.9 to −1.6. In other embodiments, the channel 140 and/or the face 112 may have structure with different relative dimensions.

The various dimensions of the center portion 130 of the channel 140 of the club head 102 in FIGS. 27-33 and 38-39C may have relative dimensions with respect to the face height 56 of the head 102 that may be expressed by ratios. In one embodiment, the face height 56 and the width W in the center portion 130 of the channel 140 are in a ratio of approximately 3.5:1 to 4.5:1 (height/width). In one embodiment, the face height 56 and the depth D in the center portion 130 of the channel 140 are in a ratio of approximately 3.5:1 to 4.5:1 (height/depth). In one embodiment, the face height 56 and the wall thickness T in the center portion 130 of the channel 140 are in a ratio of approximately 20:1 to 25:1 (height/thickness). The face height 56 may be inversely related to the width W and/or depth D of the channel 140 in the heel and toe portions 131, 132 in one embodiment, such that the width W and/or depth D of the channel 140 increases as the face height 56 decreases toward the heel 120 and toe 122. In one embodiment, the heel and toe portions 131, 132 of the channel 140 may have a width W that varies with the face height 56 in a substantially linear manner, with a slope (width/height) of −0.8 to −1.7. In other embodiments, the channel 140 and/or the face 112 may have structure with different relative dimensions.

The various dimensions of the center portion 130 of the channel 140 and the face 112 of the club head 102 in FIGS. 1-13 may have relative dimensions with respect to the rearward spacing of the center portion 130 from the face 112 that may be expressed by ratios. In one embodiment, the face height 56 and the rearward spacing S between the face 112 and the front edge 146 of the center portion 130 of the channel 140 are in a ratio of approximately 6.5:1 to 7.5:1

(height/spacing). In one embodiment, the center portion 130 of the channel 140 of the club head 102 has a rearward spacing S between the face 112 and the front edge 146 and a width W that are in a ratio of approximately 0.8:1 to 1:1 (spacing/width). In one embodiment, the center portion 130 of the channel 140 of the club head 102 has a rearward spacing S between the face 112 and the front edge 146 and a depth D that are in a ratio of approximately 3:1 to 3.5:1 (spacing/depth). In one embodiment, the center portion 130 of the channel 140 of the club head 102 has a rearward spacing S between the face 112 and the front edge 146 and a wall thickness T that are in a ratio of approximately 7.5:1 to 8:1 (spacing/thickness). In other embodiments, the channel 140 and the face 112 may have structure with different relative dimensions.

The various dimensions of the center portion 130 of the channel 140 and the face 112 of the club head 102 in FIGS. 14-20 may have relative dimensions with respect to the rearward spacing S of the center portion 130 from the face 112 that may be expressed by ratios. In one embodiment, the face height 56 and the rearward spacing S between the face 112 and the front edge 146 of the center portion 130 of the channel 140 are in a ratio of approximately 7:1 to 9:1 (height/spacing). In one embodiment, the center portion 130 of the channel 140 of the club head 102 has a rearward spacing S between the face 112 and the front edge 146 and a width W that are in a ratio of approximately 0.7:1 to 0.9:1 (spacing/width). In one embodiment, the center portion 130 of the channel 140 of the club head 102 has a rearward spacing S between the face 112 and the front edge 146 and a depth D that are in a ratio of approximately 2.5:1 to 3:1 (spacing/depth). In one embodiment, the center portion 130 of the channel 140 of the club head 102 has a rearward spacing S between the face 112 and the front edge 146 and a wall thickness T that are in a ratio of approximately 5.5:1 to 6:1 (spacing/thickness). In other embodiments, the channel 140 and the face 112 may have structure with different relative dimensions.

The various dimensions of the center portion 130 of the channel 140 and the face 112 of the club head 102 in FIGS. 21-26D and 36-37F may have relative dimensions with respect to the rearward spacing S of the center portion 130 from the face 112 that may be expressed by ratios. In one embodiment, the face height 56 and the rearward spacing S between the face 112 and the front edge 146 of the center portion 130 of the channel 140 are in a ratio of approximately 3.5:1 to 5.5:1 (height/spacing). In other embodiments, the height/spacing ratio may be 4.5:1 to 5.5:1 or 3.5:1 to 4.5:1. In one embodiment, the center portion 130 of the channel 140 of the club head 102 has a rearward spacing S between the face 112 and the front edge 146 and a width W that are in a ratio of approximately 0.6:1 to 1.15:1 (spacing/width). In other embodiments, the spacing/width ratio may be 0.6:1 to 0.9:1 or 0.85:1 to 1.15:1. In one embodiment, the center portion 130 of the channel 140 of the club head 102 has a rearward spacing S between the face 112 and the front edge 146 and a depth D that are in a ratio of approximately 0.7:1 to 1:1 (spacing/depth). In other embodiments, the spacing/depth ratio may be 0.6:1 to 0.9:1 or 0.85:1 to 1.15:1. In one embodiment, the center portion 130 of the channel 140 of the club head 102 has a rearward spacing S between the face 112 and the front edge 146 and a wall thickness T that are in a ratio of approximately 4.25:1 to 5.75:1 (spacing/thickness). In other embodiments, the spacing/thickness ratio may be 4:1 to 4.5:1 or 5.5:1 to 6:1. In further embodiments, the channel 140 and the face 112 may have structure with different relative dimensions.

The various dimensions of the center portion 130 of the channel 140 and the face 112 of the club head 102 in FIGS. 27-33 and 38-39C may have relative dimensions with respect to the rearward spacing S of the center portion 130 from the face 112 that may be expressed by ratios. In one embodiment, the face height 56 and the rearward spacing S between the face 112 and the front edge 146 of the center portion 130 of the channel 140 are in a ratio of approximately 4:1 to 6:1 (height/spacing). In other embodiments, the height/spacing ratio may be 3.5:1 to 4.5:1 or 5:1 to 6:1. In one embodiment, the center portion 130 of the channel 140 of the club head 102 has a rearward spacing S between the face 112 and the front edge 146 and a width W that are in a ratio of approximately 0.5:1 to 1.25:1 (spacing/width). In other embodiments, the spacing/width ratio may be 0.8:1 to 1.2:1 or 0.5:1 to 0.9:1. In one embodiment, the center portion 130 of the channel 140 of the club head 102 has a rearward spacing S between the face 112 and the front edge 146 and a depth D that are in a ratio of approximately 0.5:1 to 1.25:1 (spacing/depth). In other embodiments, the spacing/width ratio may be 0.8:1 to 1.2:1 or 0.5:1 to 0.9:1. In one embodiment, the center portion 130 of the channel 140 of the club head 102 has a rearward spacing S between the face 112 and the front edge 146 and a wall thickness T that are in a ratio of approximately 3.5:1 to 5.5:1 (spacing/thickness). In other embodiments, the spacing/thickness ratio may be 4.75:1 to 5.25:1 or 3.5:1 to 4:1. In further embodiments, the channel 140 and the face 112 may have structure with different relative dimensions.

Structural Ribs of Club Head

The ball striking heads 102 according to the present invention can include additional features that can influence the impact of a ball on the face 112, such as one or more structural ribs. Structural ribs can, for example, increase the stiffness or cross-sectional area moment of inertia of the striking head 102 or any portion thereof. Strengthening certain portions of the striking head 102 with structural ribs can affect the impact of a ball on the face 112 by focusing flexing to certain parts of the ball striking head 102 including the channel 140. For example, in some embodiments, greater ball speed can be achieved at impact, including at specific areas of the face 112, such as off-center areas. Structural ribs and the locations of such ribs can also affect the sound created by the impact of a ball on the face 112.

Figure 34A:
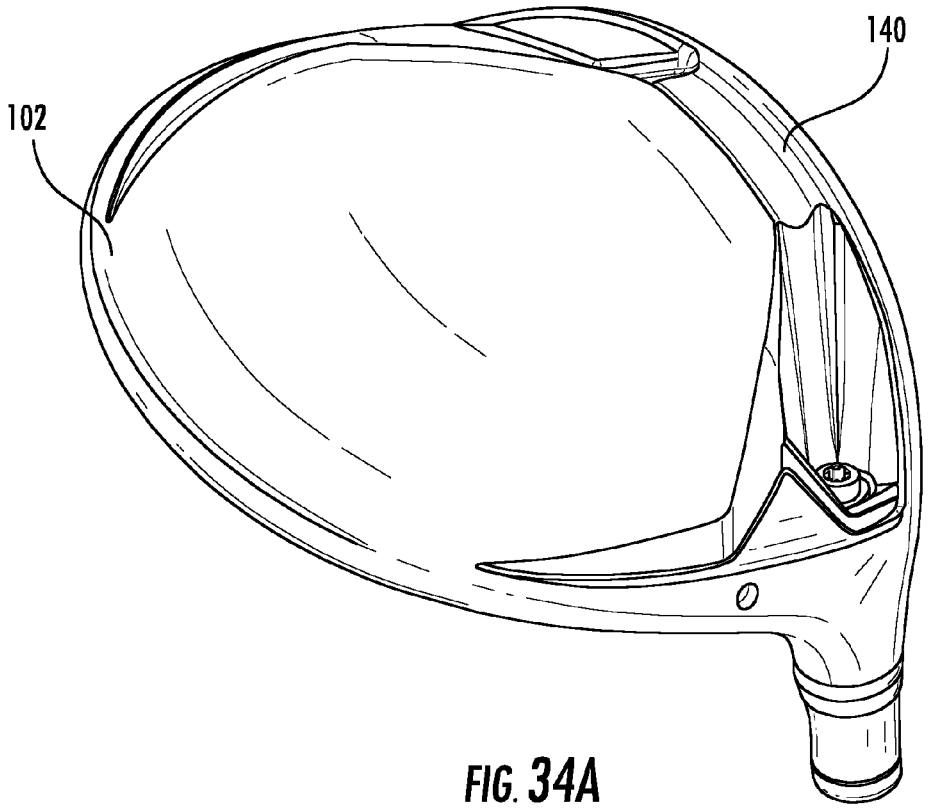
FIG. 34A is a bottom right rear perspective view of another embodiment of a golf club head according to aspects of the disclosure, in the form of a golf driver.
Figure 34B:
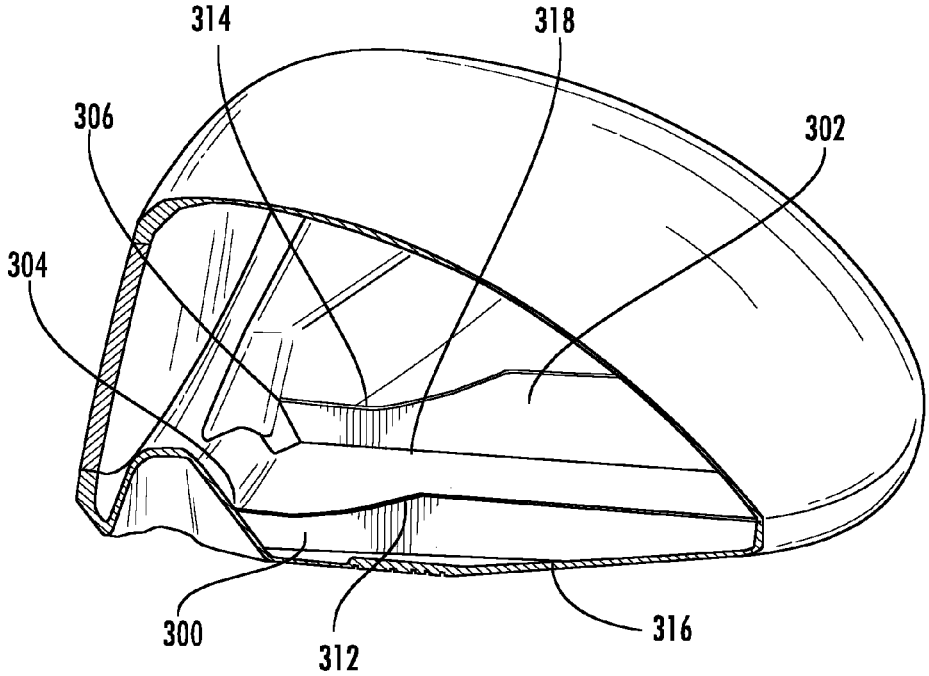
FIG. 34B is a top left perspective view of the club head of FIG. 34A, with a portion removed to show internal detail.

A golf club head 102 including channel 140 as described above, but without void 160 is shown in FIG. 34A. As shown in at least FIG. 34B, the club 102 of FIG. 34A can also include ribs 300, 302. The ribs can connect to the interior side of the sole 118, and can extend between interior portions of the rear 126 of the body 108 and the rear edge 148 of the channel 140. In other embodiments, the ribs 300, 302 may not extend the entire distance between the interior portion of rear 126 of the body 108 and/or the interior of the rear edge 148 of the channel 140, and in still other embodiments ribs 300, 302 can connect to the crown 116. In one embodiment, as illustrated in FIG. 34B, ribs 300, 302 are generally parallel with one another and aligned in a generally vertical plane or Z-axis 18 direction that is perpendicular to the striking face 112. In other configurations, the ribs 300, 302 can be angled with respect to X-axis 14, Y-axis 16, or Z-axis 18 directions and/or angled with respect to each other. The ribs 300, 302 can be located anywhere in the heel-toe direction. For example, ribs 300, 302 can be equally or unequally spaced in the heel-toe direction from the center of gravity or from the face center. In one embodiment, rib 300 can be located approximately 8.2 mm+/−2 mm or may be in the range of approximately 0 to 30 mm towards the heel 120 from the face center location 40 measured along the X-axis 14; and rib 302 can be located approximately 25 mm+/−2 mm or may be in the range of approximately 0 to 45 mm towards the toe 122 from the face center location 40 measured along the X-axis 14. In another embodiment, rib 300 can be located approximately 2.5 mm+/−2 mm or may be in the range of approximately 0 to 25 mm towards the heel 120 from the face center location 40 measured along the X-axis 14; and rib 302 can be located approximately 20.7 mm+/−2 mm or may be in the range of approximately 0 to 35 mm towards the toe 122 from the face center location 40 measured along the X-axis 14.

Each of the ribs 300, 302 have front end portions 304, 306 towards the front 124 of the body 108 extending to the edge of the rib which can connect to the interior of the rear edge 148 of the channel 140. Each of the ribs 300, 302 also has rear end portions 308 (not shown), 310 (not shown), towards the rear 126 of the body 108 extending to the edge of the rib which can extend and/or connect to the rear 126 of the body 108. The ribs 300, 302 also include upper portions 312, 314 extending to the edge of the rib and lower portions 316, 318 extending to the edge of the rib. As shown in FIG. 34B the upper portions 312, 314 of ribs 300, 302 can be curved, generally forming a concave curved shape. In other embodiments the upper portions 312, 314 can have a convex curved shape, straight shape, or any other shape. The lower portions 316, 318 of the ribs can connect to an interior of the sole 118 of the golf club.

Each rib 300, 302 also has first side and a second side and a rib width defined there between. The width of the rib can affect the strength and weight of the golf club. The ribs 300, 302 can have a substantially constant rib width of approximately 0.9 mm+/−0.2 mm or may be in the range of approximately 0.5 to 5.0 mm, or can have a variable rib width. Additionally, in some embodiments, for example, the ribs 300, 302 can have a thinner width portion throughout the majority or a center portion of the rib and a thicker width portion. The thicker width portion can be near the front end portions 304, 306, rear end portions 308, 310, upper portions 312, 314, or lower portions 316, 318, or any other part of the rib. The thickness of the thicker width portion can be approximately 2 to 3 times the width of the thinner portion.

Each rib 300, 302 may also have a maximum height measured along the rib in the Z-axis 18 direction. The maximum height of rib 300, 302 can be approximately may be in the range of approximately 0 to 60.0 mm, and may extend to the crown 116. Additionally, each rib 300, 302 may also have a maximum length, measured along the rib in the Y-axis 16 direction. The maximum length of ribs 300, 302 may be in the range of approximately 0 to 120.0 mm and can extend substantially to the rear 126 of the club.

While only two ribs 300, 302 are shown, any number of ribs can be included on the golf club. It is understood that the ribs may extend at different lengths, widths, heights, and angles and have different shapes to achieve different weight distribution and performance characteristics.

The ribs 300, 302 may be formed of a single, integrally formed piece, e.g., by casting with the sole 118. Such an integral piece may further include other components of the body 108, such as the entire sole 118 (including the channel 140) or the entire club head body 108. In other embodiments the ribs 300, 302 can be connected to the crown 116 and/or sole 118 by welding or other integral joining technique to form a single piece.

In other embodiments club 102 can include internal and/or external ribs. As depicted in at least in FIGS. 1, 8, and 11C, the cover 161 can include external ribs 402, 404. In one embodiment, as illustrated in FIG. 8, external ribs 402, 404 are generally arranged in an angled or v-shaped alignment, and converge towards one another with respect to the Y-axis 16 in a front 124 to rear 126 direction. In this configuration, the ribs 402, 404 converge towards one another at a point beyond the rear 126 of the club. As shown in FIG. 8, the angle of the ribs 402, 404 from the Y-axis 16 can be approximately 6.6 degrees+/−2 degree, or may be in the range of 0-30 degrees, and approximately 8 degrees+/−2 degree, or may be in the range of 0-30 degrees respectively. In other configurations, the ribs 402, 404 can angle away from one another or can be substantially straight in the Y-axis 16 direction. As shown in FIGS. 9C and 9E, the external ribs 402, 404 can be substantially straight in the vertical plane or Z-axis 18 direction. In other embodiments, the ribs 402, 404 can be angled in the Z-axis 18 direction, and can be angled relative to each other as well.

Each of the ribs 402, 404 have front end portions 406, 408 toward the front 124 of the body 108 extending to the edge of the rib, and rear end portions 410, 412 toward the rear 126 of the body 108 extending to the edge of the rib. In one embodiment the front end portions 406, 408 of ribs 402, 404 can connect to the first wall 166 and the second wall 167 respectively, and the rear end portions 410, 412 can extend substantially to the rear 126 of the club. The external ribs 402, 404 also include upper portions 414, 416 extending to the edge of the rib and lower portions 418, 420 extending to the edge of the rib. As shown in FIGS. 9E and 11C, the upper portions 414, 416 of ribs 402, 404 connect to the cover 161. The lower portions 418, 420 of ribs 402, 404 can define a portion of the bottom or sole 118 of the golf club. As shown in FIG. 11B the lower portions 418, 420 of ribs 402, 404 can be curved, generally forming a convex shape. In other embodiments the lower portions 402, 404 can have a concave curved shape, a substantially straight configuration, or any other shape. In another embodiment, external ribs 402, 404 can extend to the crown 116. In some such embodiments, the external ribs 402, 404 can intersect the cover 161 and connect to an internal surface of the crown 116. And in some embodiments, external ribs 402, 404 can connect to an internal surface of the sole 118 and/or an internal surface of the rear edge 148 of the channel 140 or any other internal surface of the club.

The ribs 402, 404 can be located anywhere in the heel-toe direction and in the front-rear direction. For example, ribs 402, 404 can be equally or unequally spaced in the heel-toe direction from the center of gravity or from the face center. In one embodiment, the front end portion 406 of rib 402 can be located approximately 15 mm+/−2 mm, or may be in the range of 0 mm to 25 mm, towards the heel 120 from the face center location 40 measured in the X-axis 14 direction, and the front end portion 408 of rib 404 can be located approximately 33 mm+/−2 mm, or may be in the range of 0 mm to 45 mm, towards the toe 122 from the face center location 40 measured along the X-axis 14. In one embodiment, the front end portion 406 of rib 402 can be located approximately 53 mm+/−2 mm or may be in the range of 20 mm to 70 mm, towards the rear 126 from the striking face measured in the Y-axis 16 direction, and the front end portion 408 of rib 404 can be located approximately 55 mm+/−2 mm, or may be in the range of 20 mm to 70 mm, towards the rear 126 from the striking face measured along the Y-axis 16. In another embodiment, the front end portion 406 of rib 402 can be located approximately 12 mm+/−2 mm or may be in the range of 0 mm to 25 mm, towards the heel 120 from the face center location 40 measured in the X-axis 14 direction, and the front end portion 408 of rib 404 can be located approximately 32 mm+/−2 mm or may be in the range of 0 mm to 45 mm, towards the toe 122 from the face center location 40 measured along the X-axis 14. The front end portion 406 of rib 402 can be located approximately 51 mm+/−2 mm or may be in the range of 20 mm to 70 mm, towards the rear 126 from the striking face measured in the Y-axis 16 direction, and the front end portion 408 of rib 404 can be located approximately 49 mm+/−2 mm or may be in the range of 20 mm to 70 mm, towards the rear 126 from the striking face measured along the Y-axis 16.

Each rib 402, 404 also has an internal side 411, 413 and an external side 415, 417 and a width defined there between. The width of the ribs 402, 404 can affect the strength and weight of the golf club. As shown in FIGS. 9E and 11C, the ribs 402, 404 can have a thinner width portion 422 throughout the majority, or center portion, of the rib. The thinner width portion 422 of the rib can be approximately 1 mm+/−0.2 mm, or may be in the range of approximately 0.5 to 5.0 mm and can be substantially similar throughout the entire rib. The ribs 402, 404 can also include a thicker width portion 424. The thicker width portion 424 can be near the front end portions 406, 408, rear end portions 410, 412, upper portions 414, 416, or lower portions 418, 420. As depicted in FIGS. 9E and 11C, the ribs 402, 404 include a thicker width portion 424 over part of the front end portions 406, 408, part of the rear end portions 410, 412, and the lower portions 418, 420. As shown in FIGS. 9C and 9E, the thicker width portion 424 can be disposed substantially on the internal sides 411, 413 of the ribs 402, 404. In other embodiments the thicker width portion can be distributed equally or unequally on the internal sides 411, 413 and the external sides 415, 417, or substantially on the external sides 415, 417. The thickness of the thicker width portion can be approximately 3.0 mm+/−0.2 mm or may be in the range of approximately 1.0 to 10.0 mm. The width of the thicker portion 424 can be approximately 2 to 3 times the width of the thinner portion 422.

Ribs 402, 404 can also be described as having a vertical portion 431 and a transverse portion 433 such that the portions 431 and 433 form a T-shaped or L-shaped cross-section. As shown in FIG. 9E, the transverse portion 433 can taper into the vertical portion 431, but in other embodiments the transverse portion may not taper into the vertical portion. The vertical portion 431 and the transverse portion can both have a height and a width. As described above the width of the vertical portion can be approximately 1 mm+/−0.2 mm, or may be in the range of approximately 0.5 to 5.0 mm, and the width of the transverse portion can be approximately 3.0 mm+/−0.2 mm or may be in the range of approximately 1.0 to 10.0 mm. The height of the transverse portion 433 can be approximately 1.0 mm+/−0.5 mm, or may be in the range of approximately 0.5 to 5.0 mm. Any of the ribs described herein can include, or can be described as having, a vertical portion and at least one transverse portion. The transverse portion can be included on an upper portion, lower portion, front end portion, and/or rear end portion, or any other portion of the rib. As previously discussed the intersection of the vertical portion and the transverse portion can generally form a T-shaped or L-shaped cross-section.

Each rib 402, 404 also has a maximum height defined by the distance between the upper portions 414, 416 and the lower portions 418, 420 measured along the ribs 402, 404 in the Z-axis 18 direction. A maximum height of the ribs 402, 404 can be in the range of approximately 5 to 40 mm. Additionally, each rib 402, 404 also has a maximum length, defined by the distance between the front end portions 406, 408 and rear end portions 410, 412 measured along the ribs 402, 404 in the plane defined by the X-axis 14 and the Y-axis 16. The length of rib 402 can be approximately 54 mm+/−3 mm or may be in the range of approximately 20 to 70 mm; and the length of rib 404 can be approximately 53 mm+/−3 mm or may be in the range of approximately 20 to 70 mm. In another embodiment, the length of rib 402 can be approximately 48 mm+/−2 mm or may be in the range of approximately 20 to 70 mm; and the length of rib 404 can be approximately 50 mm+/−2 mm or may be in the range of approximately 20 to 70 mm. The ratio of the length of the ribs 402, 404 to the total head breadth 60 of the club in the front 124 to rear 126 direction can be approximately 1:2 (rib length/total head breadth) or approximately 0.75:2 to 1.25:2

While only two external ribs 402, 404 are shown, any number of ribs can be included on the golf club. It is understood that the ribs may extend at different lengths, widths, heights, and angles and have different shapes to achieve different weight distribution and performance characteristics.

The external ribs 402, 404 may be formed of a single, integrally formed piece, e.g., by casting with the cover 161. Such an integral piece may further include other components of the body 108, such as the entire sole 118 (including the channel 140) or the entire club head body 108. In other embodiments the ribs 402, 404 can be connected to the cover 161 and/or sole 118 by welding or other integral joining technique to form a single piece.

Figure 11A:
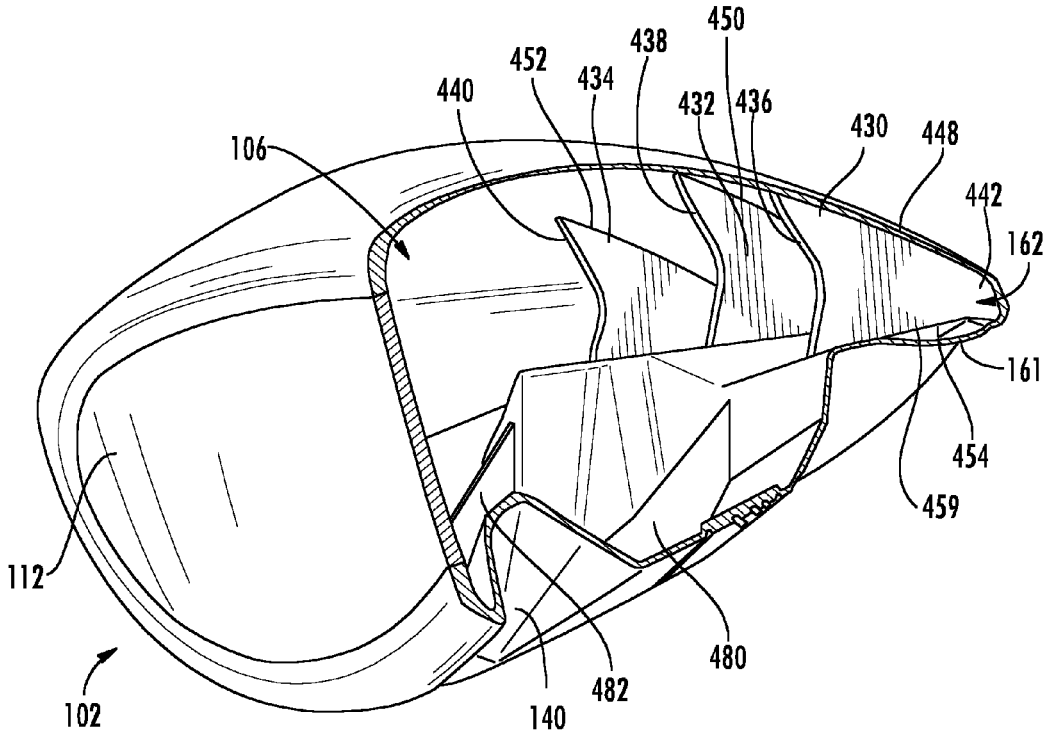
FIG. 11A is a front left perspective view of the club head of FIG. 1, with a portion removed to show internal detail.
Figure 11B:
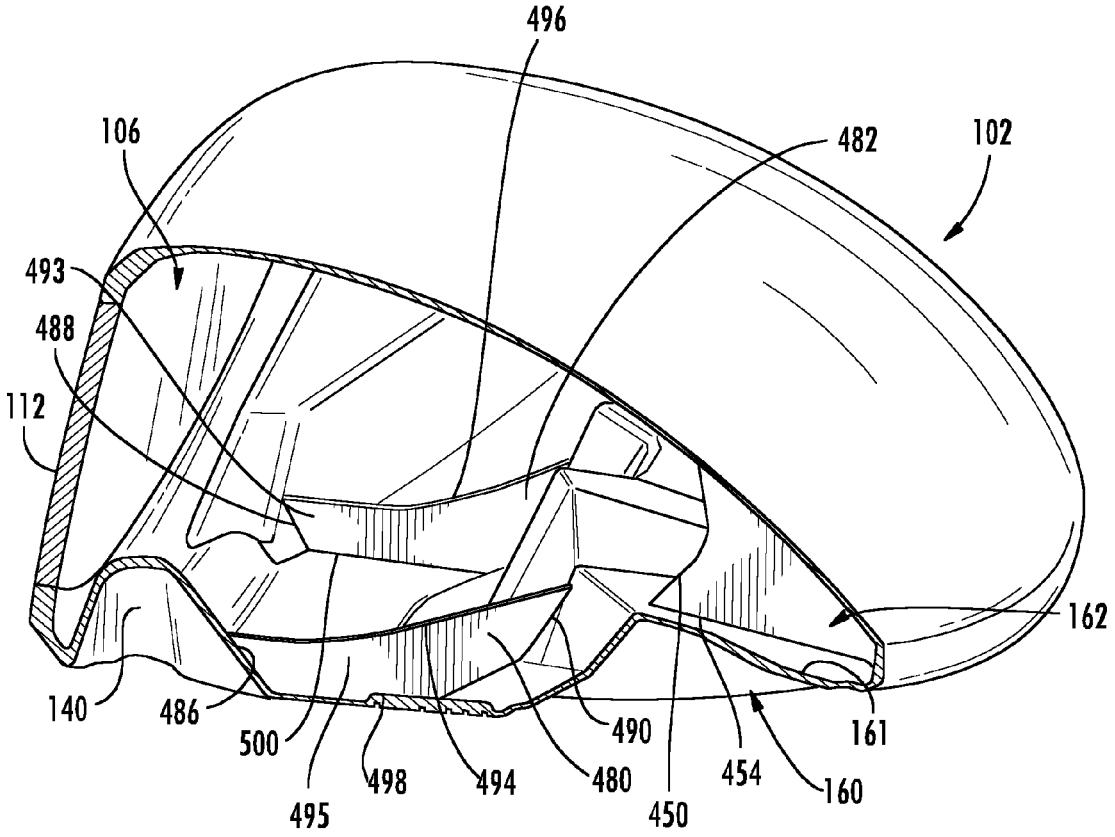
FIG. 11B is a top left perspective view of the club head of FIG. 1, with a portion removed to show internal detail.
Figure 11C:
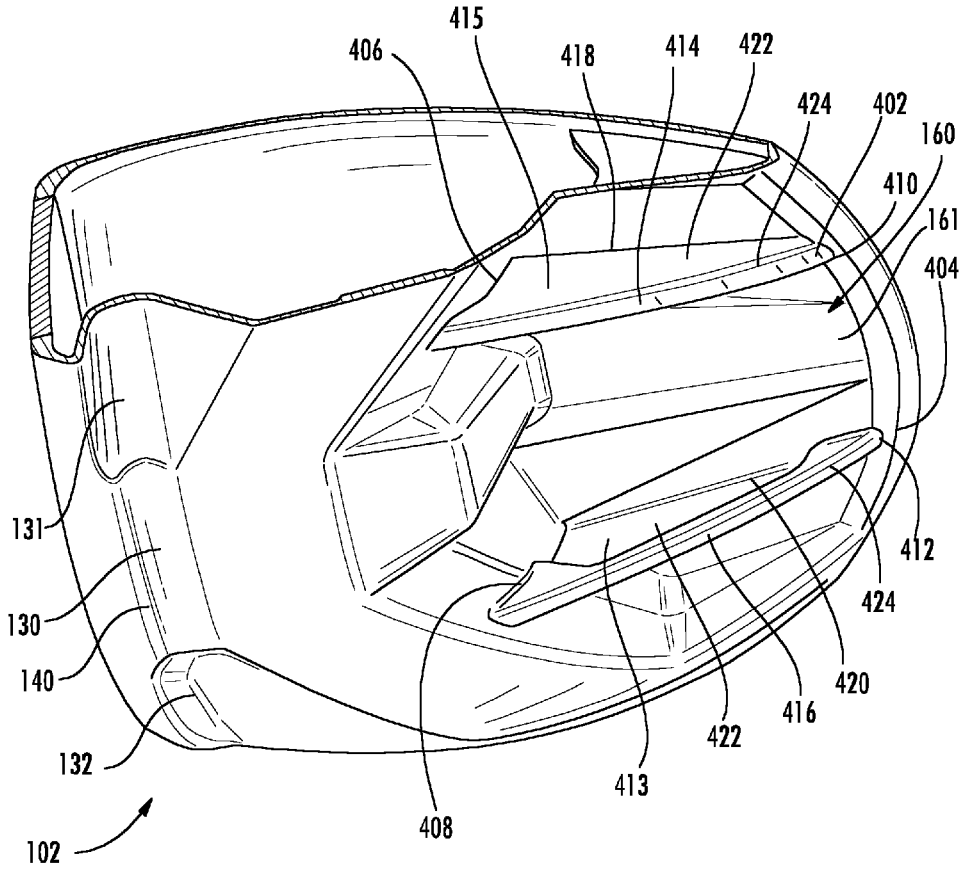
FIG. 11C is a bottom left perspective view of the club head of FIG. 1, with a portion removed to show internal detail.

As shown in at least FIGS. 9C, 9E, and 11A, the club can also include upper internal ribs 430, 432, 434 within the space 162 of the inner cavity 106. The ribs 430, 432, 43 can extend between the interior portions of the crown 116 and the cover 161, and in other embodiments can connect only to an interior portion of the crown 116 and/or the cover 161. In one embodiment, as illustrated in FIGS. 9C, 9E, and 11A, upper internal ribs 430, 432, 434 are generally parallel with one another and substantially aligned in a generally vertical plane or Z-axis 18 direction and are substantially perpendicular to the striking face 112. In other configurations, the upper internal ribs 430, 432, 434 can be angled with respect to X-axis 14, Y-axis 16, or Z-axis 18 directions and/or angled with respect to each other. The ribs 430, 432, 434 can be located anywhere in the heel-toe direction. For example, ribs 430, 432, 434 can be equally or unequally spaced in the heel-toe direction from the center of gravity or from the face center. In one embodiment, rib 430 can be located approximately 18 mm+/−2 mm or may be in the range of approximately 5 to 35 mm towards the heel 120 from the face center location 40 measured along the X-axis 14; rib 432 can be located approximately 16 mm+/−2 mm or may be in the range of approximately 0 to 30 mm towards the toe 122 from the face center location 40 measured along the X-axis 14; and rib 434 can be located approximately 38.5 mm+/−2.0 mm or may be in the range of approximately 20 to 50 mm towards the toe 122 from the face center location 40 measured along the X-axis 14. In another embodiment, rib 430 can be located approximately 15 mm+/−2 mm or may be in the range of approximately 0 to 30 mm towards the heel 120 from the face center location 40 measured along the X-axis 14; rib 432 can be located approximately 10 mm+/−2 mm or may be in the range of approximately 0 to 20 mm towards the toe 122 from the face center location 40 measured along the X-axis 14; and rib 434 can be located approximately 32 mm+/−2 mm or may be in the range of approximately 10 to 45 mm towards the toe 122 from the face center location 40 measured along the X-axis 14.

Each of the ribs 430, 432, 434 have front end portions 436, 438, 440 toward the front 124 of the body 108 extending to the edge of the rib, and rear end portions 442, 444 (not shown), 446 (not shown) toward the rear 126 of the body 108 extending to the edge of the rib. In one embodiment the front end portions 436, 438, 440 include a concave curved shape. In other embodiments, the front end portions 436, 438, 440 can have a convex curved shape, a straight shape, or any other shape.

Ribs 430, 432, 434 also include upper portions 448, 450, 452 and lower portions 454, 456, 458. As shown in FIGS. 9C, 9E, and 11A the upper portions 448, 450, 452 of ribs 430, 432, 434 can connect to the internal side of the crown 116, and the lower portions 454, 456, 458 can connect to an internal side of the cover 161. In other embodiments the ribs may only be connected to the cover 161 and/or the crown 116.

Each rib 430, 432, 434 also has first side oriented towards the heel 131 and a second side oriented towards the toe 132 and a width defined there between. The width of the ribs can affect the strength and weight of the golf club. As shown in FIG. 9C, the ribs 430, 432, 434 can have an approximately constant width which can be approximately 0.9 mm+/−0.2 mm or may be in the range of approximately 0.5 to 5.0 mm. This width can be substantially the same for each rib. In other embodiments, the width of each rib can vary. Additionally, for example, the ribs 430, 432, 434 can include a thinner width portion throughout the majority, or a center portion, of the rib. The ribs 430, 432, 434 can also include a thicker width portion. The thicker width portion can be near the front end portions 436, 438, 440, rear end portions 442, 444 (not shown), 446, upper portions 448, 450, 452 or lower portions 454, 456, 458. The thickness of the thicker width portion can be approximately 2 to 3 times the width of the thinner portion.

Each of ribs 430, 432, 434 also has a maximum height defined by the maximum distance between the upper portions 448, 450, 452 or lower portions 454, 456, 458 measured along the rib in the Z-axis 18 direction. The maximum height of ribs 430, 432, 434 can be approximately in the range of approximately 25 to 35 mm or in the range of approximately 15 to 50 mm. Additionally, each rib 430, 432, 434 also has a maximum length, measured along the rib in Y-axis 16 direction. The maximum length of rib 430 can be approximately 33 mm+/−2 mm or may be in the range of approximately 20 to 50 mm, the maximum length of rib 432 can be approximately 35 mm+/−2 mm or may be in the range of approximately 20 to 50 mm, and the maximum length of rib 434 can be approximately 30 mm+/−2 mm or may be in the range of approximately 25 to 50 mm. As shown in FIG. 11A each or ribs 430, 432, 434 have similar same lengths, but in other embodiments each of the ribs can have different lengths. In one embodiment The maximum length of rib 430 can be approximately 24 mm+/−2 mm or may be in the range of approximately 15 to 40 mm, the maximum length of rib 432 can be approximately 28 mm+/−2 mm or may be in the range of approximately 15 to 40.0 mm, and the maximum length of rib 434 can be approximately 25 mm+/−2 mm or may be in the range of approximately 15 to 40 mm. In still other embodiments the length of ribs 430, 432, 434 can be longer or shorter, and for example, in some embodiments ribs 430, 432, 434 can connect to an internal side of the striking face 112.

Figure 10A:
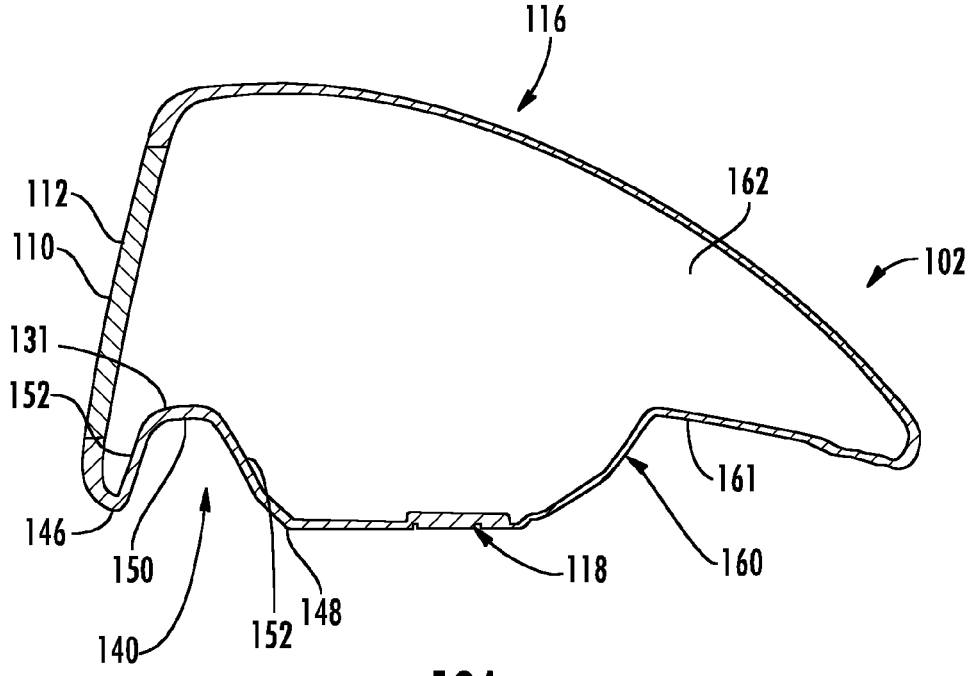
FIG. 10A is a cross-section view taken along line 10A-10A of FIGS. 5 and 8.
Figure 10B:
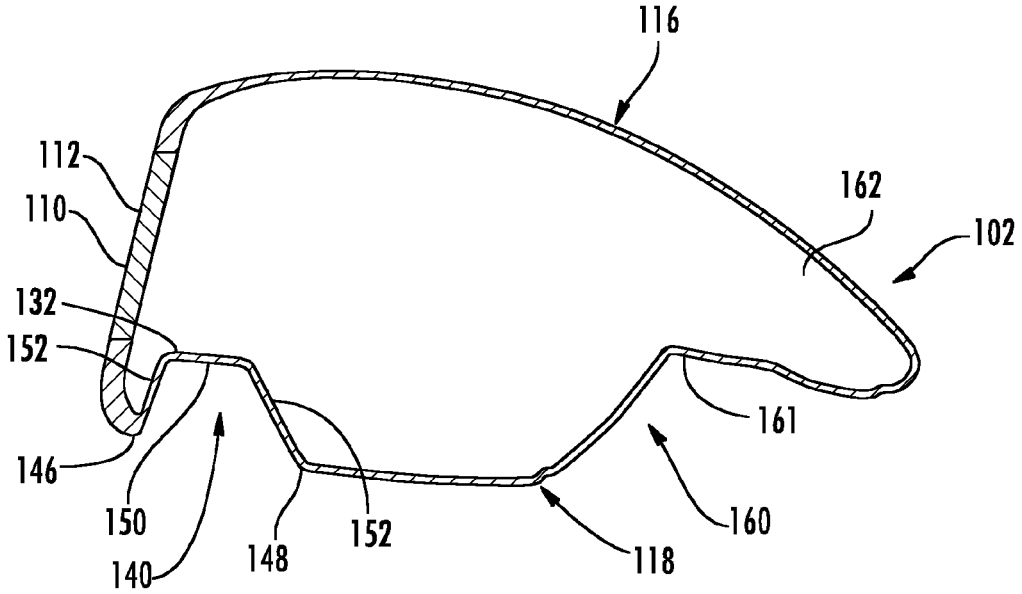
FIG. 10B is a cross-section view taken along line 10B-10B of FIGS. 5 and 8.
Figure 10C:
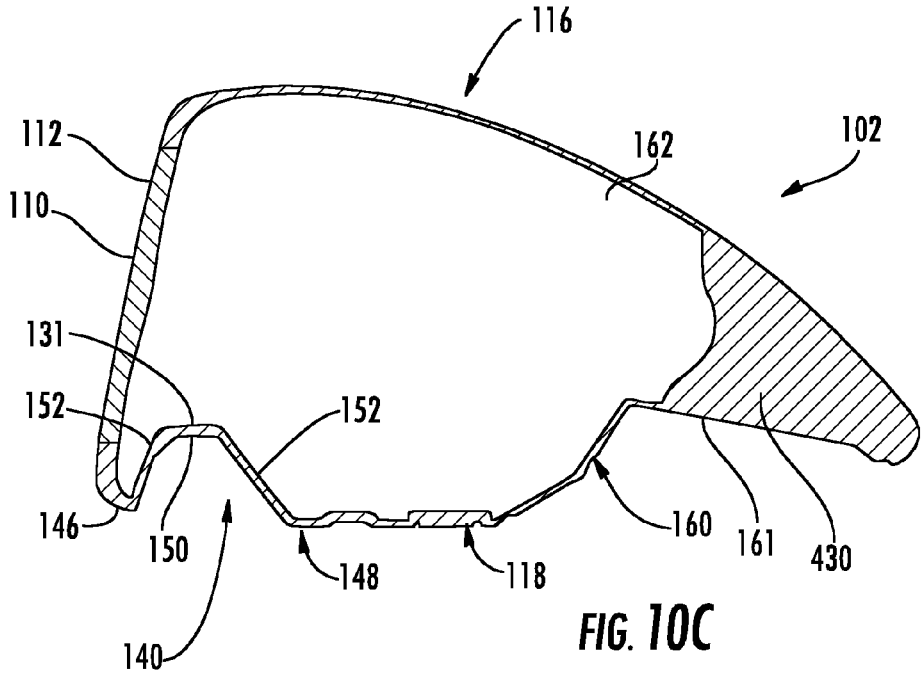
FIG. 10C is a cross-section view taken along line 10C-10C of FIG. 8.
Figure 11D:
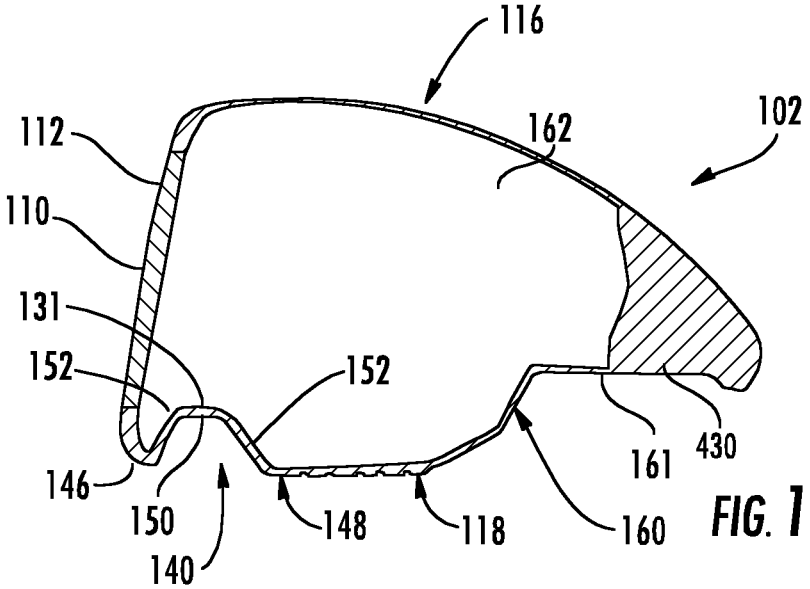
FIG. 11D is a cross-section view of another embodiment of a golf club head according to aspects of the disclosure, in the form of a golf driver.

A cross-section of the golf club through rib 430 is show in FIG. 10C. In other embodiments, ball striking head 102 may be sized or shaped differently. For example, a cross-section view of another embodiment of a ball striking head 102 according to aspects of the disclosure is shown in FIG. 11D also including rib 430.

While three upper internal ribs 430, 432, 434 are shown, any number of ribs can be included on the golf club. It is understood that the ribs may extend at different lengths, widths, heights, and angles and have different shapes to achieve different weight distribution and performance characteristics.

The upper internal ribs 430, 432, 434 may be formed of a single, integrally formed piece, e.g., by casting with the cover 161 and/or crown 116. Such an integral piece may further include other components of the body 108, such as the entire sole 118 (including the channel 140), the crown 116, or the entire club head body 108. In other embodiments the ribs 430, 432, 434 can be connected to the cover 161 and/or crown 116 by welding or other integral joining technique to form a single piece.

The combination of both the internal ribs 430, 432, and 434 along with the external ribs 402 and 404 can be positioned relative to each other such that at least one of the external ribs 402 and 404 and at least one of the internal ribs 430, 432, and 434 can be located where the at least one external rib and the at least one internal rib occupy the same location in a view defined by the plane defined by the X-axis 14 and Y-axis 16 (or intersect if extended perpendicular to the view) but are separated by only the wall thickness between them. The external rib and internal rib then diverge at an angle. The angle between the external and internal rib can be an angle in the range of 4 to 10 degrees or may be in the range of 0 to 30 degrees. In other configurations, the at least one external rib and the at least one internal rib occupy the same point in a view defined by the plane defined by the X-axis 14 and Z-axis 18 (or intersect if extended perpendicular to the view) but are separated by only the wall thickness between them. The external rib and internal rib then diverge at an angle. The angle that the external and internal rib can be an angle in the range of 4 to 10 degrees or may be in the range of 0 to 30 degrees.

As shown in at least FIGS. 9C and 11B, the club can also include lower internal ribs 480, 482. The ribs can connect to the interior side of the sole 118, and can extend between interior portions of the first and second walls 166, 167 and the rear edge 148 of the channel 140. In other embodiments the ribs 480, 482 can connect only to the interior portion of first and second walls 166, 167 and/or the interior of the rear edge 148 of the channel 140, and in still other embodiments ribs 480, 482 can connect to the crown 116. In one embodiment, as illustrated in FIGS. 9C and 11B, lower internal ribs 480, 482 are generally parallel with one another and aligned in a generally vertical plane or Z-axis 18 direction that is perpendicular to the striking face 112. In other configurations, the lower internal ribs 480, 482 can be angled with respect to X-axis 14, Y-axis 16, or Z-axis 18 directions and/or angled with respect to each other. The ribs 480, 482 can be located anywhere in the heel-toe direction. For example, ribs 480, 482 can be equally or unequally spaced in the heel-toe direction from the center of gravity or from the face center. In one embodiment, rib 480 can be located approximately 8.2 mm+/−2 mm or may be in the range of approximately 0 to 30 mm towards the heel 120 from the face center location 40 measured along the X-axis 14; and rib 482 can be located approximately 25.1 mm+/−2 mm or may be in the range of approximately 0 to 45 mm towards the toe 122 from the face center location 40 measured along the X-axis 14. In another embodiment, rib 480 can be located approximately 2.6 mm+/−2 mm or may be in the range of approximately 0 to 25 mm towards the heel 120 from the face center location 40 measured along the X-axis 14; and rib 482 can be located approximately 20.7 mm+/−2 mm or may be in the range of approximately 0 to 35 mm towards the toe 122 from the face center location 40 measured along the X-axis 14.

Each of the ribs 480, 482 have front end portions 486, 488 towards the front 124 of the body 108 extending to the edge of the rib which can connect to the interior of the rear edge 148 of the channel 140. Each of the ribs 480, 482 also has rear end portions 490, 492, respectively, towards the rear 126 of the body 108 extending to the edge of the rib which can connect to the first and second walls 166, 167. The lower internal ribs 482 and 484 also include upper portions 494, 496 extending to the edge of the rib and lower portions 498, 500 extending to the edge of the rib. As shown in FIG. 11B the upper portions 494, 496 of ribs 480, 482 can be curved, generally forming a concave curved shape. In other embodiments the upper portions 494, 496 can have a convex curved shape, straight shape, or any other shape. The lower portions 498, 500 of the ribs can connect to an interior of the sole 118 of the golf club.

Each rib 480, 482 also has an internal side 491 (not shown), 493 and an external side 495, 497 (not shown) and a width defined there between. The width of the rib can affect the strength and weight of the golf club. The ribs 480, 482 can have a substantially constant rib width of approximately 0.9 mm+/−0.2 mm or may be in the range of approximately 0.5 to 5.0 mm, or can have a variable width. Additionally, in some embodiments, for example, the ribs 480, 482 can have a thinner width portion throughout the majority or a center portion of the rib and a thicker width portion. The thicker width portion can be near the front end portions 486, 488, rear end portions 490, 492, upper portions 494, 496, or lower portions 498, 500, or any other part of the rib. The thickness of the thicker width portion can be approximately 2 to 3 times the width of the thinner portion.

Each rib 480, 482 also has a maximum height defined as the maximum distance between the upper portions and the lower portions measured along the rib in the Z-axis 18 direction. The maximum height of rib 480 can be approximately 16 mm+/−2 mm or may be in the range of approximately 0 to 40 mm, and the maximum height of rib 482 can be approximately 20 mm+/−2 mm or may be in the range of approximately 0 to 40 mm. In another embodiment, the maximum height of rib 480 can be approximately 20 mm+/−2 mm or may be in the range of approximately 0 to 30 mm, and the maximum height of rib 482 can be approximately 21 mm+/−2 mm or may be in the range of approximately 0 to 30 mm. Additionally, each rib 480, 482 also has a maximum length defined as the maximum distance between the front end portions and rear end portions measured along the rib in the Y-axis 16 direction. The maximum length of rib 480 can be approximately 46 mm+/−2 mm or may be in the range of approximately 0 to 60 mm, and the maximum length of rib 482 can be approximately 46 mm+/−2 mm or may be in the range of approximately 0 to 60 mm. In another embodiment, the maximum length of rib 480 can be approximately 40 mm+/−2 mm or may be in the range of approximately 0 to 50 mm, and the maximum length of rib 482 can be approximately 39 mm+/−2 mm or may be in the range of approximately 0 to 50 mm.

Figure 10D:
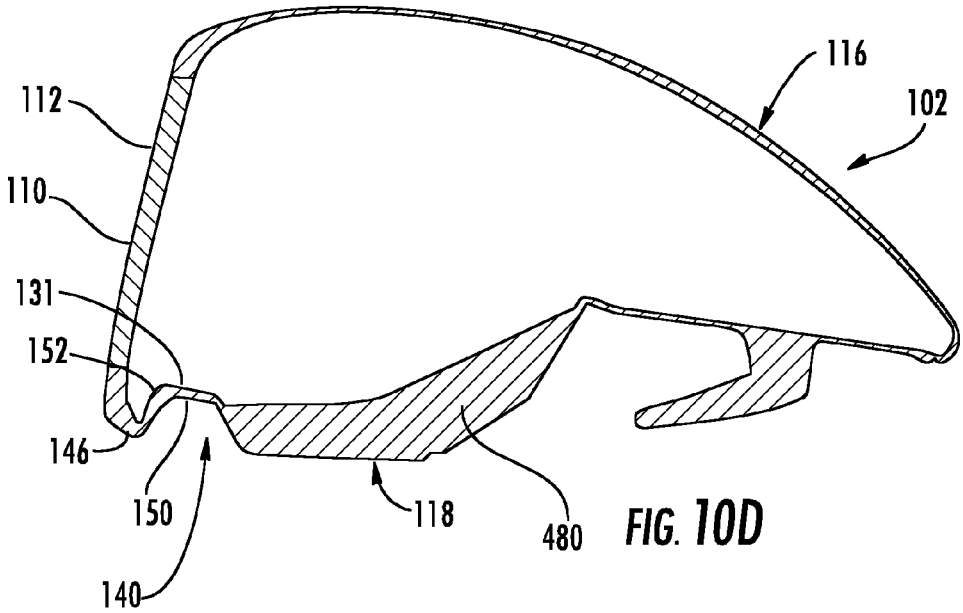
FIG. 10D is a cross-section view taken along line 10D-10D of FIG. 8.
Figure 11E:
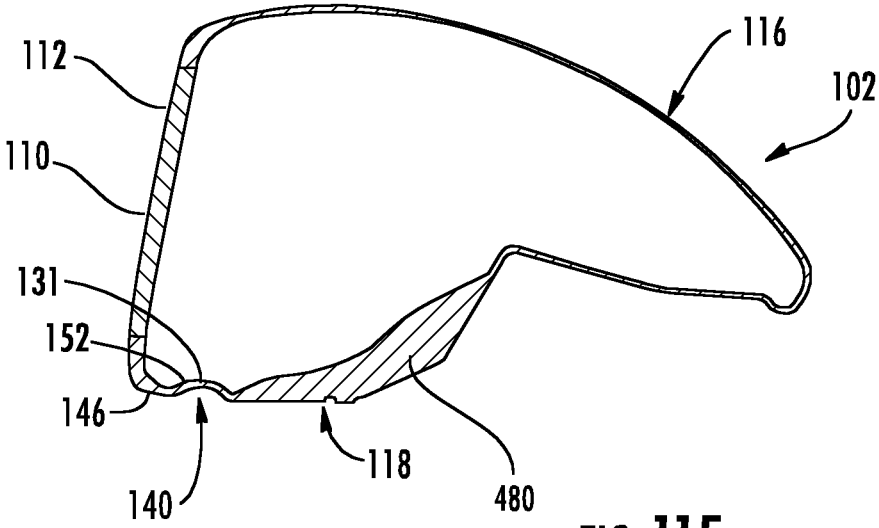
FIG. 11E is a cross-section view of another embodiment of a golf club head according to aspects of the disclosure, in the form of a golf driver.
Figure 12:
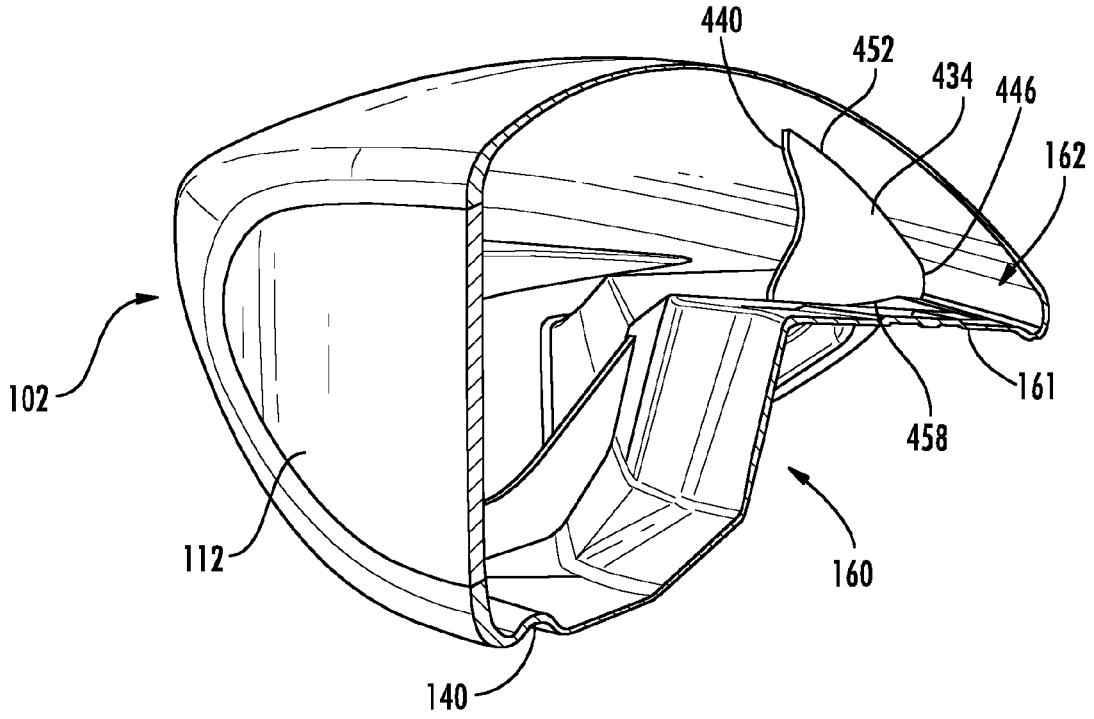
FIG. 12 is a front left perspective view of the club head of FIG. 1, with a portion removed to show internal detail.
Figure 13:
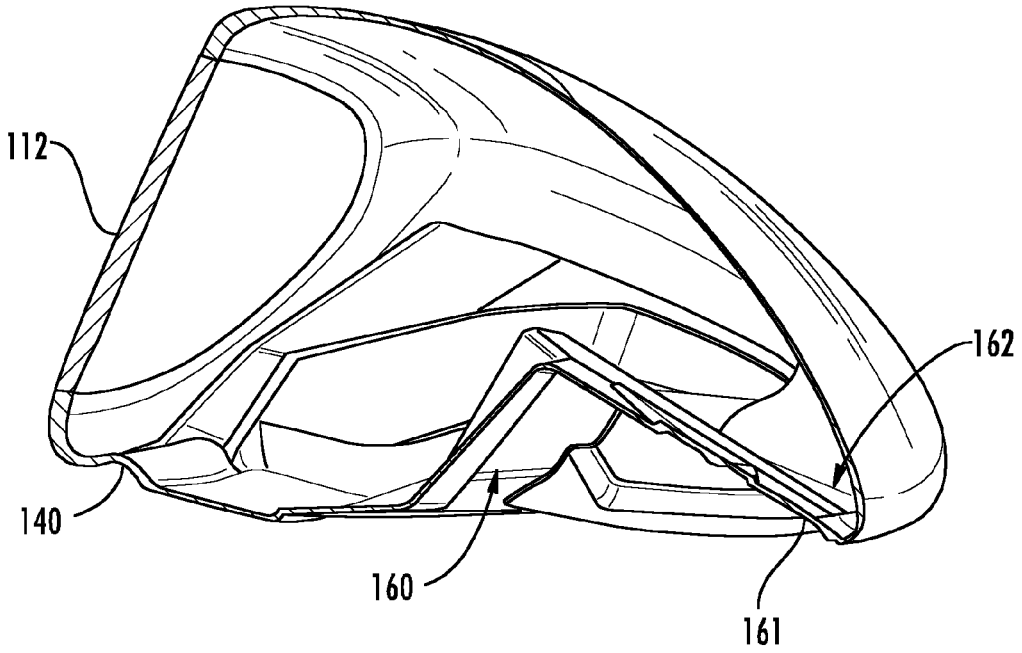
FIG. 13 is a rear left perspective view of the club head of FIG. 1, with a portion removed to show internal detail.

A cross-section of the golf club through rib 480 is shown in FIG. 10D. In other embodiments, ball striking head 102 may be sized or shaped differently. For example, a cross-section view of another embodiment of a ball striking head 102 according to aspects of the disclosure is shown in FIG. 11E also including rib 480.

While only two lower internal ribs 480, 482 are shown, any number of ribs can be included on the golf club. It is understood that the ribs may extend at different lengths, widths, heights, and angles and have different shapes to achieve different weight distribution and performance characteristics.

The lower internal ribs 480, 482 may be formed of a single, integrally formed piece, e.g., by casting with the sole 118. Such an integral piece may further include other components of the body 108, such as the entire sole 118 (including the channel 140) or the entire club head body 108. In other embodiments the ribs 480, 482 can be connected to the crown 116 and/or sole 118 by welding or other integral joining technique to form a single piece.

Additionally, the rear end portions 490, 492 of the internal ribs 480, 482 and the forward most portions 406, 408 of the external ribs 402,404 may be positioned relative to each other by a dimension defined in a direction parallel to the X-axis 14 between 2 to 4 mm or may be in the range of 1 to 10 mm.

While internal and external ribs have generally been described in relation to the embodiment disclosed in FIGS. 1-13, it is understood that any rib configuration can apply to any other portion of any embodiment described.

Driver #2—Structural Ribs

Figure 18:
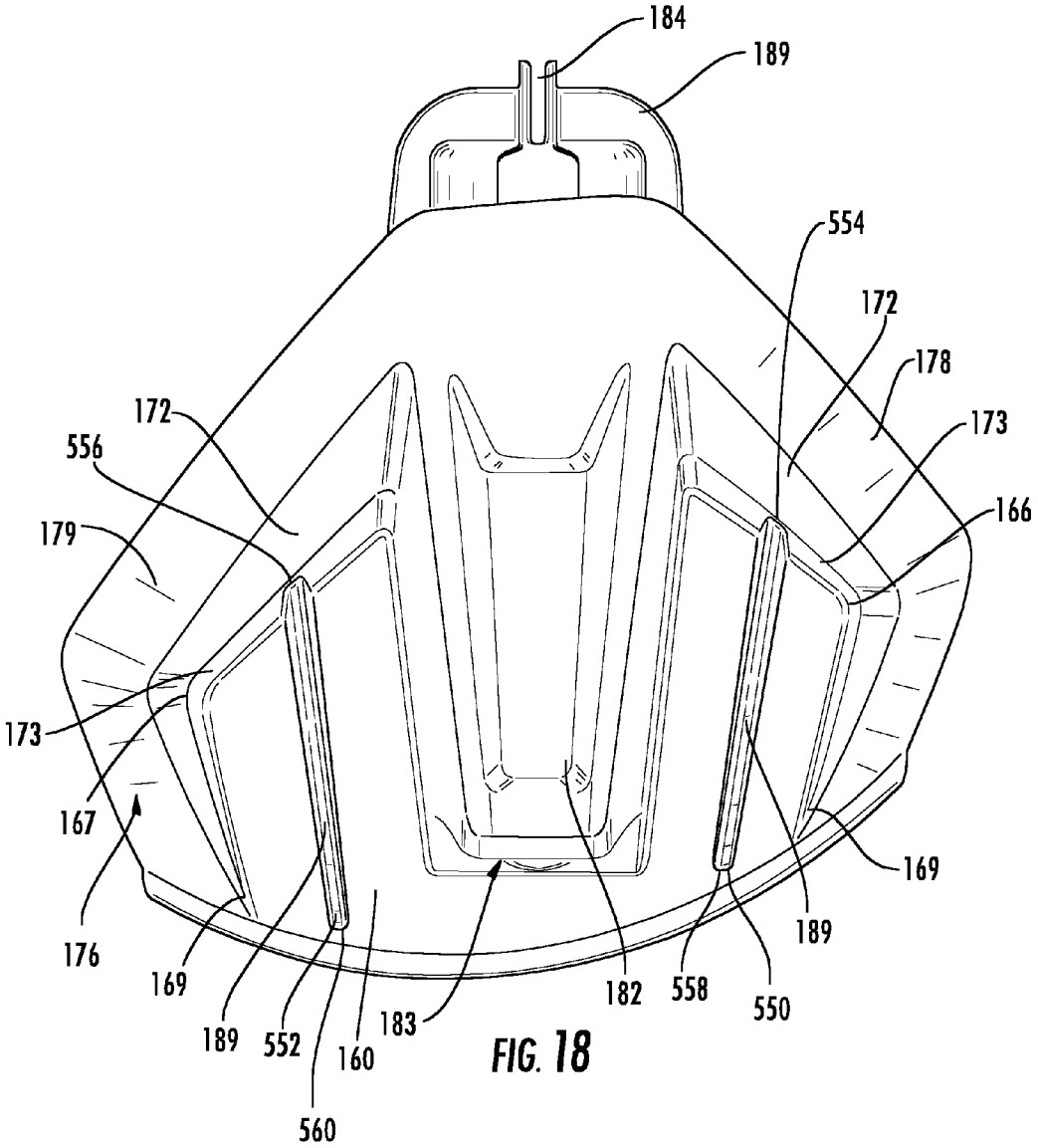
FIG. 18 is a bottom view of the sole piece of the club head of FIG. 14.
Figure 19:
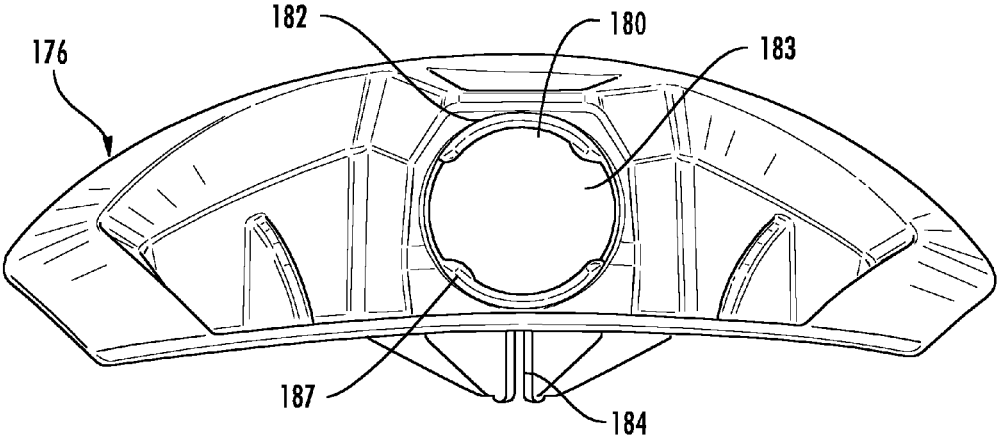
FIG. 19 is a rear view of the sole piece of FIG. 18.

As discussed above, ball striking heads 102 according to the present invention can include additional features, such as internal and external structural ribs, that can influence the impact of a ball on the face 112 as well as other performance characteristics. As depicted in at least in FIGS. 14, 15 and 18, the sole piece 176 can include external ribs 550, 552. In one embodiment, as illustrated in FIG. 14, external ribs 550, 552 are generally arranged in an angled or v-shaped alignment, converging towards one another with respect to the Y-axis 16 in a front 124 to rear 126 direction. In this configuration, the ribs 550, 552 converge towards one another at a point beyond the rear 126 of the club. As shown in FIGS. 14, 15 and 18, the angle of the ribs 550, 552 from the Y-axis 16 can be approximately may be in the range of 0-30 degrees. In other configurations, the ribs 550, 552 can angle away from one another or can be substantially straight in the Y-axis 16 direction. The external ribs 550, 552 can be substantially straight in the vertical plane or Z-axis 18 direction. In other embodiments, the ribs 550, 552 can be angled in the Z-axis 18 direction, and can be angled relative to each other as well.

Each of the ribs 550, 552 have front end portions 554, 556 toward the front 124 of the body 108 extending to the edge of the rib, and rear end portions 558, 560 toward the rear 126 of the body 108 extending to the edge of the rib. In one embodiment the front end portions 554, 556 of ribs 550, 552 can connect to the first wall 166 and the second wall 167, and the rear end portions 558, 560 can extend substantially to the rear 126 of the club. The external ribs 550, 552 also include upper portions 562, 564 extending to the edge of the rib and lower portions 566, 568 extending to the edge of the rib. As shown in FIG. 14, the upper portions 562, 564 of ribs 550, 552 connect to the sole piece 176. The lower portions 566, 568 of ribs 550, 552 can define a portion of the bottom or sole 118 of the golf club. As shown in FIG. 14 the lower portions 566, 568 of ribs 550, 552 can be curved, generally forming a convex shape. In other embodiments the lower portions 550, 552 can have a concave curved shape, a substantially straight configuration, or any other shape.

The ribs 550, 552 can be located anywhere in the heel-toe direction and in the front-rear directions. For example, ribs 550, 552 can be equally or unequally spaced in the heel-toe direction from the center of gravity or from the face center. In one embodiment, the front end portion 556 of rib 550 can be located in the range of 0 mm to 50 mm, towards the heel 120 from the face center location 40 measured along the X-axis 14, and the front end portion 558 of rib 552 can be located in the range of 10 to 60 mm, towards the toe 122 from the face center location 40 measured along the X-axis 14. In one embodiment, the front end portion 556 of rib 550 can be located approximately in the range of 20 to 80 mm, towards the rear 126 from the striking face measured in the Y-axis 16 direction, and the front end portion 558 of rib 552 can be located approximately in the range of 20 to 80 mm, towards the rear 126 from the striking face measured along the Y-axis 16.

Each rib 550, 552 also has an internal side 570, 572 and an external side 574, 576 and a width defined there between. The width of the ribs 550, 552 can affect the strength and weight of the golf club. The width of the ribs 550, 552, can be substantially constant as shown in FIG. 18 and can be approximately 1.6 mm+/−0.2 mm, or may be in the range of 0.5 mm to 5.0 mm. In other embodiments, the ribs 550, 552 can have a thinner width portion throughout the majority, or center portion, of the rib, and a thicker width portion near the front end portions 554, 556, rear end portions 558, 560, upper portions 562, 564, or lower portions 566, 568.

Each rib 550, 552 also has a maximum height defined by the distance between the upper portions 562, 564 and the lower portions 566, 568 measured along the ribs 550, 552 in the Z-axis 18 direction. A maximum height of the ribs 550, 552 can be approximately 12 mm+/−4 mm or may be in the range of approximately 5 to 40 mm. Additionally, each rib 550, 552 also has a maximum length, defined by the distance between the front end portions 554, 556 and rear end portions 558, 560 measured along the ribs 550, 552 in the plane defined by the X-axis 14 and the Y-axis 16. The length can be approximately 35 mm+/−4 mm, or may be in the range of 10 mm to 60 mm.

While only two external ribs 550, 552 are shown, any number of ribs can be included on the golf club. It is understood that the ribs may extend at different lengths, widths, heights, and angles and have different shapes to achieve different weight distribution and performance characteristics.

The external ribs 550, 552 may be formed of a single, integrally formed piece with the sole piece 176. In other embodiments the ribs 550, 552 can be connected to the sole piece 176 and/or sole 118 by an integral joining technique to form a single piece.

As illustrated at least in in FIG. 14, in some embodiments, the golf club can include one or more structural ribs 185 that interlocks with a channel 184 in the sole piece 176. As shown in at least FIG. 14, a rib 185 can extend along at least a part of an interior portion of the crown 116. The rib can also extend between and connect to the interior of the rear edge 148 of the channel 140 and the substantially the rear of the club 126. The rib 185 can be substantially straight in the vertical plane or Z-axis 18 direction. In other configurations, as shown in FIG. 14, the rib 185 can be angled with respect to a vertical plane or Z-axis 18 direction. For example the angle of rib 185 from the Z-axis 18, in the plane created by the X-axis 14 and the Z-axis 18, can be approximately 8 degrees+/−1 degree, or may be in the range of 0 to 30 degrees.

The rib 185 has a front end portion 502 (not shown) towards the front 124 of the body 108 extending to the edge of the rib which can connect to the interior of the rear edge 148 of the channel 140. The rib 185 also has a rear end portion 504 toward the rear 126 of the body 108 extending to the edge of the rib. The rib 185 also includes an upper portion 506 extending to the edge of the rib and a lower portion 508 extending to the edge of the rib. As shown in FIG. 14, the lower portion 508 can connect to an internal side of the crown 116, and the upper portion 506 can be configured to interlock with the channel 184.

The rib 185 also has first side 510 oriented toward the heel 131 and a second side 512 (not shown) oriented toward the toe 132 and a width defined there between. The width of the rib can affect the strength and weight of the golf club. As shown in FIG. 14, the rib 185 can have approximately a constant width which can be approximately 0.9 mm+/−0.2 mm or may be in the range of approximately 0.5 to 5.0 mm. In other embodiments, the width of the rib 185 can vary. Additionally, for example, the rib 185 can include a thinner width portion throughout the majority, or a center portion, of the rib. The ribs 185 can also include a thicker width portion. The thicker width portion can be near the front end portion 502, the rear end portion 504, the upper portion 506, or the lower portion 508. The thickness of the thicker width portion can be approximately 2 to 3 times the width of the thinner portion.

The rib 185 also has a maximum height defined by the distance between the upper portions 506 and the lower portions 508 measured along the rib 185. A maximum height of the rib 185 may be in the range of approximately 0 to 45 mm. Additionally, the rib 185 also has a maximum length, defined by the distance between the front end portions 510 and rear end portions 512 measured along the rib 185 in the Y-axis 16 direction. The length may be in the range of approximately 20 to 100 mm. In some embodiments the length of the rib 185 may be shorter than the distance between the between the interior of the rear edge 148 of the channel 140 and the rear of the club 126.

While only one rib 185 is shown in FIG. 14, any number of ribs can be included on the golf club. It is understood that the ribs may extend at different lengths, widths, heights, and angles and have different shapes to achieve different weight distribution and performance characteristics.

The rib 185 may be formed of a single, integrally formed piece, e.g., by casting with the crown 116. Such an integral piece may further include other components of the body 108, such as the entire sole 118 (including the channel 140), or the entire club head body 108. In other embodiments the rib 185 can be connected to the sole 118 by welding or other integral joining technique to form a single piece.

As discussed above with FIGS. 1-13, the ball striking head in FIGS. 14-20 can include internal and external structural ribs that can influence the impact of a ball on the face as well as other performance characteristics. As discussed below with FIGS. 1-13, the structural ribs discussed herein in FIGS. 14-20 can affect the stiffness of the striking head 102.

Fairway Woods/Hybrid Club Heads—Structural Ribs

As described above with regards to the embodiments shown in FIGS. 1-20, the golf club head shown in FIGS. 21-26D, the golf club head shown in FIGS. 27-33, the golf club head shown in FIG. 35, the golf club head shown in FIGS. 36-37C, and the golf club head shown in FIG. 38-39C can include similar internal and external rib structures although the sizing a location of such structures can vary. The same reference numbers are used consistently in this specification and the drawings to refer to the same or similar parts.

Figure 21:
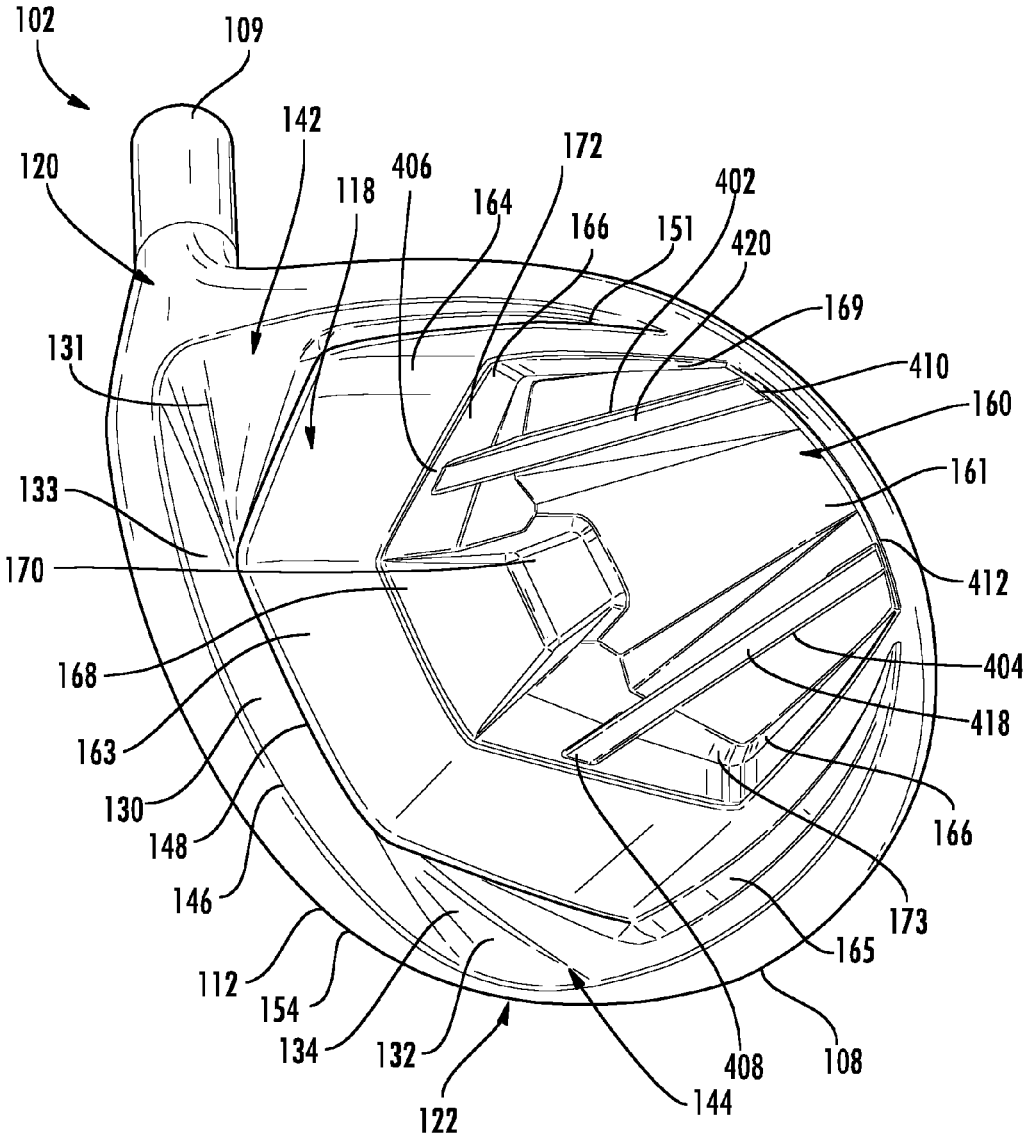
FIG. 21 is a bottom left perspective view of another embodiment of a golf club head according to aspects of the disclosure, in the form of a fairway wood golf club head.
Figure 22:
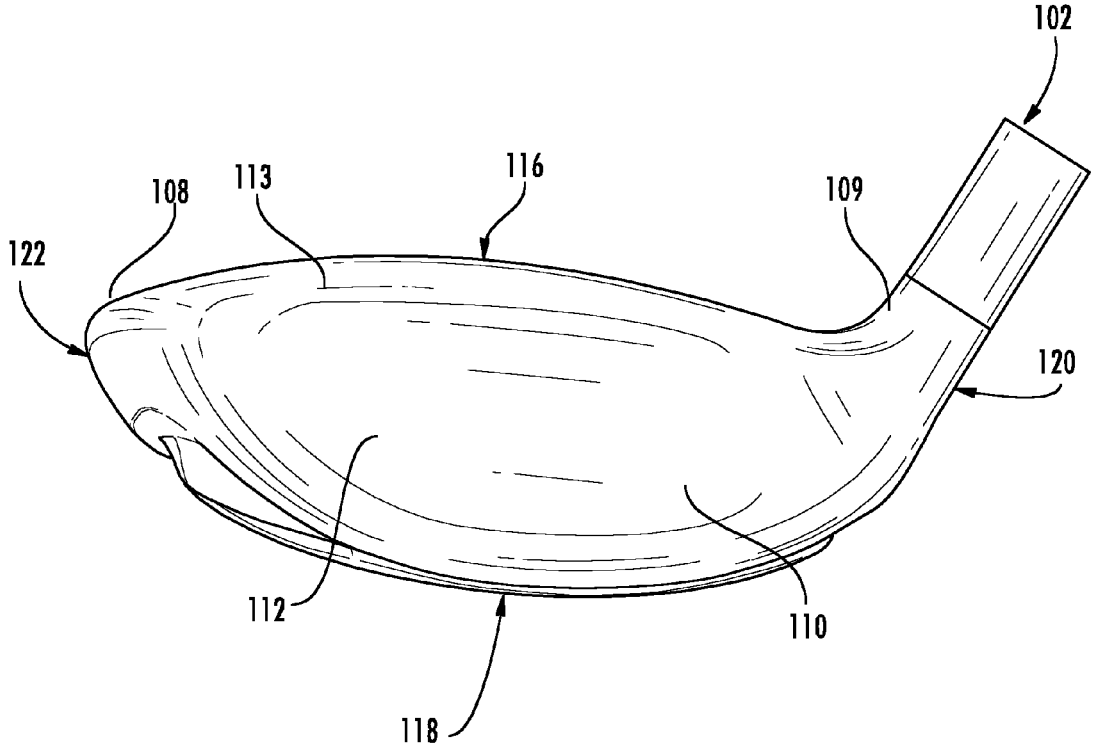
FIG. 22 is a front view of the club head of FIG. 21.
Figure 23:
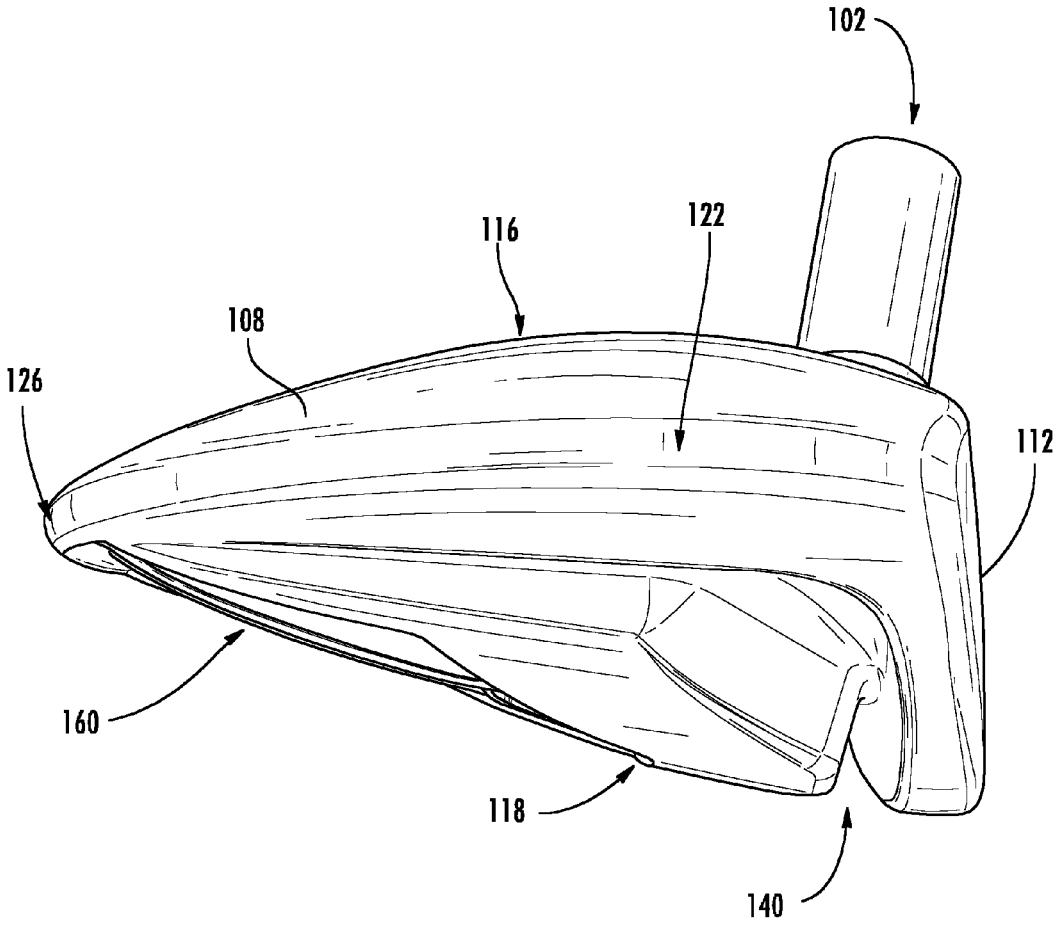
FIG. 23 is a side view of the club head of FIG. 21.

As depicted in fairway wood and hybrid embodiments shown in FIGS. 21-26D, 27-33, 36-37F, and 38-39C the cover 161 can include external ribs 402, 404. In one embodiment, as illustrated in FIGS. 21 and 27 external ribs 402, 404 are generally arranged in an angled or v-shaped alignment, converge towards one another with respect to the Y-axis 16 in a front 124 to rear 126 direction. In this configuration, the ribs 402, 404 converge towards one another at a point beyond the rear 126 of the club. As shown in FIG. 21, the angle of the ribs 402, 404 from the Y-axis 16 can be approximately 6.9 degrees+/−1 degree, or may be in the range of 0 to 30 degrees, and approximately 10.8 degrees+/−1 degree, or may be in the range of 0 to 30 degrees respectively. As shown in FIG. 27, the angle of the ribs 402, 404 from the Y-axis 16 can be approximately 13 degrees+/−1 degree, or may be in the range of 0 to 30 degrees, and approximately 13.3 degrees+/−1 degree, or may be in the range of 0 to 30 degrees respectively.

The ribs 402, 404 can be located anywhere in the heel-toe direction and in the front-rear direction. For example, ribs 402, 404 can be equally or unequally spaced in the heel-toe direction from the center of gravity or from the face center. In one embodiment, as shown in FIG. 21, the front end portion 406 of rib 402 can be located approximately 12 mm+/−2 mm, or may be in the range of 0 to 25 mm, towards the heel 120 from the face center location 40 measured along the X-axis 14, and the front end portion 408 of rib 404 can be located approximately 26.5 mm+/−2.0 mm, or may be in the range of 0 to 40 mm, towards the toe 122 from the face center location 40 measured along the X-axis 14. In another embodiment, as shown in FIG. 27 the front end portion 406 of rib 430 can be located approximately 10 mm+/−2 mm, or may be in the range of 5 to 30 mm, towards the heel 120 from the face center location 40 measured along the X-axis 14, and the front end portion 408 of rib 404 can be located approximately 22 mm+/−2 mm, or may be in the range of 5 to 40 mm, towards the toe 122 from the face center location 40 measured along the X-axis 14. In one embodiment, as shown in FIG. 21, the front end portion 406 of rib 402 can be located approximately 41 mm+/−2 mm, or may be in the range of 20 to 70 mm, towards the rear 126 from the striking face measured in the Y-axis 16 direction, and the front end portion 408 of rib 404 can be located approximately 42.5 mm+/−2.0 mm, or may be in the range of 20 to 70 mm, towards the rear 126 from the striking face measured along the Y-axis 16. In another embodiment, as shown in FIG. 27, the front end portion 406 of rib 402 can be located approximately 37 mm+/−2 mm, or may be in the range of 20 to 70 mm, towards the rear 126 from the striking face measured in the Y-axis 16 direction, and the front end portion 408 of rib 404 can be located approximately 43 mm+/−2 mm, or may be in the range of 20 to 70 mm, towards the rear 126 from the striking face measured along the Y-axis 16.

As depicted in embodiments shown in FIGS. 21-26D, 27-33, 36-37F, and 38-39C, each rib 402, 404 also has an internal side 411, 413 and an external side 415, 417 and a width defined there between. The width of the ribs 402, 404 can affect the strength and weight of the golf club. As shown in FIG. 26A the ribs 402, 404 can have a thinner width portion 422 throughout the majority, or center portion, of the rib. The thinner width portion 422 of the rib can be approximately 1.0 mm+/−0.2 mm, or may be in the range of approximately 0.5 to 5.0 mm and can be substantially similar throughout the entire rib. The ribs 402, 404 can also include a thicker width portion 424. The thicker width portion 424 can be near the front end portions 406, 408, rear end portions 410, 412, upper portions 414, 416, or lower portions 418, 420. As depicted in FIGS. 9E and 11C, the ribs 402, 404 include a thicker width portion 424 over part of the front end portions 406, 408, part of the rear end portions 410, 412, and the lower portions 418, 420. The thicker width portion 424 can be disposed substantially on the internal sides 411, 413 of the ribs 402, 404. In other embodiments the thicker width portion can be distributed equally or unequally on the internal sides 411, 413 and the external sides 415, 417, or substantially on the external sides 415, 417. The thickness of the thicker width portion can be approximately 3.0 mm+/−0.2 mm or may be in the range of approximately 1 to 10 mm. The width of the thicker portion 424 can be approximately 2 to 3 times the width of the thinner portion 422. As shown in FIG. 32 the ribs 402, 404 can have a substantially similar width throughout the rib that can be approximately 2.1 mm+/−0.2 mm, or may be in the range of approximately 0.5 to 5.0 mm and can be substantially similar throughout the entire rib.

Each rib 402, 404 also has a maximum height defined by the distance between the upper portions 414, 416 and the lower portions 418, 420 measured along the ribs 402, 404 in the Z-axis 18 direction. A maximum height of the ribs 402, 404 of FIGS. 21-26D may be in the range of approximately 5 to 30 mm. A maximum height of the ribs 402, 404 of FIGS. 27-33 may be in the range of approximately 5 to 30 mm. Additionally, each rib 402, 404 also has a maximum length, defined by the distance between the front end portions 406, 408 and rear end portions 410, 412 measured along the ribs 402, 404 in the plane defined by the X-axis 14 and the Y-axis 16. The length of the rib 402 of FIGS. 21-26D can be approximately 39 mm+/−2 mm or may be in the range of approximately 10 to 60 mm. The length of the rib 404 of FIGS. 21-26D can be approximately 43 mm+/−2 mm or may be in the range of approximately 10 to 60 mm. The length of the rib 402 of FIGS. 27-33 can be approximately 24 mm+/−2 mm or may be in the range of approximately 10 to 50 mm. The length of the rib 404 of FIGS. 27-33 can be approximately 27 mm+/−2 mm or may be in the range of approximately 10 to 50 mm.

Figure 26A:
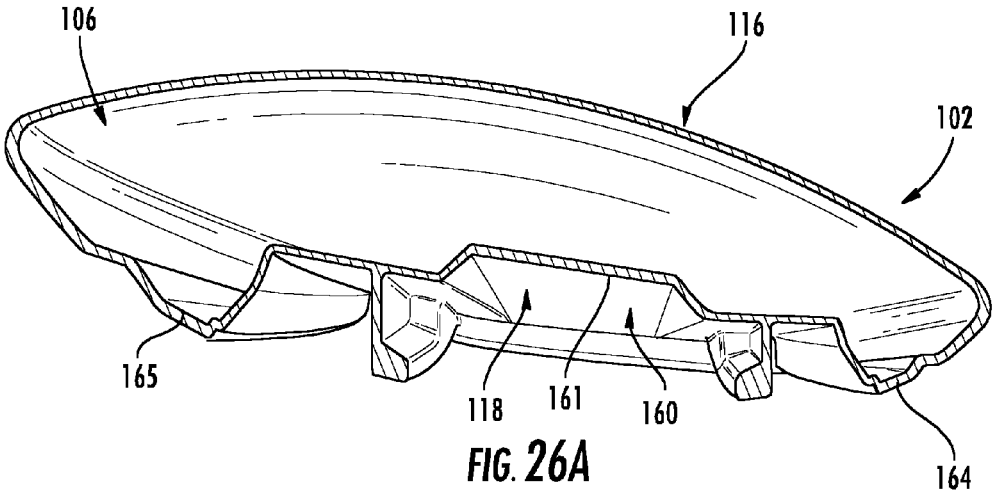
FIG. 26A is a front perspective view of the club head of FIG. 24, with a portion removed to show internal detail.
Figure 26B:
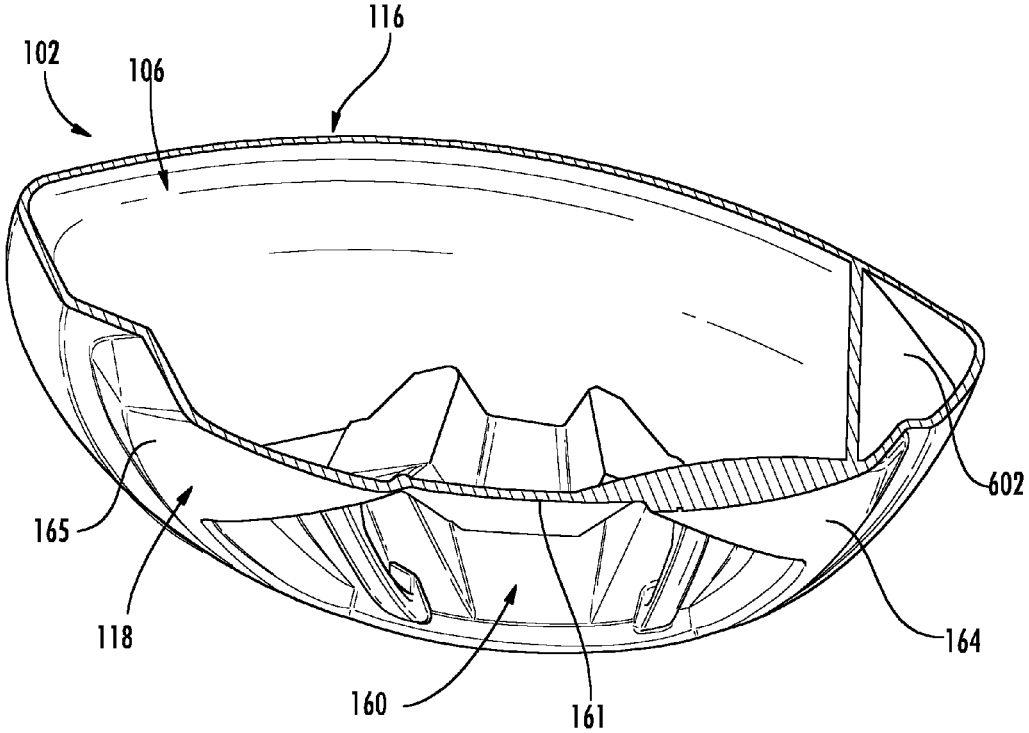
FIG. 26B is a front perspective view of the club head of FIG. 24, with a portion removed to show internal detail.
Figure 26C:
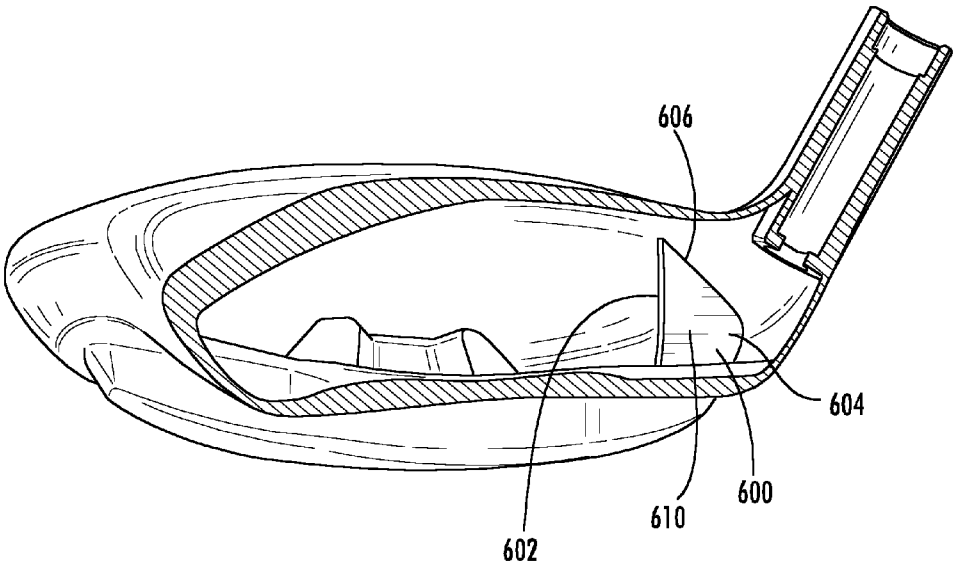
FIG. 26C is a front perspective view of the club head of FIG. 24, with a portion removed to show internal detail.
Figure 26D:
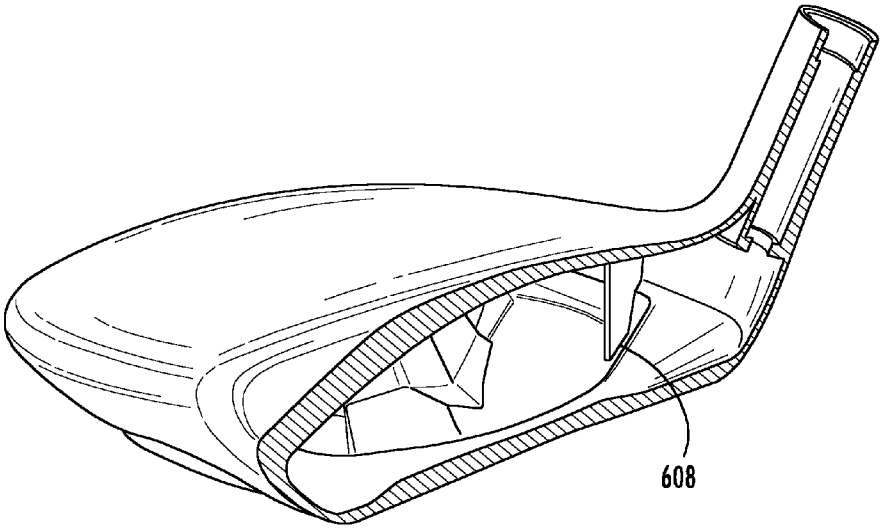
FIG. 26D is a front perspective view of the club head of FIG. 24, with a portion removed to show internal detail.
Figure 27:
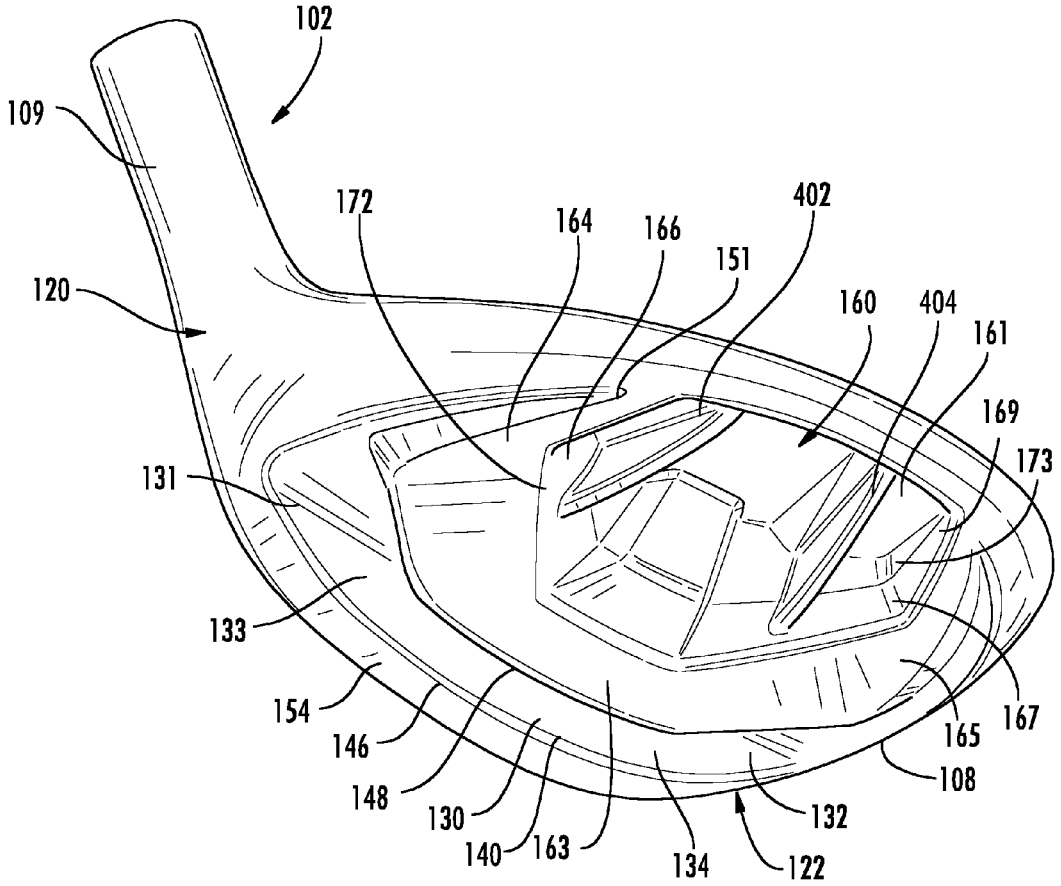
FIG. 27 is a bottom left perspective view of another embodiment of a golf club head according to aspects of the disclosure, in the form of a hybrid golf club head.
Figure 28:
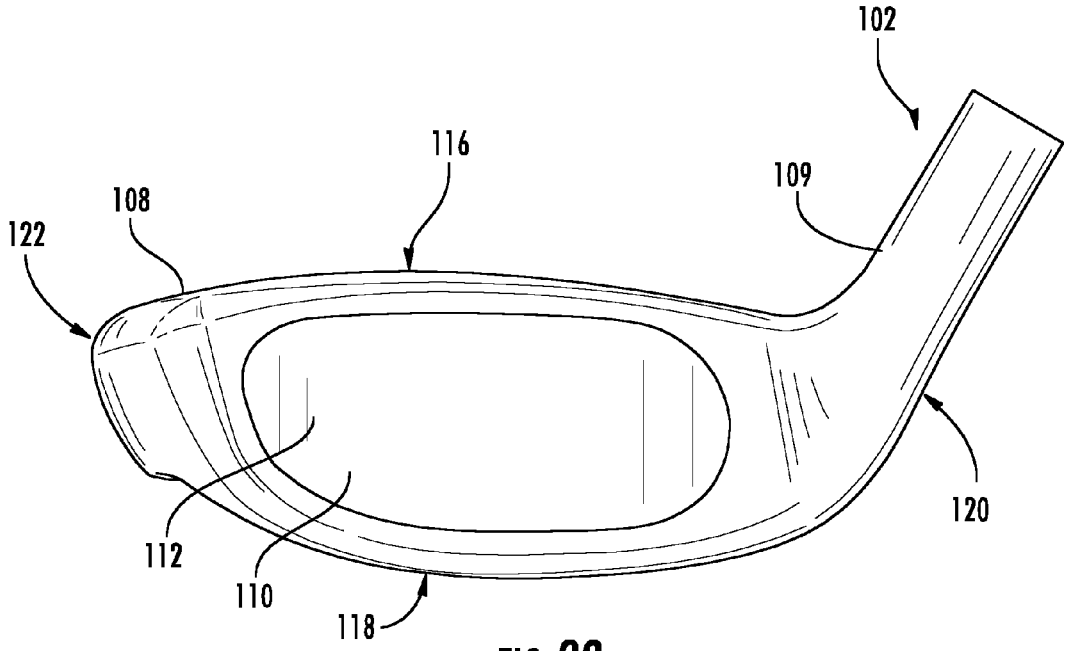
FIG. 28 is a front view of the club head of FIG. 27.
Figure 29:
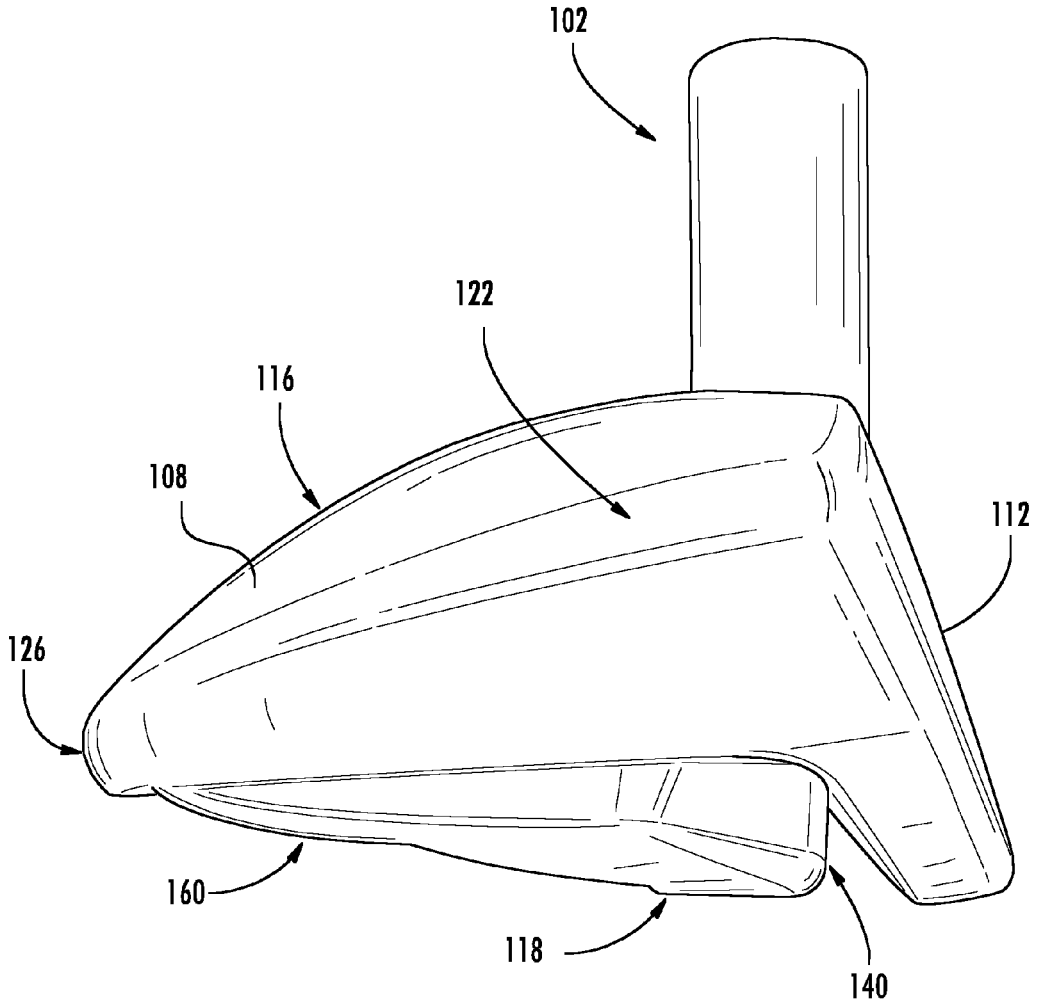
FIG. 29 is a side view of the club head of FIG. 27.

As show in FIGS. 26B-26D, golf club heads can include other rib structures. For example as shown in FIGS. 26B-26D the club can include an internal corner rib 600 that can connect to the interior of the club near the hosel. As shown in FIGS. 26B-26D, the rib 600 can connect to an interior side of the sole 118, an interior side of the crown 116 and an interior portion of the rear edge 148 of the channel 140. In other embodiments the rib 600 can connect only to an interior side of the sole 118, and/or an interior side of the crown 116, and/or an interior portion of the rear edge 148 of the channel 140.

Rib 600 has a front end portion 602 toward the front 124 of the body 108 extending to the edge of the rib, and a rear end portion 604 toward the rear 126 of the body 108 extending to the edge of the rib. The front end portion 602, as shown in FIGS. 26B-26D can be curved, generally forming a concave curved shape. In other embodiments the front end portion 602 can have a convex curved shape, straight shape, or any other shape. The rib 600 also includes an upper portion 606 extending to the edge of the rib and a lower portion 608 extending to the edge of the rib.

Rib 600 also includes a front side 610 and a back side 612 and a width defined there between. The width that can affect the strength and weight of the golf club. The rib 600 can have a substantially constant width of approximately 0.8 mm+/−0.1 mm or may be in the range of approximately 0.5 to 5.0 mm, or can have a variable width. In some embodiments, for example, rib 600 can have a thinner width portion throughout the majority, or center portion, of the rib, and can have a thicker width portion can be near the front end portions 602, rear end portion 604, upper portion 606, or lower portions 608 or any other part of the rib. The width of the thicker portion can be approximately 2 to 3 times the width of the thinner portion.

The rib 600 also has a maximum height defined by the maximum distance between the upper portions 606 and lower portion 608 measured along the rib measured along the Z-axis 18 direction. The maximum height rib 600 can be approximately 25 mm+/−3 mm or may be in the range of approximately 5 to 40 mm. Additionally, the rib 600 also has a maximum length, defined as the maximum distance between the front end portion 602 and the rear end portion 604 measured along the rib in the plane created by the X-axis 14 and the Y Axis. The maximum length of rib 482 can be approximately 20.5 mm+/−2 mm or may be in the range of approximately 0 to 30 mm.

While only a single corner rib is shown in FIGS. 26B-26D, any number of ribs can be included on the golf club. It is understood that the ribs may extend at different lengths, widths, heights, and angles and have different shapes to achieve different weight distribution and performance characteristics. Additionally, while corner rib 600 has been described in relation to the embodiment disclosed in FIGS. 26B-26D, it is understood that any rib configuration can apply to any other portion of any embodiment described herein.

The corner rib 600 may be formed of a single, integrally formed piece, e.g., by casting with the sole 118. Such an integral piece may further include other components of the body 108, such as the entire sole 118 (including the channel 140) or the entire club head body 108. In other embodiments the rib 600 can be connected to the crown 116 and/or sole 118 by welding or other integral joining technique to form a single piece.

As shown in FIGS. 37D-37F, the club head 102 can also include lower internal ribs 650, 652. The ribs can connect to the interior side of the sole 118, and interior portions of the first and second walls 166, 167. Lower internal ribs 650, 652 can be generally parallel with one another and aligned in a generally vertical plane that is perpendicular to the striking face 112, or the ribs can extend in an angle that is not perpendicular to the striking face 112. In other configurations, the lower internal ribs 650, 652 can be angled with respect to a vertical plane and angled with respect to each other.

The ribs 650, 652 can be located anywhere in the heel-toe direction. For example, ribs 650, 652 can be equally or unequally spaced in the heel-toe direction from the center of gravity or from the face center. In one embodiment, rib 650 can be located approximately 2 mm+/−2 mm or may be in the range of approximately 0 to 20 mm towards the heel 120 from the face center location 40 measured along the X-axis 14; and rib 652 can be located approximately 15 mm+/−2 mm or may be in the range of approximately 0 to 30 mm towards the toe 122 from the face center location 40 measured along the X-axis 14.

Each of the ribs 650, 652 have front end portions 654, 656 towards the front 124 of the body 108 extending to the edge of the rib, and rear end portions 658, 660 towards the rear 126 of the body 108 extending to the edge of the rib which can connect to the first and second walls 166, 167 extending to the edge of the rib. The lower internal ribs 650, 652 can also include upper portions 662, 664 extending to the edge of the rib and lower portions 668, 670 extending to the edge of the rib which can connect to the sole 118. As shown in FIGS. 37D-37F the upper portions 662, 664 can be substantially straight. In other embodiments, the upper portions 662, 664 can be curved or can have any other shape.

As described above with regard to other ribs, ribs 650, 652 can have a width that is variable or substantially constant. The ribs 650, 652 can have a substantially constant width of approximately 0.9 mm+/−0.2 mm or may be in the range of approximately 0.5 to 5.0 mm Each rib 650, 652 also has a maximum height defined by the maximum distance between the upper portions 662, 664 and lower portions 668, 670 measured along the rib in the Z-axis 18 direction. The maximum height of rib 650 can be approximately 15 mm+/−2 mm or may be in the range of approximately 5 to 30 mm, and the maximum height of rib 652 can be approximately 12 mm+/−2 or may be in the range of approximately 5 to 30 mm. Additionally, each rib 650, 652 also has a maximum length defined as the maximum distance between the front end portions 654, 656 and the rear end portions 658, 660, measured along the rib in the Y-axis 16 direction. The maximum length of rib 650 can be approximately 33 mm+/−2 mm or may be in the range of approximately 10 to 50 mm, and the maximum length of rib 652 can be approximately 27 mm+/−2 mm or may be in the range of approximately 10 to 50 mm.

The lower internal ribs 650, 652 may be formed of a single, integrally formed piece, e.g., by casting with the sole 118. Such an integral piece may further include other components of the body 108, such as the entire sole 118 (including the channel 140) or the entire club head body 108. In other embodiments the ribs 650, 652 can be connected to the sole 118 by welding or other integral joining technique to form a single piece.

Stiffness/Cross-Sectional Area Moment of Inertia of Club Head

As discussed above, the structural ribs discussed herein can affect the stiffness or cross-sectional area moment of inertia of the club head 102 which can in some embodiments affect the impact efficiency. The cross-sectional area moment of inertia with respect to the X-axis shown parallel to the ground plane in the FIG. 9C can be an indicator of the golf club head body's stiffness with respect to a force created from an impact with a golf ball on the striking face or the corresponding moment created when a golf ball is struck above or below the center of gravity of the club head. Similarly, the cross-sectional area moment of inertia with respect to the Z-axis shown perpendicular to the ground plane in FIG. 9C can be an indicator of the golf club head body's stiffness with respect to the force created from the impact with the golf ball or the corresponding moment created when a golf ball is struck on either the toe or heel side of the center of gravity. The two-dimensional cross-sectional area moments of inertia, (Ix-x and Iz-z), with respect to both a horizontal X-axis and a vertical Z-axis can easily be calculated using CAD software with either a CAD generated model of the club head or a model generated by a digitized scan of both the exterior and interior surfaces of an actual club head. Furthermore, CAD software can also generate a cross-sectional area, A, of any desired cross-section. The cross-sectional area can give an indication of the amount of weight generated by the cross-section since it is the composite of the all of a club head's cross-sections that determine the overall mass of the golf club. Using these cross-sectional area moments of inertia in conjunction with the modulus of elasticity of the material, E, the flexural rigidity of the structure at that cross-section can be calculated by multiplying the modulus of the material by the corresponding cross-sectional inertia value, (E*I).

For example, for the embodiment shown in FIG. 1A, a cross-section of the club shown in FIG. 9C can be taken approximately 25 mm from the forward most edge of the striking face in a plane parallel to the plane created by the X-axis 14 and Z-axis 18. The cross-sectional area moment of inertia at the center of gravity of the cross-section can be estimated with and without internal ribs 480 and 482. For example, the cross-sectional area moment of inertia with respect to the X-axis Ix-x at the cross section can be approximately 764,000 $mm^4$ with ribs 480 and 482 and approximately 751,000 $mm^4$ without ribs 480 and 482. Additionally, the cross-sectional area moment of inertia around the Z-axis Iz-z at the cross-section can be approximately 383,000 $mm^4$ with ribs 480 and 482 and approximately 374,000 $mm^4$ without ribs 480, 482.

Figure 9A:
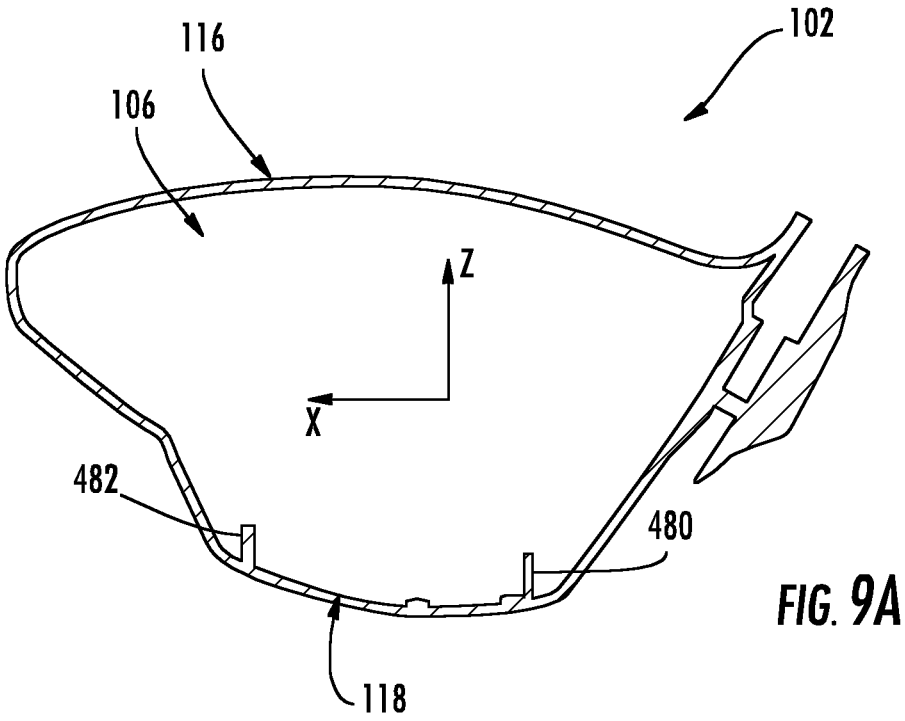
FIG. 9A is a cross-section view taken along line 9A-9A of FIG. 8.
Figure 9B:
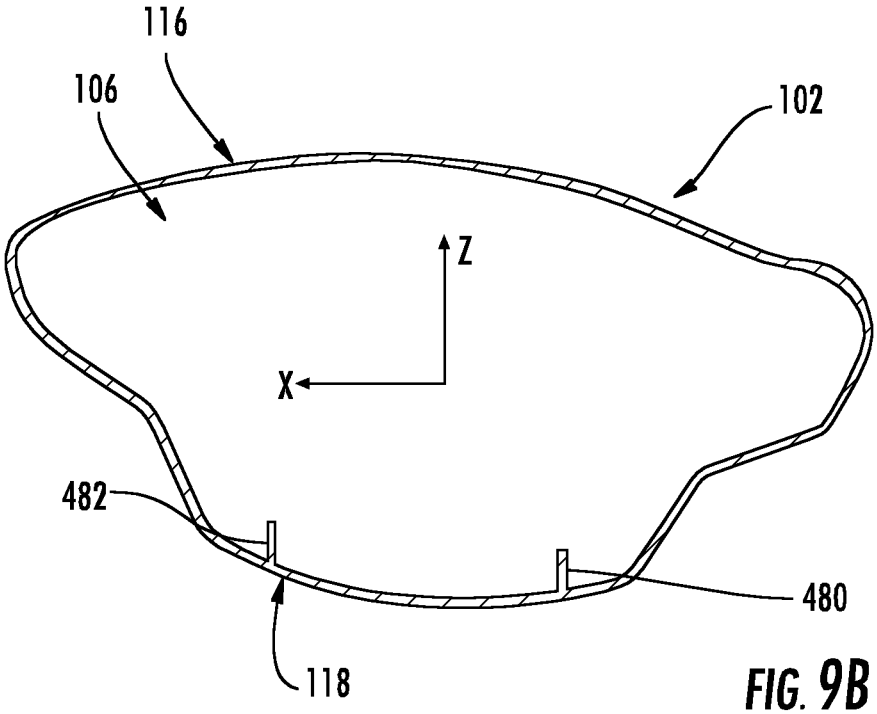
FIG. 9B is a cross-section view taken along line 9B-9B of FIG. 8.
Figure 9C:
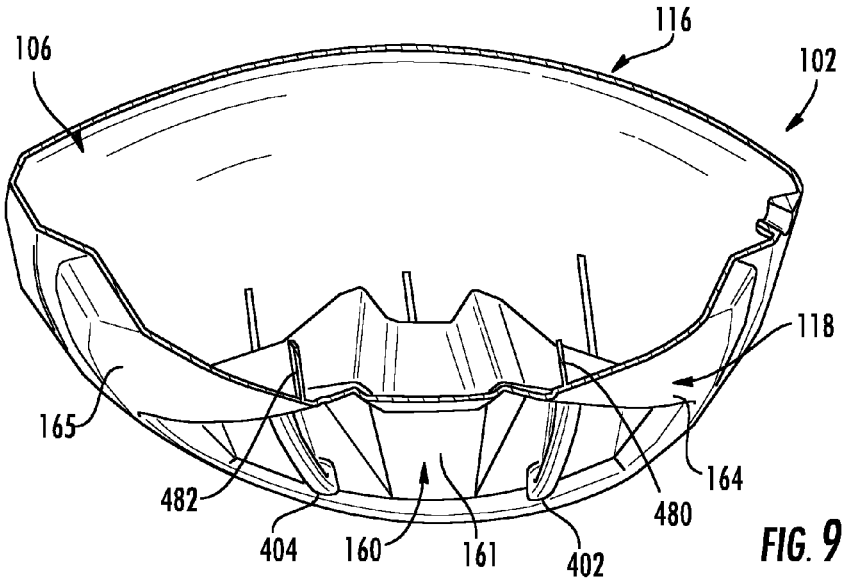
FIG. 9C is a cross-section view taken along line 9C-9C of FIG. 8.

Further, for the club head 102 of the embodiment shown in FIG. 1A, a cross-section of the club shown in FIG. 9B, in the plane created by the X-axis 14 and Z-axis 18, can be taken at approximately 25% of the head breadth dimension measured from the forward most edge of the golf club face. The cross-sectional area moment of inertia at the center of gravity of the cross-section can be estimated with and without internal ribs 480 and 482. For example, the cross-sectional area moment of inertia with respect to the X-axis, Ix-x at the cross section can be approximately 139,000 $mm^4$ with ribs 480 and 482 and approximately 131,000 $mm^4$ without ribs 480 and 482. Additionally, the cross-sectional area moment of inertia with respect to the Z-axis, Iz-z at the cross-section can be approximately 375,000 $mm^4$ with ribs 480 and 482 and approximately 370,000 $mm^4$ without ribs 480 and 482.

The impact of the ribs can be expressed as the ratio of the cross-sectional area moment of inertia divided by its corresponding cross-sectional area, A, which can give an indication of the increased stiffness relative to the mass added by the ribs. Again using the club head 102 shown in FIG. 1A, the ratio of the cross-sectional area moment of inertia relative to the cross-sectional area can be calculated such that Ix-x divided by the area A with and without the ribs giving a ratio of 1.02:1 $mm^2$. The ratio of the cross-sectional inertia with respect to the X-axis divided by the corresponding cross-sectional area with and without the ribs may be 1.0:1 to 1.05:1, while the ratio of corresponding cross-sectional inertia with respect to the Z-axis divided by the cross-sectional area with and without the ribs may be 0.9:1 to 1:1. The ratio of cross-sectional area moment of inertia Ix-x with and without external ribs is greater than a ratio of cross-sectional area moment of inertia the Iz-z with and without external ribs.

Figure 9D:
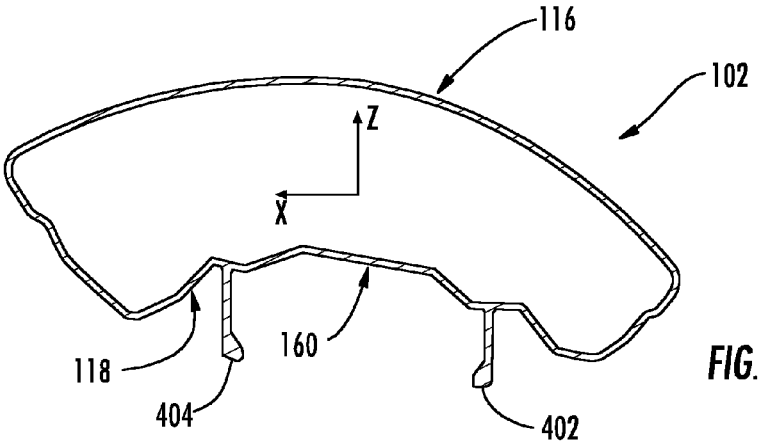
FIG. 9D is an area cross-section view taken along line 9D-9D of FIG. 8.
Figure 9E:
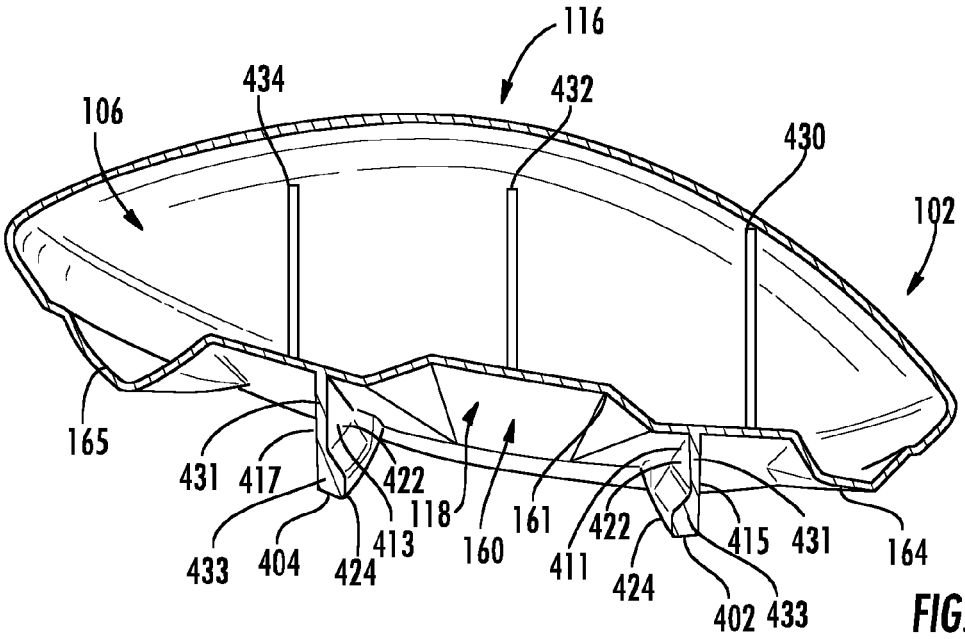
FIG. 9E is an area cross-section view taken along line 9E-9E of FIG. 8.

Further, for the club head 102 of the embodiment shown in FIG. 1A, a cross-section of the club shown in FIG. 9D, in the plane created by the X-axis 14 and Z-axis 18, can be taken at approximately 60% of the head breadth dimension measured from the forward most edge of the golf club face. The cross-sectional area moment of inertia at the center of gravity of the cross-section can be estimated with and without ribs 402 and 404. For example, the cross-sectional area moment of inertia with respect to the X-axis, Ix-x, at the cross section can be approximately 61,500 $mm^4$ with ribs 402 and 404 and approximately 44,500 $mm^4$ without ribs 402 and 404. Additionally, the cross-sectional area moment of inertia with respect to the Z-axis, Iz-z, at the cross-section can be approximately 267,000 $mm^4$ with ribs 402 and 404 and approximately 243,000 $mm^4$ without ribs 402 and 404.

Figure 9F:
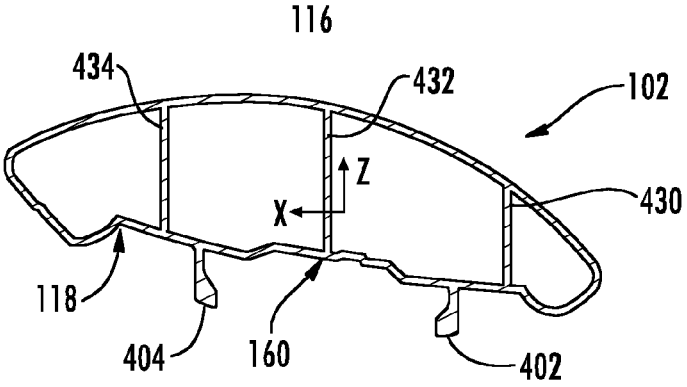
FIG. 9F is an area cross-section view taken along line 9F-9F of FIG. 8.

In addition, for the club head 102 of the embodiment shown in FIG. 1A, a cross-section of the club shown in FIG. 9F, in the plane created by the X-axis 14 and Z-axis 18, can be taken at approximately 80% of the head breadth dimension measured from the forward most edge of the golf club face. The cross-sectional area moment of inertia at the center of gravity of the cross-section can be estimated with and without external ribs 402 and 404, as well with and without internal ribs 430, 432, and 434. For example, the cross-sectional area moment of inertia with respect to the X-axis Ix-x at the cross section can be approximately 26,600 $mm^4$ with external ribs 402, 404 and internal ribs 430, 432, and 434 and approximately 17,200 $mm^4$ without ribs 402, 404, 430, 432, and 434. Additionally, the cross-sectional area moment of inertia with respect to the Z-axis Iz-z at the cross-section can be approximately 156,000 $mm^4$ with ribs 402, 404, 430, 432, and 434 and approximately 122,000 $mm^4$ without ribs 402, 404, 430, 432, and 434.

As evidenced in Table 3A below, the effect of the ribs on the stiffness of aft body may be expressed by ratios of the cross-sectional area moment of inertia measurements at 60% and 80% of the head breadth dimension. For example, for the driver embodiment of club head 102 shown in FIG. 1A at a cross-section taken approximately 60% of the head breadth dimension, the external ribs contribute to a ratio of Ix-x with the ribs to Ix-x without the ribs of 1.39:1 and an Iz-z with the ribs to Iz-z without the ribs of 1.10:1. The impact of the ribs can be expressed as the ratio of the cross-sectional area moment of inertia divided by its corresponding cross-sectional area, A, which can give an indication of the increased stiffness relative to the mass added by the ribs. Again using the club head 102 shown in FIG. 1A, the ratio of the cross-sectional area moment of inertia relative to the cross-sectional area can be calculated such that Ix-x divided by the area A with and without the ribs giving a ratio of 1.11:1 $mm^2$. In other similar driver embodiments, the cross-sectional area moment of inertia ratio at a location of approximately 60% of the head breadth dimension with respect to the X-axis with and without the ribs ratio may be 1.2:1 to 1.5:1, while the corresponding ratio of the cross-sectional inertia in the with respect to the Z-axis with and without the ribs ratio may be 1:1 to 1.3:1. The ratio of the cross-sectional inertia with respect to the X-axis divided by the corresponding cross-sectional area with and without the ribs may be 1:1 to 1.2:1, while the ratio of corresponding cross-sectional inertia with respect to the Z-axis divided by the cross-sectional area with and without the ribs may be 0.8:1 to 1:1. The ratio of cross-sectional area moment of inertia Ix-x with and without external ribs is greater than a ratio of cross-sectional area moment of inertia the Iz-z with and without external ribs.

To further show this effect, for the driver embodiment of club head 102 of FIG. 1A, the cross-section taken at 80% of the head breadth dimension, the ratio of the Ix-x with the external and internal ribs compared to the Ix-x without the ribs is 1.55:1, while the Iz-z with the external and internal ribs compared to the Iz-z without the ribs is 1.28:1. This can have a significant impact on the overall stiffness of the structure. In other similar driver embodiments, this cross-sectional inertia at a location of approximately 80% of the head breadth with respect to the X-axis with and without the ribs ratio may be 1.3:1 to 1.7:1, while the corresponding ratio of the cross-sectional inertia with respect to the Z-axis with and without the ribs ratio may be 1.1:1 to 1.4:1. The ratio of the cross-sectional inertia with respect to the X-axis divided by the corresponding cross-sectional area with and without the ribs may be 0.9:1 to 1.2:1, while the ratio of corresponding cross-sectional inertia with respect to the Z-axis divided by the cross-sectional area with and without the ribs may be 0.7:1 to 1:1. The ratio of cross-sectional area moment of inertia Ix-x with and without the internal and external ribs is greater than a ratio of cross-sectional area moment of inertia the Iz-z with and without the internal and external ribs.

Another aspect of the rib structure for the embodiment shown in FIGS. 1A and 35 is its impact on the overall sound and feel of the golf club head. The internal and external rib structures 402, 404, 430, 432, 434, 480, and 482 in the club head 102 of the embodiment shown FIG. 1A can create a more rigid overall structure, which produces a higher pitch sound when the club head strikes a golf ball. For example, the rib structure can enable the first natural frequency of the golf club head to increase from approximately 2200 Hz to over 3400 Hz, while limiting the increase in weight to less than 10 grams. A golf club head having a first natural frequency lower than 3000 Hz can create a sound that is not pleasing to golfers.

Additionally, the rib structure of the embodiment shown in FIGS. 1A and 35 may create a stiffer a rear portion of the golf club head than the forward portion of the golf club head. The rib structure may enable the golf club head to have a mode shape or Eigenvector of its first natural frequency to be located near the channel 140 away from crown of the golf club as is typical of most modern golf club heads. Thus, the mode shape of the club head's first natural frequency may be located on the sole within a dimension of approximately 25% of the club head breadth when measured in a direction parallel to the Y-axis 16 from the forward most edge of the golf club head.

Figure 24:
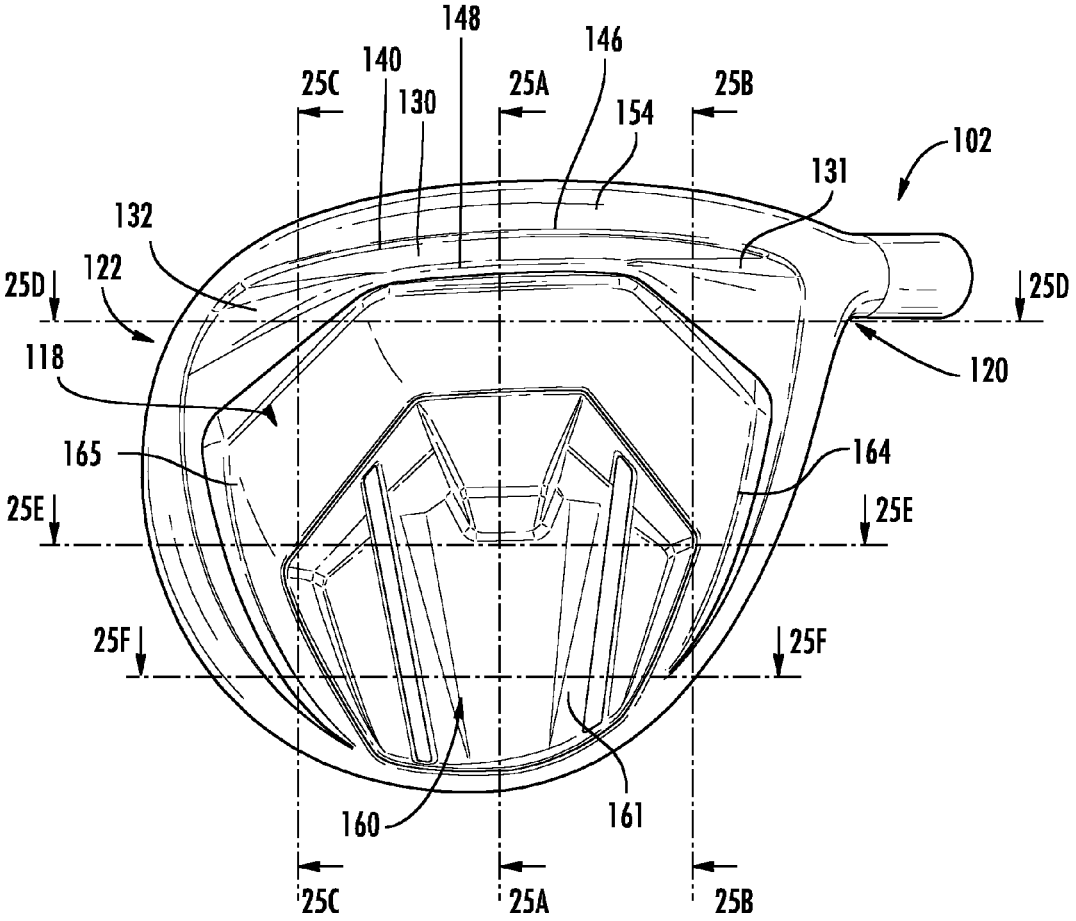
FIG. 24 is a bottom view of the club head of FIG. 21.

As illustrated in FIG. 24, the structural ribs discussed herein can affect the stiffness or cross-sectional area moment of inertia of the club head 102 which can in some embodiments affect the impact efficiency. The thickness of certain parts of the golf club can also have a similar effect. The thickened sole portion 125 can help to improve the structural stiffness of the structure behind the channel region. For example, for the fairway wood club head embodiment shown in FIG. 24, a cross-section of the club shown in FIG. 25D can be taken at approximately 20% of the club head breadth dimension measured from the forward most edge of the golf club in a plane parallel to the plane created by the X-axis 14 and Z-axis 18. The cross-sectional area moment of inertia with respect to the X and Z axes can be an indicator of the golf club head body's stiffness. The cross-sectional area moment of inertia at the center of gravity of the cross-section can be estimated. For example, the cross-sectional area moment of inertia with respect to the X-axis Ix-x at the cross section can be approximately 56,000 $mm^4$ with thickness 125. Additionally, the cross-sectional area moment of inertia with respect to the Z-axis, Iz-z, at the cross-section can be approximately 197,000 $mm^4$.

Alternatively the sole 118 behind the channel may have a combination of a thickened section and ribs. For example, for the fairway wood club head embodiment shown in FIG. 36, a cross-section of the club shown in FIG. 37A can be taken at approximately one-third or 32% of the club head breadth dimension measured from the forward most edge of the golf club in a plane parallel to the plane created by the X-axis 14 and Z-axis 18. FIG. 37A shows a combination of both a thickened section 125 and ribs 650 and 652. The cross-sectional area moment of inertia at the center of gravity of the cross-section with respect to the X-axis Ix-x at the cross section can be approximately 54,300 $mm^4$ with the thickened region and ribs and approximately 53,500 $mm^4$ without the thickened region and ribs. Additionally, the cross-sectional area moment of inertia with respect to the Z-axis, Iz-z, at the cross-section can be approximately 216,650 $mm^4$ with the thickened region and ribs and approximately 216,300 $mm^4$ without the thickened region and ribs.

The ratio of Ix-x with the internal ribs 650, 652 and thickened region 125 compared to the Ix-x without the ribs and thickened region at approximately 32% of the club head breadth dimension measured from the forward most edge of the golf club in a plane parallel to the plane created by the X-axis 14 and Z-axis 18 can be 1.02:1 and the Iz-z with the external ribs compared to the Iz-z without the ribs is 1.0:1. The ratios of the inertias relative to the cross-sectional areas are 1.0:1 and 0.98:1 respectively. The ratio of the cross-sectional inertia with respect to the X-axis divided by the corresponding cross-sectional area with and without the ribs may be 1.0:1 to 1.1:1, while the ratio of corresponding cross-sectional inertia with respect to the Z-axis divided by the cross-sectional area with and without the ribs may be 0.95:1 to 1.05:1.

Figure 25A:
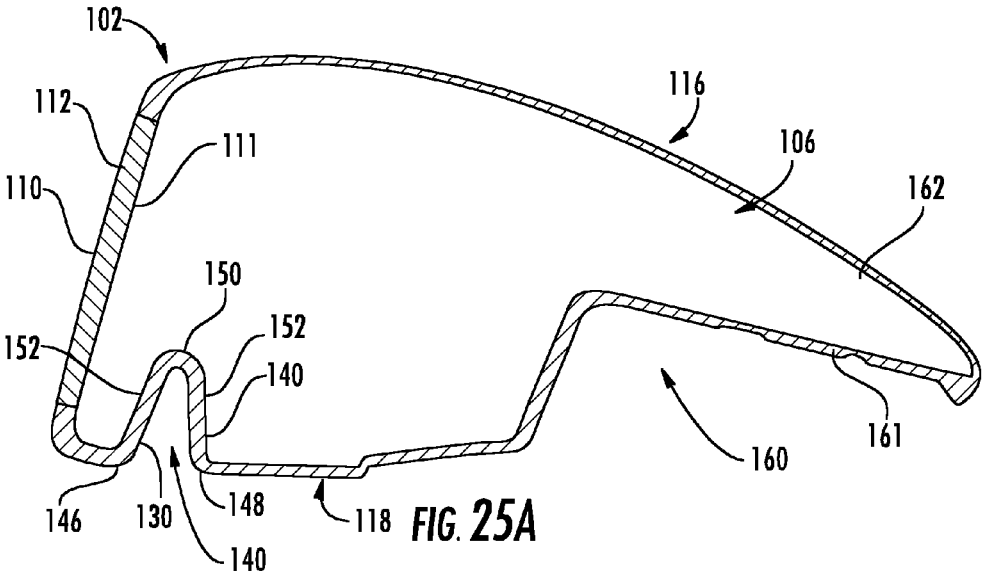
FIG. 25A is a cross-section view taken along line 25A-25A of FIG. 24.
Figure 25B:
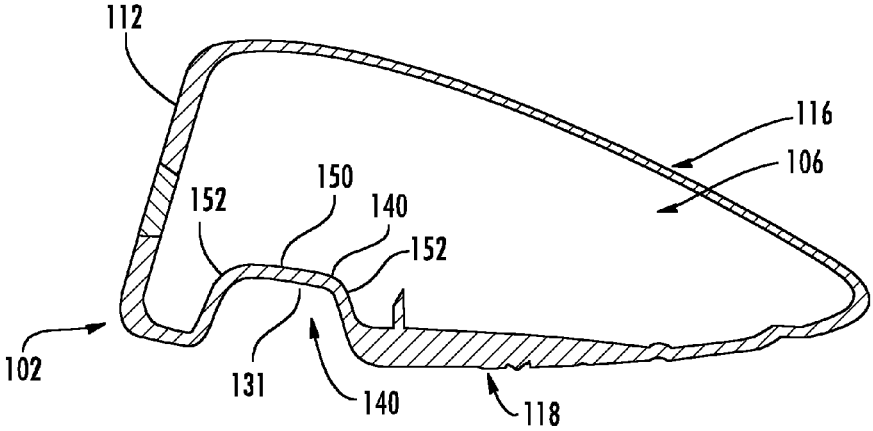
FIG. 25B is a cross-section view taken along line 25B-25B of FIG. 24.
Figure 25C:
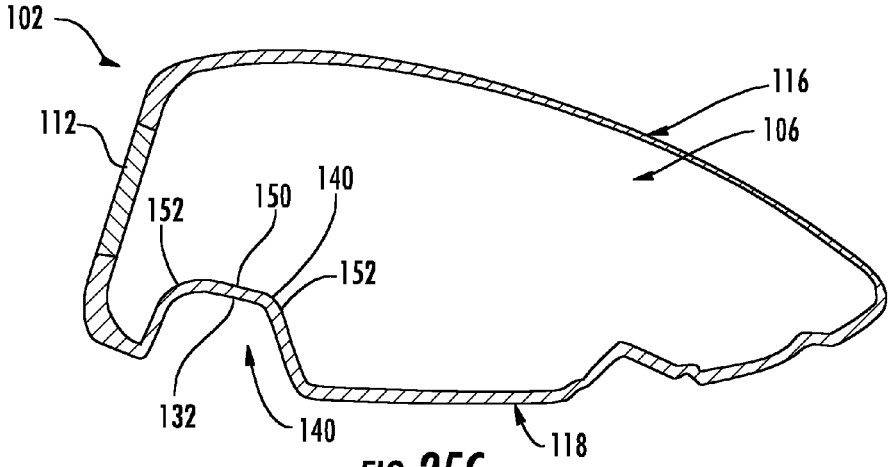
FIG. 25C is a cross-section view taken along line 25C-25C of FIG. 24.
Figure 25D:
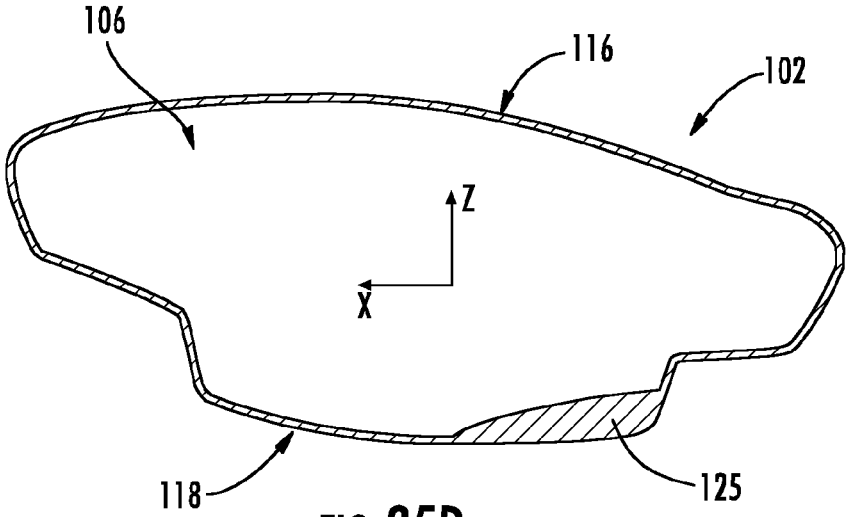
FIG. 25D is an area cross-section view taken along line 25D-25D of FIG. 24.
Figure 25E:
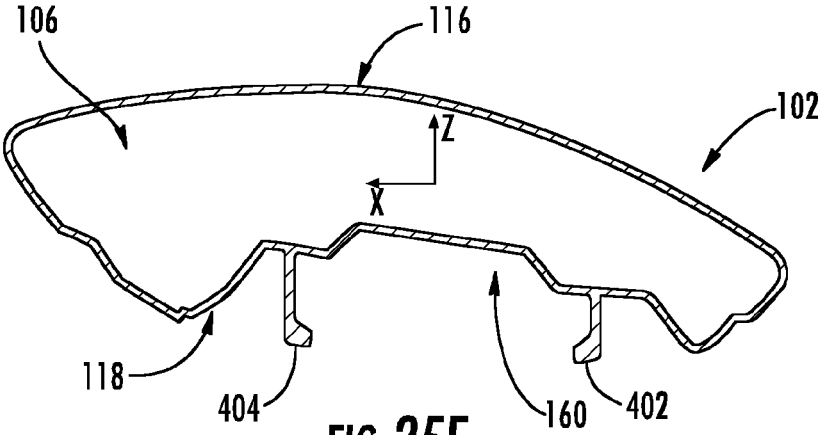
FIG. 25E is an area cross-section view taken along line 25E-25E of FIG. 24.

Additionally, for example, for the fairway wood club head embodiment shown in FIG. 24, a cross-section of the club shown in FIG. 25E can be taken at approximately 60% of the club head breadth dimension measured from the forward most edge of the golf club in a plane parallel to the plane created by the X-axis 14 and Z-axis 18. The cross-sectional area moment of inertia with respect to the X and Z axes can be an indicator of the golf club head body's stiffness. The cross-sectional area moment of inertia at the center of gravity of the cross-section can be estimated with and without ribs 402 and 404. For example, the cross-sectional area moment of inertia with respect to the X-axis Ix-x at the cross section can be approximately 18,000 $mm^4$ with ribs 402 and 404, and approximately 14,300 $mm^4$ without ribs 402 and 404. Additionally, the cross-sectional area moment of inertia with respect to the Z-axis, Iz-z, at the cross-section can be approximately 140,000 $mm^4$ with ribs 402 and 404, and approximately 132,000 $mm^4$ without ribs 402 and 404.

Figure 25F:
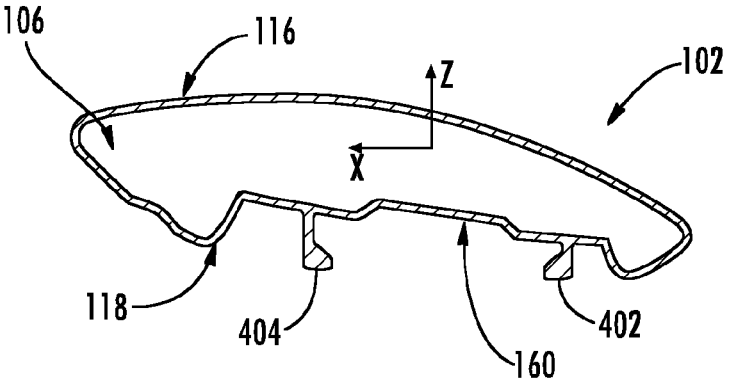
FIG. 25F is an area cross-section view taken along line 25F-25F of FIG. 24.

Similarly, for the embodiment shown in FIG. 24, a cross-section of the club shown in FIG. 25F can be taken at approximately 80% of the club head breadth dimension from the forward most edge of the golf club in a plane parallel to the plane created by the X-axis 14 and Z-axis 18. The cross-sectional area moment of inertia at the center of gravity of the cross-section can be estimated with and without external ribs 402 and 404. For example, the cross-sectional area moment of inertia with respect to the X-axis Ix-x at the cross section can be approximately 6,750 $mm^4$ with external ribs 402 and 404 and approximately 5,350 $mm^4$ without ribs 402 and 404. Additionally, the cross-sectional area moment of inertia with respect to the Z-axis Iz-z at the cross-section can be approximately 70,400 $mm^4$ with ribs 402 and 404 and approximately 65,700 $mm^4$ without ribs 402 and 404.

In addition, for the fairway wood club head 102 of the embodiment shown in FIG. 36, a cross-section of the club shown in FIG. 37B can be taken at approximately 60% of the club head breadth dimension from the forward most edge of the golf club in a plane parallel to the plane created by the X-axis 14 and Z-axis 18. The cross-sectional area moment of inertia at the center of gravity of the cross-section can be estimated with and without ribs 402 and 404. For example, the cross-sectional area moment of inertia with respect to the X-axis, Ix-x, at the cross section can be approximately 21,600 $mm^4$ with ribs 402 and 404 and approximately 19,300 $mm^4$ without ribs 402 and 404. Additionally, the cross-sectional area moment of inertia with respect to the Z-axis, Iz-z, at the cross-section can be approximately 146,000 $mm^4$ with ribs 402 and 404 and approximately 142,000 $mm^4$ without ribs 402 and 404.

Likewise, for the embodiment shown in FIG. 36, a cross-section of the club shown in FIG. 37C can be taken at approximately 80% of the club head breadth dimension from the forward most edge of the golf club in a plane parallel to the plane created by the X-axis 14 and Z-axis 18. The cross-sectional area moment of inertia at the center of gravity of the cross-section can be estimated with and without external ribs 402 and 404. For example, the cross-sectional area moment of inertia with respect to the X-axis Ix-x at the cross section can be approximately 8,100 $mm^4$ with external ribs 402 and 404 and approximately 7,100 $mm^4$ without ribs 402 and 404. Additionally, the cross-sectional area moment of inertia with respect to the Z-axis Iz-z at the cross-section can be approximately 71,500 $mm^4$ with ribs 402 and 404, and approximately 69,000 $mm^4$ without ribs 402 and 404.

Further looking at the ratios for the fairway wood embodiment of club head 102 of FIGS. 21-26D, for a cross-section taken at a location approximately 60% of the head breadth dimension, the ratio of Ix-x with the external ribs compared to the Ix-x without the ribs is 1.26:1 and the Iz-z with the external ribs compared to the Iz-z without the ribs is 1.06:1. The ratio of the cross-sectional inertias with respect to the x and z axes divided by its corresponding cross-sectional area, A, are 1.09:1 and 0.92:1 respectively. For the fairway wood embodiment club head 102 of FIGS. 36-37F, for a cross-section taken at 60% of the head breadth dimension, the ratio of Ix-x with the external ribs compared to the Ix-x without the ribs to be 1.12:1 and the Iz-z with the external ribs compared to the Iz-z without the ribs is 1.03:1. Additionally, the ratios of the cross-sectional inertias with respect to the x and z axes divided by its corresponding cross-sectional areas are 1.02:1 and 0.94:1 respectively. In other similar fairway wood embodiments, the cross-sectional inertia ratio at a location of approximately 60% of the head breadth dimension with respect to the X-axis with and without the ribs ratio may be 1.05:1 to 1.35:1, while the corresponding ratio of the cross-sectional inertia with respect to the Z-axis with and without the ribs ratio may be 1.0:1 to 1.3:1. The ratio of the cross-sectional inertia with respect to the X-axis divided by the corresponding cross-sectional area with and without the ribs may be 1.0:1 to 1.2:1, while the ratio of corresponding cross-sectional inertia with respect to the Z-axis divided by the cross-sectional area with and without the ribs may be 0.8:1 to 1:1.

For the fairway wood embodiment of club head 102 of FIG. 21-26D, the cross-section taken at 80% of the head breadth dimension, the ratio of Ix-x with the external ribs compared to the Ix-x without the ribs is 1.26:1 and the Iz-z with the external ribs compared to the Iz-z without the ribs is 1.06:1. The ratios of the inertias relative to the cross-sectional areas are 1.10:1 and 0.93:1 respectively. Similarly for another fairway wood embodiment of club head 102 of FIGS. 36-37F, the ratio of Ix-x with the external ribs compared to the Ix-x without the ribs to be 1.14:1 and the Iz-z with the external ribs compared to the Iz-z without the ribs is 1.04:1. The ratios of the inertias relative to the cross-sectional areas are 1.02:1 and 0.93:1 respectively. In other similar fairway wood embodiments, the cross-sectional inertia ratio at a location of approximately 80% of the head breadth dimension with respect to the X-axis with and without the ribs ratio may be 1.05:1 to 1.35:1, while the corresponding ratio of the cross-sectional inertia with respect to the Z-axis with and without the ribs ratio may be 1.0:1 to 1.3:1. The ratio of the cross-sectional inertia with respect to the X-axis divided by the corresponding cross-sectional area with and without the ribs may be 1.0:1 to 1.2:1, while the ratio of corresponding cross-sectional inertia with respect to the Z-axis divided by the cross-sectional area with and without the ribs may be 0.85:1 to 1.05:1.

As discussed above, the structural ribs discussed herein can affect the stiffness or cross-sectional area moment of inertia of the club head 102 which can in some embodiments affect the impact efficiency. The thickness of certain parts of the golf club can also have a similar effect. For example, as shown in FIGS. 31A-31C the sole of the golf club can be thicker behind the channel which can increase stiffness or cross-sectional area moment of inertia of the striking head 102. For example, for the hybrid golf club head embodiment shown in FIG. 27 can be taken approximately 20 mm behind the striking face in a plane parallel to the plane created by the X-axis 14 and Z-axis 18. The thickened sole portion 125 can help to improve the structural stiffness of the structure behind the channel region. The cross-sectional area moment of inertia can be estimated with and without the thickened sole portion. The cross-sectional area moment of inertia can be estimated with and without the thickened sole portion. For example, the cross-sectional area moment of inertia with respect to the X-axis (parallel to the ground plane), Ix-x, at the cross section can be approximately 175,000 $mm^4$ with the thickened sole portion and approximately 132,000 $mm^4$ without the thickened sole portion. Additionally, for example, the cross-sectional area moment of inertia in the Z-axis (perpendicular to the ground plane), Iz-z, at the cross-section can be approximately 742,000 $mm^4$ with the thickened sole portion and approximately 689,000 $mm^4$ without the thickened sole portion.

Figure 31A:
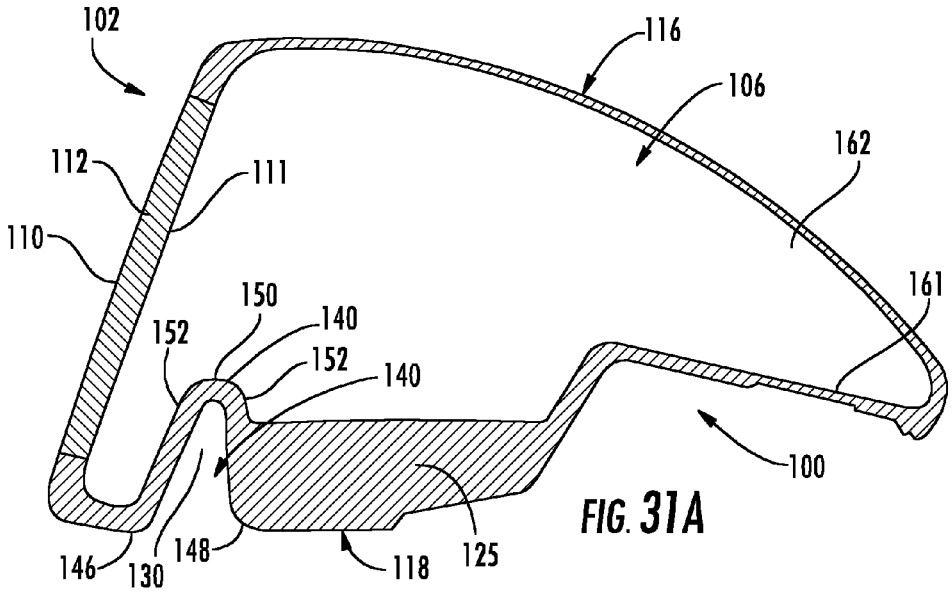
FIG. 31A is a cross-section view taken along line 31A-31A of FIG. 30.
Figure 31B:
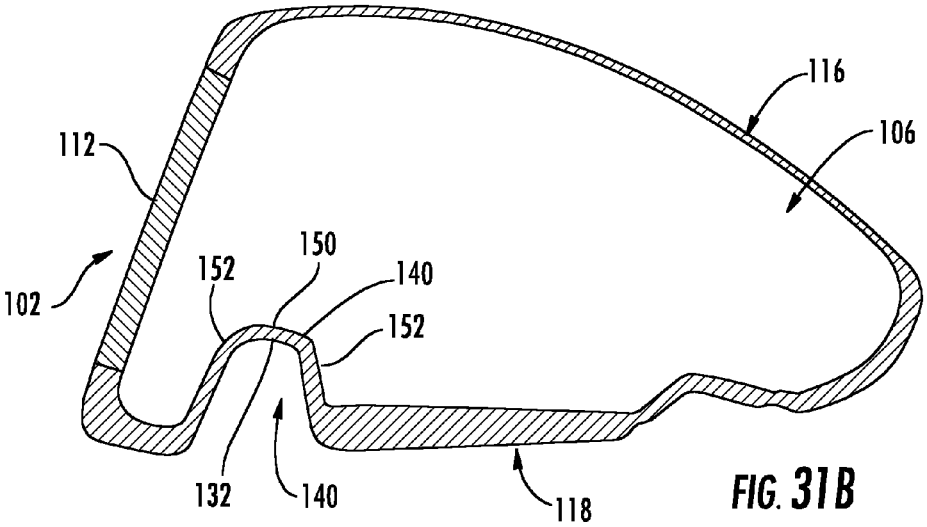
FIG. 31B is a cross-section view taken along line 31B-31B of FIG. 30.
Figure 31C:
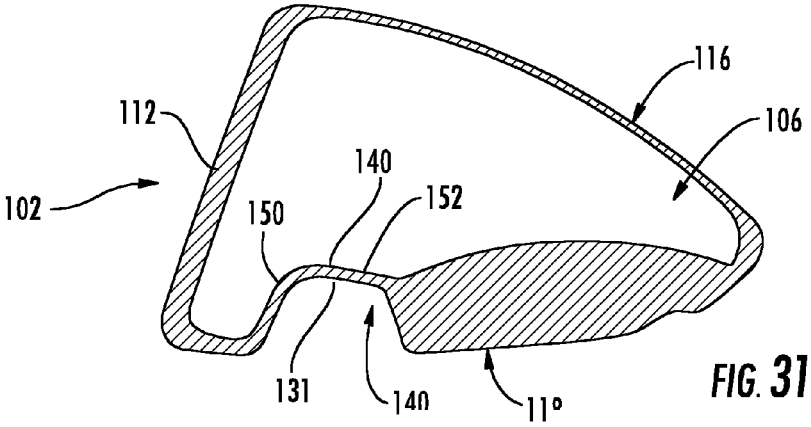
FIG. 31C is a cross-section view taken along line 31C-31C of FIG. 30.
Figure 31D:
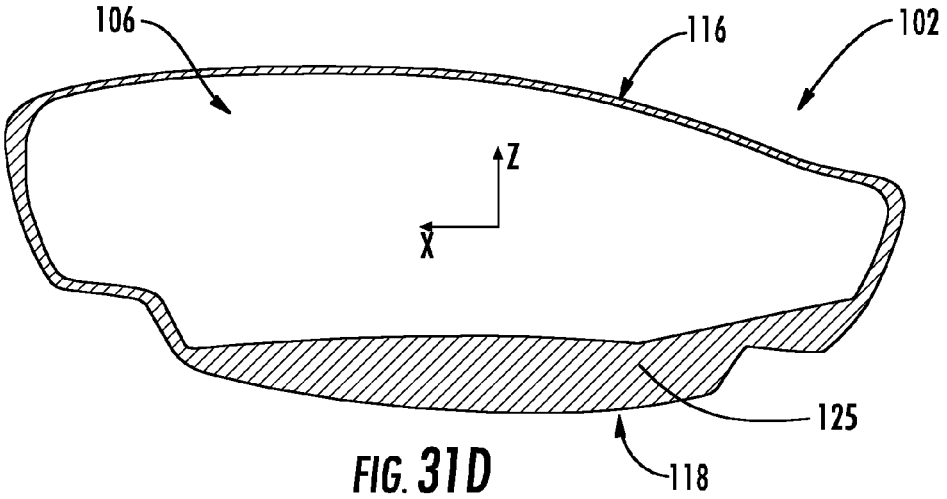
FIG. 31D is an area cross-section view taken along line 31D-31D of FIG. 30.
Figure 32:
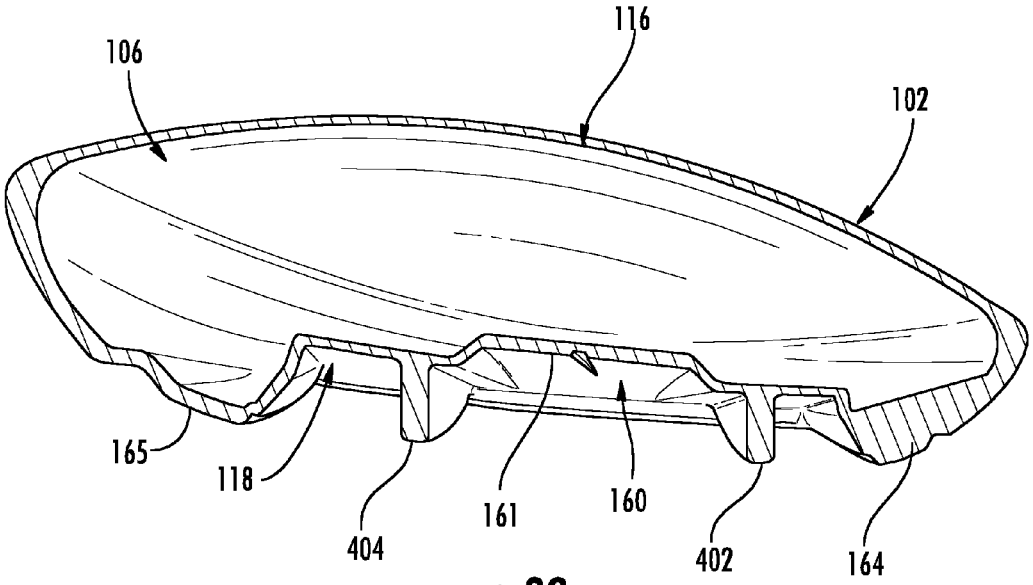
FIG. 32 is a front perspective view of the club head of FIG. 27, with a portion removed to show internal detail.
Figure 33:
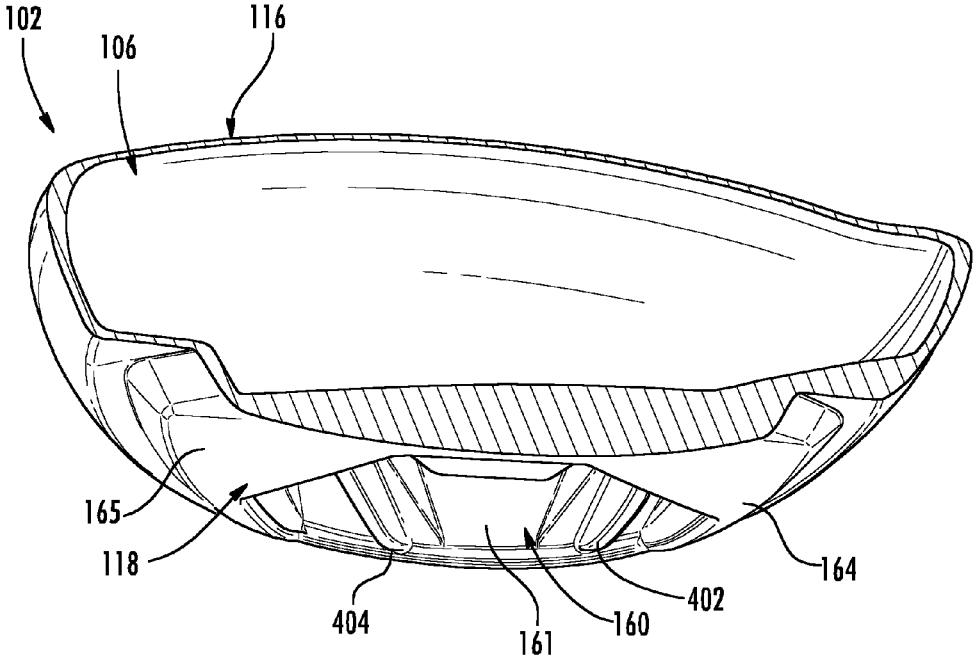
FIG. 33 is a front perspective view of the club head of FIG. 27, with a portion removed to show internal detail.

For club head 102 of a hybrid golf club head embodiment shown in FIG. 27, a cross-section of the club shown in FIG. 31D can be taken at approximately 35% of the head breadth dimension from the forward most edge of the golf club head in a plane parallel to the plane created by the X-axis 14 and Z-axis 18. The cross-sectional area moment of inertia with respect to the X-axis (parallel to the ground plane), Ix-x, at the cross section can be approximately 60,800 $mm^4$ and the cross-sectional area moment of inertia in the Z-axis (perpendicular to the ground plane), Iz-z, at the cross-section can be approximately 347,500 $mm^4$ with the thickened sole portion.

As an alternative embodiment for club head 102 of a hybrid golf club head embodiment shown in FIG. 38, a cross-section of the club shown in FIG. 39A can be taken at approximately 40% of the head breadth dimension from the forward most edge of the golf club head in a plane parallel to the plane created by the X-axis 14 and Z-axis 18. The cross-sectional area moment of inertia with respect to the X-axis (parallel to the ground plane), Ix-x, at the cross section can be approximately 49,600 $mm^4$ with the thickened sole portion and approximately 33,400 $mm^4$ without the thickened sole portion. Additionally, for example, the cross-sectional area moment of inertia in the Z-axis (perpendicular to the ground plane), Iz-z, at the cross-section can be approximately 272,500 $mm^4$ with the thickened sole portion and approximately 191,000 $mm^4$ without the thickened sole portion.

Figure 30:
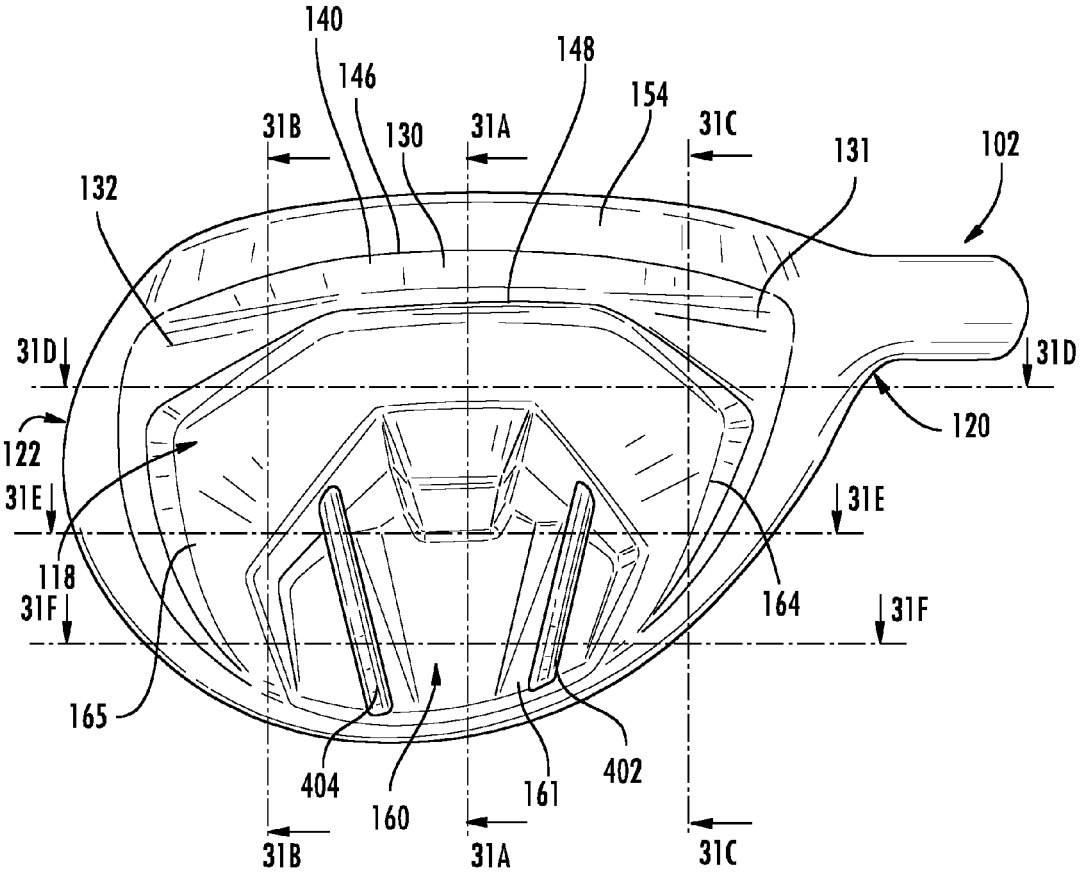
FIG. 30 is a bottom view of the club head of FIG. 27.
Figure 31E:
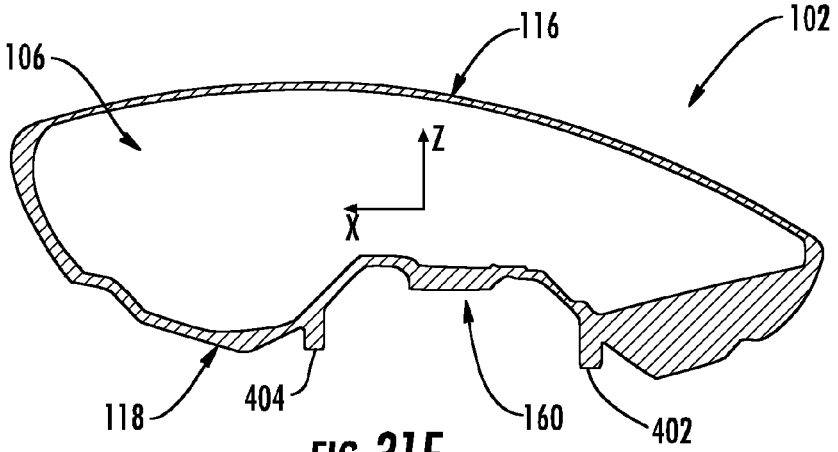
FIG. 31E is an area cross-section view taken along line 31E-31E of FIG. 30.

Furthermore, the hybrid club head 102 of the embodiment shown in FIG. 30, a cross-section of the club can be taken at approximately 60% of the club head breadth dimension from the forward most edge of the golf club shown in FIG. 31E in a plane parallel to the plane created by the X-axis 14 and Z-axis 18. The cross-sectional area moment of inertia at the center of gravity of the cross-section can be estimated with and without ribs 402 and 404. For example, the cross-sectional area moment of inertia with respect to the X-axis Ix-x at the cross section can be approximately 28,600 $mm^4$ with ribs 402 and 404 and approximately 27,600 $mm^4$ without ribs. Additionally, the cross-sectional area moment of inertia with respect to the Z-axis, Iz-z, at the cross-section can be approximately 251,000 $mm^4$ with ribs 402 and 404, and approximately 248,000 $mm^4$ without ribs 402 and 404.

Figure 31F:
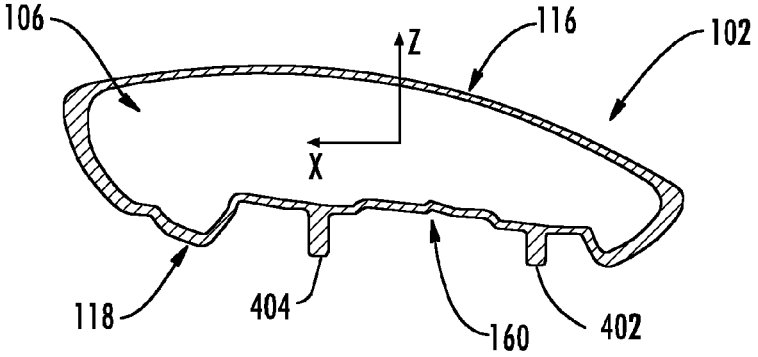
FIG. 31F is an area cross-section view taken along line 31F-31F of FIG. 30.

Also, for the embodiment shown in FIG. 30, a cross-section of the club shown in FIG. 31F, in the plane created by the X-axis 14 and Z-axis 18, can be taken at approximately 80% of the club head breadth dimension from the forward most edge of the golf club. The cross-sectional area moment of inertia at the center of gravity of the cross-section can be estimated with and without external ribs 402 and 404. For example, the cross-sectional area moment of inertia with respect to the X-axis Ix-x at the cross section can be approximately 8,000 $mm^4$ with external ribs 402 and 404 and approximately 7,000 $mm^4$ without ribs 402 and 404. Additionally, for example, the cross-sectional area moment of inertia with respect to the Z-axis Iz-z at the cross-section can be approximately 78,000 $mm^4$ with ribs 402 and 404, and approximately 75,500 $mm^4$ without ribs 402 and 404.

In addition, for the hybrid club head embodiment shown in FIG. 38, a cross-section of the club shown in FIG. 39B can be taken at approximately 60% of the club head breadth dimension from the forward most edge of the golf club in a plane parallel to the plane created by the X-axis 14 and Z-axis 18. The cross-sectional area moment of inertia at the center of gravity of the cross-section can be estimated with and without ribs 402 and 404. For example, the cross-sectional area moment of inertia with respect to the X-axis Ix-x at the cross section can be approximately 26,500 $mm^4$ with ribs 402 and 404 and approximately 25,800 $mm^4$ without ribs 402 and 404. Additionally, the cross-sectional area moment of inertia with respect to the Z-axis Iz-z at the cross-section can be approximately 224,000 $mm^4$ with ribs 402 and 404, and approximately 221,000 $mm^4$ without ribs 402 and 404.

Furthermore, for the embodiment shown in FIG. 38, a cross-section of the club shown in FIG. 39C can be taken at approximately 80% of the club head breadth dimension from the forward most edge of the golf club in a plane parallel to the plane created by the X-axis 14 and Z-axis 18. The cross-sectional area moment of inertia at the center of gravity of the cross-section can be estimated with and without external ribs 402 and 404. For example, the cross-sectional area moment of inertia with respect to the X-axis, Ix-x, at the cross section can be approximately 7,900 $mm^4$ with external ribs 402, 404, and approximately 7,200 $mm^4$ without ribs 402 and 404. Additionally, the cross-sectional area moment of inertia with respect to the Z-axis Iz-z at the cross-section can be approximately 101,000 $mm^4$ with ribs 402 and 404, and approximately 97,300 $mm^4$ without ribs 402 and 404.

For the hybrid embodiments of FIGS. 27-33, section taken at 60% of the head breadth, the ratio of Ix-x with the external ribs compared to the Ix-x without the ribs to be 1.04:1 and the Iz-z with the external ribs compared to the Iz-z without the ribs is 1.01:1. Additionally, the ratios of the inertias relative to the cross-sectional areas are 1.00:1 and 0.97:1 respectively. For the hybrid embodiments of FIGS. 38-39C, section taken at 60% of the head breadth, the ratio of Ix-x with the external ribs compared to the Ix-x without the ribs to be 1.03:1 and the Iz-z with the external ribs compared to the Iz-z without the ribs is 1.01:1. Additionally, the ratios of the inertias relative to the cross-sectional areas are 0.99:1 and 0.98:1 respectively. In other hybrid embodiments, the cross-sectional inertia ratio at a location of approximately 60% of the head breadth dimension with respect to the X-axis with and without the ribs ratio may be 1:1 to 1.25:1, while the corresponding ratio of the cross-sectional inertia with respect to the Z-axis with and without the ribs ratio may be 1:1 to 1.2:1. The ratio of the cross-sectional inertia with respect to the X-axis divided by the corresponding cross-sectional area with and without the ribs may be 1:1 to 1.2:1, while the ratio of corresponding cross-sectional inertia with respect to the Z-axis divided by the cross-sectional area with and without the ribs may be 0.8:1 to 1:1.

For an embodiment of the hybrid embodiment of golf club 102 shown in FIGS. 27-33, for a cross-section taken at 80% of the head breadth dimension, the ratio of Ix-x with the external ribs compared to the Ix-x without the ribs is 1.14:1 and the Iz-z with the external ribs compared to the Iz-z without the ribs is 1.03:1. The ratios of the inertias relative to the cross-sectional areas are 1.05:1 and 0.94:1 respectively. For the hybrid embodiments of FIGS. 38-39C, section taken at 80% of the head breadth dimension, the ratio of Ix-x with the external ribs compared to the Ix-x without the ribs is 1.10:1 and the Iz-z with the external ribs compared to the Iz-z without the ribs is 1.04:1. The ratios of the inertias relative to the cross-sectional areas are 0.97:1 and 0.94:1 respectively. In other hybrid embodiments, the cross-sectional inertia ratio at a location of approximately 80% of the head breadth dimension with respect to the X-axis with and without the ribs ratio may be 1:1 to 1.25:1, while the corresponding ratio of the cross-sectional inertia with respect to the Z-axis with and without the ribs ratio may be 1:1 to 1.2:1. The ratio of the cross-sectional inertia with respect to the X-axis divided by the corresponding cross-sectional area with and without the ribs may be 1:1 to 1.2:1, while the ratio of corresponding cross-sectional inertia with respect to the Z-axis divided by the cross-sectional area with and without the ribs may be 0.8:1 to 1:1.

The various structural dimensions, relationships, ratios, etc., described herein for various components of the club heads 102 in FIGS. 1-39C may be at least partially related to the materials of the club heads 102 and the properties of such materials, such as tensile strength, ductility, toughness, etc., in some embodiments. Accordingly, it is noted that the heads 102 in FIGS. 1-13, 14-20, and 34A-35 may be manufactured having some or all of the structural properties described herein, with a face 112 made from a Ti-6Al-4V alloy with a yield strength of approximately 1000 MPa, an ultimate tensile strength of approximately 1055 MPa, and an elastic modulus, E, of approximately 114 GPa and a density of 4.43 g/cc. and a body 108 made from a Ti-8Al-1Mo-1V alloy with a yield strength of approximately 760 MPa, an ultimate tensile strength of approximately 820 MPa, and an elastic modulus, E, of approximately 121 GPa and a density of 4.37 g/cc. Alternatively, the face could be made from a higher strength titanium alloy such as Ti-15V-3Al-3Cr-3Sn and Ti-20V-4V-1Al which can exhibit a higher yield strength and ultimate tensile strength while having a lower modulus of elasticity than Ti-6Al-4V alloy of approximately 100 GPa. Additionally, the face could be made from a higher strength titanium alloy, such as SP700, (Ti-4.5Al-3V-2Fe-2Mo) which can have a higher yield strength and ultimate tensile strength while having a similar modulus of elasticity of 115 GPa. It is also noted that the heads 102 in FIGS. 21-26D, 27-33, and 36-39C may be manufactured having some or all of the structural properties described herein, with a face 112 and a body 108 both made from 17-4PH stainless steel having an elastic modulus, E, of approximately 197 GPa, with the face 112 being heat treated to achieve a yield strength of approximately 1200 MPa and the body 108 being heat treated to achieve a yield strength of approximately 1140 MPa. In other embodiments, part or all of each head 102 may be made from different materials, and it is understood that changes in structure of the head 102 may be made to complement a change in materials and vice/versa.

The specific embodiments of drivers, fairway woods, and hybrid club heads in the following tables utilize the materials described in this paragraph, and it is understood that these embodiments are examples, and that other structural embodiments may exist, including those described herein. Table 1 provides a summary of data as described above for club head channel dimensional relationships for the driver illustrated in FIGS. 1-13 and corresponding fairway and hybrids. Table 2 provides a summary of data as described above for club head channel dimensional relationships for the driver illustrated in FIGS. 14-20 and corresponding fairway and hybrids. Table 3A provides a summary of data as described above for the stiffness/cross-sectional moment of inertia for the driver illustrated in FIGS. 1-13. Table 3B provides a summary of data as described above for the stiffness/cross-sectional moment of inertia for the fairway woods illustrated in FIGS. 21-26D and 36-37F. Table 3C provides a summary of data as described above for the stiffness/cross-sectional moment of inertia for the hybrid club heads illustrated in FIGS. 27-3 and 38-39C.

TABLE 1

Club Head Channel Dimensional Relationships for Driver #1/Fairway Wood/Hybrid

| Club Head Characteristic/ Parameters | Driver FIGS. 1-13 | Fairway Woods (config. 1) | Hybrids (config. 1) |
|---|---|---|---|
| Face Height | | | |
| Height | 50-72 mm (59.9 mm) | 28-40 mm (35-37 mm) | 28-40 mm (34-35 mm) |
| Channel | | | |
| Width (Center) | 8.5-9.5 mm (9.0 mm) | 8.5-9.5 mm (9.0 mm) | 7.5-8.5 mm (8.0 mm) |
| Depth (Center) | 2.0-3.0 mm (2.5 mm) | 8.5-9.5 mm (9.0 mm) | 7.5-8.5 mm (8.0 mm) |
| Channel Rearward Spacing | 8.5 mm | 7.0 mm | 8.0 mm |
| Channel Wall Thickness | | | |
| Center | 1.0-1.2 mm (1.1 mm) | 1.5-1.7 mm (1.6 mm) | 1.5-1.7 mm (1.6 mm) |
| Heel | 0.6-0.8 mm (0.7 mm) | 0.85-1.05 mm (0.95 mm) | 0.9-1.1 mm (1.0 mm) |
| Toe | 0.6-0.8 mm (0.7 mm) | 0.85-1.05 mm (0.95 mm) | 0.9-1.1 mm (1.0 mm) |
| Ratios (expressed as X:1) | | | |
| Face Width: Channel Length | 2.5-3.5 | 1.5-2.5 | 1.5-2.5 |
| Channel Width (Center):Channel Wall Thickness | 8-10 | 5-6.5 | 4.5-5.5 |
| Channel Width (Center):Channel Depth (Center) | 3.5-4.5 | 0.8-1.2 | 0.8-1.2 |
| Channel Depth (Center):Channel Wall Thickness | 2-2.5 | 5-6.5 | 4.5-5.5 |
| Channel Length: Channel Width (Center) | 3-4 | 4-4.5 | 4.5-5 |
| Face Height:Channel Width (Center) | 6-7.5 | 3.5-5 | 3.5-4.5 |
| Face Height:Channel Depth (Center) | 23-25 | 3.5-5 | 3.5-4.5 |
| Face Height:Channel Wall Thickness | 52-57 | 20-25 | 20-25 |
| Channel Spacing Ratios (expressed as X:1) | | | |
| Face Height: Channel Spacing | 12-13 | 4.5-5.5 | 3.5-4.5 |
| Channel Spacing: Channel Width (Center) | 0.5-1.0 | 0.6-0.9 | 0.8-1.2 |
| Channel Spacing: Channel Depth (Center) | 1.5-2.5 | 0.6-0.9 | 0.8-1.2 |
| Channel Spacing: Wall Thickness | 3.5-4.0 | 4.0-4.5 | 4.75-5.25 |

TABLE 2

Club Head Channel Dimensional Relationships for Driver #2/Fairway Wood/Hybrid

| Club Head Characteristic/ Parameters | Driver FIGS. 14-20 | Fairway Woods (config. 2) | Hybrids (config. 2) |
|---|---|---|---|
| Face (F) | | | |
| Height | 45-65 mm (55.5 mm) | 28-40 mm (35-37 mm) | 28-40 mm (34-35 mm) |
| Channel | | | |
| Width (Center) | 8.5-9.5 mm (9.0 mm) | 8.5-9.5 mm (9.0 mm) | 7.5-8.5 mm (8.0 mm) |
| Depth (Center) | 2.0-3.0 mm (2.5 mm) | 8.5-9.5 mm (9.0 mm) | 7.5-8.5 mm (8.0 mm) |
| Channel Rearward Spacing | 7.0 mm | 9.0 mm | 6.0 mm |
| Channel Wall Thickness | | | |
| Center | 1.1-1.3 mm (1.2 mm) | 1.5-1.7 mm (1.6 mm) | 1.5-1.7 mm (1.6 mm) |
| Heel | 0.6-0.8 mm (0.7 mm) | 0.85-1.05 mm (0.95 mm) | 0.9-1.1 mm (1.0 mm) |
| Toe | 0.6-0.8 mm (0.7 mm) | 0.85-1.05 mm (0.95 mm) | 0.9-1.1 mm (1.0 mm) |
| Ratios | | | |
| Face Width:Channel LE Length | 2.5-3.5 | 1.5-2.5 | 1.5-2.5 |
| Channel Width (Center):Channel Wall Thickness | 7.5-9.5 | 5-6.5 | 4.5-5.5 |
| Channel Width (Center):Channel Depth (Center) | 3.5-4.5 | 0.8-1.2 | 0.8-1.2 |
| Channel Depth (Center):Channel Wall Thickness | 1.5-2.5 | 5-6.5 | 4.5-5.5 |
| Channel Length: Channel Width (Center) | 3-4 | 4-4.5 | 4.5-5 |
| Face Height:Channel Width (Center) | 5.5-6.5 | 3.5-5 | 3.5-4.5 |

TABLE 2-continued

| Club Head Channel Dimensional Relationships for Driver #2/Fairway Wood/Hybrid | | | |
|---|---|---|---|
| Club Head Characteristic/ Parameters | Driver FIGS. 14-20 | Fairway Woods (config. 2) | Hybrids (config. 2) |
| Face Height:Channel Depth (Center) | 20-25 | 3.5-5 | 3.5-4.5 |
| Face Height:Channel Wall Thickness | 41-51 | 20-25 | 20-25 |
| Channel Spacing Ratios | | | |
| Face Height:Channel Spacing | 12-13 | 3.5-4.5 | 5.0-6.0 |
| Channel Spacing: Channel Width (Center) | 0.5-1.0 | 0.85-1.15 | 0.5-0.9 |
| Channel Spacing: Channel Depth (Center) | 1.5-2.5 | 0.85-1.15 | 0.5-0.9 |
| Channel Spacing: Wall Thickness | 3.5-4.0 | 5.5-6.0 | 3.5-4.0 |

TABLE 3A

| Stiffness/Cross-Sectional Moment of Inertia for Driver #1 (FIGS. 1-13) | | | | |
|---|---|---|---|---|
| | With Ribs 60% of Breadth | Without Ribs 60% of Breadth | With Ribs 80% of Breadth | Without rib 80% of Breadth |
| Driver of FIGS. 1-13 | | | | |
| Ix-x ($mm^4$) | 61,800 | 44,500 | 26,600 | 17,200 |
| Iz-z ($mm^4$) | 267,000 | 243,000 | 156,000 | 122,000 |
| Area ($mm^2$) | 245 | 196 | 237 | 155 |
| Ix-x/A ($mm^2$) | 252 | 227 | 112 | 111 |
| Iz-z/A ($mm^2$) | 1,090 | 1,240 | 658 | 787 |
| Ratios (expressed as X:1) (With Ribs/Without Ribs) | | | | |
| Ix-x | 1.2-1.5 | | 1.3-1.7 | |
| Iz-z | 1.0-1.3 | | 1.1-1.4 | |
| Ix-x/A | 1.0-1.2 | | 0.9-1.2 | |
| Iz-z/A | 0.8-1.0 | | 0.7-1.0 | |

TABLE 3B

| Stiffness/Cross-Sectional Moment of Inertia for Fairway Woods | | | | |
|---|---|---|---|---|
| | With Ribs 60% of Breadth | Without Ribs 60% of Breadth | With Ribs 80% of Breadth | Without rib 80% of Breadth |
| Fairway Wood of FIGS. 21-26D | | | | |
| Ix-x ($mm^4$) | 18,000 | 14,300 | 6,750 | 5,350 |
| Iz-z ($mm^4$) | 140,000 | 132,000 | 70,400 | 65,700 |
| Area ($mm^2$) | 194 | 168 | 151 | 131 |
| Ix-x/A ($mm^2$) | 93 | 85 | 45 | 41 |
| Iz-z/A ($mm^2$) | 722 | 786 | 466 | 501 |
| Fairway Wood of FIGS. 36-37F | | | | |
| Ix-x ($mm^4$) | 21,600 | 19,300 | 8,100 | 7,100 |
| Iz-z ($mm^4$) | 146,000 | 142,000 | 71,500 | 69,000 |
| Area ($mm^2$) | 216 | 197 | 165 | 148 |
| Ix-x/A ($mm^2$) | 100 | 98 | 49 | 48 |
| Iz-z/A ($mm^2$) | 675 | 720 | 435 | 468 |
| Ratios(expressed as X:1) | | | | |

TABLE 3B-continued

| Stiffness/Cross-Sectional Moment of Inertia for Fairway Woods | | | | |
|---|---|---|---|---|
| | With Ribs 60% of Breadth | Without Ribs 60% of Breadth | With Ribs 80% of Breadth | Without rib 80% of Breadth |
| (With Ribs/Without Ribs) | | | | |
| Ix-x | 1.05-1.35 | | 1.05-1.35 | |
| Iz-z | 1.0-1.3 | | 1.0-1.3 | |
| Ix-x/A | 1.0-1.2 | | 1.0-1.2 | |
| Iz-z/A | 0.8-1.0 | | 0.85-1.05 | |

TABLE 3C

| Stiffness/Cross-Sectional Moment of Inertia for Hybrids | | | | |
|---|---|---|---|---|
| | With Ribs 60% of Breadth | Without Ribs 60% of Breadth | With Ribs 80% of Breadth | Without rib 80% of Breadth |
| Hybrid Club Head of FIGS. 27-33 | | | | |
| Ix-x ($mm^4$) | 28,600 | 27,600 | 8,000 | 7,000 |
| Iz-z ($mm^4$) | 251,000 | 248,000 | 78,000 | 75,500 |
| Area ($mm^2$) | 362 | 349 | 174 | 159 |
| Ix-x/A ($mm^2$) | 79 | 79 | 46 | 44 |
| Iz-z/A ($mm^2$) | 692 | 710 | 447 | 475 |
| Hybrid Club Head of FIGS. 38-39C | | | | |
| Ix-x ($mm^4$) | 26,500 | 25,800 | 7,900 | 7,200 |
| Iz-z ($mm^4$) | 224,000 | 221,000 | 101,000 | 97,300 |
| Area ($mm^2$) | 373 | 360 | 235 | 214 |
| Ix-x/A ($mm^2$) | 71 | 72 | 34 | 34 |
| Iz-z/A ($mm^2$) | 601 | 613 | 428 | 455 |
| Ratios (expressed as X:1) (With Ribs/Without Ribs) | | | | |
| Ix-x | 1.0-1.25 | | 1.0-1.25 | |
| Iz-z | 1.0-1.2 | | 1.0-1.2 | |
| Ix-x/A | 1.0-1.2 | | 1.0-1.2 | |
| Iz-z/A | 0.8-1.0 | | 0.8-1.0 | |

It is understood that one or more different features of any of the embodiments described herein can be combined with one or more different features of a different embodiment described herein, in any desired combination. It is also understood that further benefits may be recognized as a result of such combinations.

Golf club heads 102 incorporating the body structures disclosed herein, e.g., channels, voids, ribs, etc., may be used as a ball striking device or a part thereof. For example, a golf club 100 as shown in FIG. 1 may be manufactured by attaching a shaft or handle 104 to a head that is provided, such as the heads 102, et seq., as described above. "Providing" the head, as used herein, refers broadly to making an article available or accessible for future actions to be performed on the article, and does not connote that the party providing the article has manufactured, produced, or supplied the article or that the party providing the article has ownership or control of the article. Additionally, a set of golf clubs including one or more clubs 100 having heads 102 as described above may be provided. For example, a set of golf clubs may include one or more drivers, one or more fairway wood clubs, and/or one or more hybrid clubs having features as described herein. In other embodiments, different types of ball striking devices can be manufactured according to the principles described herein. Additionally, the head 102, golf club 100, or other ball striking device may be fitted or customized for a person, such as by attaching a shaft 104 thereto having a particular length, flexibility, etc., or by adjusting or interchanging an already attached shaft 104 as described above.

The ball striking devices and heads therefor having channels as described herein provide many benefits and advantages over existing products. For example, the flexing of the sole 118 at the channel 140 results in a smaller degree of deformation of the ball, which in turn can result in greater impact efficiency and greater ball speed at impact. As another example, the more gradual impact created by the flexing can result in greater energy and velocity transfer to the ball during impact. Still further, because the channel 140 extends toward the heel and toe edges 113 of the face 112, the head 102 can achieve increased ball speed on impacts that are away from the center or traditional "sweet spot" of the face 112. The greater flexibility of the channels 140 near the heel 120 and toe 122 achieves a more flexible impact response at those areas, which offsets the reduced flexibility due to decreased face height at those areas, further improving ball speed at impacts that are away from the center of the face 112. As an additional example, the features described herein may result in improved feel of the golf club 100 for the golfer, when striking the ball. Additionally, the configuration of the channel 140 may work in conjunction with other features (e.g. the ribs 185, 400, 402, 430, 432, 434, 480, 482, 550, 552, 600, 650, 652, the access 128, etc.) to influence the overall flexibility and response of the channel 140, as well as the effect the channel 140 has on the response of the face 112. Further benefits and advantages are recognized by those skilled in the art.

The ball striking devices and heads therefore having a void structure as described herein also provide many benefits and advantages over existing products. The configuration of the void 160 provides the ability to distribute weight more towards the heel 120 and toe 122. This can increase the moment of inertia (MOI) approximately a vertical axis through the CG of the club head (MOIz-z). Additionally, certain configurations of the void can move the CG of the club head forward, which can reduce the degree and/or variation of spin on impacts on the face 112. The structures of the legs 164, 165, the cover 161, and the void 160 may also improve the sound characteristics of the head 102. It is further understood that fixed or removable weight members can be internally supported by the club head structure, e.g., in the legs 164, 165, in the interface area 168, within the void 160, etc.

Additional structures such as the internal and external ribs 185, 400, 402, 430, 432, 434, 480, 482, 550, 552, 600, 650, 652 as described herein also provide many benefits and advantages over existing products. For example, the configuration of the internal and external ribs provide for the desired amount of rigidity and flexing of the body. The resulting club head provides enhanced performance and sound characteristics.

The benefits of the channel, the void, and other body structures described herein can be combined together to achieve additional performance enhancement. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A fairway wood golf club head comprising:

a face having a striking surface configured for striking a ball and a face center, the face having a face height of 28-40 mm;

a fairway wood golf club body connected to the face and extending rearwardly from the face, the body having a crown, a sole, a heel, and a toe;

an elongated channel extending across a portion of the sole between a first end located proximate the heel and a second end located proximate the toe, wherein the channel is recessed from adjacent surfaces of the sole; and a void defined on the sole of the body, rearward of the channel, wherein the body comprises a first leg and a second leg extending rearwardly from a base portion of the body, with the void being defined between the first and second legs, wherein the channel has a variable maximum width and a variable maximum depth of recession along a length of the channel, the variable maximum width defined in a front to rear direction and the variable maximum depth of recession defined from the adjacent surfaces of the sole at a vertical plane passing through the face center, wherein a ratio of the width to the depth is approximately 0.8:1 to 1.2:1, wherein the channel comprises a center portion extending toward the heel and the toe from the vertical plane passing through the face center, a heel portion extending from a heel end of the center portion toward the heel, and a toe portion extending from a toe end of the center portion toward the toe, wherein the channel has a boundary that is defined by a front edge and a rear edge that extend between the first end and the second end of the channel, and the front edge and the rear edge at the heel portion and the toe portion are angled away from each other such that the channel width at the heel and toe portion gradually increase toward the heel and the toe respectively, and further wherein the depth of heel portion and the toe portion of the channel increase from the center portion toward the heel and the toe, respectively.

2. The fairway wood golf club head of claim 1, wherein the width has no more than +/−10% variance over the center portion.

3. The fairway wood golf club head of claim 1, wherein the depth has no more than +/−10% variance over the center portion.

4. A hybrid golf club head comprising:

a face having a striking surface configured for striking a ball and a face center, the face having a face height of 28-40 mm;

a hybrid golf club body connected to the face and extending rearwardly from the face, the body having a crown, a sole, a heel, and a toe;

an elongated channel extending across a portion of the sole between a first end located proximate the heel and a second end located proximate the toe, wherein the channel is recessed from adjacent surfaces of the sole; and a void defined on the sole of the body, rearward of the channel, wherein the body comprises a first leg and a second leg extending rearwardly from a base portion of the body, with the void being defined between the first and second legs, wherein the channel has a variable maximum width and a variable maximum depth of recession along a length of the channel, the variable maximum width defined in a front to rear direction and the variable maximum depth of recession defined from the adjacent surfaces of the sole at a vertical plane passing through the face center, wherein a ratio of the width to the depth is approximately 0.8:1 to 1.2:1, wherein the channel comprises a center portion extending toward the heel and the toe from the vertical plane passing through the face center, a heel portion extending from a heel end of the center portion toward the heel, and a toe portion extending from a toe end of the center portion toward the toe, wherein the channel has a boundary that is defined by a front edge and a rear edge that extend between the first end and the second end of the channel, and the front edge and the rear edge at the heel portion and the toe portion are angled away from each other such that the channel width at the heel and toe portion gradually increase toward the heel and the toe respectively, and further wherein the depth of heel portion and the toe portion of the channel increase from the center portion toward the heel and the toe, respectively.

5. The hybrid golf club head of claim 4, wherein the width has no more than +/−10% variance over the center portion.

6. The hybrid golf club head of claim 4, wherein the depth has no more than +/−10% variance over the center portion.

7. A fairway wood golf club head comprising:

a face having a striking surface configured for striking a ball and a face center, the face having a face height of 28-40 mm;

a fairway wood golf club body connected to the face and extending rearwardly from the face, the body having a crown, a sole, a heel, and a toe;

an elongated channel extending across a portion of the sole between a first end located proximate the heel and a second end located proximate the toe, wherein the channel is recessed from adjacent surfaces of the sole; and a void defined on the sole of the body, rearward of the channel, wherein the body comprises a first leg and a second leg extending rearwardly from a base portion of the body, with the void being defined between the first and second legs, wherein the channel has a variable maximum width and a variable maximum depth of recession along a length of the channel, the variable maximum width defined in a front to rear direction and the variable maximum depth of recession defined from the adjacent surfaces of the sole and the channel further having a wall thickness at a vertical plane passing through the face center, wherein a ratio of the width to the wall thickness is approximately 5:1 to 6.5:1, wherein the channel comprises a center portion extending toward the heel and the toe from the vertical plane passing through the face center, a heel portion extending from a heel end of the center portion toward the heel, and a toe portion extending from a toe end of the center portion toward the toe, wherein the channel has a boundary that is defined by a front edge and a rear edge that extend between the first end and the second end of the channel, and the front edge and the rear edge at the heel portion and the toe portion are angled away from each other such that the channel width at the heel and toe portion gradually increase toward the heel and the toe respectively, and further wherein the depth of heel portion and the toe portion of the channel increase from the center portion toward the heel and the toe, respectively.

8. The fairway wood golf club head of claim 7, wherein the width has no more than +/−10% variance over the center portion.

9. The fairway wood golf club head of claim 7, wherein the wall thickness has no more than +/−10% variance over the center portion.

10. A hybrid golf club head comprising:

a face having a striking surface configured for striking a ball and a face center, the face having a face height of 28-40 mm;

a hybrid golf club body connected to the face and extending rearwardly from the face, the body having a crown, a sole, a heel, and a toe;

an elongated channel extending across a portion of the sole between a first end located proximate the heel and a second end located proximate the toe, wherein the channel is recessed from adjacent surfaces of the sole; and a void defined on the sole of the body, rearward of the channel, wherein the body comprises a first leg and a second leg extending rearwardly from a base portion of the body, with the void being defined between the first and second legs, wherein the channel has a variable maximum width and a variable maximum depth of recession along a length of the channel, the variable maximum width defined in a front to rear direction and the variable maximum depth of recession defined from the adjacent surfaces of the sole and the channel further having a wall thickness at a vertical plane passing through the face center, wherein a ratio of the width to the wall thickness is approximately 4.5:1 to 5.5:1, wherein the channel comprises a center portion extending toward the heel and the toe from the vertical plane passing through the face center, a heel portion extending from a heel end of the center portion toward the heel, and a toe portion extending from a toe end of the center portion toward the toe, wherein the channel has a boundary that is defined by a front edge and a rear edge that extend between the first end and the second end of the channel, and the front edge and the rear edge at the heel portion and the toe portion are angled away from each other such that the channel width at the heel and toe portion gradually increase toward the heel and the toe respectively, and further wherein the depth of heel portion and the toe portion of the channel increase from the center portion toward the heel and the toe, respectively.

11. The hybrid golf club head of claim 10, wherein the width has no more than +/−10% variance over the center portion.

12. The hybrid golf club head of claim 10, wherein the wall thickness has no more than +/−10% variance over the center portion.

13. A fairway wood golf club head comprising:

a face having a striking surface configured for striking a ball and a face center, the face having a face height of 28-40 mm;

a fairway wood golf club body connected to the face and extending rearwardly from the face, the body having a crown, a sole, a heel, and a toe;

an elongated channel extending across a portion of the sole between a first end located proximate the heel and a second end located proximate the toe, wherein the channel is recessed from adjacent surfaces of the sole; and a void defined on the sole of the body, rearward of the channel, wherein the body comprises a first leg and a second leg extending rearwardly from a base portion of the body, with the void being defined between the first and second legs, wherein the channel has a variable maximum width and a variable maximum depth of recession along a length of the channel, the variable maximum width defined in a front to rear direction and the variable maximum depth of recession defined from the adjacent surfaces of the sole and the channel further having a wall thickness at a vertical plane passing through the face center, wherein a ratio of the depth to the wall thickness is approximately 5:1 to 6.5:1, wherein the channel comprises a center portion extending toward the heel and the toe from the vertical plane passing through the face center, a heel portion extending from a heel end of the center portion toward the heel, and a toe portion extending from a toe end of the center portion toward the toe, wherein the channel has a boundary that is defined by a front edge and a rear edge that extend between the first end and the second end of the channel, and the front edge and the rear edge at the heel portion and the toe portion are angled away from each other such that the channel width at the heel and toe portion gradually increase toward the heel and the toe respectively, and further wherein the depth of heel portion and the toe portion of the channel increase from the center portion toward the heel and the toe, respectively.

14. The fairway wood golf club head of claim 13, wherein the channel comprises a center portion extending toward the heel and the toe from the vertical plane passing through the face center, a heel portion extending from a heel end of the center portion toward the heel, and a toe portion extending from a toe end of the center portion toward the toe, wherein the depth has no more than +/−10% variance over the center portion.

15. The fairway wood golf club head of claim 13, wherein the wall thickness has no more than +/−10% variance over the center portion.

16. A hybrid golf club head comprising:

a face having a striking surface configured for striking a ball and a face center, the face having a face height of 28-40 mm;

a hybrid golf club body connected to the face and extending rearwardly from the face, the body having a crown, a sole, a heel, and a toe;

an elongated channel extending across a portion of the sole between a first end located proximate the heel and a second end located proximate the toe, wherein the channel is recessed from adjacent surfaces of the sole; and a void defined on the sole of the body, rearward of the channel, wherein the body comprises a first leg and a second leg extending rearwardly from a base portion of the body, with the void being defined between the first and second legs, wherein the channel has a variable maximum width and a variable maximum depth of recession along a length of the channel, the variable maximum width defined in a front to rear direction and the variable maximum depth of recession defined from the adjacent surfaces of the sole and the channel further having a wall thickness at a vertical plane passing through the face center, wherein a ratio of the depth to the wall thickness is approximately 4.5:1 to 5.5:1, wherein the channel comprises a center portion extending toward the heel and the toe from the vertical plane passing through the face center, a heel portion extending from a heel end of the center portion toward the heel, and a toe portion extending from a toe end of the center portion toward the toe, wherein the channel has a boundary that is defined by a front edge and a rear edge that extend between the first end and the second end of the channel, and the front edge and the rear edge at the heel portion and the toe portion are angled away from each other such that the channel width at the heel and toe portion gradually increase toward the heel and the toe respectively, and further wherein the depth of heel portion and the toe portion of the channel increase from the center portion toward the heel and the toe, respectively.

17. The hybrid golf club head of claim 16, wherein the depth has no more than +/−10% variance over the center portion.

18. The hybrid golf club head of claim 16, wherein the wall thickness has no more than +/−10% variance over the center portion.

* * * * *